US007865114B2

(12) United States Patent
Ishikawa et al.

(10) Patent No.: US 7,865,114 B2
(45) Date of Patent: Jan. 4, 2011

(54) IMAGE FORMING APPARATUS, IMAGE FORMING METHOD AND PROCESS CARTRIDGE

(75) Inventors: Masahiko Ishikawa, Fuji (JP); Masami Tomita, Numazu (JP); Yoshiaki Kawasaki, Susono (JP)

(73) Assignee: Ricoh Company Limited, Tokyo (JP)

( * ) Notice: Subject to any disclaimer, the term of this patent is extended or adjusted under 35 U.S.C. 154(b) by 257 days.

(21) Appl. No.: 11/943,713

(22) Filed: Nov. 21, 2007

(65) Prior Publication Data

US 2008/0241716 A1 Oct. 2, 2008

(30) Foreign Application Priority Data

Nov. 21, 2006 (JP) ..... 2006-314898
Jul. 4, 2007 (JP) ..... 2007-175832

(51) Int. Cl.
*G03G 15/08* (2006.01)

(52) U.S. Cl. ..... 399/159; 430/58.05; 430/58.7; 430/66; 430/108.6; 430/108.7

(58) Field of Classification Search ..... 430/58.7, 430/58.05, 66
See application file for complete search history.

(56) References Cited

U.S. PATENT DOCUMENTS 4,772,525 A 9/1988 Badesha et al.

(Continued)

FOREIGN PATENT DOCUMENTS

JP 52-36016 3/1977

(Continued)

OTHER PUBLICATIONS

Diamond, Handbook of Imaging Materials, Marcel Dekker Inc., NY, NY 2001. pp. 191-192.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

An image forming apparatus including an image bearing member, a charging device, an irradiating device, a developing device, a transfer device, a fixing device, and a cleaning device, wherein the image bearing member includes a substrate on which a photosensitive layer and a cross-linked surface layer are accumulated and the cross-linked surface layer comprises a cross-linked material formed by curing a monomer having at least three radical polymerizable function groups without a charge transport structure and a radical polymerizable compound having a charge transport structure by a photo-energy irradiation device, wherein the toner has a volume average particle diameter of from 1 to 5 μm and an average circularity of from 0.95 to 0.98, wherein external additives added to the toner satisfy the following relationship: $1<3X/5+Y<3$, wherein X represents the amount of an external additive having a primary particle diameter of from 10 to 20 nm and Y represents the amount of another external additive having an primary particle diameter of from 100 to 200 nm and X and Y satisfy the following relationship: $X<Y$, $0<X\leqq 1$ and $1\leqq Y$, and wherein the cleaning device includes a cleaning blade made of a polyurethane rubber plate having a hardness of from 70 to 80°, and a rebound resilience of from 10 to 35% at 25° C.

12 Claims, 6 Drawing Sheets

U.S. PATENT DOCUMENTS

| | | | | |
|---|---|---|---|---|
| 6,756,175 | B2 | 6/2004 | Emoto et al. | |
| 7,033,718 | B2 | 4/2006 | Tomita et al. | |
| 7,056,636 | B2 | 6/2006 | Tomita et al. | |
| 2002/0048473 | A1* | 4/2002 | Yamada et al. | 399/350 |
| 2004/0248025 | A1* | 12/2004 | Miyakawa | 430/107.1 |
| 2005/0025520 | A1 | 2/2005 | Murakami et al. | |
| 2005/0158641 | A1 | 7/2005 | Yanagawa et al. | |
| 2005/0208408 | A1 | 9/2005 | Uchinokura et al. | |
| 2005/0277048 | A1 | 12/2005 | Tomita et al. | |
| 2005/0287452 | A1 | 12/2005 | Tamura et al. | |
| 2006/0024097 | A1 | 2/2006 | Yamada et al. | |
| 2006/0039726 | A1 | 2/2006 | Shintani et al. | |
| 2006/0062594 | A1 | 3/2006 | Kawasumi et al. | |
| 2006/0076345 | A1* | 4/2006 | Yamano | 219/619 |
| 2006/0110668 | A1 | 5/2006 | Kawasaki et al. | |
| 2006/0115286 | A1 | 6/2006 | Uchitani et al. | |
| 2006/0121382 | A1* | 6/2006 | Choi et al. | 430/108.21 |
| 2006/0133834 | A1 | 6/2006 | Yoneda et al. | |
| 2006/0133837 | A1 | 6/2006 | Shimojo et al. | |
| 2006/0194662 | A1 | 8/2006 | Hozumi et al. | |
| 2006/0199092 | A1* | 9/2006 | Sugino et al. | 430/66 |
| 2007/0009818 | A1 | 1/2007 | Yanagawa et al. | |
| 2007/0031748 | A1 | 2/2007 | Kotsugai et al. | |
| 2007/0212627 | A1 | 9/2007 | Yanagawa et al. | |
| 2007/0218396 | A1 | 9/2007 | Tomita | |

FOREIGN PATENT DOCUMENTS

| | | | |
|---|---|---|---|
| JP | 64-1728 | | 1/1989 |
| JP | 64-9964 | | 1/1989 |
| JP | 64-13061 | | 1/1989 |
| JP | 64-19049 | | 1/1989 |
| JP | 1-241559 | | 9/1989 |
| JP | 3-52058 | | 8/1991 |
| JP | 4-11627 | | 1/1992 |
| JP | 4-175337 | | 6/1992 |
| JP | 4-183719 | | 6/1992 |
| JP | 4-225014 | | 8/1992 |
| JP | 4-230767 | | 8/1992 |
| JP | 4-320420 | | 11/1992 |
| JP | 5-19497 | | 1/1993 |
| JP | 5-70595 | | 3/1993 |
| JP | 5-60503 | | 9/1993 |
| JP | 5-232727 | | 9/1993 |
| JP | 5-310904 | | 11/1993 |
| JP | 6-45770 | | 6/1994 |
| JP | 6-234836 | | 8/1994 |
| JP | 6-234837 | | 8/1994 |
| JP | 6-234838 | | 8/1994 |
| JP | 6-234839 | | 8/1994 |
| JP | 6-234840 | | 8/1994 |
| JP | 6-234841 | | 8/1994 |
| JP | 6-236050 | | 8/1994 |
| JP | 6-236051 | | 8/1994 |
| JP | 6-239049 | | 8/1994 |
| JP | 6-295077 | | 10/1994 |
| JP | 6-93150 | | 11/1994 |
| JP | 7-56374 | | 3/1995 |
| JP | 8-176293 | | 7/1996 |
| JP | 8-208820 | | 8/1996 |
| JP | 8-211640 | | 8/1996 |
| JP | 8-253568 | | 10/1996 |
| JP | 8-269183 | | 10/1996 |
| JP | 9-43883 | | 2/1997 |
| JP | 9-62019 | | 3/1997 |
| JP | 9-71642 | | 3/1997 |
| JP | 9-87376 | | 3/1997 |
| JP | 9-104746 | | 4/1997 |
| JP | 9-110974 | | 4/1997 |
| JP | 9-110976 | | 4/1997 |
| JP | 9-157378 | | 6/1997 |
| JP | 9-221544 | | 8/1997 |
| JP | 9-227669 | | 9/1997 |
| JP | 9-235367 | | 9/1997 |
| JP | 9-241369 | | 9/1997 |
| JP | 9-268226 | | 10/1997 |
| JP | 9-272735 | | 10/1997 |
| JP | 9-302084 | | 11/1997 |
| JP | 9-302085 | | 11/1997 |
| JP | 9-328539 | | 12/1997 |
| JP | 10-73944 | | 3/1998 |
| JP | 3164426 | | 3/2001 |
| JP | 2001-175016 | * | 6/2001 |
| JP | 2002-55508 | | 2/2002 |
| JP | 2006-154387 | | 6/2006 |
| JP | 3825600 | | 7/2006 |
| JP | 2007-065181 | * | 3/2007 |

OTHER PUBLICATIONS

Translation of JP 2001-175016 published Jun. 2001.*
Translation of JP 2007-065181 published Mar. 2007.*

* cited by examiner

IMAGE FORMING APPARATUS, IMAGE FORMING METHOD AND PROCESS CARTRIDGE

BACKGROUND OF THE INVENTION

1. Field of the Invention

The present invention relates to an image forming apparatus, an image forming method and a process cartridge.

2. Discussion of the Background

In recent years, with the advance of the size reduction of an image forming apparatus, image bearing members have been decreased in size. Also, high speed operation and maintenance-free operation have been demanded and thus an image bearing member having a high durability has been desired. From this point of view, organic photoconductors (image bearing members) are generally soft because the surface layer thereof is mainly made of a low molecular weight charge transport material and an inert polymer. When such an organic photoconductor is repetitively used in the electrophotography process, the organic photoconductor tends to be abraded under mechanical stress by a developing system or a cleaning system.

In addition, in accordance with size reduction of toner particles for improving image quality, the rubber of a cleaning blade is hardened and the contact pressure between an image bearing member and a cleaning blade is increased to improve the cleaning property. This accelerates the abrasion of the image bearing member. Such abrasion of an image bearing member causes deterioration of electric characteristics, such as sensitivity and chargeability, which leads to production of abnormal images, such as a decrease in image density and background fouling. When an image bearing member is locally damaged by abrasion, the damaged portion causes streaks on an image resulting from bad cleaning performance on the image bearing member. Currently, this abrasion or damage is a controlling factor of the lifetime of an image bearing member and once an image bearing member has such abrasion or damage, the image bearing member must be replaced immediately to sustain image quality and performance.

With regard to charging of an image bearing member, a contact type charging system is adopted in which a charging unit (e.g., a charging roller) formed of a metal core covered with an elastic electroconductive member is brought into contact with an image bearing member and a driving voltage is applied to the charging unit (Refer to unexamined published Japanese Patent Applications No. (hereinafter referred to as JOP) S63-149668 and H01-267667).

However, in this contact type charging system, an image bearing member is charged while in contact with a charging unit. Therefore, toners, external additives, dust, etc. that have slipped through a cleaning blade are attached to the charging unit (charging roller). This contamination on a charging unit causes production of uneven images. Also the photosensitive layer is unevenly abraded by the contamination attached to the charging unit. Thus, the lifetime of such an image bearing member tends to be shortened.

With regard to contamination on a charging unit, an AC charging system has a relatively large margin in comparison with a DC charging system. It is thus preferred to select an AC charging system in consideration of the stability of images over time. The contamination on a charging unit may be decreased by the selection of an AC charging system, however, since the charging unit is in direct contact with the image bearing member, the margin has not reached the level to which an image bearing member having a desired lifetime is provided.

To avoid the problems mentioned above, JOPs 2001-194868 and 2002-55508 describe an image forming apparatus having a non-contact type charging device which can be disposed in the vicinity of an image bearing member by a spacer provided at both ends of the charging device. By this structure, an image bearing member can be uniformly charged and ozone is less produced and also the charging device is less contaminated by residual toner remaining on the image bearing member.

The disposition in the vicinity of an image bearing member represents a state in which there is a minute gap between a non-contact type charging device and an image bearing member. The gap is preferably from 10 to 100 μm and more preferably from 20 to 50 μm. Thereby, charging unit fouling can be reduced but it is not sufficient to produce a quality image without image deficiency.

For example, JOP 2006-154387 describes an image forming apparatus capable of producing images without image deficiency caused by contamination on a charging device (roller) by specifying an external additive added to a toner in the case of a non-contact type charging device (roller) disposed in the vicinity of an image bearing member.

In each teaching described above, an image bearing member having a high durability is obtained. The surface of such an image bearing member is hard and tough for abrasion, however, has an opposite action, namely, this type of image bearing member is somewhat inferior to a typical image bearing member with regard to the margin for abrasion by a cleaning blade. Thus, the cleaning performance deteriorates according to this phenomenon especially when quality images are pursued with a toner having a small particle diameter.

SUMMARY OF THE INVENTION

Because of these reasons, the present inventors recognize that a need exists for an image forming apparatus, an image forming method and a process cartridge using an image bearing member having a hard surface layer and toner having a small particle diameter, by which contamination on a charging device (roller), caused by toner that has slipped through a cleaning blade, is reduced and image deficiency does not occur.

Accordingly, an object of the present invention is to provide an image forming apparatus, an image forming method and a process cartridge using an image bearing member having a hard surface layer and toner having a small particle diameter, by which contamination on a charging device (roller), caused by toner that has slipped through a cleaning blade, is reduced and image deficiency does not occur.

Briefly these objects and other objects of the present invention as hereinafter described will become more readily apparent and can be attained, either individually or in combination thereof, by an image forming apparatus including an image bearing member configured to bear a latent electrostatic image a surface thereof; a charging device configured to uniformly charge the image bearing member; an irradiating device configured to irradiate the surface of the image bearing member with writing light to form the latent electrostatic image thereon; a developing device configured to develop and visualize the latent electrostatic image with a developing agent comprising a toner; a transfer device configured to transfer the visualized image to a recording medium; a fixing device configured to fix the visualized image on the recording medium; and a cleaning device configured to clean the surface of the image bearing member, wherein the image bearing member includes a substrate on which at least a photosensitive layer and a cross-linked surface layer are accumulated and the cross-linked surface layer includes units obtained from a monomer having at least three radical polymerizable function groups without a charge transport structure and a radical polymerizable compound having a charge transport structure cured by a photo-energy irradiation device and wherein the toner has a volume average particle diameter of from 1 to 5 μm and an average circularity of from 0.95 to 0.98, and external additives added to the surface of the toner satisfy the following relationship: $1<3X/5+Y<3$, wherein X represents the amount by weight % of an external additive having a primary particle diameter of from 10 to 20 nm and Y represents the amount by weight % of another external additive having a primary particle diameter of from 100 to 200 nm and X and Y satisfy the following relationship: $X<Y$, $0<X\leqq 1$ and $1\leqq Y$, and wherein the cleaning device comprises a cleaning blade formed of a polyurethane rubber plate having a hardness of from 70 to 80°, and a rebound resilience of from 10 to 35% at 25° C.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
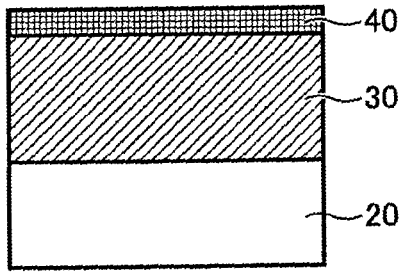
FIG. 1 is a schematic diagram illustrating an example of the layer structure of an image bearing member related to an embodiment of the present invention.

The present invention relates to an image forming apparatus including an image bearing member configured to bear a latent electrostatic image a surface thereof; a charging device configured to uniformly charge the image bearing member; an irradiating device configured to irradiate the surface of the image bearing member with writing light to form the latent electrostatic image thereon; a developing device configured to develop and visualize the latent electrostatic image with a developing agent comprising a toner; a transfer device configured to transfer the visualized image to a recording medium; a fixing device configured to fix the visualized image on the recording medium; and a cleaning device configured to clean the surface of the image bearing member. The image bearing member comprises a substrate on which at least a photosensitive layer and a cross-linked surface layer are accumulated and the cross-linked surface layer comprises a monomer having at least three radical polymerizable function groups without a charge transport structure and a radical polymerizable compound having a charge transport structure cured by a photo-energy irradiation device. The toner has a volume average particle diameter of from 1 to 5 μm and an average circularity of from 0.95 to 0.98. In addition, external additives added to the surface of the toner satisfy the following relationship: $1<3X/5+Y<3$, wherein X represents the amount by weight % of an external additive having a primary particle diameter of from 10 to 20 nm and Y represents the amount by weight % of another external additive having a primary particle diameter of from 100 to 200 nm and X and Y satisfy the following relationship: $X<Y$, $0<X\leqq 1$ and $1\leqq Y$, and wherein the cleaning device comprises a cleaning blade formed of a polyurethane rubber plate having a hardness of from 70 to 80°, and a rebound resilience of from 10 to 35% at 25° C.

It is preferred that, in the image forming apparatus mentioned above, the image bearing member comprises an adhesive layer between the photosensitive layer and the cross-linked surface layer and at least the photosensitive layer, the adhesive layer and the cross-linked surface layer are laminated in this order.

It is still further preferred that, in the image forming apparatus mentioned above, the toner is prepared by conducting in an aqueous medium at least one of a cross-linking reaction and an elongation reaction of a toner liquid material in which at least a polymer having a portion reactive with a compound having an active hydrogen group, a polyester, a coloring agent, and a releasing agent are dispersed or dissolved in an organic solvent.

It is still further preferred that, in the image forming apparatus mentioned above, the toner is a color toner.

It is still further preferred that, in the image forming apparatus mentioned above, the developing agent is a two component developing agent containing the toner and a carrier.

It is still further preferred that, in the image forming apparatus mentioned above, the developing agent is a one component developing agent containing the toner.

It is still further preferred that, in the image forming apparatus mentioned above, the charging device applies a voltage in which at least an alternating voltage is overlapped with a direct voltage.

It is still further preferred that, in the image forming apparatus mentioned above, the charging device includes a charging member having a roller form and located in the vicinity of the image bearing member in a non-contact manner.

It is still further preferred that the image forming apparatus mentioned above further includes an intermediate transfer body to which the toner image developed on the image bearing member is primarily transferred, a plurality of color toner images are sequentially overlapped on the intermediate transfer body to form a color image and the color image is secondarily transferred to the recording medium at one time.

It is still further preferred that in the image forming apparatus mentioned above, the fixing device comprises; a heating roller made of a magnetic metal and heated by electromagnetic induction; a fixing roller provided in parallel with the heating roller; a toner heating medium having an endless form which is heated by the heating roller, suspended over the heating roller and the fixing roller and rotationally driven thereby; and a pressing roller which is pressed against the fixing roller via the toner heating medium to form a nip portion therewith while rotating in a forward direction of the toner heating medium.

As another aspect of the present invention, an image forming method is provided which comprises: charging an image bearing member; irradiating a surface of the image bearing member with a writing light to form the latent electrostatic image thereon; developing the latent electrostatic image with a developing agent comprising a toner; transferring the visualized image to a recording medium;

fixing the visualized image on the recording medium; and cleaning the surface of the image bearing member and the image forming apparatus mentioned above is used in the image forming method.

As another aspect of the present invention, a process cartridge is provided which comprises: an image bearing member configured to bear a latent electrostatic image on a surface thereof; a developing device configured to develop and visualize the latent electrostatic image with a developing agent comprising a toner; and a cleaning device configured to clean the surface of the image bearing member. The image bearing member comprises a substrate on which at least a photosensitive layer and a cross-linked surface layer are accumulated and the cross-linked surface layer comprising units obtained from a monomer having at least three radical polymerizable function groups without a charge transport structure and a radical polymerizable compound having a charge transport structure cured by a photo-energy irradiation device. The toner has a volume average particle diameter of from 1 to 5 μm and an average circularity of from 0.95 to 0.98. External additives added to the surface of the toner satisfy the following relationship: $1<3X/5+Y<3$, wherein X represents the amount by weight % of an external additive having a primary particle diameter of from 10 to 20 nm and Y represents the amount by weight % of another external additive having a primary particle diameter of from 100 to 200 nm, and wherein the cleaning device comprises a cleaning blade formed of a polyurethane rubber plate having a hardness of from 70 to 80°, and a rebound resilience of from 10 to 35% at 25° C.

The image forming apparatus, the image forming method and the process cartridge of the present invention will be described below in detail with reference to several embodiments and accompanying drawings. The embodiments described below are preferred embodiments of the present invention and technically limited in various ways but the scope of the present invention is not limited thereto, unless the limitation to the present invention is specified below.

The image bearing member for use in embodiments of the image forming apparatus related to the present invention is an electrophotographic image bearing member having a photosensitive layer on an electroconductive substrate. The surface of the image bearing member is a cross-linked surface layer formed by curing a monomer having at least three radical polymerizable function groups without a charge transport structure and a radical polymerizable compound having a charge transport structure by a photo-energy irradiation device. The image bearing member has excellent anti-abrasion property, anti-damage property and cleaning property and can produce quality images for an extended period of time.

Though not wishing to be bound by any particular mechanism of action, it is believed that the improved properties are due, at least in part, to the following: The image bearing member of the present invention uses a radical polymerizable monomer having at least three functional groups so that the three dimensional network structure is developed and thus the cross-linked surface layer has an extremely high cross-linking ratio with a high hardness and obtains a high anti-abrasion property. To the contrary, when a monomer having one or two radical polymerizable functional groups is used, the cross-linking bonding is thin in the cross-linked surface layer and thus the anti-abrasion property is not improved. When a polymer material is contained in the cross-linked surface layer, the three dimensional network structure is not developed. Thus, the cross-linking ratio is reduced and the anti-abrasion property is not sufficient in comparison with the present invention. Furthermore, the compatibility between the polymer material and the cured compound made from the reaction of a radical polymerizable composition (monomers having at least one radical polymerizable functional group and radical polymerizable compounds having a charge transport structure) is bad, which causes local phase separation and results in abrasion and surface damage.

In the formation of the cross-linked surface layer for use in the present invention, a radical polymerizable compound having a charge transport structure in addition to the monomer mentioned above having at least three radical polymerizable functional groups are contained. The radical polymerizable compound having a charge transport structure is taken into the cross-linking during the curing of the monomer mentioned above having at least three radical polymerizable functional groups. By contrast, when a charge transport material having a low molecular weight having no functional group is contained in a cross-linked surface layer, the charge transport material having a low molecular weight tends to precipitate and cause white turbidity due to its low compatibility. The mechanical strength of the cross-linked surface layer also deteriorates.

Next, the composition materials of a liquid application for the cross-linked surface layer of the image bearing member of the present invention are described.

Monomer Having at Least Three Radical Polymerizable Functional Groups without Charge Transport Structure The monomer having at least three radical polymerizable functional groups without a charge transport structure for use in the present invention is, for example, a monomer having at least three radical polymerizable functional groups which does not have a positive hole transport structure, such as the positive hole transport structure of triarylamine, hydrazone, pyrazoline or carbazole, or which does not have an electron transport structure, such as the electron transport structure of electron-attracting aromatic ring having condensed polycyclic quinone, diphenoquinone, cyano group, or nitro group. Any radical polymerizable functional group having a carbon-carbon double bond and capable of conducting radical polymerization reaction can be used.

Specific examples of these radical polymerizable functional groups include, but are not limited to, 1-ethylene substituted functional groups, and 1,1-substituted ethylene functional groups as follows:

Specific examples of the 1-substituted ethylene functional group include, but not limited to, functional groups represented by the following chemical formula (i):

$$CH_2{=}CH{-}X_1{-} \qquad \text{Chemical formula (i),}$$

wherein in the chemical formula (i), $X_1$ represents a substituted or non-substituted arylene group, such as phenylene group, or naphthylene group, a substituted or non-substituted alkenylene group, CO group, COO group, $CON(R_{10})$ group ($R_{10}$ represents a hydrogen atom, an alkyl group, such as methyl group or ethyl group, or an aralkyl group, such as benzyl group, naphthylmethyl group or phenethyl group, or an aryl group, such as phenyl group or naphthyl group), or an S group.

Specific examples of these substituent groups include, but are not limited to, vinyl group, styryl group, 2-methyl-1,3-butadienyl group, vinylcarbonyl group, acryloyloxy group, acryloylamide group, and vinylthioether group.

Specific examples of the 1,1-substituted ethylene functional group include, but are not limited to, functional groups represented by the following chemical formula (ii):

$$CH_2{=}CH(Y){-}X_2{-} \qquad \text{Chemical formula (ii)}$$

wherein Y represents a substituted or non-substituted alkyl group, a substituted or non-substituted aralkyl group, a substituted or non-substituted aryl group, such as phenyl group and naphthyl group, a halogen atom, cyano group, nitro group, or an alkoxy group, such as methoxy group or ethoxy group, $COOR_{11}$ ($R_{11}$ represents a hydrogen atom, a substituted or non-substituted alkyl group, such as methyl group or ethyl group; a substituted or non-substituted aralkyl group, such as benzyl group or phenethyl group, or a substituted or non-substituted aryl group, such as phenyl group or naphthyl group), or $CONR_{12}R_{13}$ ($R_{12}$ and $R_{13}$ each, independently, represent a hydrogen atom, a substituted or non-substituted alkyl group, such as methyl group or ethyl group, a substituted or non-substituted aralkyl group, such as benzyl group, naphthylmethyl group or phenethyl group, or a substituted or non-substituted aryl group, such as phenyl group or naphthyl group. $X_2$ represents the same substituent group as $X_1$, a single bond or an alkylene group. At least either of Y and $X_2$ is an oxycarbonyl group, cyano group, an alkenylene group or an aromatic ring.

Specific examples of these substituent groups include, but are not limited to, α-acryloyloxy chloride group, methacryloyloxy group, α-cyanoethylene group, α-cyanoacryloyloxy group, α-cyanophenylene group, and methacryloylamino group.

Examples of substituent groups that are furthermore substituted in the substituent group of $X_1$, $X_2$, or Y include, but are not limited to, a halogen atom, nitro group, cyano group, or an alkyl group, such as methyl group or ethyl group; an alkoxy group, such as methoxy group, and ethoxy group; an aryloxy group, such as phenoxy group; an aryl group, such as phenyl group and naphthyl group; and an aralkyl group, such as benzyl group and phenethyl group.

Among these radical polymerizable functional groups, acryloyloxy group, and methacryloyloxy group are particularly effective, and a compound having three or more acryloyloxy groups can be obtained by conducting, for example, an ester reaction or an ester exchange reaction of a compound having 3 or more hydroxyl groups in the molecule, an acrylic acid (salt), an acrylic acid halide, and an acrylic acid ester. A compound having 3 or more methacryloyl groups can also be obtained in the same manner. The radical polymerizable functional groups in the monomer having 3 or more radical polymerizable functional groups may be the same or different from each other.

Specific examples of the monomer having at least three radical polymerizable functional groups without a charge transport structure include, but are not limited to, the following compounds.

Specific examples of the monomer having at least three radical polymerizable functional groups for use in the present invention include, but are not limited to, trimethylolpropane triacrylate (TMPTA), trimethylolpropane trimethacrylate, HPA modified trimethylolpropane triacrylate, trimethylol propane ethylene oxy-modified (EO-modified) triacrylate, trimethylolpropane propyleneoxy-modified (PO-modified) triacrylate, trimethylolpropane caprolactone-modified triacrylate, trimethylolpropane HPA-modified trimethacrylate, pentaerythritol triacrylate, pentaerythritol tetraacrylate (PETTA), glycerol triacrylate, glycerol epichlorohydrine-modified (ECH-modified) triacrylate, glycerol EO-modified triacrylate, glycerol PO-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritol ethoxytetraacrylate, phosphoric acid EO-modified triacrylate, and 2,2,5,5-tetrahydroxymethyl cyclopentanone tetraacrylate. These can be used alone or in combination.

With regard to the monomer having at least three radical polymerizable functional groups without a charge transport structure for use in the present invention, the ratio of molecular weight relative to the number of functional groups (molecular weight/the number of functional group) in the monomer is preferably 250 or less to form a dense cross-linking bond in the cross-linked surface layer. When the ratio is excessively great, the cross-linked surface layer is soft and thus the abrasion resistance is degraded in some degree. Therefore, it is not suitable to single out a compound having an extremely long modified group for use among the monomers having a modified group, such as EO-modified, PO-modified group and caprolactone. The content of the monomer having at least three radical polymerizable functional groups without a charge transport structure contained in the cross-linked surface layer in the solid content of the liquid composition is adjusted such that the component ratio thereof is from 20 to 80% by weight, and preferably from 30 to 70% by weight based on the total amount of the cross-linked surface layer. When the content of the monomer component is too small, the three dimension cross-linked bonding density of the cross-linked surface layer tends to be low. Also the abrasion resistance is not significantly improved in comparison with the case where a typical thermoplastic binder resin is used. When the content of the monomer is too great, the content of the charge transport compound tends to decrease, which causes degradation of electric properties. It is difficult to jump to any conclusion but considering a good combination of the abrasion resistance and the electric characteristics, the content of the monomer preferably ranges from 30 to 70% by weight.

The radical polymerizable functional compound having a charge transport structure for use in the present invention represents a radical polymerizable functional compound having a radical polymerizable functional group and, for example, a positive hole transport structure, such as triarylamine, hydrazone, pyrazoline, and carbazole, or an electron-transport structure, such as an electron-attracting aromatic ring having condensed polycyclic quinone, diphenoquinone, cyano group, and nitro group. Specific examples of the radical polymerizable functional group include the monomers having radical polymerizable functional groups described above. Acryloyloxy groups and methacryloyloxy groups are particularly preferred.

The radical polymerizable compound having a charge transport structure having at least two functional groups can be used but the one having one functional group is preferred in consideration of film quality and electrostatic characteristics. This is because a radical polymerizable compound having a charge transport structure with two or more functional groups is fixed in the cross-linking structure by multiple linkages but the charge transport structure is extremely bulky so that distortion occurs in the cured resin and thus the internal stress increases. Therefore, carrier attachment causes cracking and/or damage. When the layer thickness is not greater than 5 μm, this does not specially cause a problem. But when the layer thickness is too thick, the internal stress in the cross-linked surface layer tends to extremely increase and the cross-linked surface layer is subject to cracking immediately after cross-linking.

With regard to electrostatic characteristics, since a radical polymerizable compound having a charge transport structure with two or more functional groups is fixed by multiple linkages, the intermediate structure (cation radical) is not stably kept during charge transport and thus the sensitivity deteriorates due to charge trapping and the residual voltage rises. This deterioration of the electrostatic characteristics results in production of images having a low density and thin characteristics. Thus, it is preferred to use a compound having one radical polymerizable functional group with a charge transport structure as the radical polymerizable compound having a charge transport structure to fix the compound in the cross linking in a pendant manner. As a result, the occurrence of cracking and damage is prevented and the electrostatic characteristics are stabilized.

As the charge transport structure, a triaryl amine structure is highly effective and a compound having one functional group is preferred. Furthermore, when a compound represented by chemical structure 1 or 2 is used, the electric characteristics, for example, sensitivity and residual voltage, are suitably maintained.

Chemical structure 1

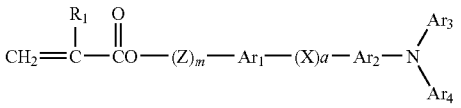

Chemical structure 2

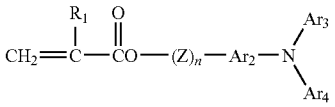

In the chemical structures (1) and (2), $R_1$ represents hydrogen atom, a halogen atom, an alkyl group, an aralkyl group, an aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ each, independently, represent hydrogen atom, a halogen atom, a substituted or non-substituted alkyl group, a substituted or non-substituted aralkyl group or a substituted or non-substituted aryl group, $Ar_1$ and $Ar_2$ each, independently, represent a substituted or unsubstituted arylene group, $Ar_3$ and $Ar_4$ each, independently, represent a substituted or unsubstituted aryl group, X represents a substituted or non-substituted alkylene group, a substituted or non-substituted cycloalkylene group, a substituted or non-substituted alkylene ether group, oxygen atom, sulfur atom or vinylene group, Z represents a substituted or non-substituted alkylene group, a substituted or non-substituted alkylene ether divalent group or an alkyleneoxy carbonyl divalent group, a represents 0 or 1 and m and n each, independently, represent 0 or an integer of from 1 to 3.

In the chemical structures (1) and (2), in the substituent group of $R_1$, specific examples of the alkyl groups include, but are not limited to, methyl group, ethyl group, propyl group, and butyl group; specific examples of the aryl groups include, but are not limited to, phenyl group and naphthyl group; specific examples of the aralkyl groups include, but are not limited to, benzyl group, phenethyl group and naphthylmethyl group; specific examples of the alkoxy group include, but are not limited to, methoxy group, ethoxy group, and propoxy group. These groups can be substituted by a halogen atom; nitro group; cyano group; an alkyl group, such as methyl group and ethyl group; an alkoxy group, such as methoxy group and ethoxy group; an aryloxy group, such as phenoxy group; an aryl group, such as phenyl group and naphthyl group; or an aralkyl group, such as benzyl group and phenethyl group.

Among the substituent groups of $R_1$, hydrogen atom, and methyl group are particularly preferred.

$Ar_3$ and $Ar_4$ are substituted or unsubstituted aryl groups, and specific examples thereof include, but are not limited to, condensed polycyclic hydrocarbon groups, non-condensed cyclic hydrocarbon groups, and heterocyclic groups.

Preferred specific examples of the condensed polycyclic hydrocarbon group include, but are not limited to, groups in which the number of the carbon atoms forming a ring is 18 or less. Specific examples thereof include, but are not limited to, pentanyl group, indenyl group, naphthyl group, azulenyl group, heptalenyl group, biphenylenyl group, as (asym)-indacenyl group, s(sym)-indacenyl group, fluorenyl group, acenaphthylenyl group, pleiadenyl group, acenaphtenyl group, phenalenyl group, phenanthryl group, anthryl group, fluoranthenyl group, acephenantolylenyl group, aceanthrylenyl group, triphenylel group, pyrenyl group, chrysenyl group and naphthacenyl group.

Specific examples of the uncondensed cyclic hydrocarbon groups include, but are not limited to, monovalent groups derived from benzene, diphenyl ether, polyethylene diphenyl ether, diphenyl thioether, diphenyl sulfone, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, monovalent groups derived from polycyclic hydrocarbons such as 9,9-diphenyl fluorene can also be used.

Specific examples of the heterocyclic groups include, but are not limited to, monovalent groups derived from carbazole, dibenzofuran, dibenzothiophene, oxadiazole, thiazole, etc.

The aryl groups represented by $Ar_3$ and $Ar_4$ may have the following substituent groups.

(1) A halogen atom, cyano group, nitro group, etc.

(2) A straight-chain or branched-chain alkyl group having 1 to 12 carbon atoms, more preferably 1 to 8 carbon atoms, and much more preferably 1 to 4 carbon atoms, which may substituted with fluorine atom; hydroxyl group; cyano group; an alkoxy group having 1 to 4 carbon atoms; or a phenyl group substituted with a halogen atom, an alkyl group having 1 to 4 carbon atoms, or an alkoxy group having 1 to 4 carbon atoms. Specific examples of the alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) An alkoxy group (—$OR_2$, wherein $R_2$ represents an alkyl group defined in the paragraph (2)). Specific examples of the alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) An aryloxy group. Specific examples of the aryl groups include, but are not limited to, phenyl group and naphthyl group. The aryloxy group can be substituted with an alkoxy group having 1 to 4 carbon atoms, an alkyl group having 1 to 4 carbon atoms, or a halogen atom. Specific examples of the aryloxy groups include, but are not limited to, phenoxy group, 1-naphthyloxy group, 2-naphthyloxy group, 4-methoxyphenoxy group, and 4-methylphenoxy group.

(5) An alkylmercapto group or an arylmercapto group. Specific examples of these groups include, but are not limited to, methylthio group, ethylthio group, phenylthio group, and p-methylphenylthio group.

(6) A substituent group represented by the following chemical formula:

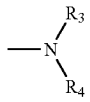

wherein each of $R_3$ and $R_4$ independently represents a hydrogen atom, an alkyl group defined in the paragraph (2), or an aryl group (e.g., phenyl group, biphenyl group, naphthyl group) which can be substituted with an alkoxy group having 1 to 4 carbon atoms, an alkyl group having 1 to 4 carbon atoms, or a halogen atom; and wherein $R_3$ and $R_4$ optionally share bond connectivity to form a ring. Specific examples of the substituent groups mentioned above include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylenedithio group such as methylenedioxy group and methylenedithio group.

(8) A substituted or unsubstituted styryl group, a substituted or unsubstituted β-phenyl styryl group, diphenyl aminophenyl group, dinitrile aminophenyl group, etc.

X represents a single bond, a substituted or unsubstituted alkylene group, a substituted or unsubstituted cycloalkylene group, a substituted or unsubstituted alkylene ether group, an oxygen atom, a sulfur atom, or a vinylene group.

The substituted or unsubstituted alkylene group is a straight-chained or branched-chain alkylene group having 1 to 12 carbon atoms, preferably 1 to 8 carbon atoms, and more preferably 1 to 4 carbon atoms. These alkylene groups may have a fluorine atom, a hydroxyl group, a cyano group, an alkoxy group having 1 to 4 carbon atoms, a phenyl group, or a phenyl group substituted with a halogen atom, an alkyl group having 1 to 4 carbon atoms, or an alkoxy group having 1 to 4 carbon atoms. Specific examples of the substituted or unsubstituted alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

The substituted or non-substituted cycloalkylene group is a cyclic alkylene group having 5 to 7 carbon atoms which may have a fluorine atom, a hydroxyl group, an alkyl group having 1 to 4 carbon atoms, or an alkoxy group having 1 to 4 carbon atoms. Specific examples of the substituted or non-substituted cycloalkylene groups include, but are not limited to, cyclohexylidene group, cyclohexylene group, and 3,3-dimethylcyclohexylidene group.

Specific examples of the substituted or non-substituted alkylene ether groups include, but are not limited to, ethyleneoxy group, propyleneoxy group, ethylene glycol, propylene glycol, diethylene glycol, tetraethylene glycol, and tripropylene glycol. The alkylene group of the alkylene ether group may have a substituent group, for example, a hydroxyl group, a methyl group, and an ethyl group.

Specific examples of the vinylene groups include, but are not limited to, the following substituent groups:

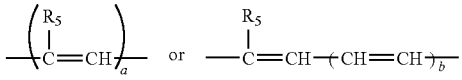

$R_5$ represents a hydrogen atom, an alkyl group (same as defined in the paragraph (2)), or an aryl group (same aryl groups as represented by $Ar_3$ and $Ar_4$); a represents an integer of 1 or 2; and b represents an integer of from 1 to 3.

Z represents a substituted or unsubstituted alkylene group, a substituted or non-substituted alkylene ether group, or an alkyleneoxycarbonyl group.

Examples of the substituted or unsubstituted alkylene group include, but are not limited to, the same alkylene groups as those described in the X.

Examples of the substituted or non-substituted alkylene ether divalent group include, but are not limited to, divalent groups of the same alkylene ether groups as those described in the X.

Examples of the alkyleneoxycarbonyl group include, but are not limited to, divalent groups of caprolactone-modified groups.

As the monomers having a radical polymerizable functional group with a charge transport structure for use in the present invention, compounds represented by the following chemical structure 3 are preferably used.

Chemical structure 3

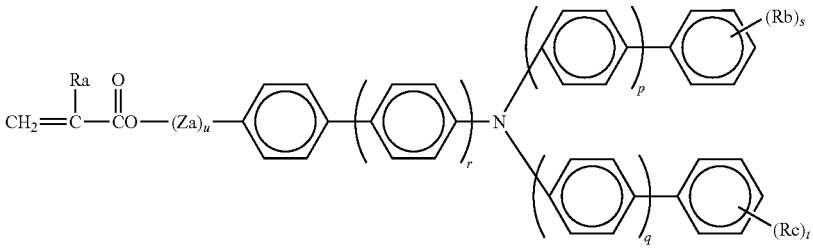

In the chemical structure 3, u, r, p, q each, independently, represent 0 or 1, s and t each, independently, represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

Among the compounds represented by chemical structure 3 illustrated above, the compounds having a methyl group or an ethyl group as each of Rb and Rc are preferred.

The radical polymerizable compound for use in the present invention having a functional group with a charge transport structure represented by the chemical structures 1, 2 and especially 3 is polymerized in such a manner that the double linkage of C and C is open to both ends. Therefore, the radical polymerizable compound is not present at the end but in the chained polymer. In a polymer in which a cross linking chain is formed with a radical polymerizable monomer having at least 3 functional groups, the radical polymerizable compound is present in the main chains of the polymer and in a cross linking chain. There are two kinds of cross linking chains. One is referred to as inter-molecular cross linking, in which the cross linking chain is formed between one polymer chain and another polymer chain. The other is referred to as internal cross linking (or intra-molecular cross linking), in which the cross linking chain is formed between a portion in the main chain present in a polymer formed in a folded state and another portion deriving from the monomer which is polymerized at a position remote from that portion in the main chain. Whether the radical polymerizable monomer having at least 3 functional groups is present in a main chain or in a cross linking chain, the triaryl amine structure suspending from the chain portion has at least three aryl groups disposed in the radial directions from the nitrogen atom therein. Such a triaryl amine structure is bulky and does not directly bind with the chain portion but suspends from the chain portion via a carbonyl group, etc. That is, the triaryl amine structure is stereoscopically fixed in the polymer in a flexible state. Therefore, these triaryl amine structures can be adjacent to each other with a moderate space in a polymer. Therefore, the structural distortion in a molecule is slight. In addition, when the structure is used in the surface layer of an image bearing member, it can be deduced that the internal molecular structure can have a structure in which there are relatively few disconnections in the charge transport route.

Specific examples of the radical polymerizable compound having a functional group with a charge transport structure include, but are not limited to, the following:

No. 1

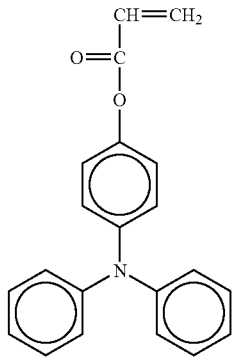

No. 2

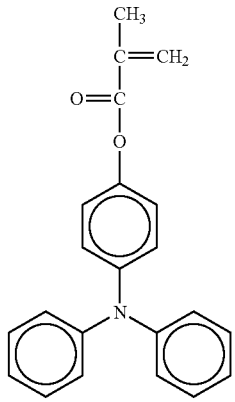

No. 3

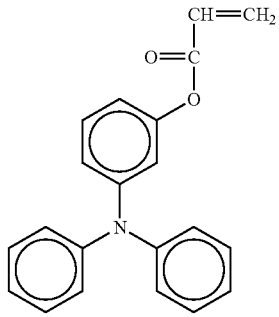

-continued
No. 4
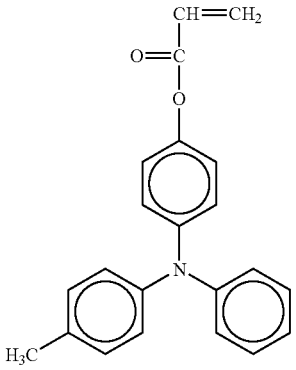
No. 5
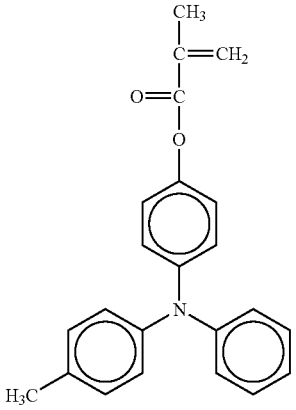
No. 6
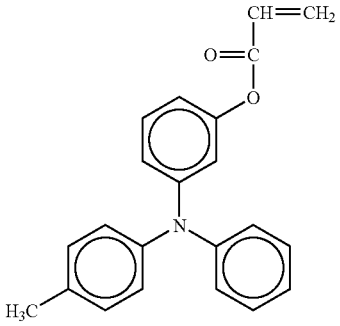
No. 7
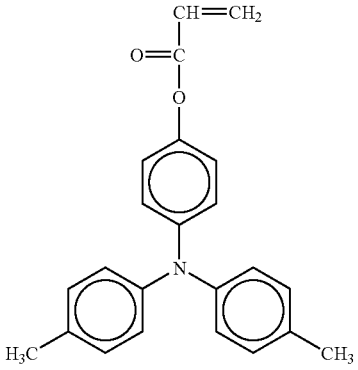
-continued
No. 8
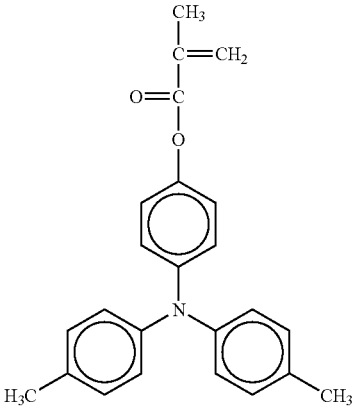
No. 9
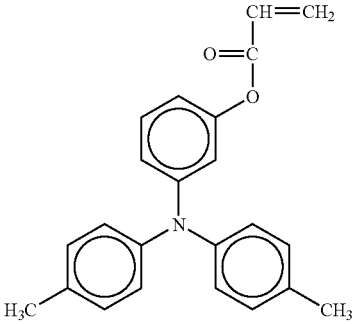
No. 10
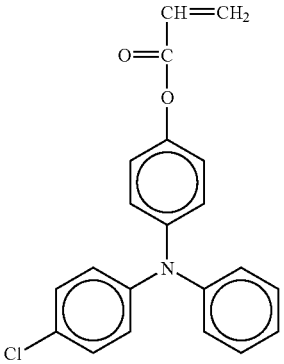
No. 11
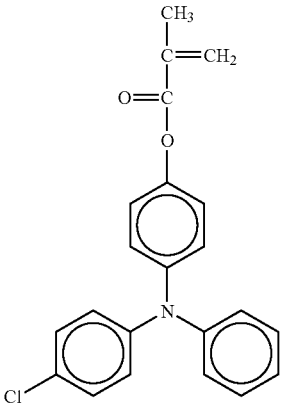

-continued
No. 12
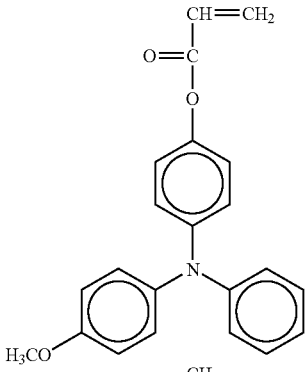
No. 13
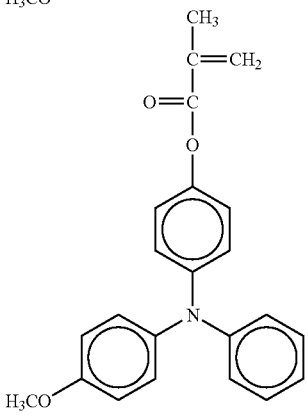
No. 14
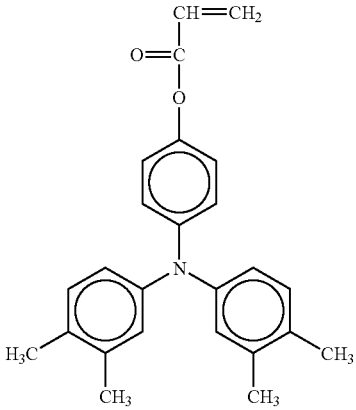
No.15
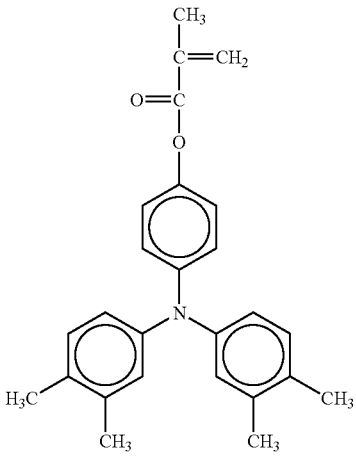
-continued
No. 16
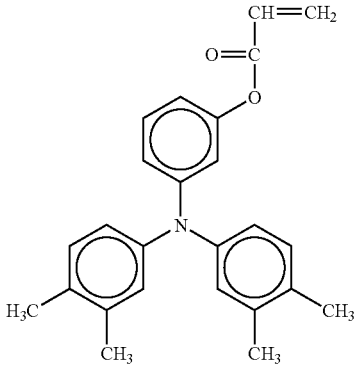
No. 17
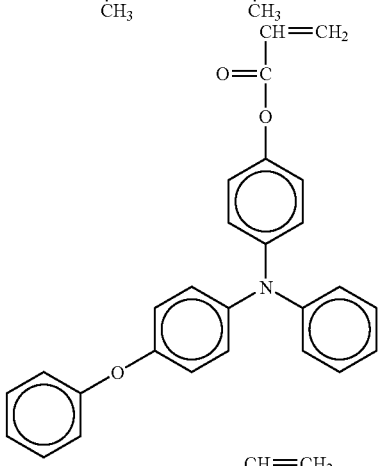
No. 18
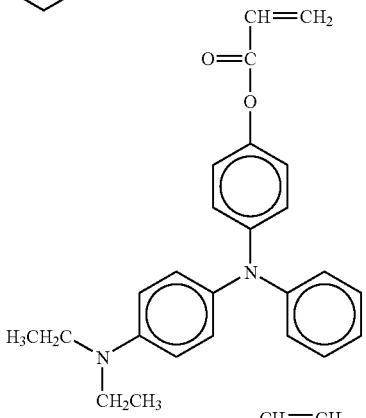
No. 19
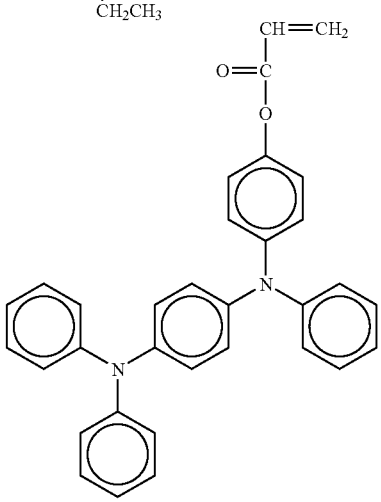

-continued
No. 20
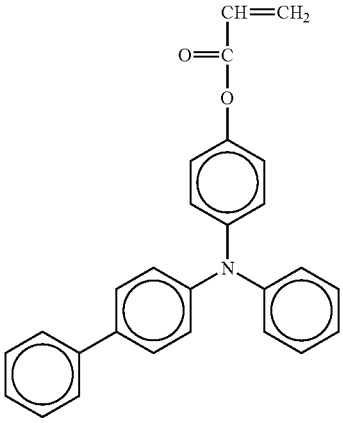
No. 21
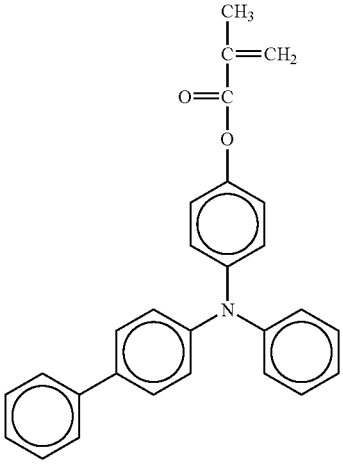
No. 22
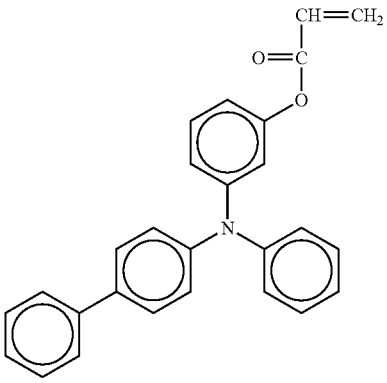
-continued
No. 23
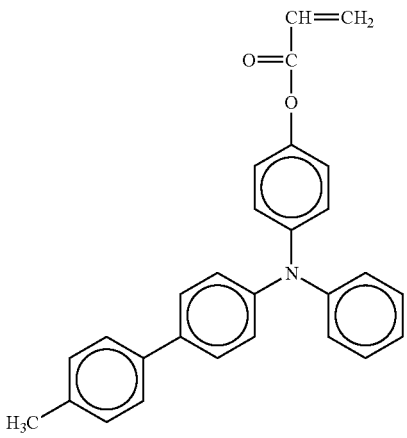
No. 24
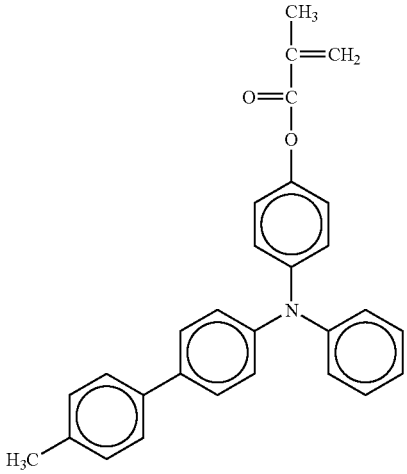
No. 25
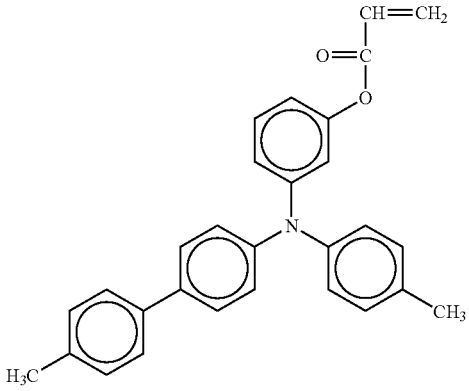

-continued
No. 26
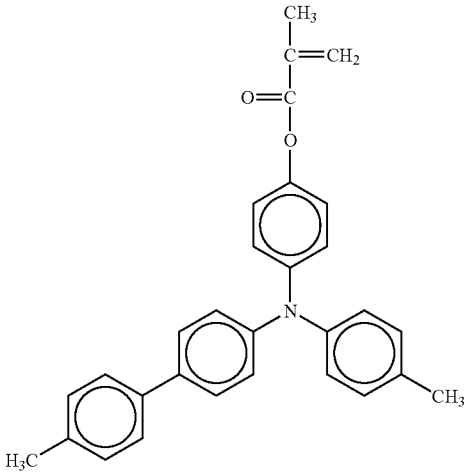
No. 27
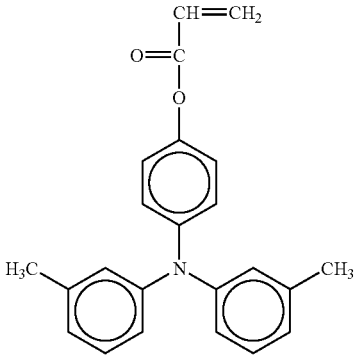
No. 28
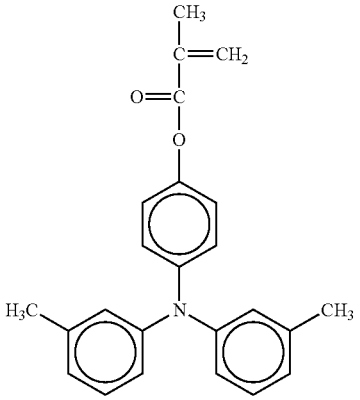
-continued
No. 29
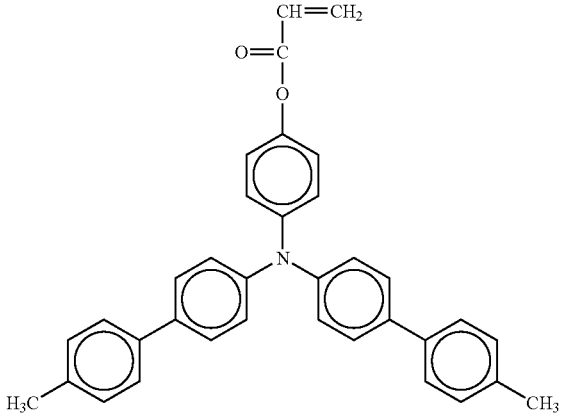
No. 30
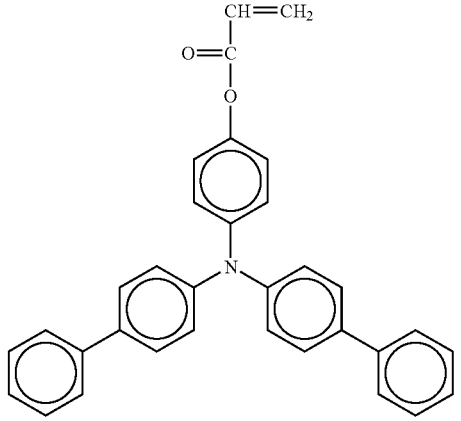
No. 31
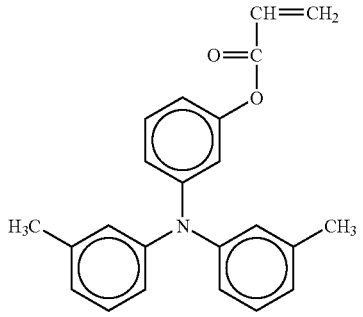
No. 32
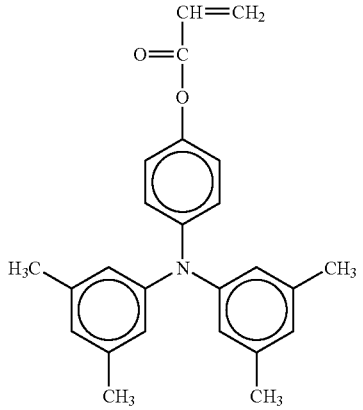

-continued
No. 33
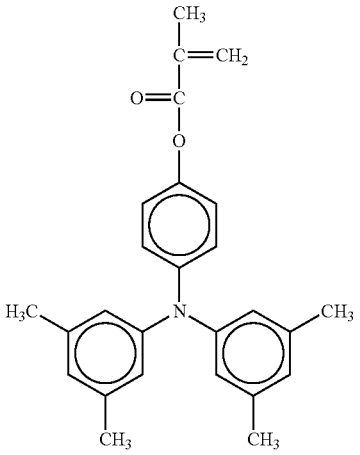
No. 34
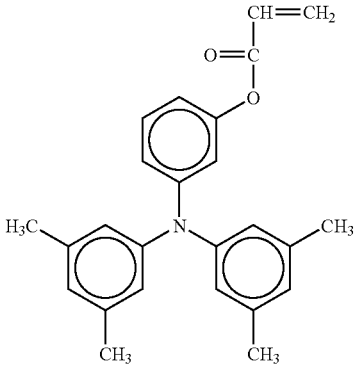
No. 35
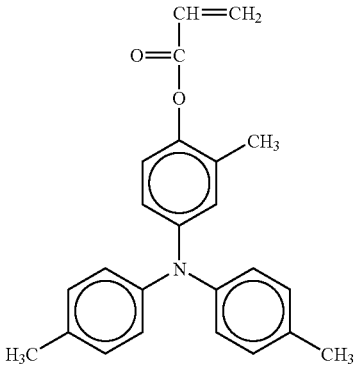
No. 36
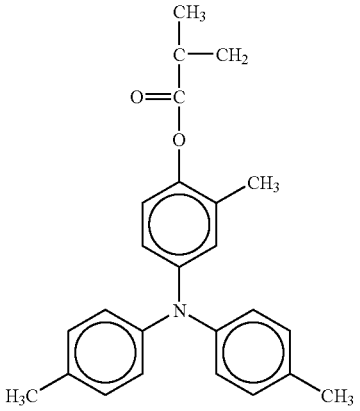
-continued
No. 37
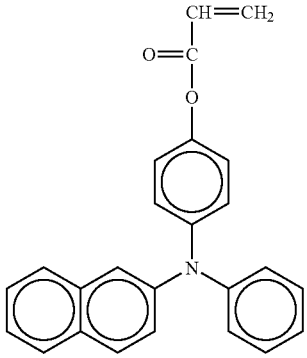
No. 38
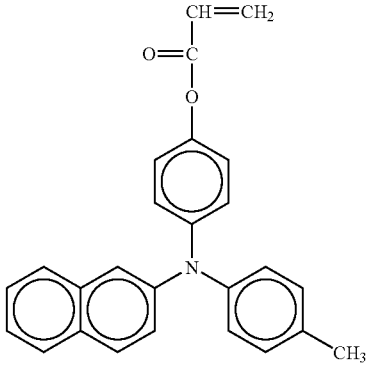
No. 39
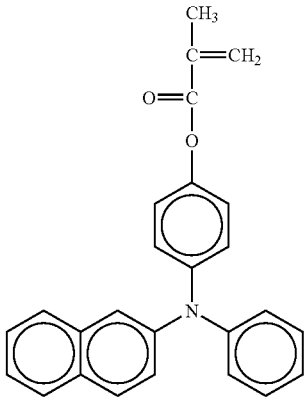
No. 40
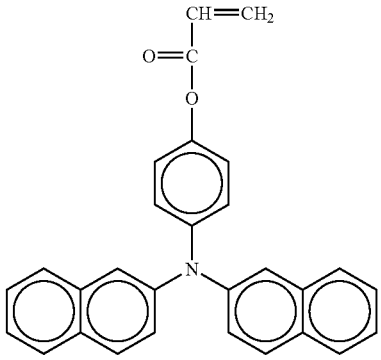

-continued
No. 41
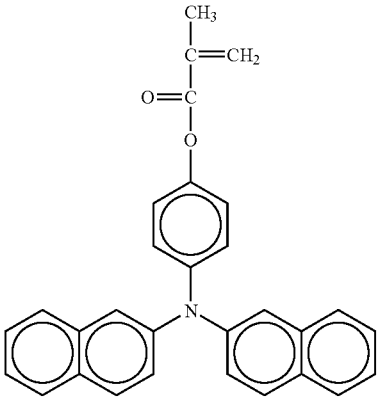
No. 42
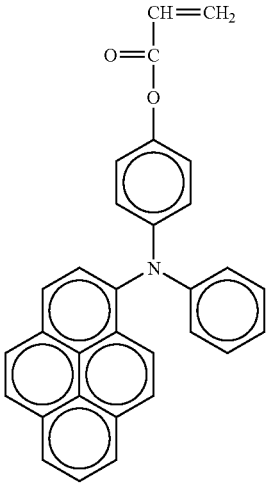
No. 43
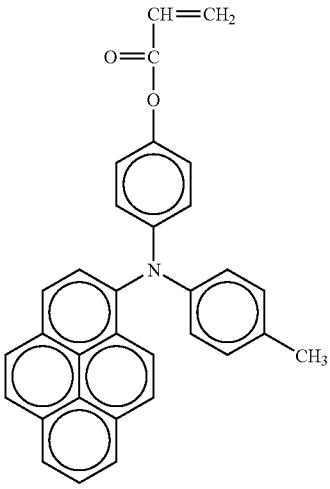
-continued
No. 44
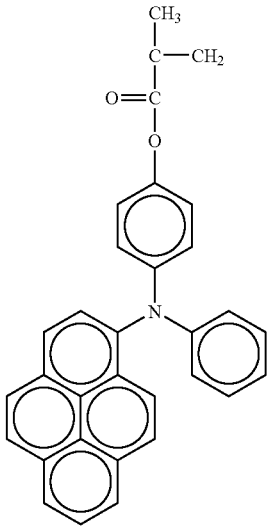
No. 45
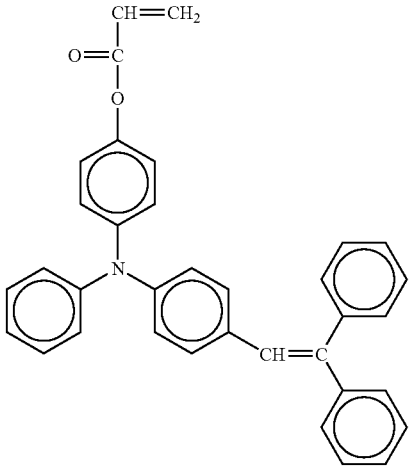
No. 46
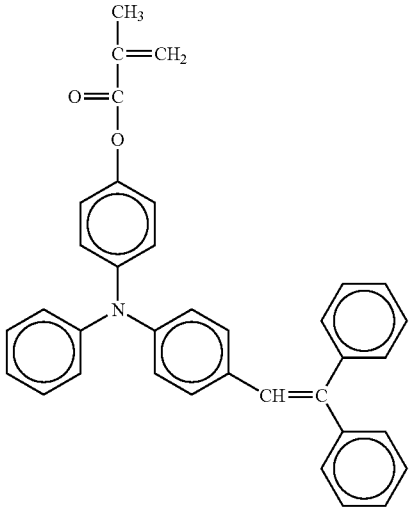

-continued
No. 47
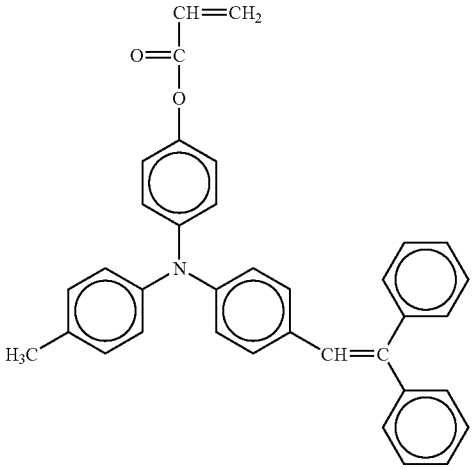
No. 48
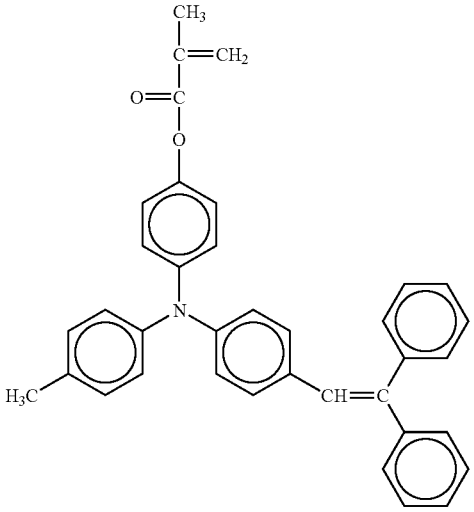
No. 49
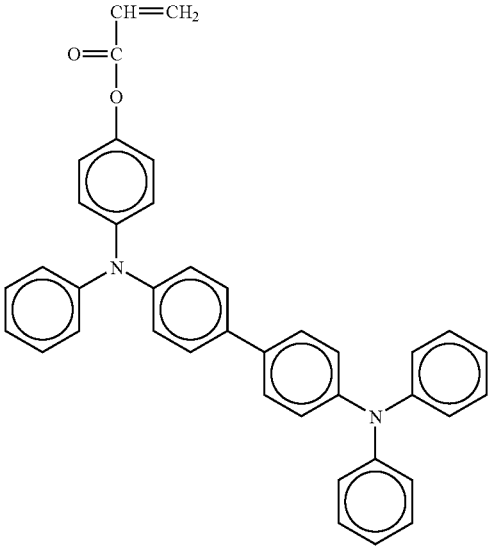
-continued
No. 50
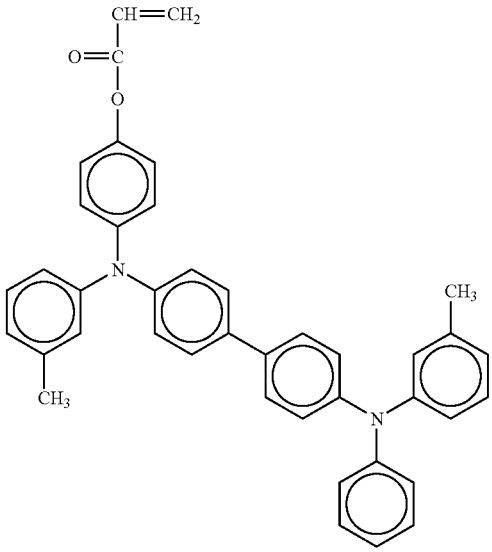
No. 51
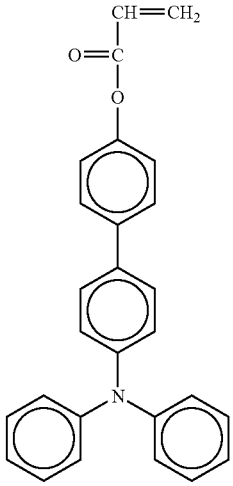
No. 52
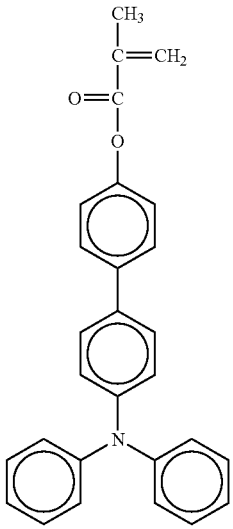

-continued
No. 53
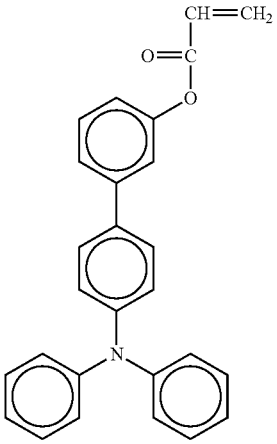
No. 54
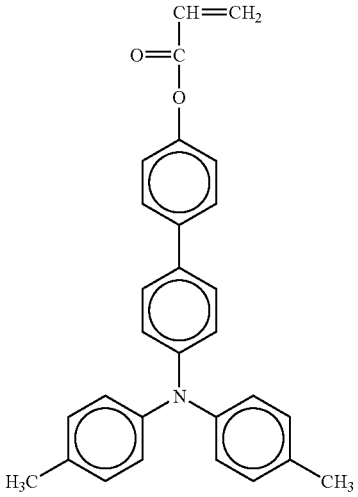
No. 55
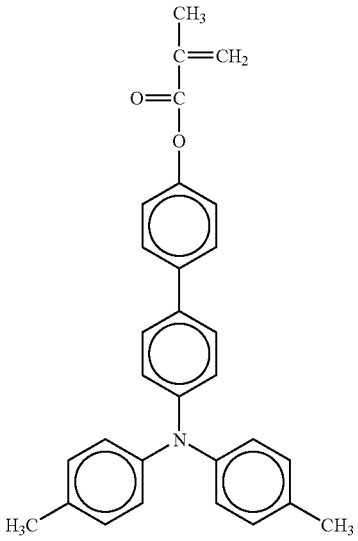
-continued
No. 56
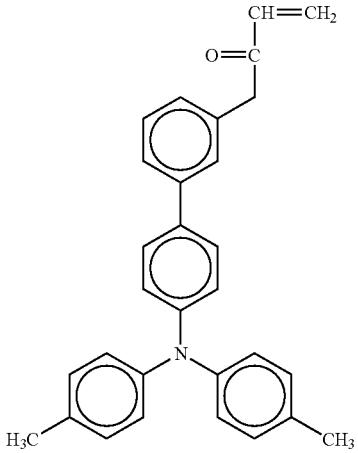
No. 57
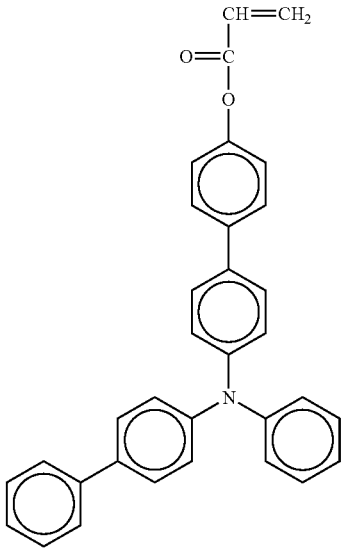
No. 58
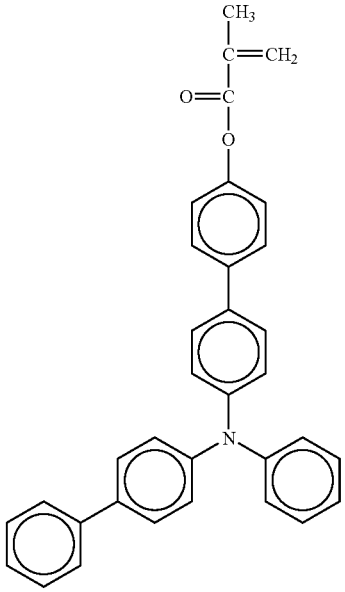

-continued
No. 59
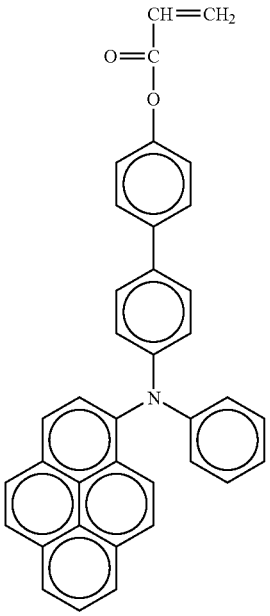
No. 60
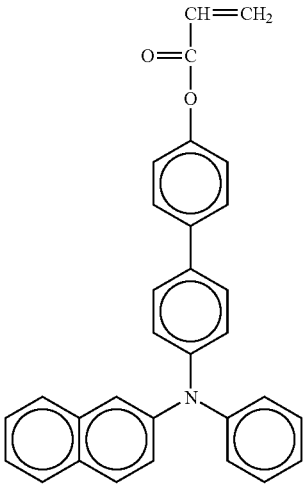
No. 61
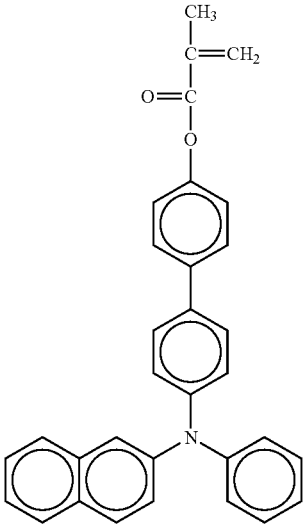
-continued
No. 62
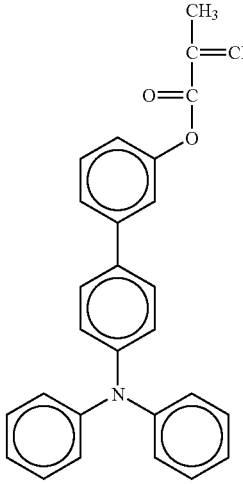
No. 63
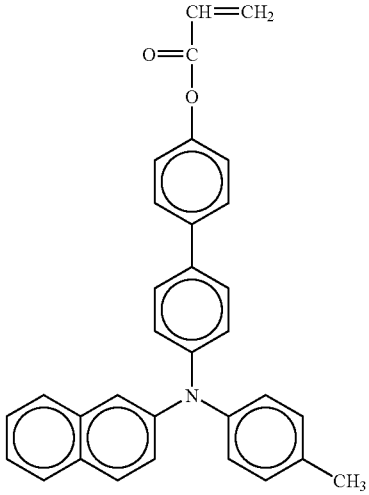
No. 64
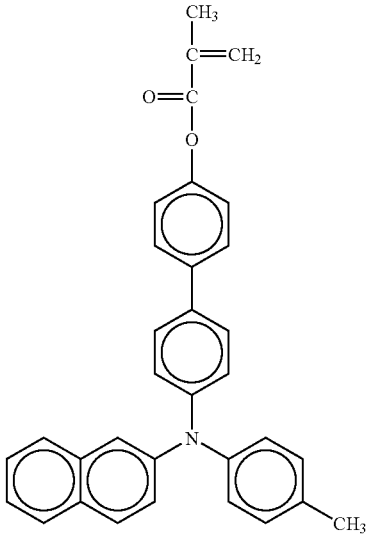

-continued
No. 65
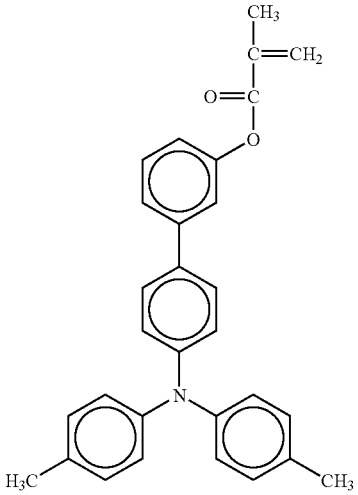
No. 66
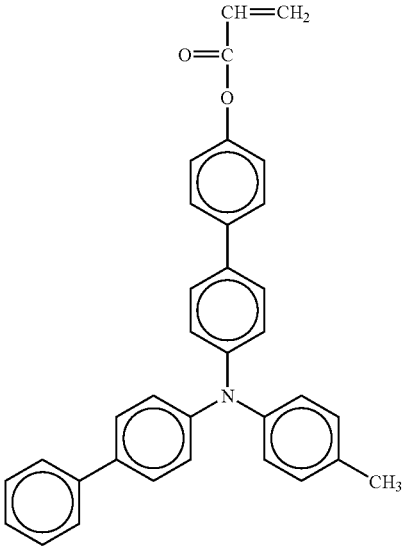
No. 67
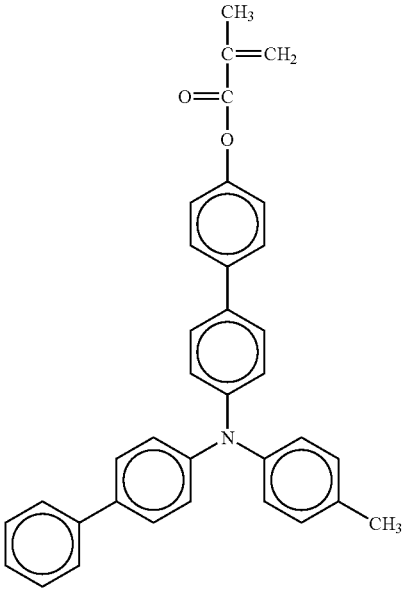
-continued
No. 68
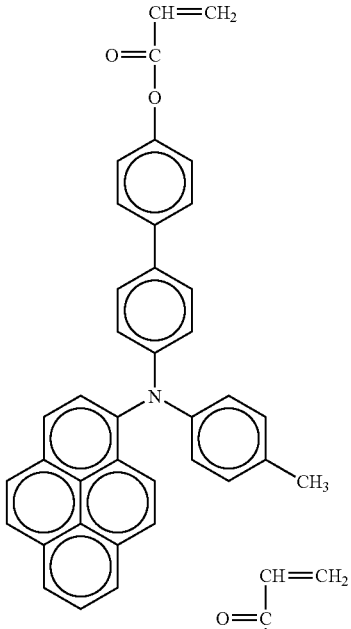
No. 69
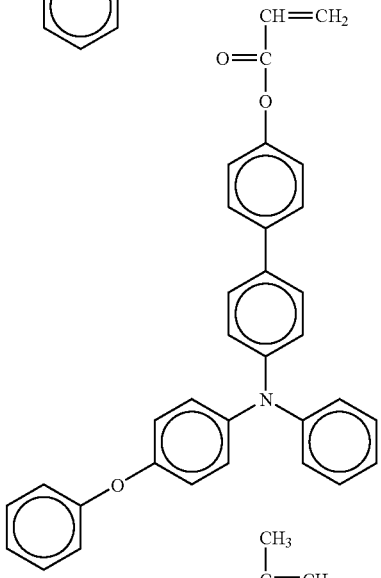
No. 70
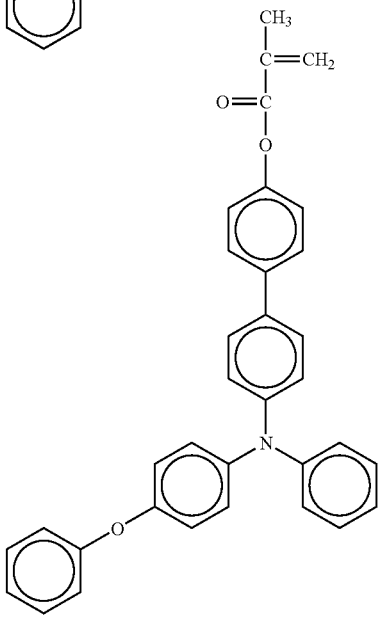

-continued
No. 71
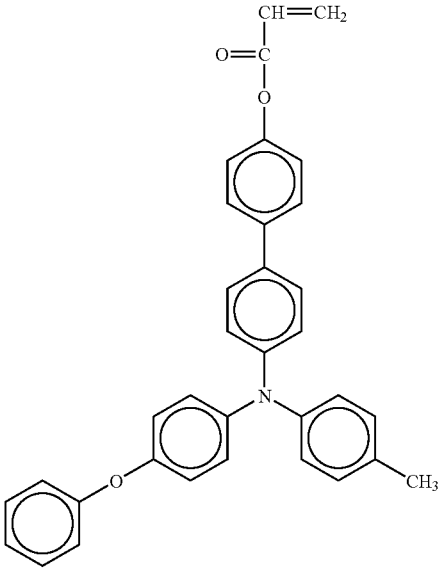
No. 72
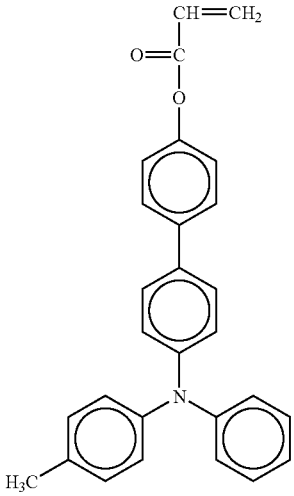
No. 73
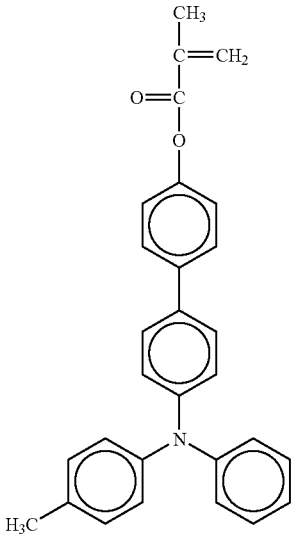
-continued
No. 74
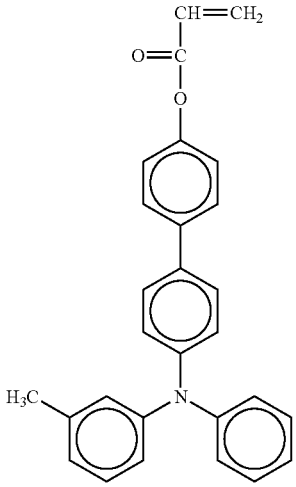
No. 75
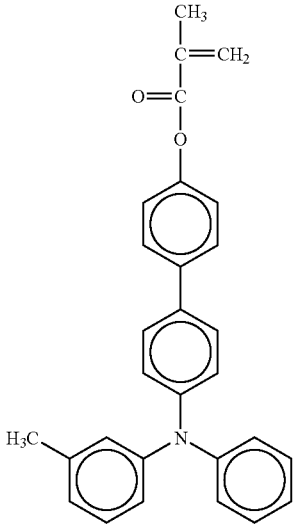
No. 76
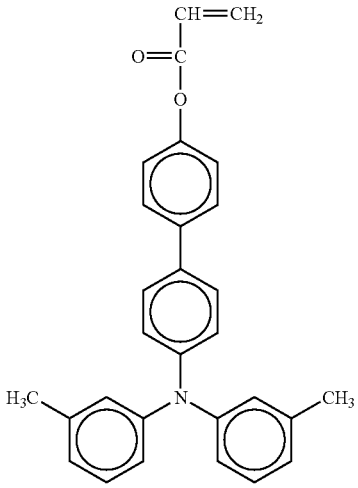

-continued
No. 77
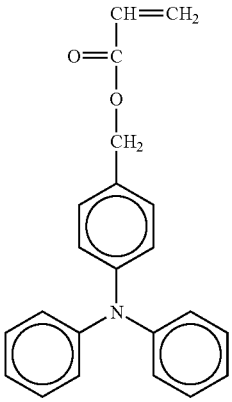
No. 78
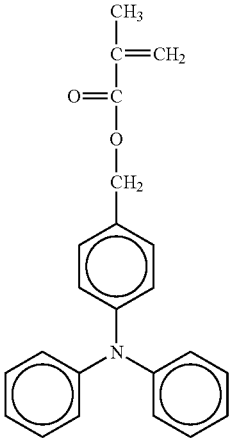
No. 79
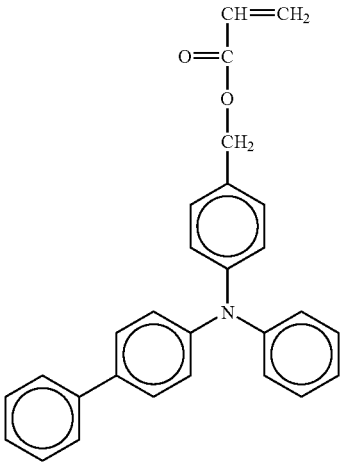
-continued
No. 80
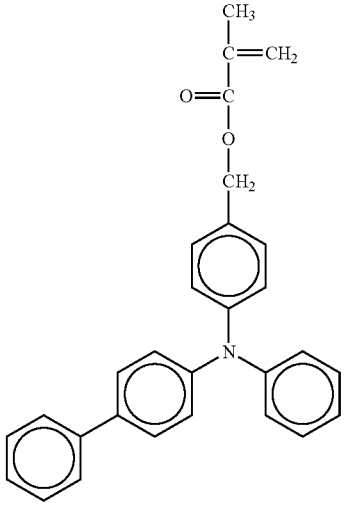
No. 81
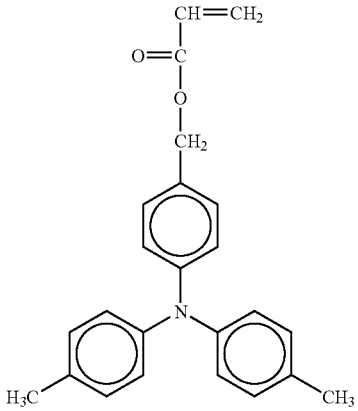
No. 82
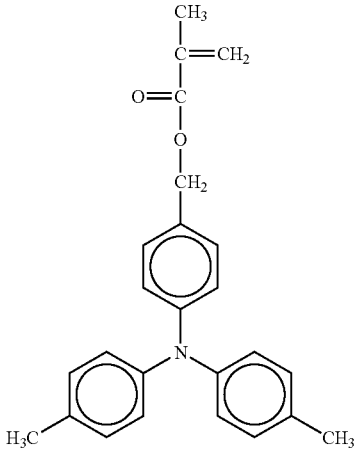

-continued
No. 83
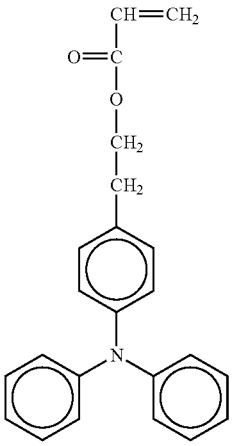
No. 84
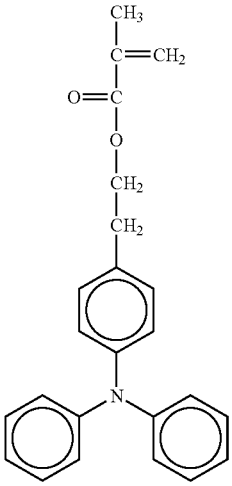
No. 85
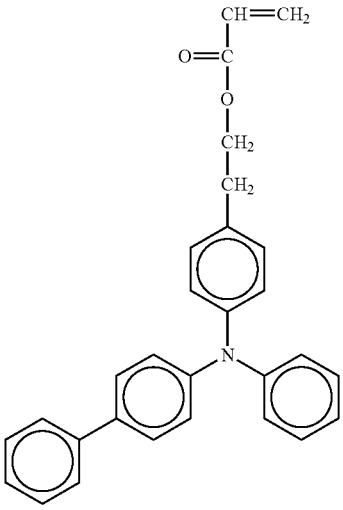
-continued
No. 86
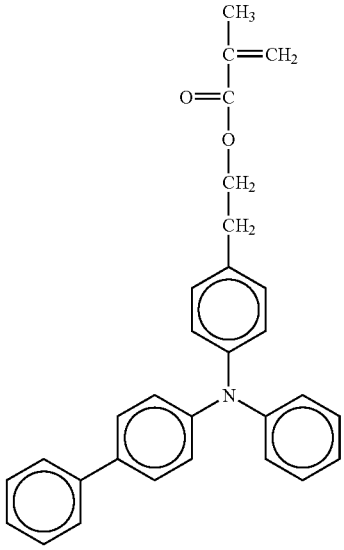
No. 87
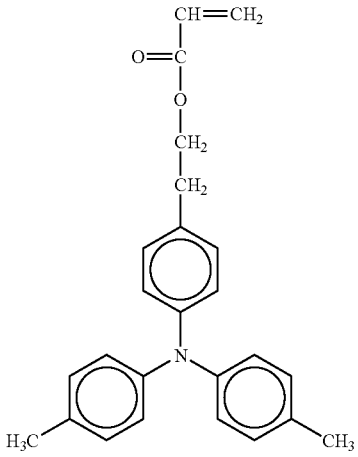
No. 88
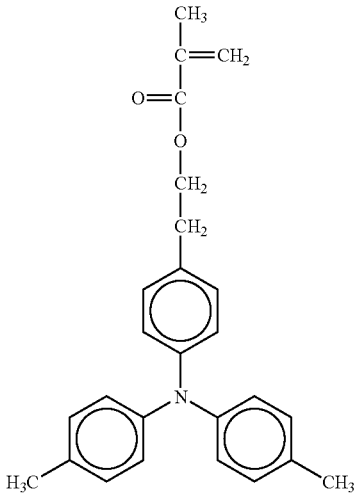

-continued
No. 89
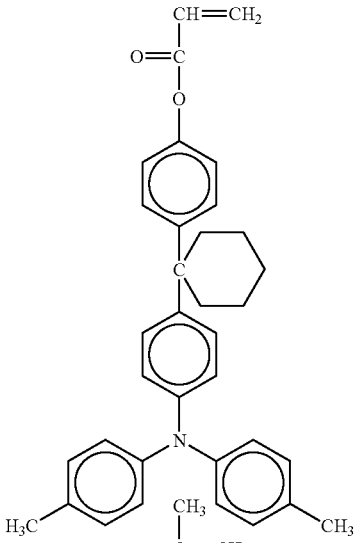
No. 90
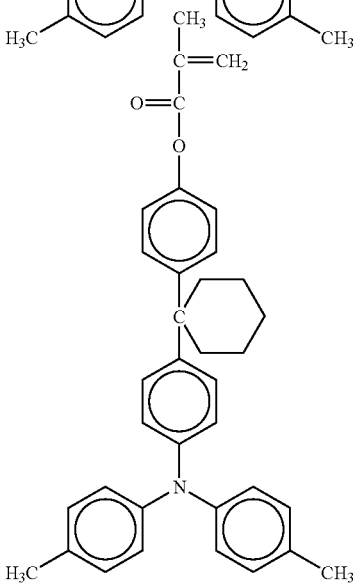
No. 91
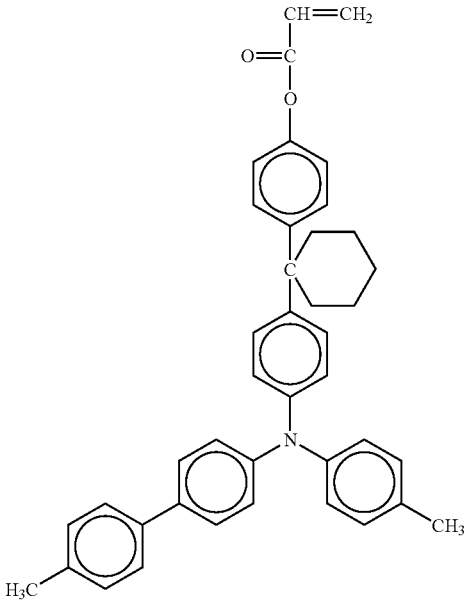
-continued
No. 92
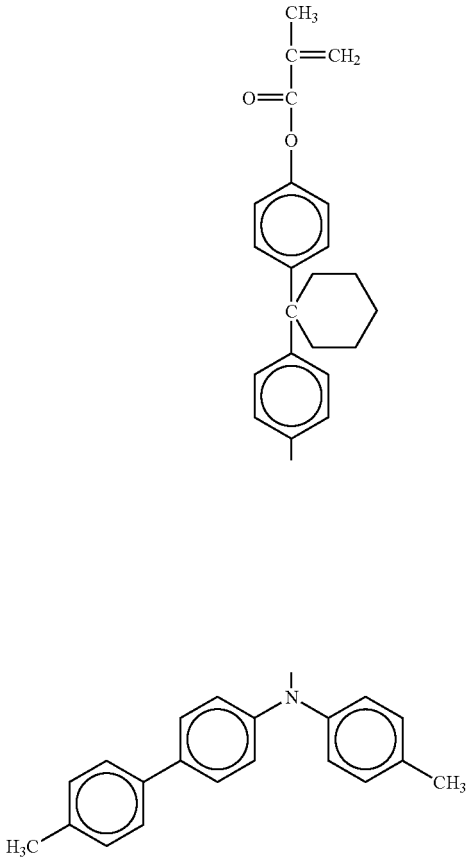
No. 93
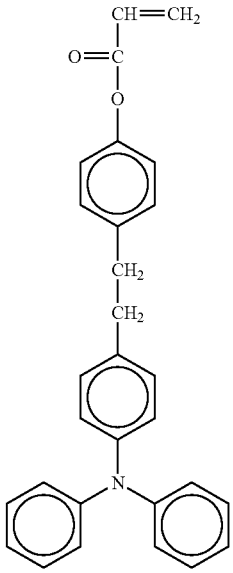

-continued
No. 94
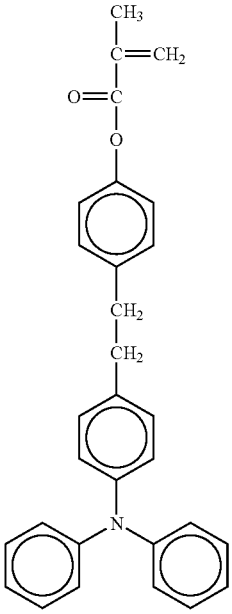
No. 95
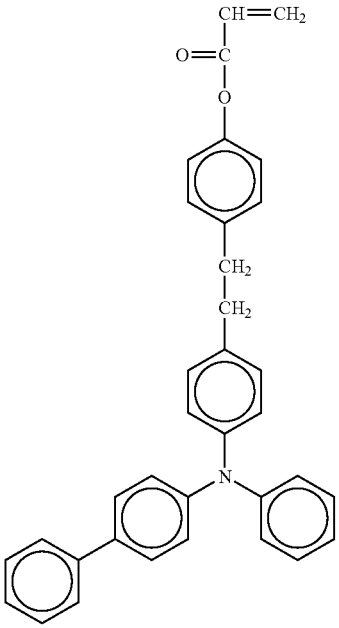
No. 96
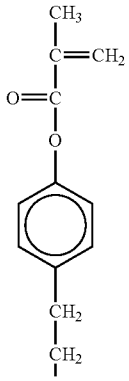
-continued
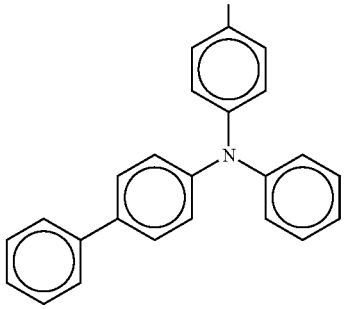
No. 97
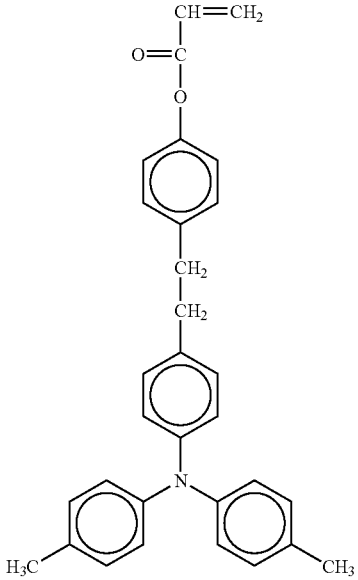
No. 98
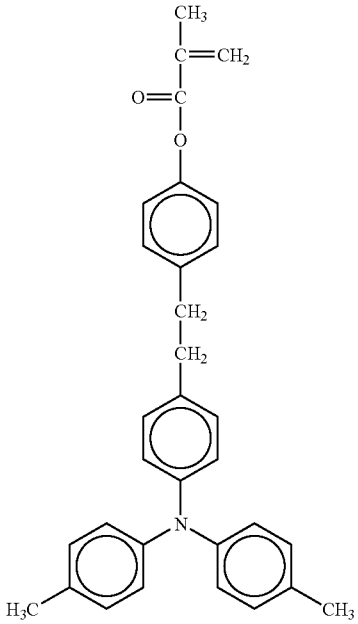

-continued
No. 99
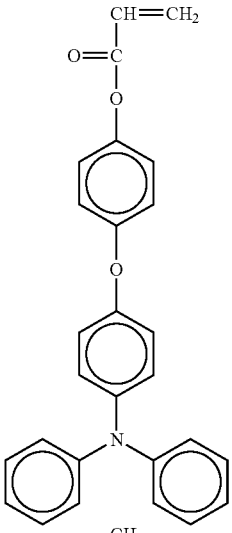
No. 100
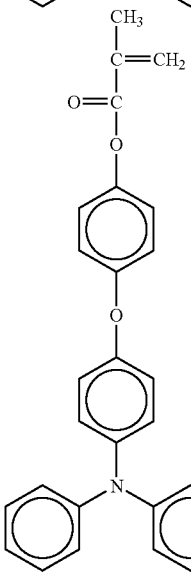
No. 101
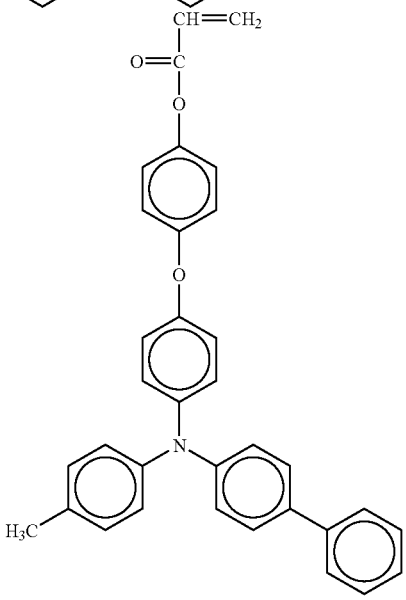
-continued
No. 102
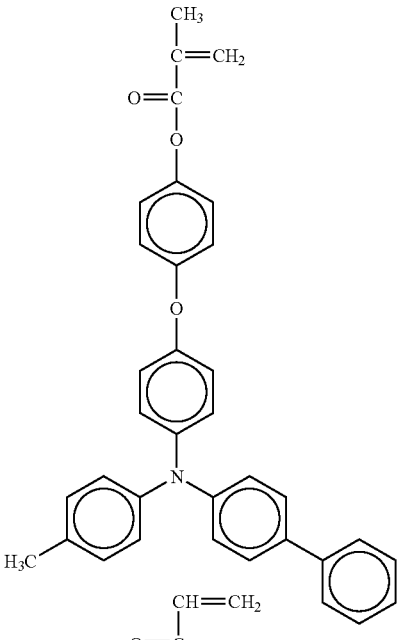
No. 103
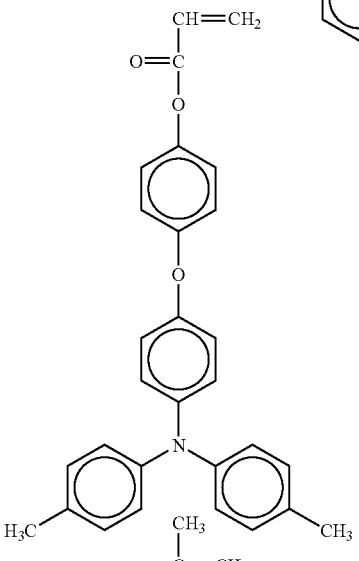
No. 104
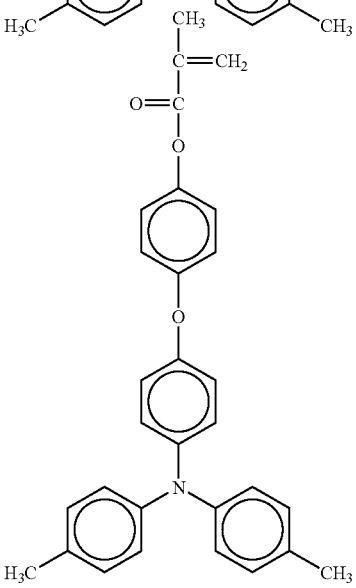

-continued
No. 105
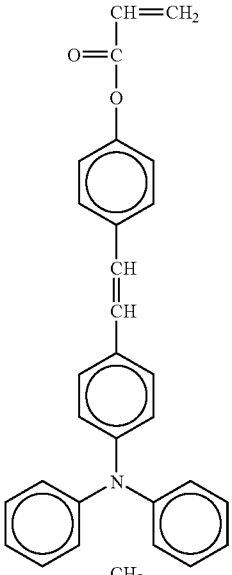
No. 106
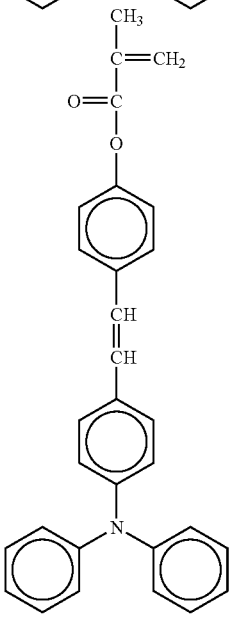
No. 107
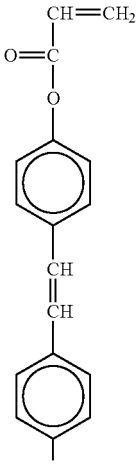
-continued
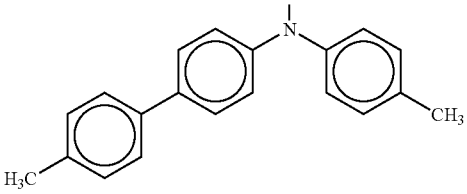
No. 108
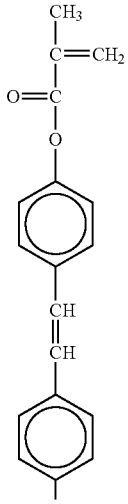
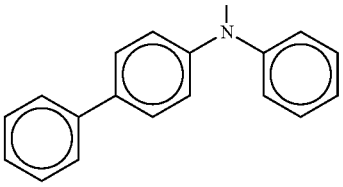
No. 109
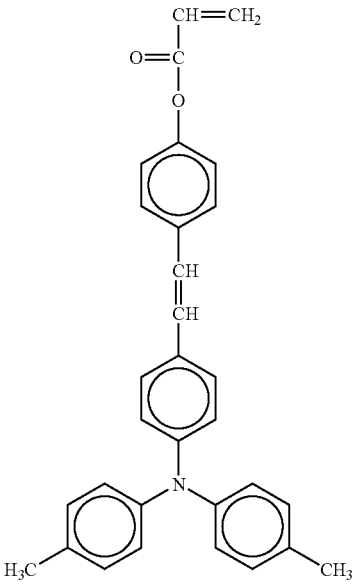

-continued
No. 110
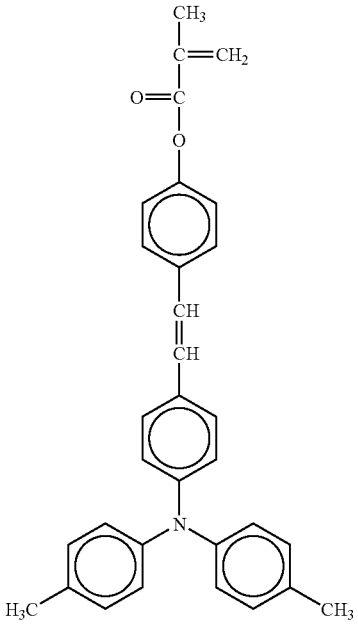
No. 111
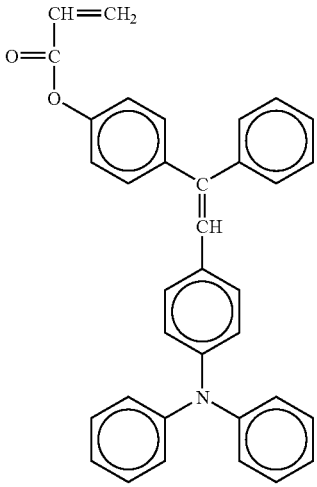
No. 112
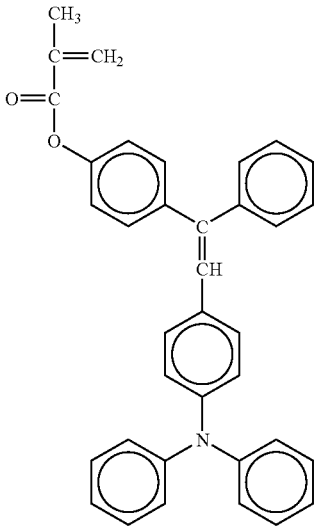
-continued
No. 113
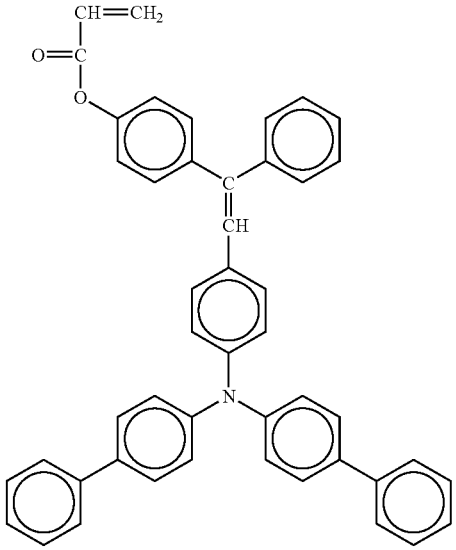
No. 114
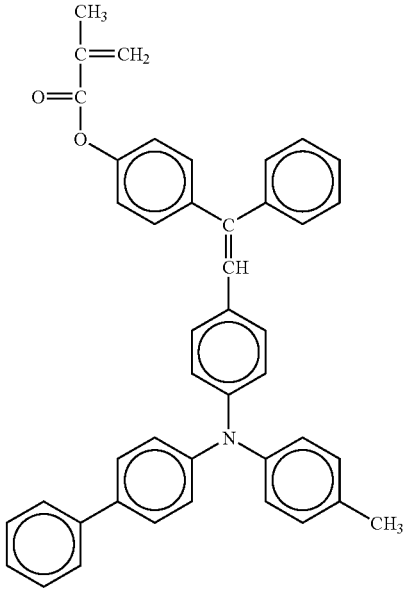
No. 115
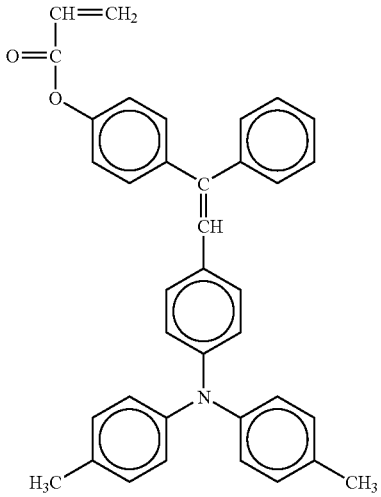

-continued
No. 116
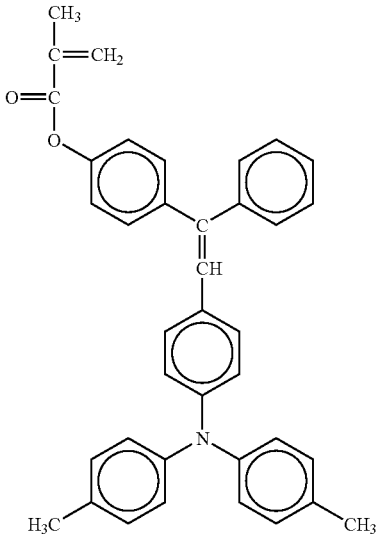
No. 117
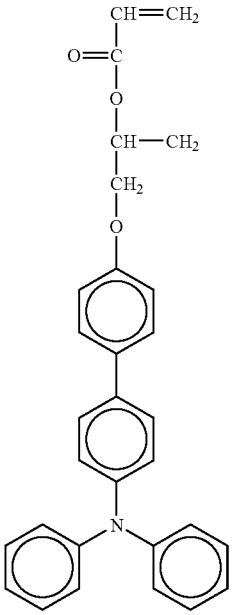
No. 118
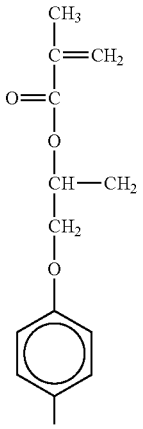
-continued
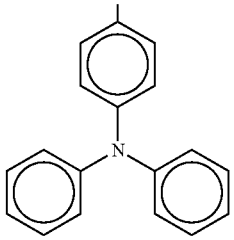
No. 119
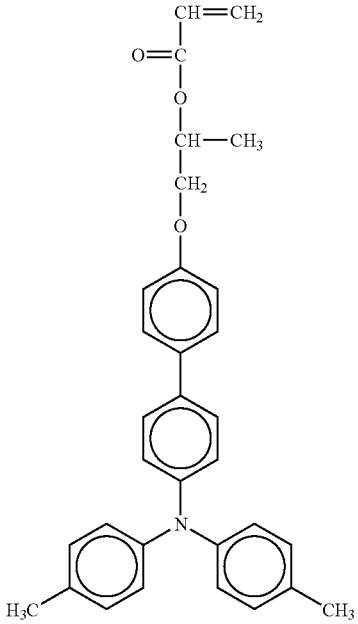
No. 120
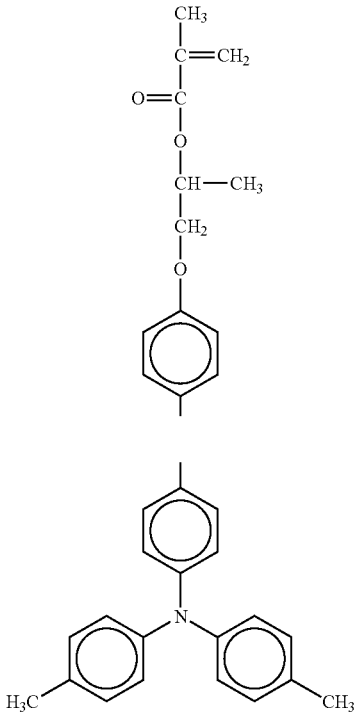

-continued
No. 121
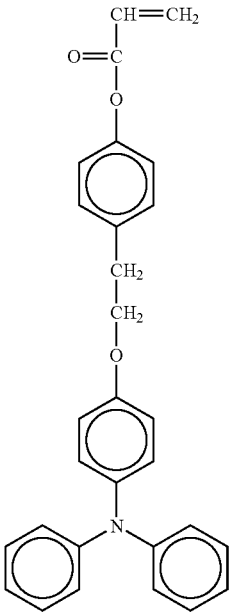
No. 122
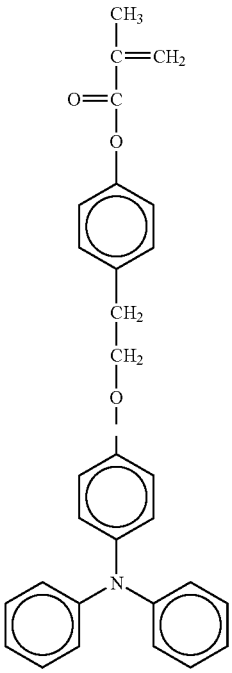
No. 123
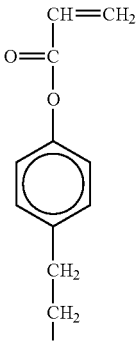
-continued
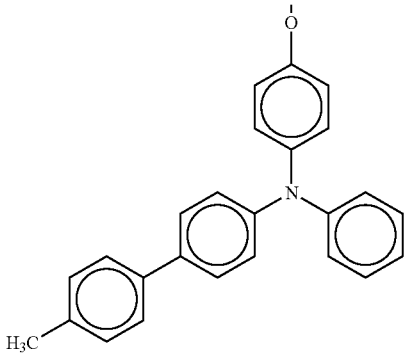
No. 124
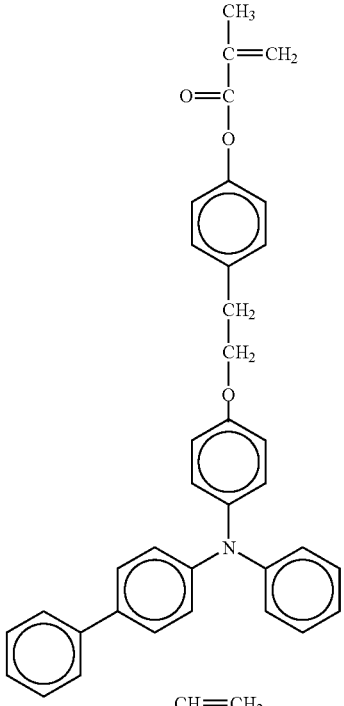
No. 125
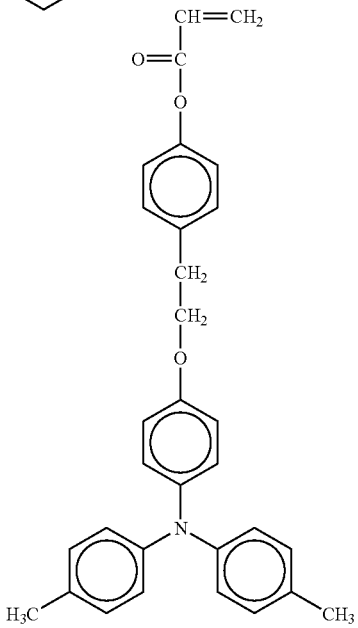

-continued
No. 126
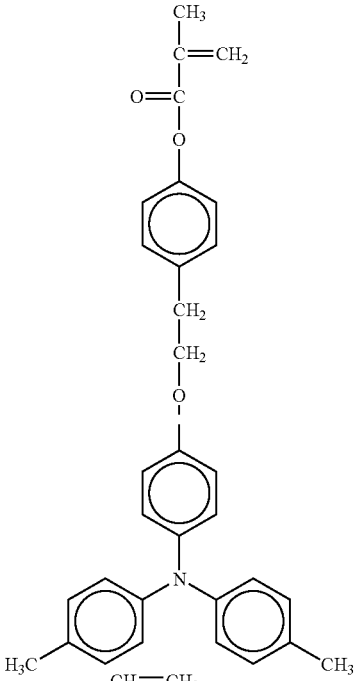
No. 127
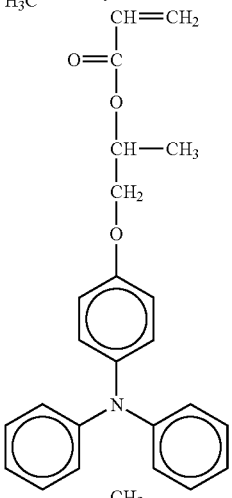
No. 128
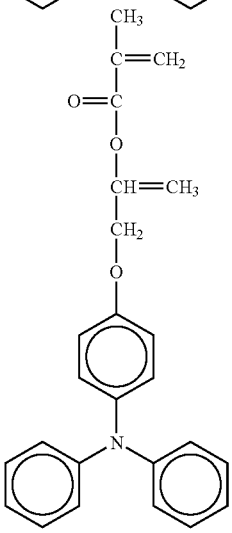
-continued
No. 129
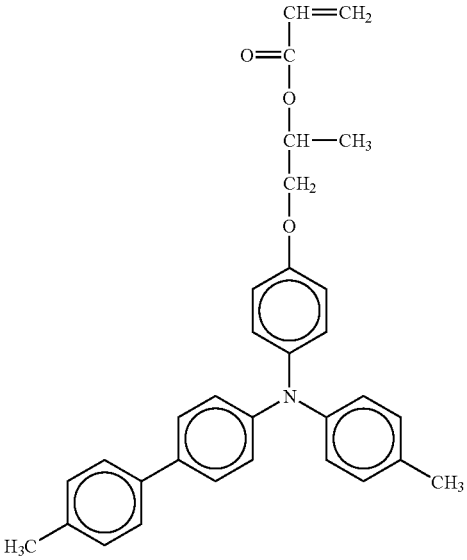
No. 130
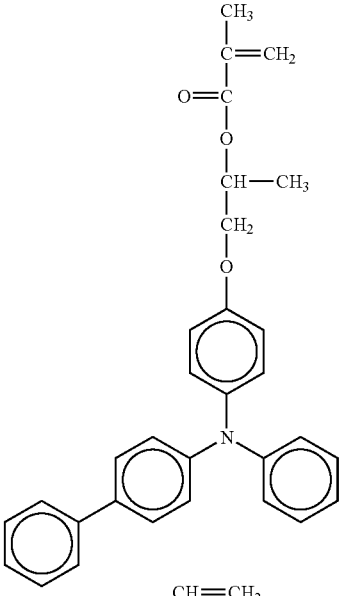
No. 131
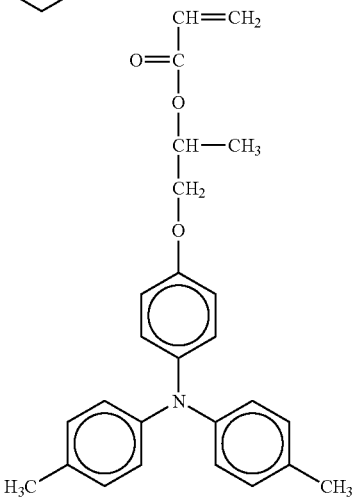

-continued
No. 132
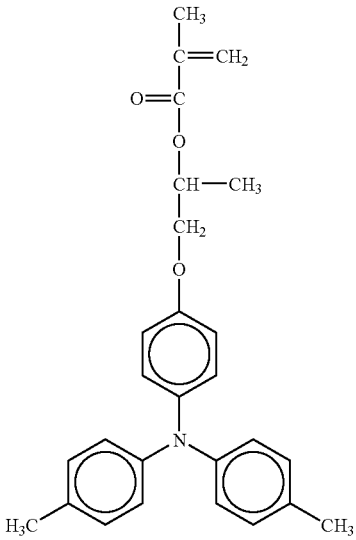
No. 133
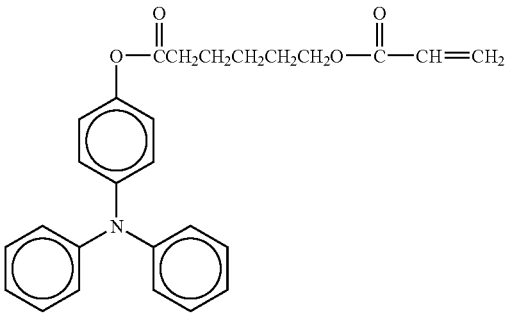
No. 134
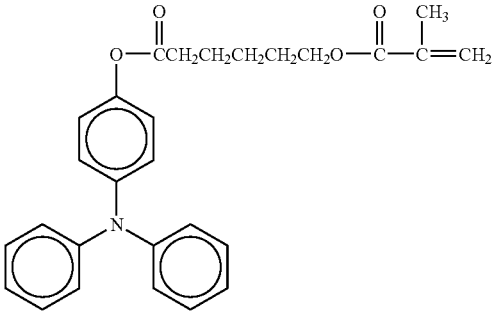
No. 135
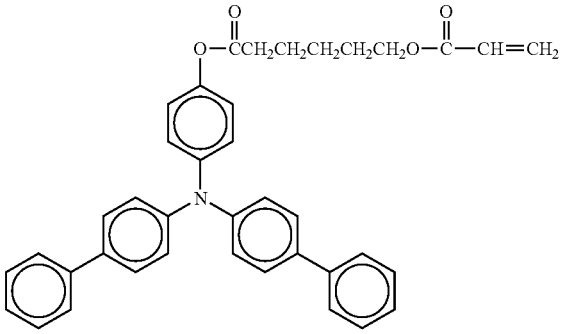
-continued
No. 136
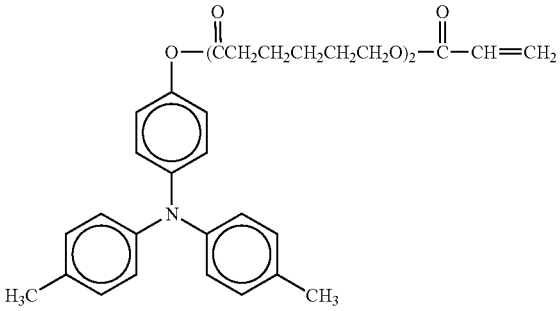
No. 137
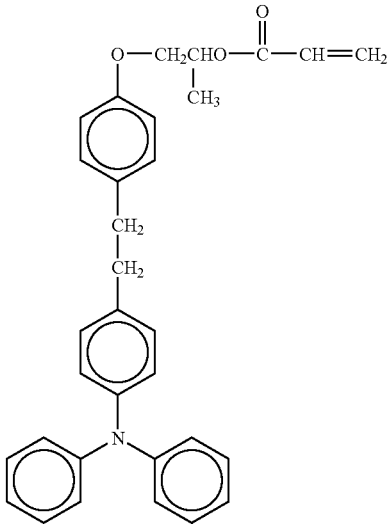
No. 138
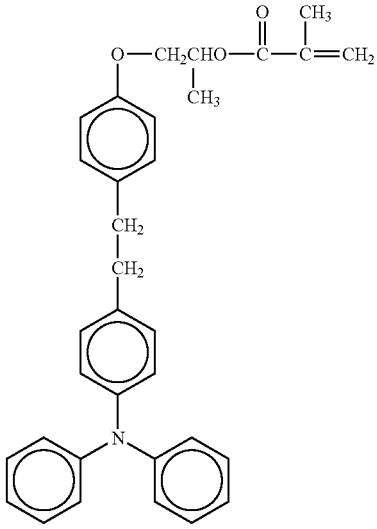

-continued
No. 139
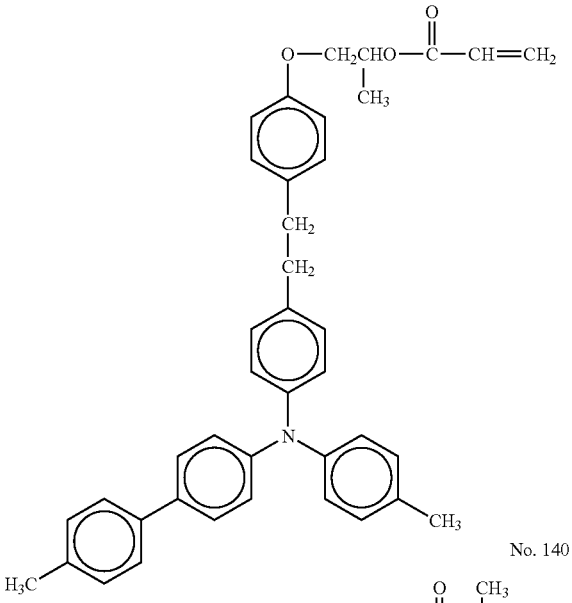
No. 140
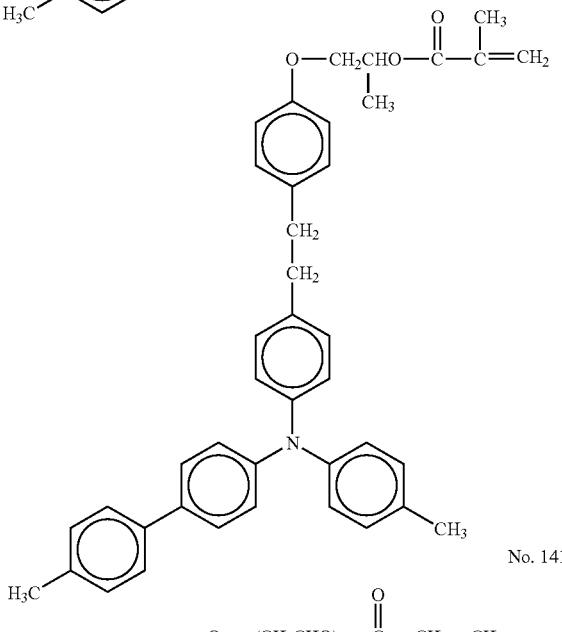
No. 141
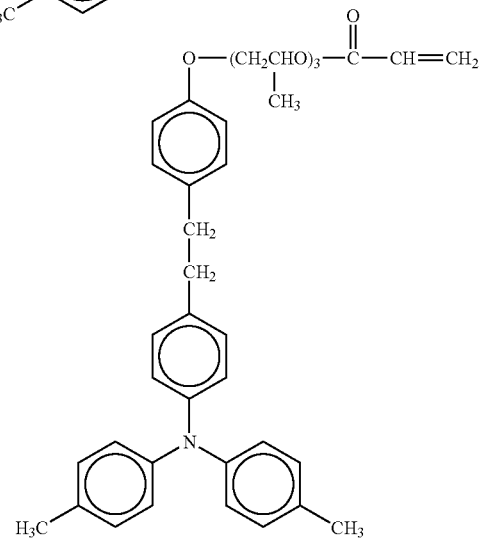
-continued
No. 142
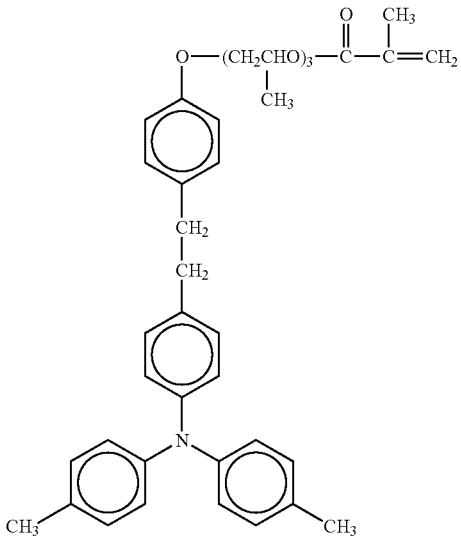
No. 143
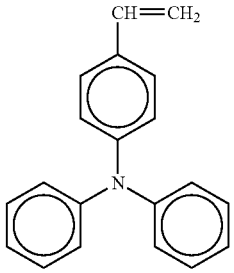
No. 144
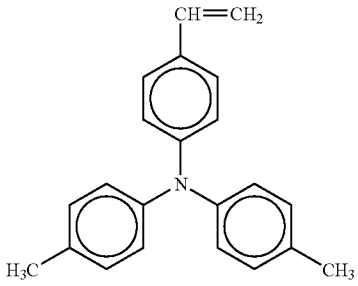
No. 145
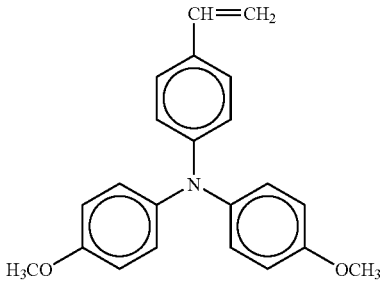

-continued
No. 146
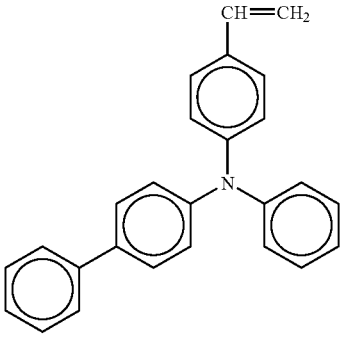
No. 147
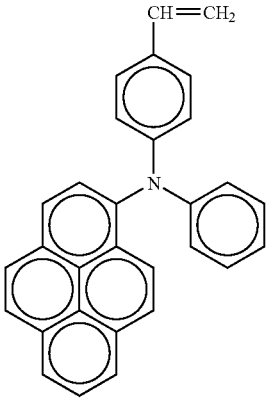
No. 148
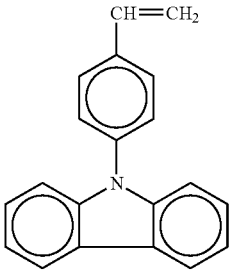
No. 149
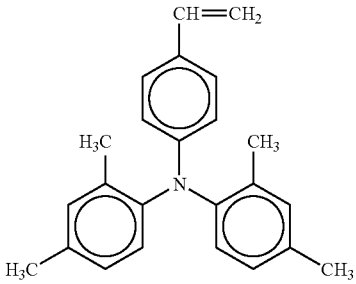
No. 150
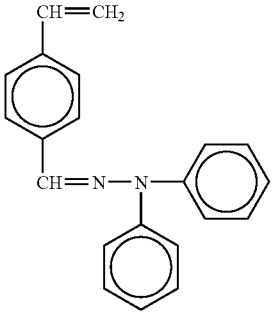
-continued
No. 151
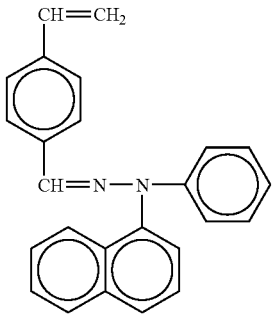
No. 152
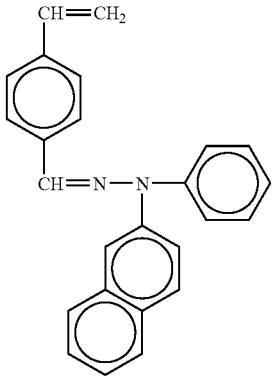
No. 153
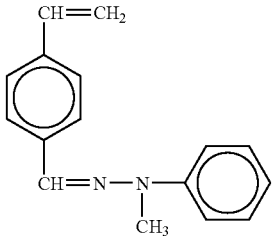
No. 154
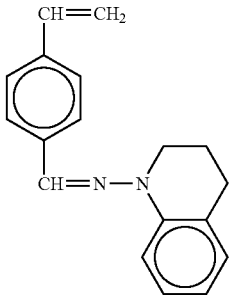
No. 155
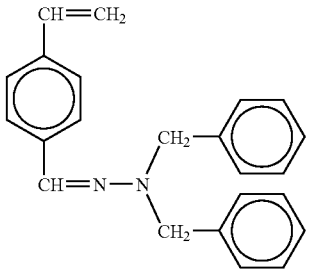

-continued
No. 156
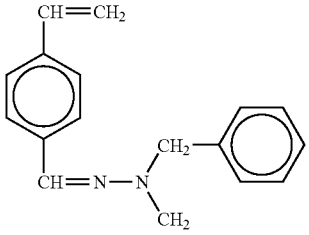
No. 157
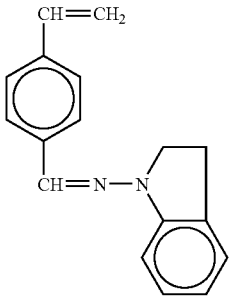
No. 158
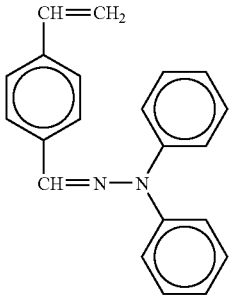
-continued
No. 159
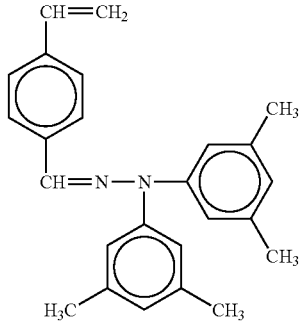
No. 160
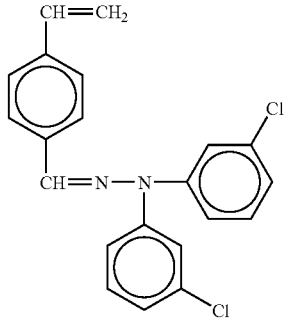
Specific examples of the radical polymerizable compound having two functional groups with a charge transport structure include, but are not limited to, the following:
NO.161
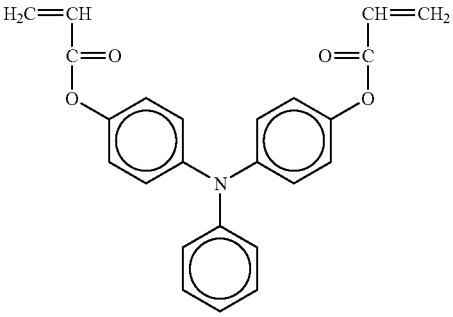
NO.162
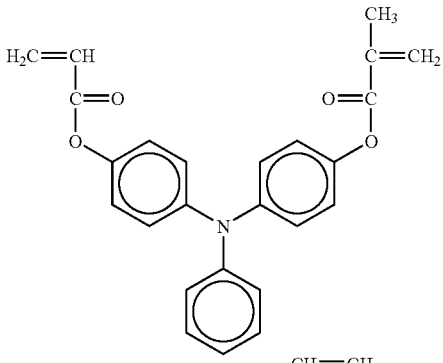
NO.163
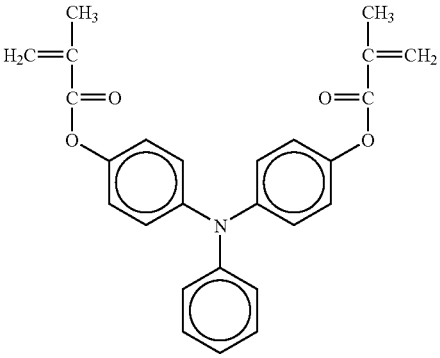
NO.164
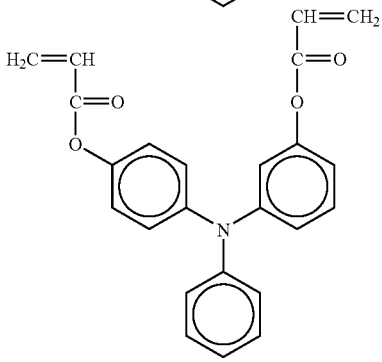

-continued
NO.165
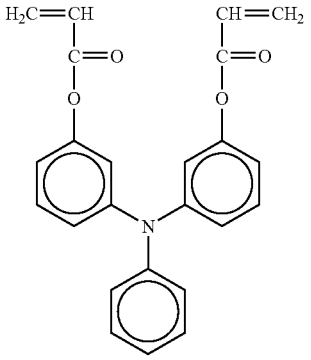
NO.166
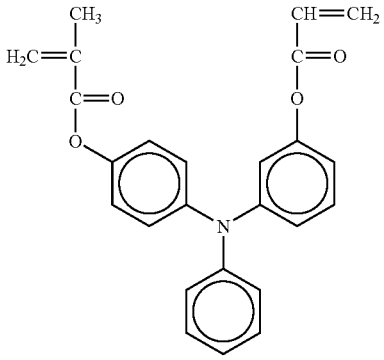
NO.167
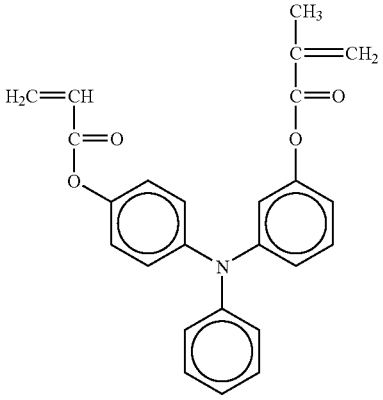
NO.168
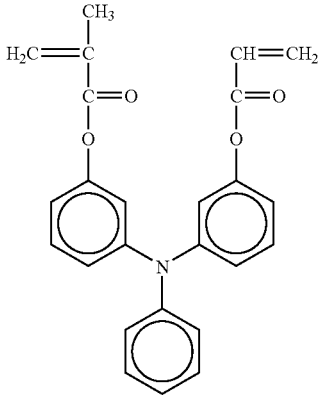
NO.169
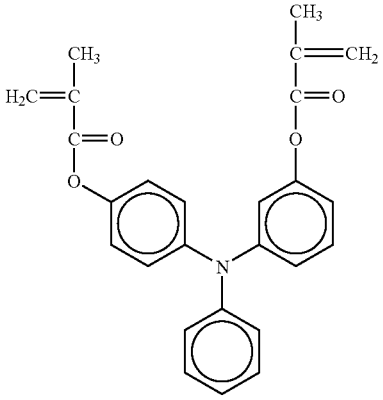
NO.170
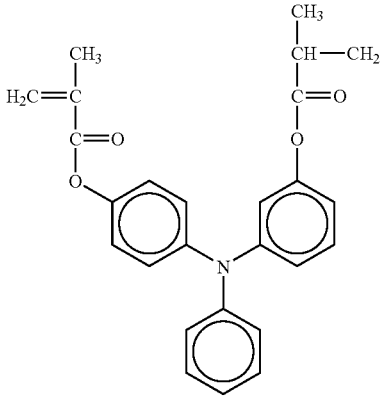
NO.171
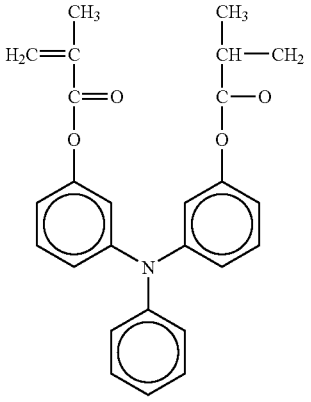
NO.172
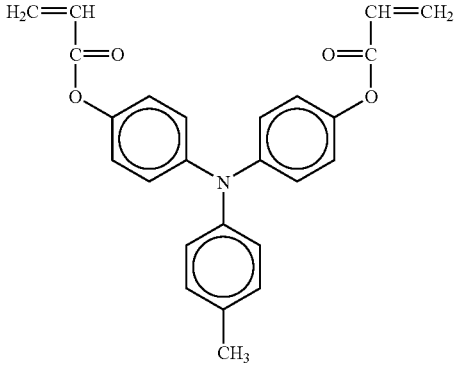

-continued
NO.173
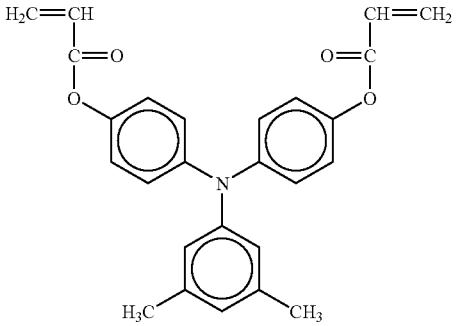
NO.174
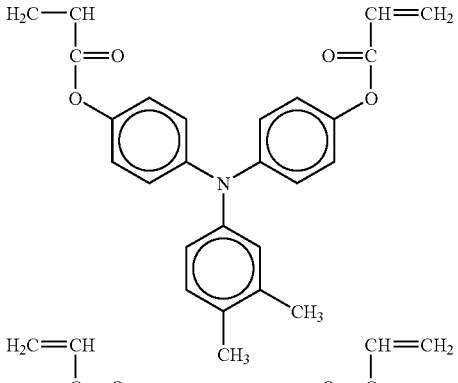
NO.175
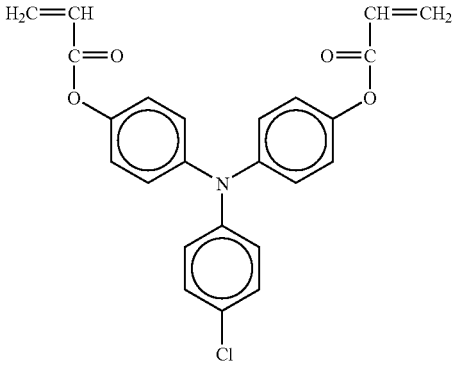
NO.176
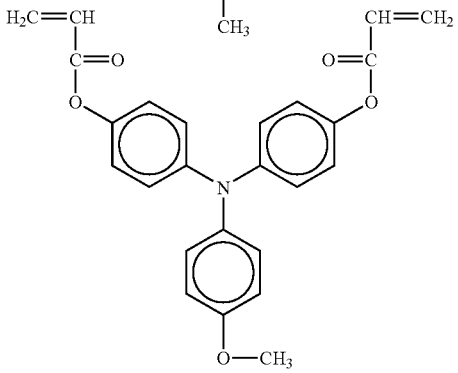
NO.177
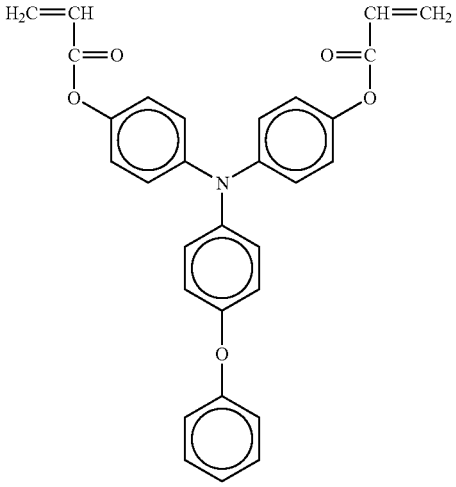
NO.178
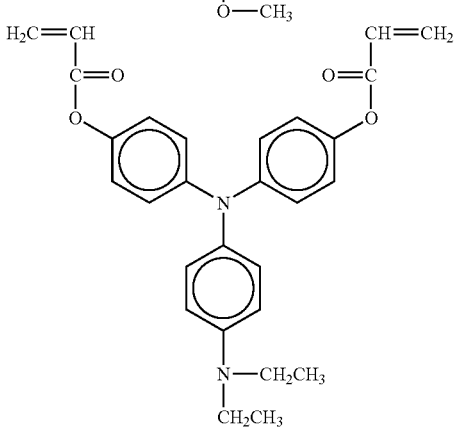
NO.179
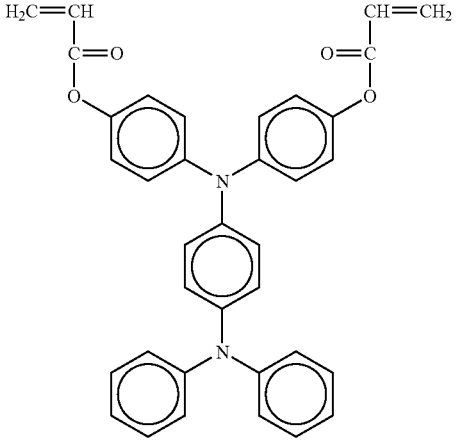
NO.180
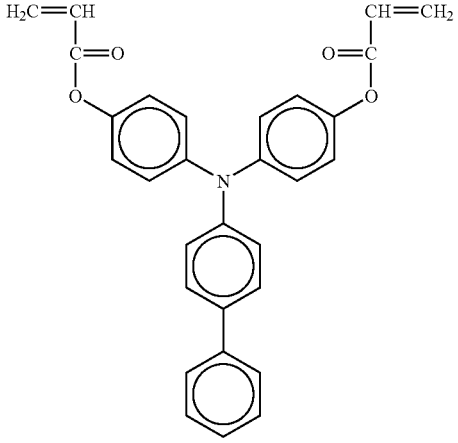

-continued
NO.181
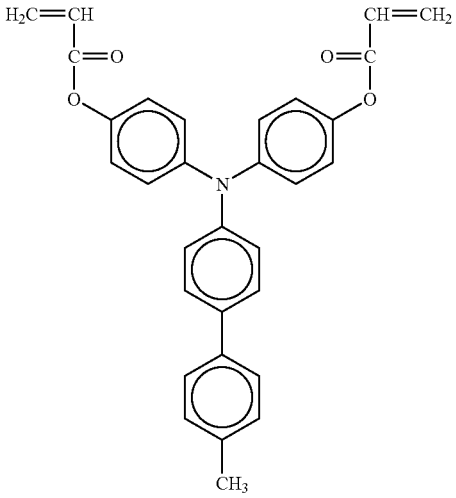
NO.182
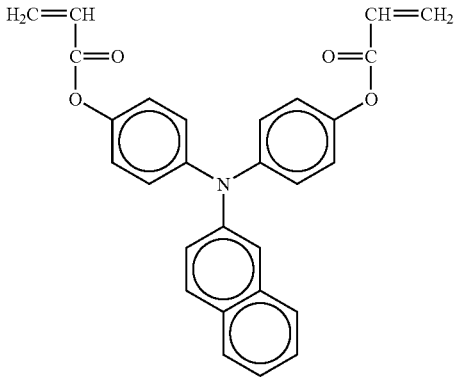
NO.183
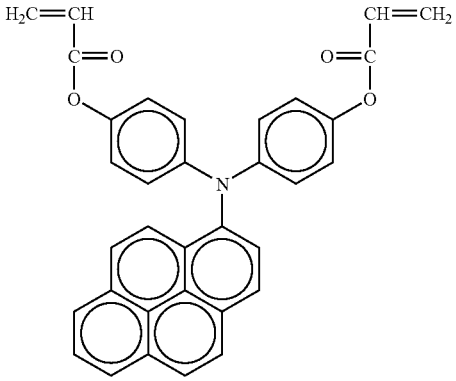
NO.184
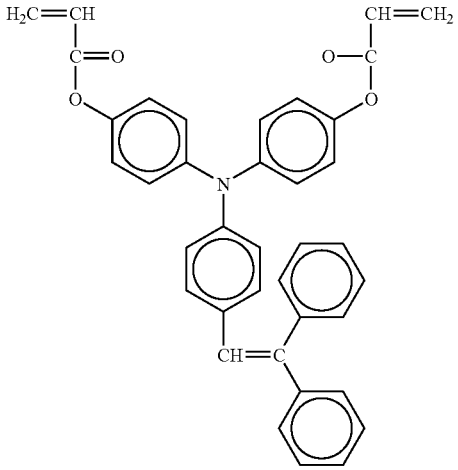
NO.185
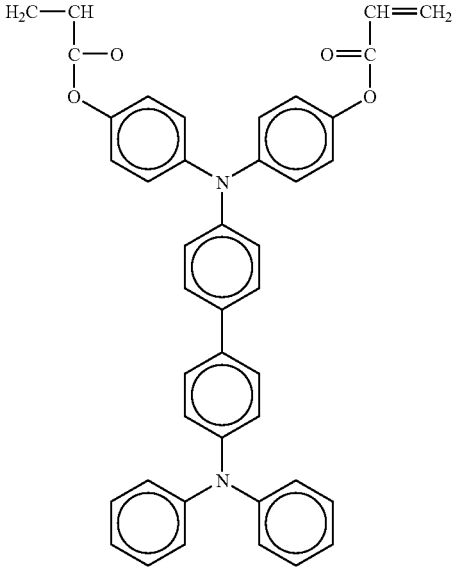
NO.186
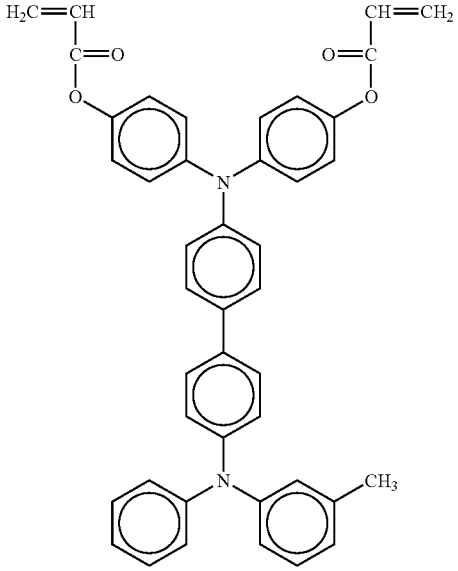

-continued
NO.187
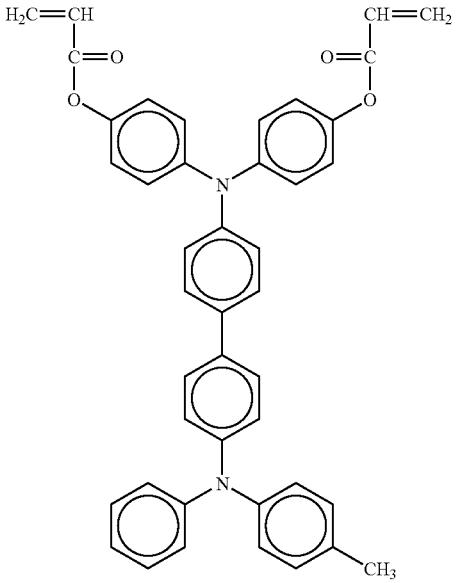
NO.188
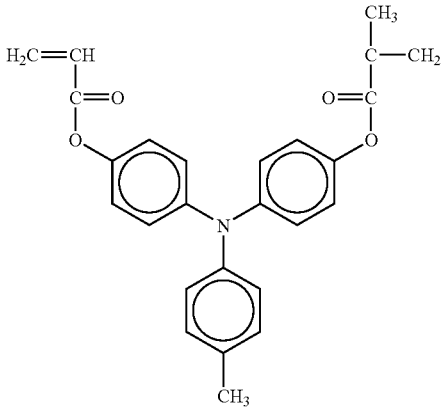
NO.189
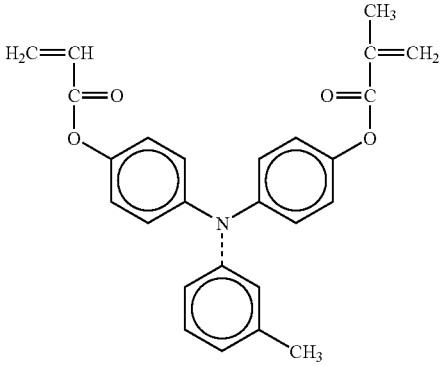
NO.190
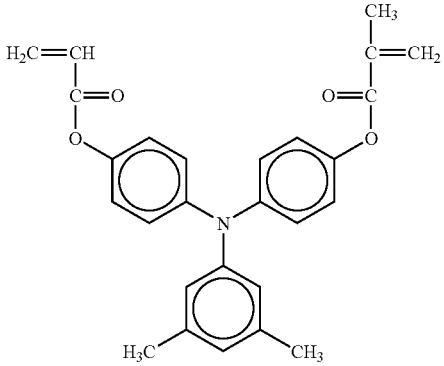
NO.191
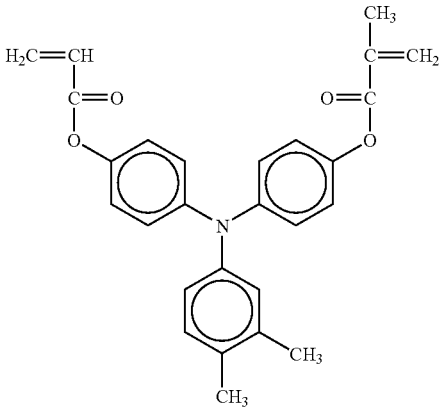
NO.192
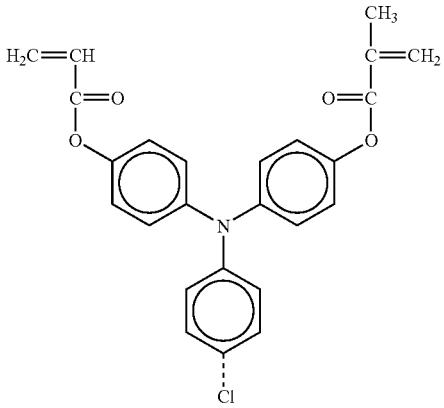

-continued
NO.193
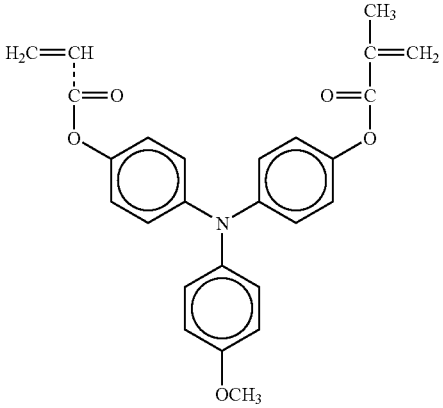
NO.194
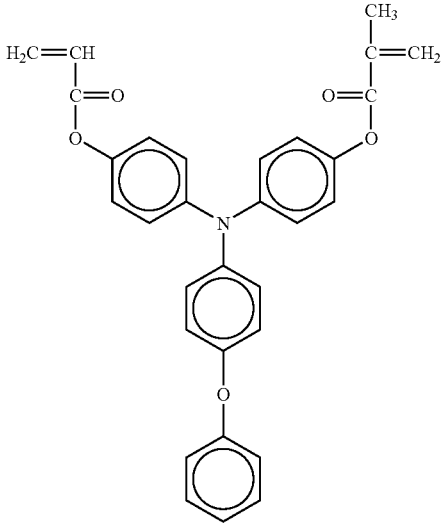
NO.195
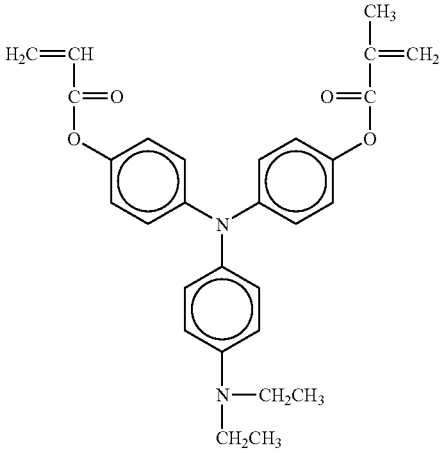
NO.196
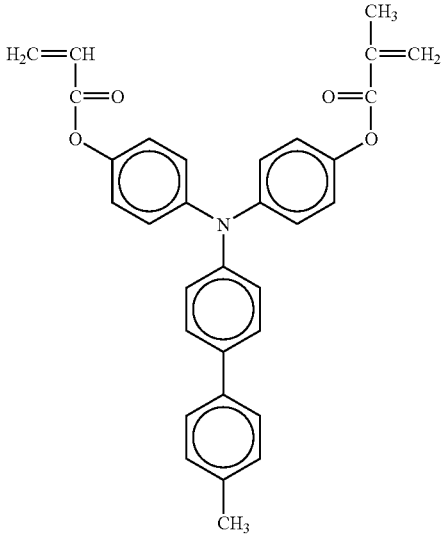
NO.197
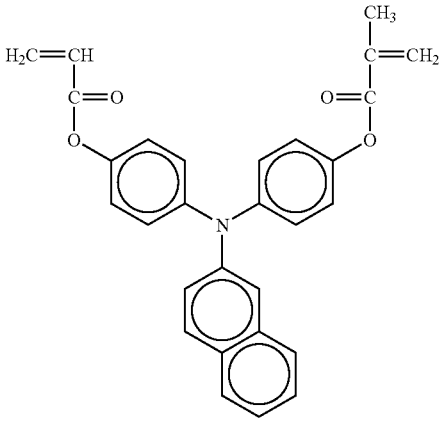
NO.198
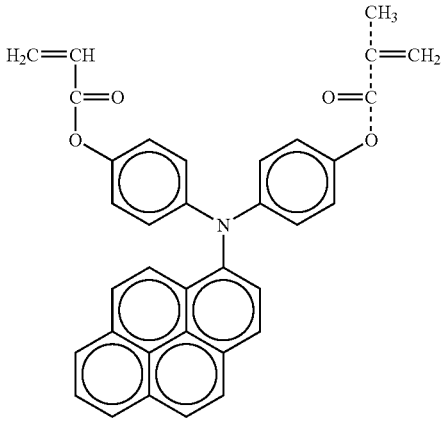

-continued
NO.199
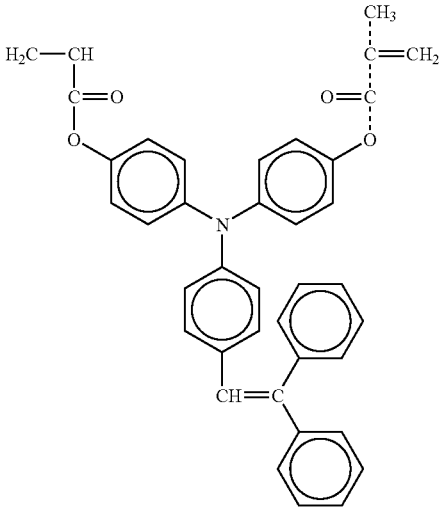
NO.200
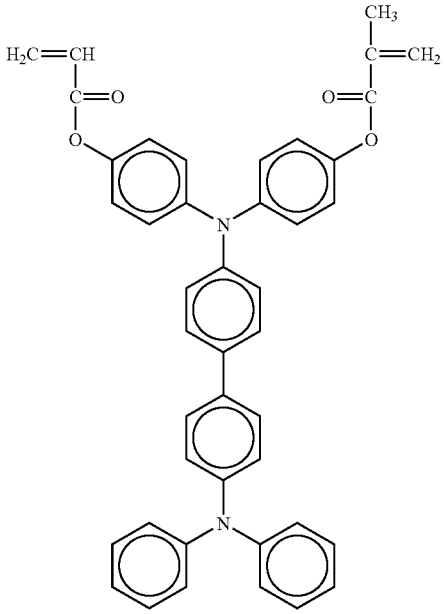
NO.201
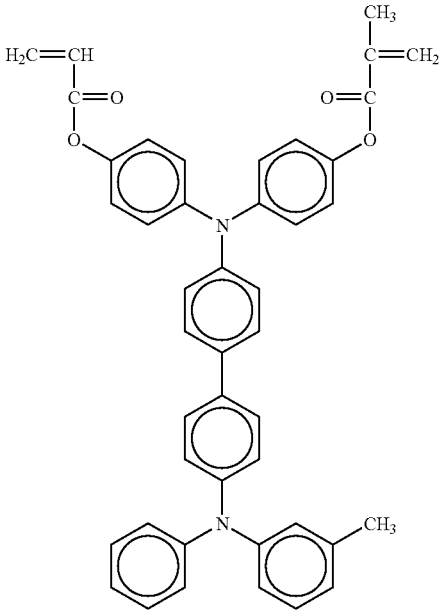
NO.202
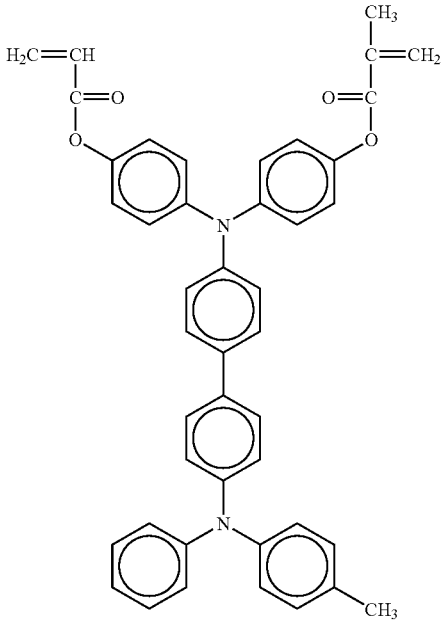
NO.203
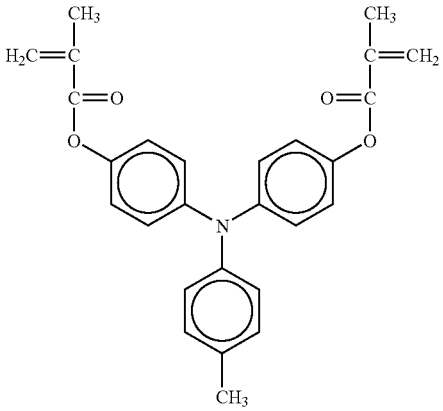
NO.204
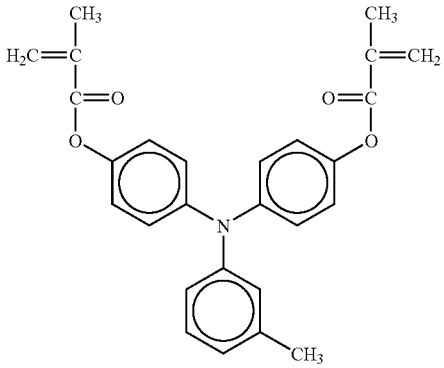

-continued
NO.205
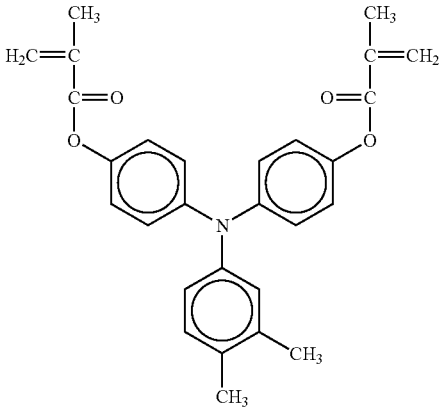
NO.206
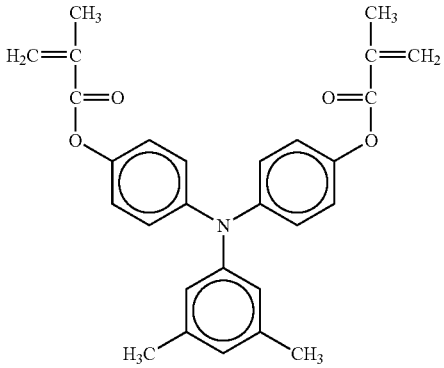
NO.207
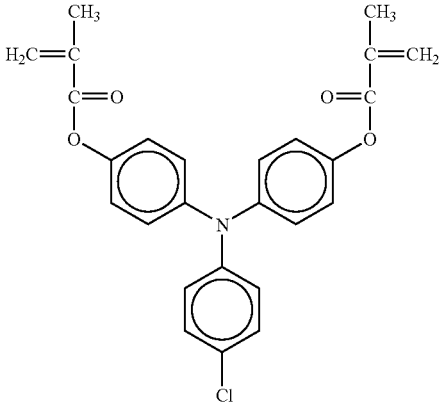
NO.208
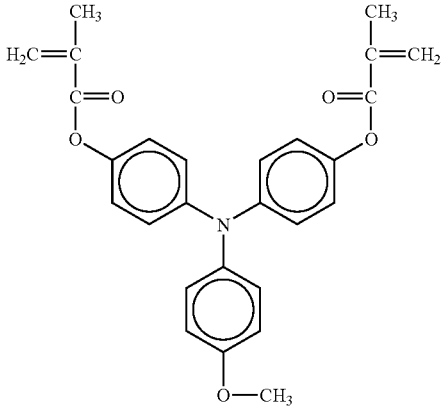
NO.209
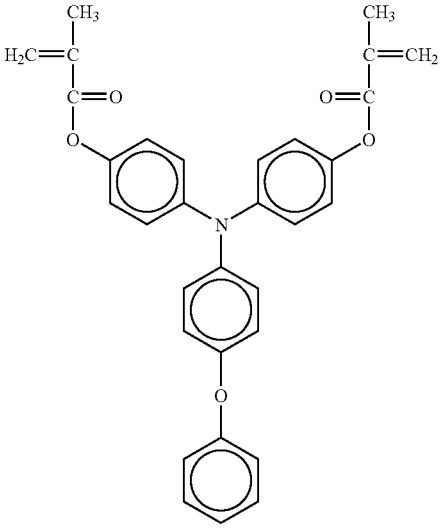
NO.210
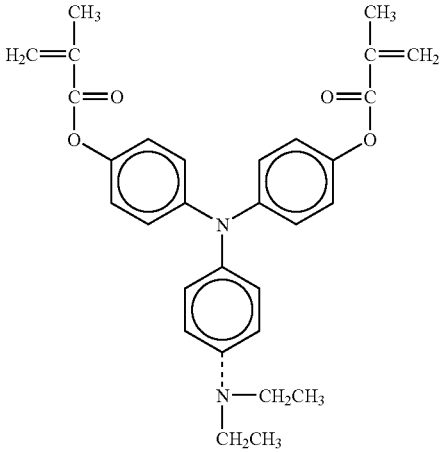

-continued
NO.211
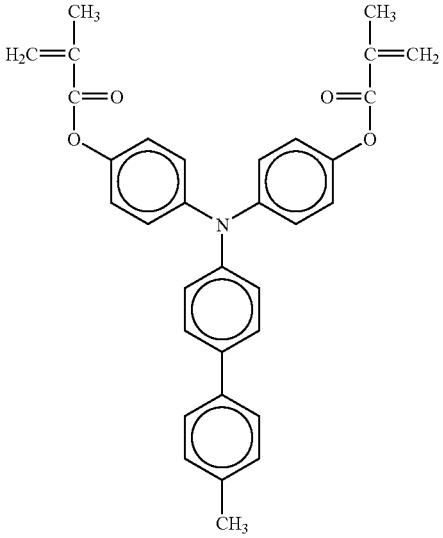
NO.212
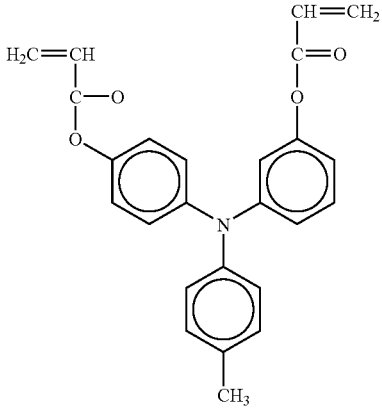
NO.213
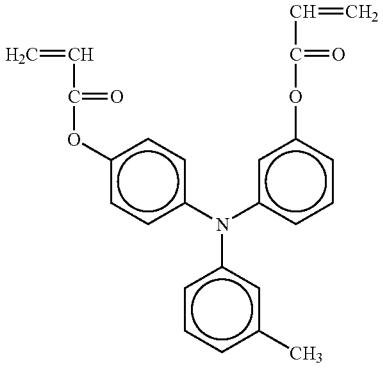
NO.214
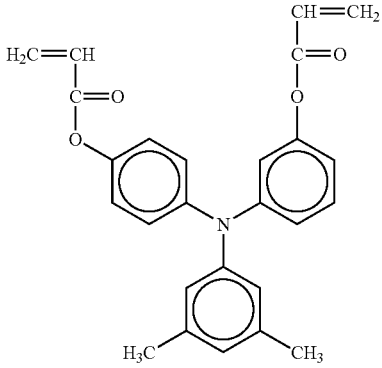
NO.215
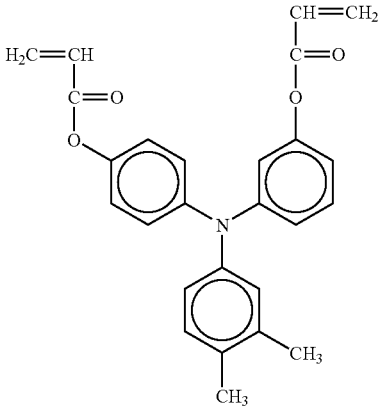
NO.216
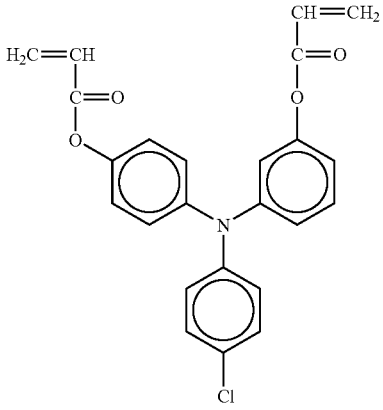

-continued
NO.217
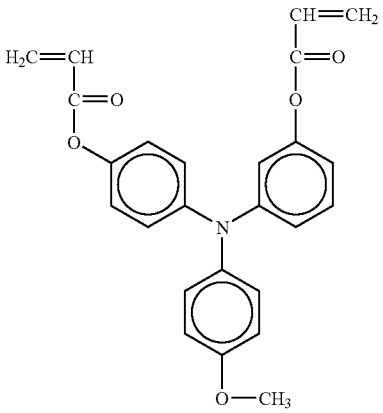
NO.218
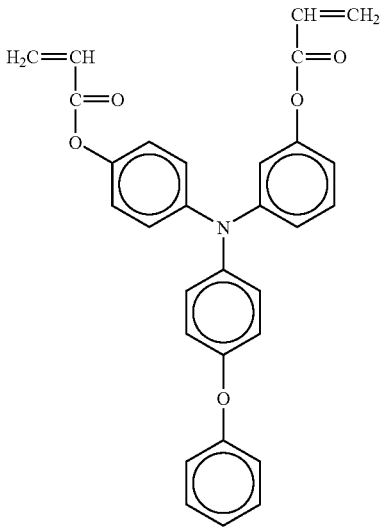
NO.219
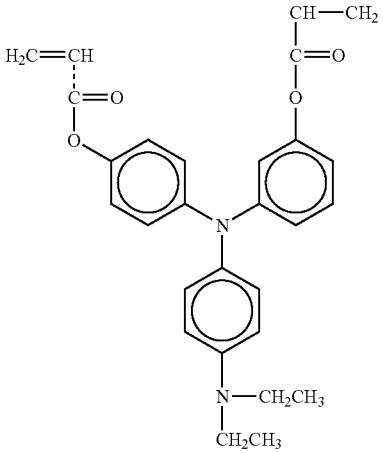
NO.220
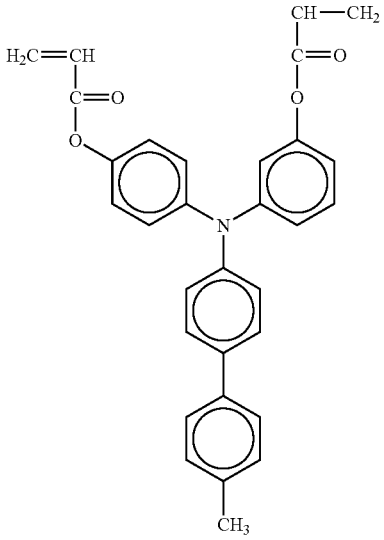
NO.221
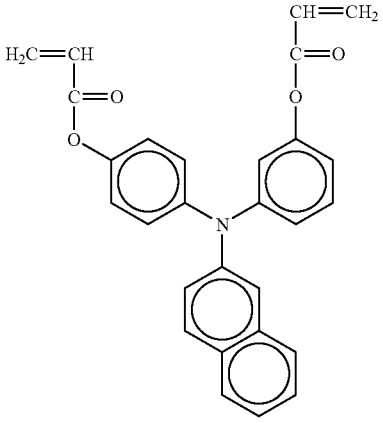
NO.222
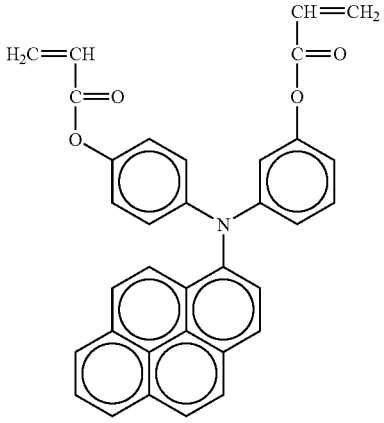

-continued
NO.223
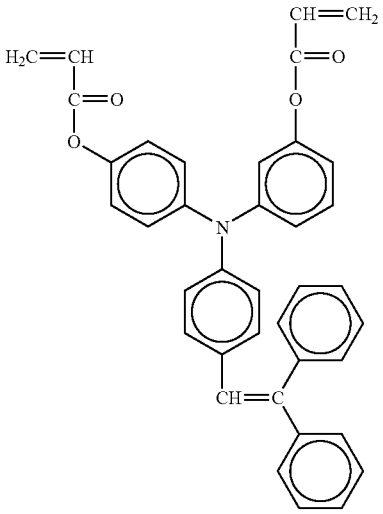
NO.224
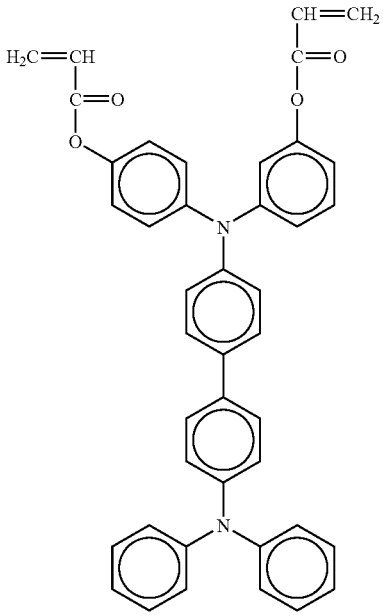
NO.225
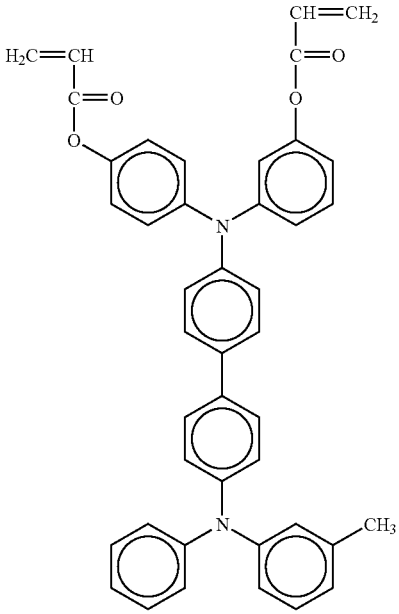
NO.226
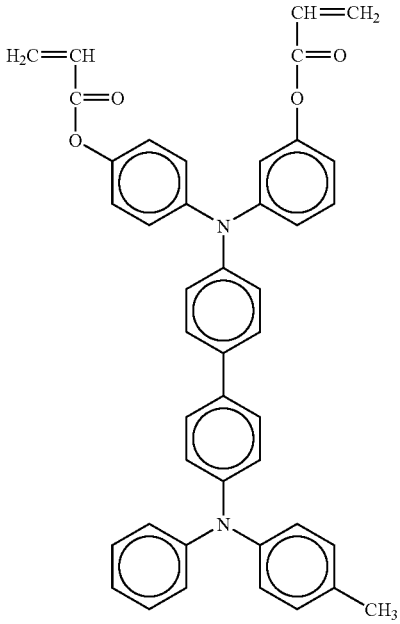
NO.227
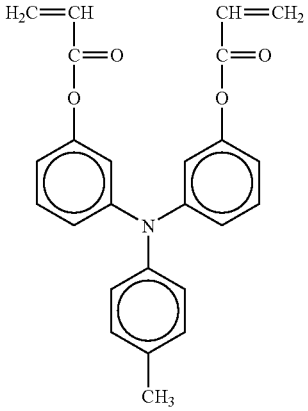
NO.228
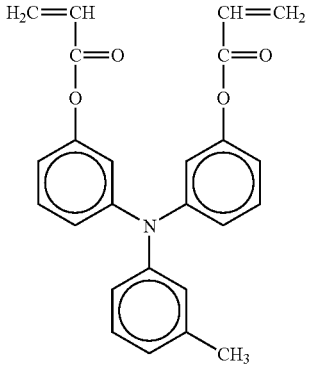

-continued
NO.229
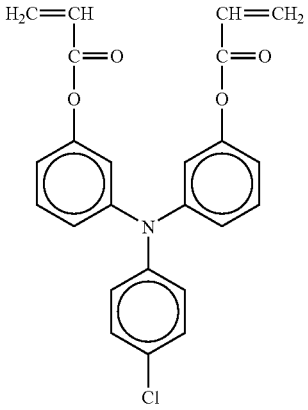
NO.230
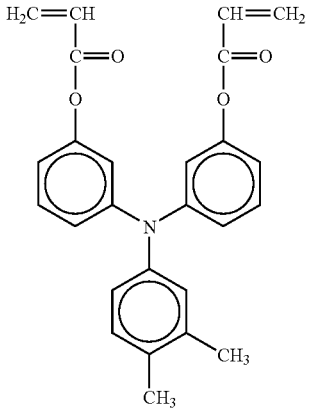
NO.231
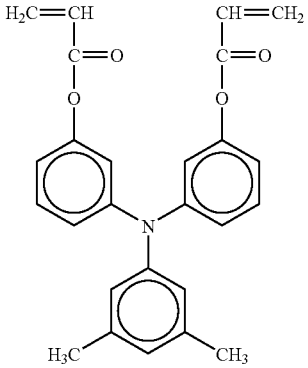
NO. 232
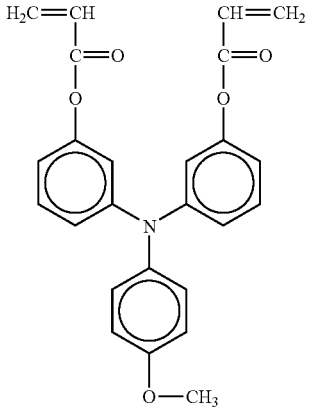
NO.233
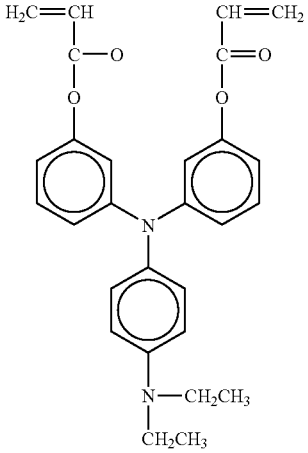
NO.234
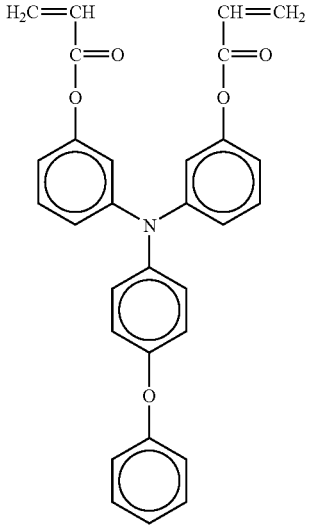

-continued
NO.235
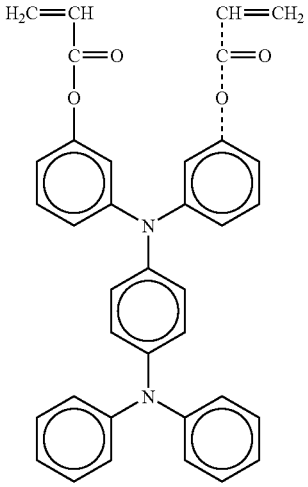
NO.236
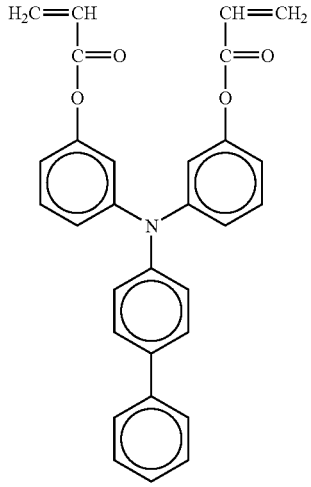
NO.237
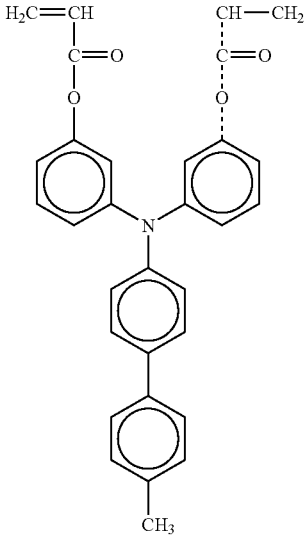
NO.238
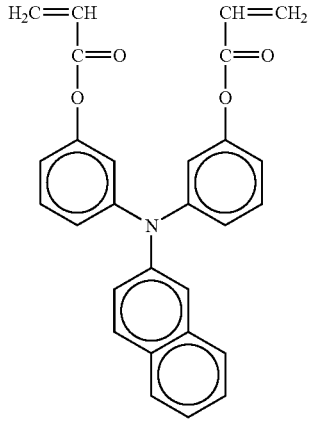
NO.239
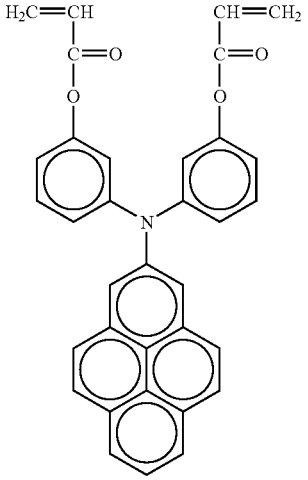
NO.240
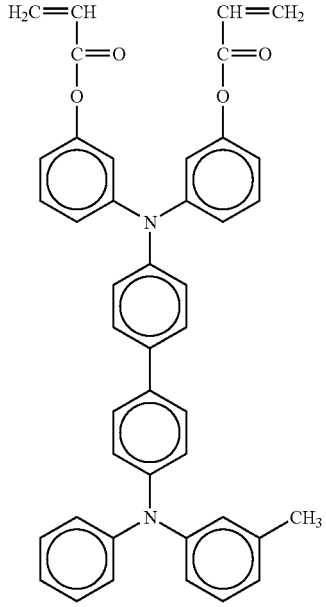

-continued
NO.241
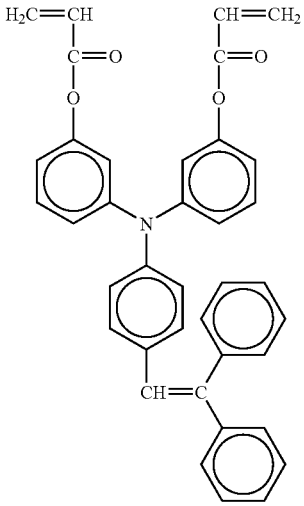
NO.242
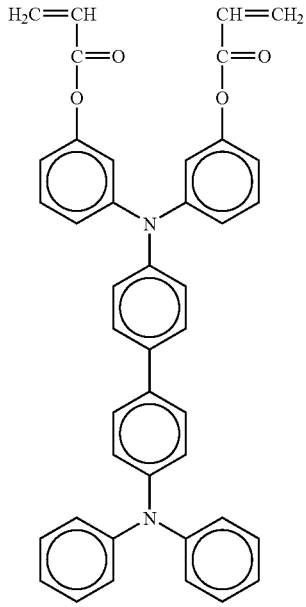
NO.243
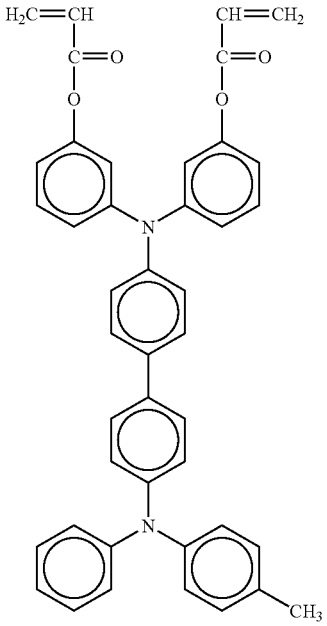
NO.244
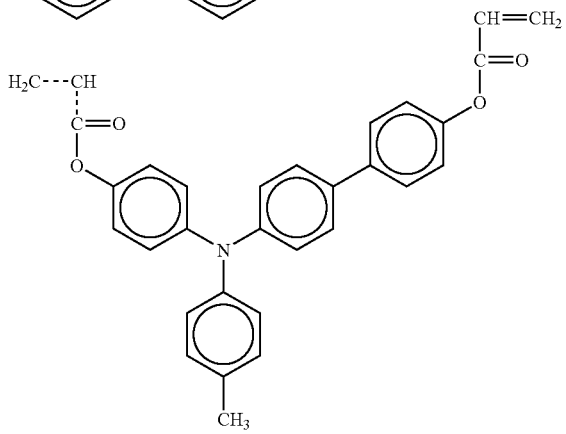
NO. 245
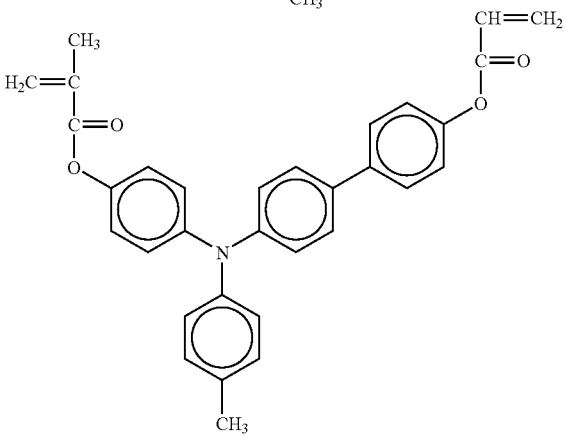
NO. 246
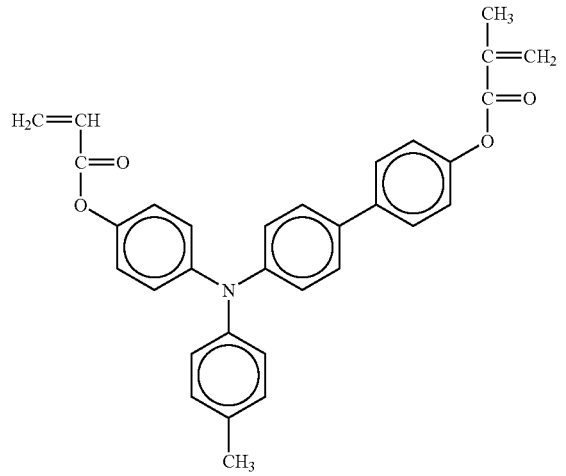

-continued
NO.247
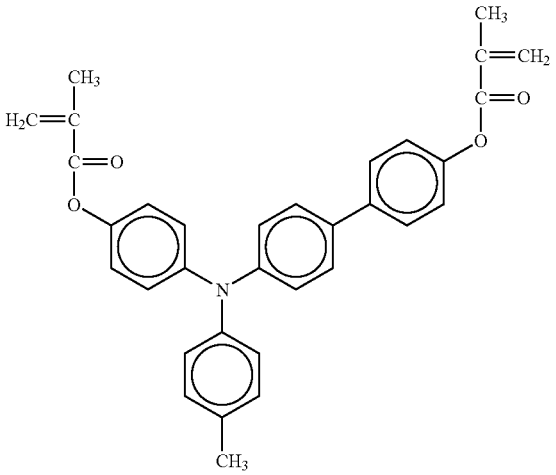
NO.248
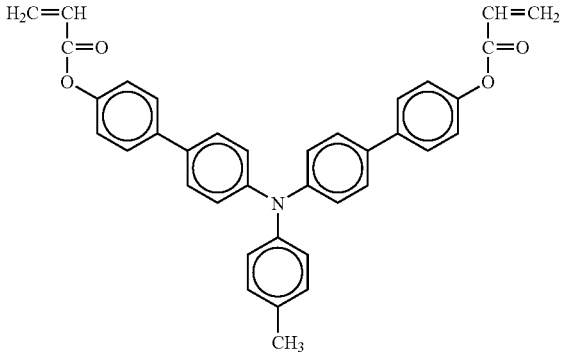
NO.249
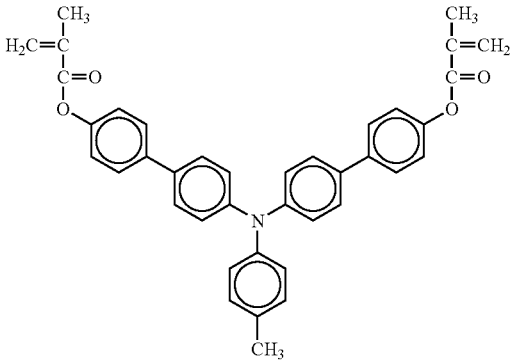
NO.250
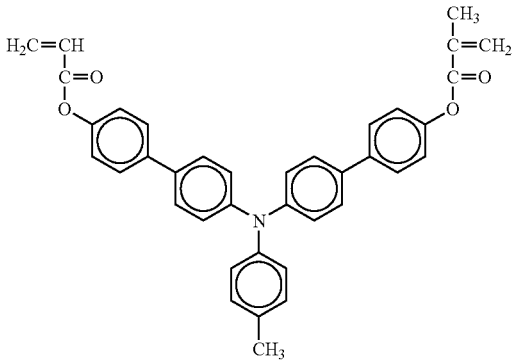
NO.251
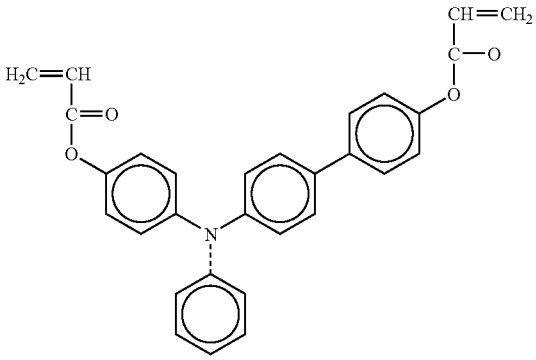
NO.252
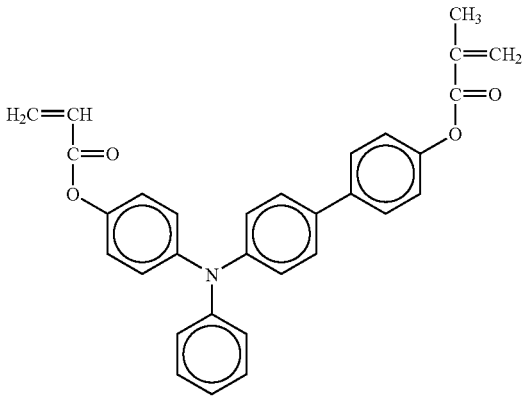

-continued
NO.253
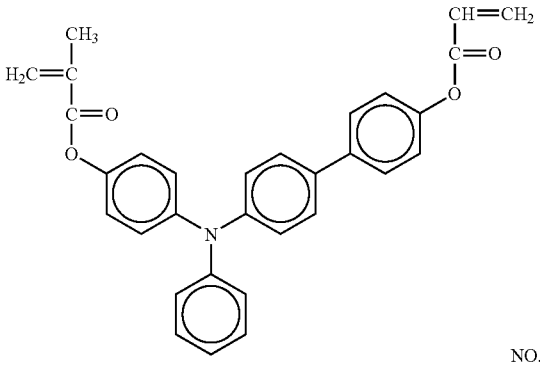
NO.254
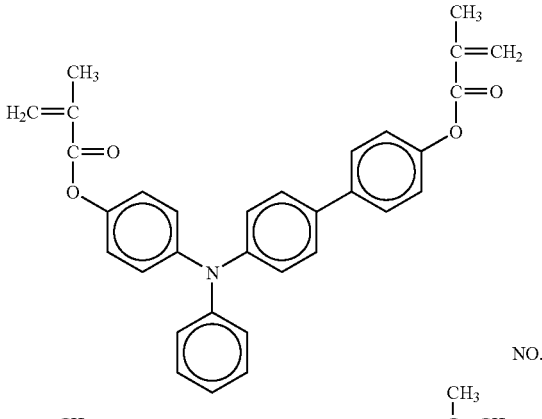
NO.255
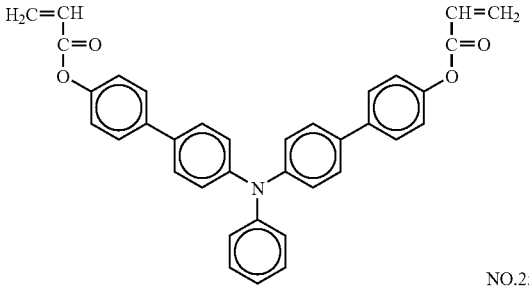
NO.256
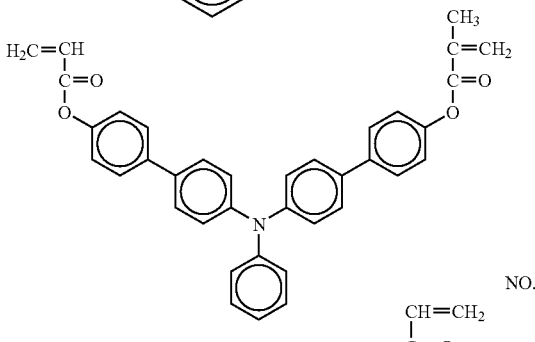
NO.257
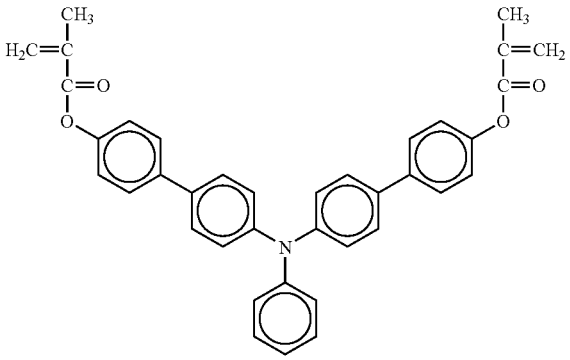
NO.258
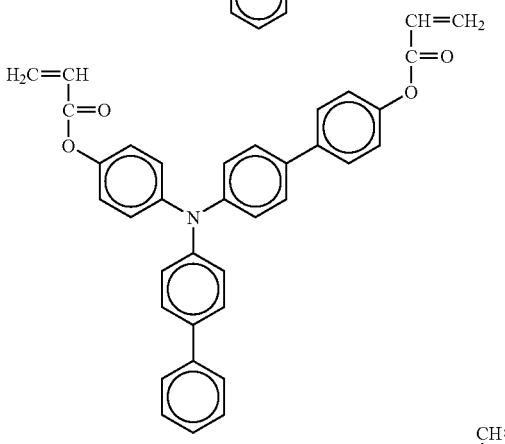
NO.259
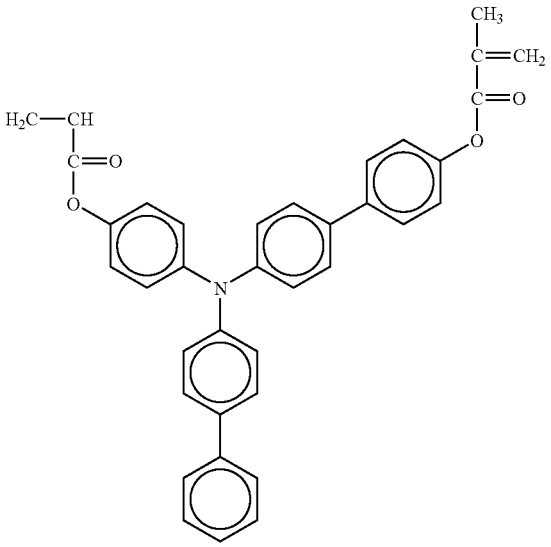
NO.260
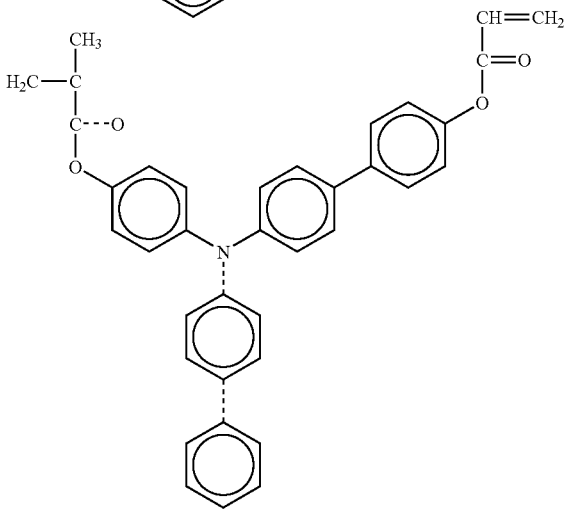

-continued
NO.261
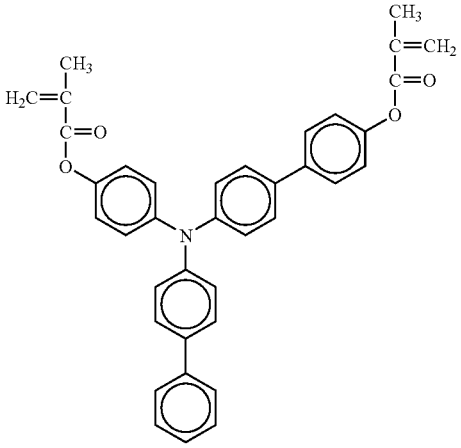
NO.262
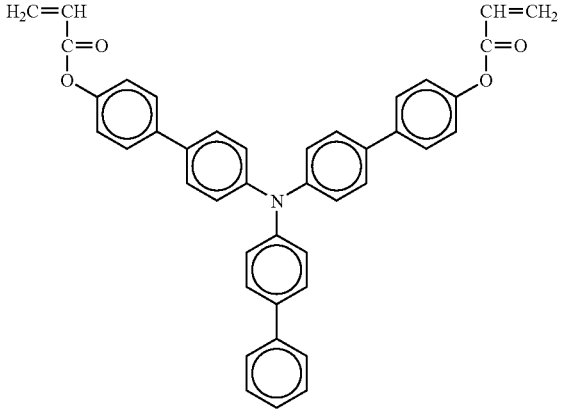
No.263
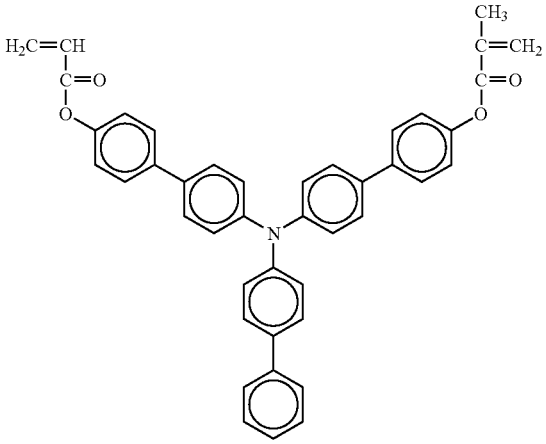
NO.264
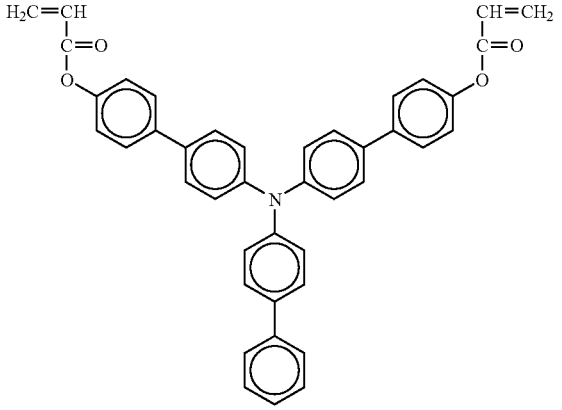
NO.265
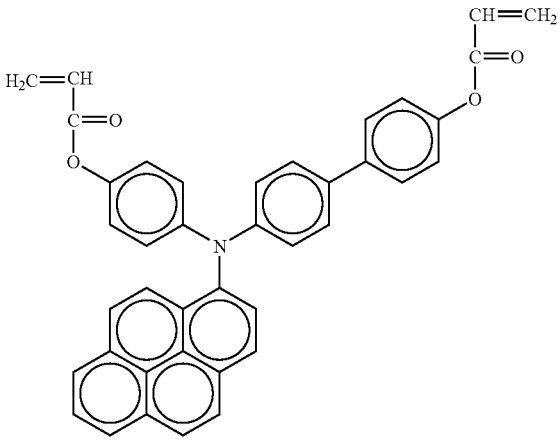
NO.266
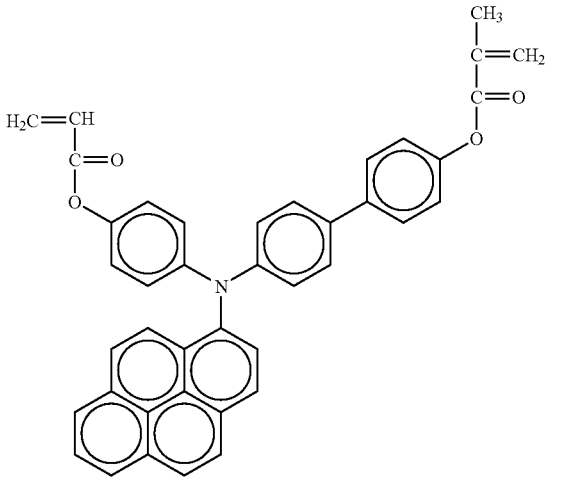

-continued
NO.267
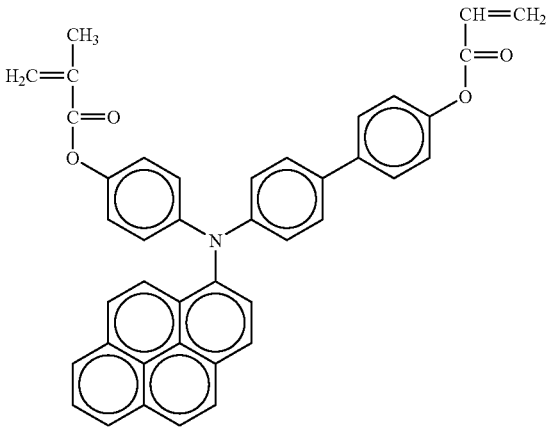
NO.268
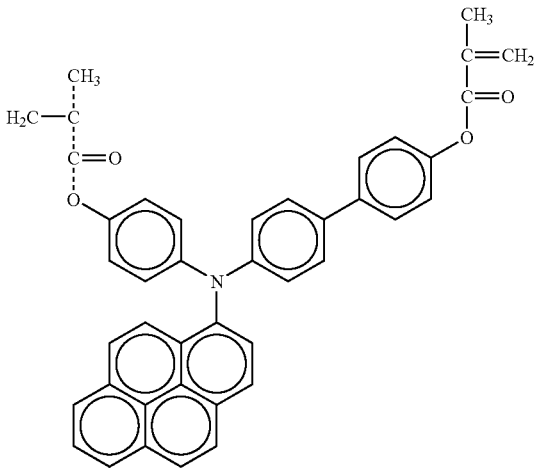
NO.269
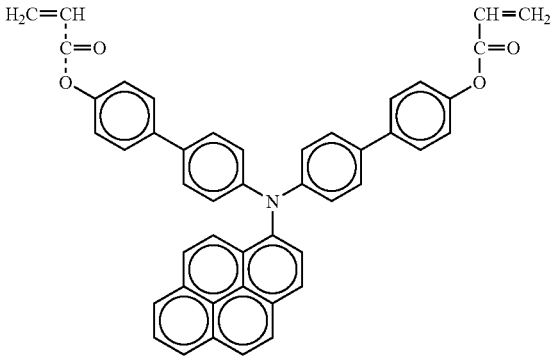
NO.270
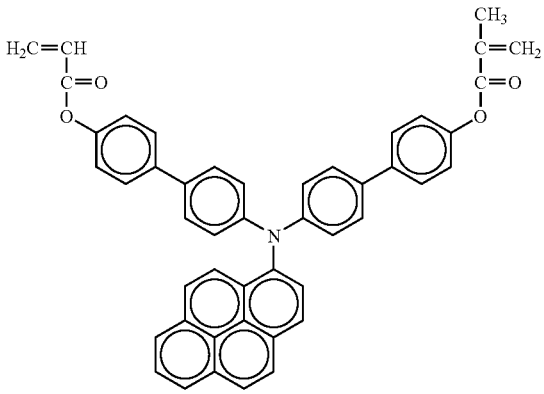
NO.271
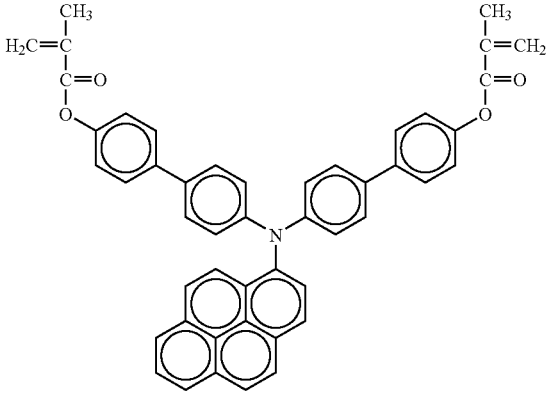
NO.272
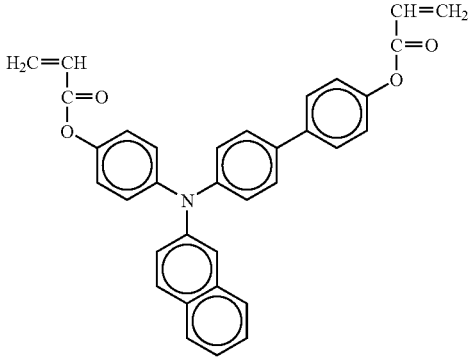

-continued
NO.273
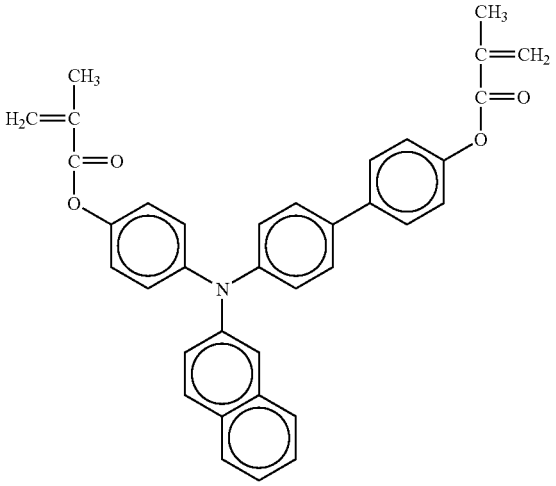
NO.274
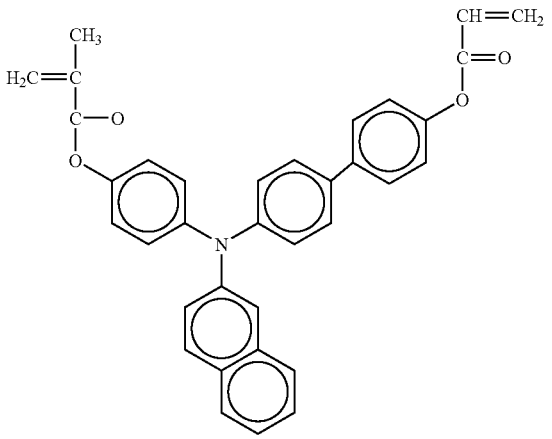
NO.275
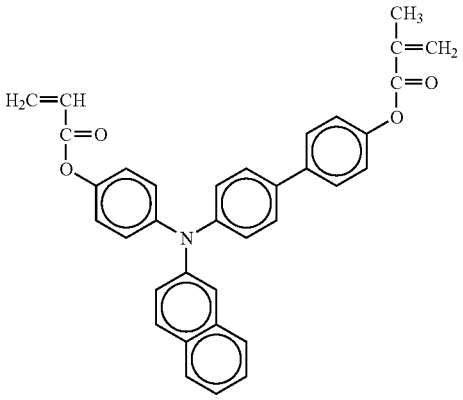
NO.276
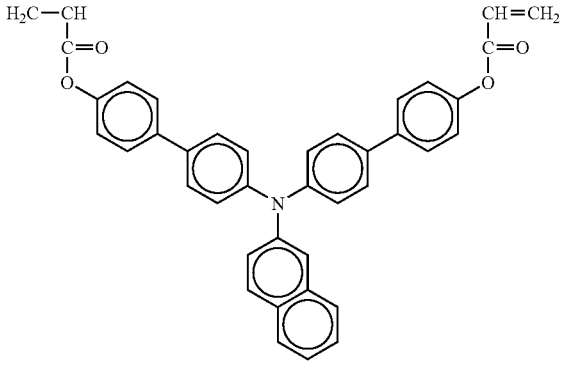
NO.277
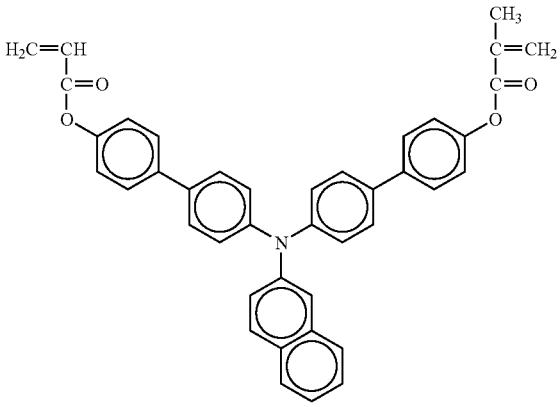
NO.278
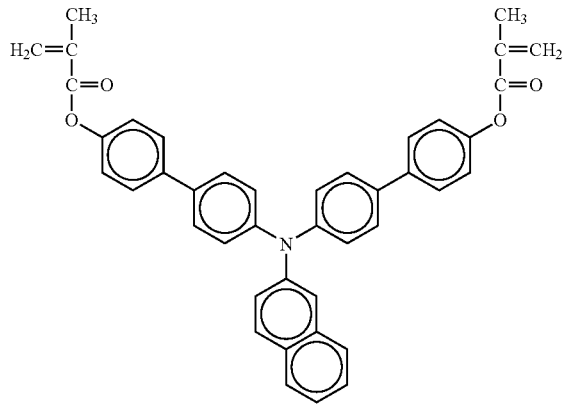

-continued
NO.279
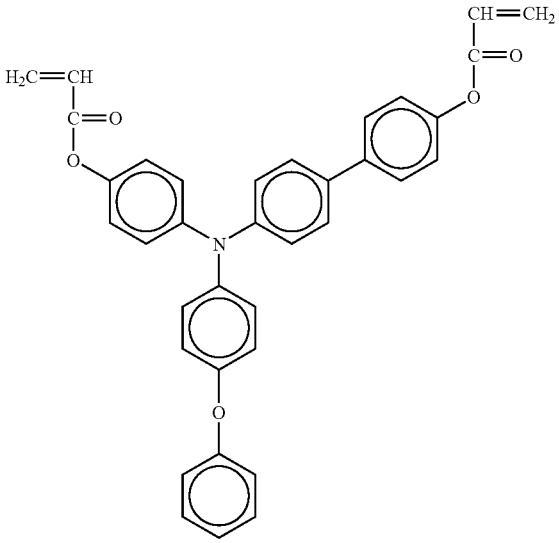
NO.280
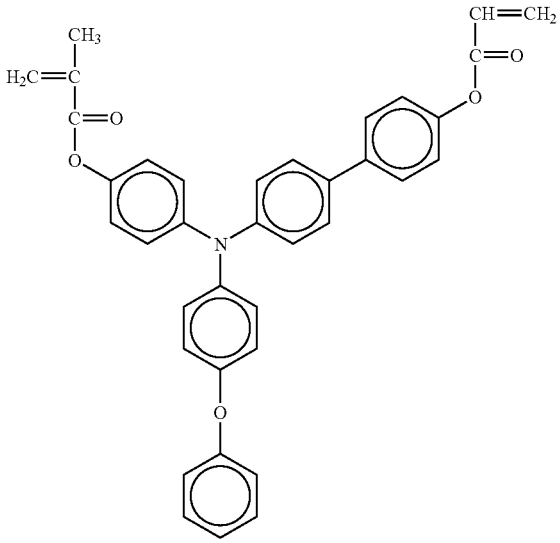
NO.281
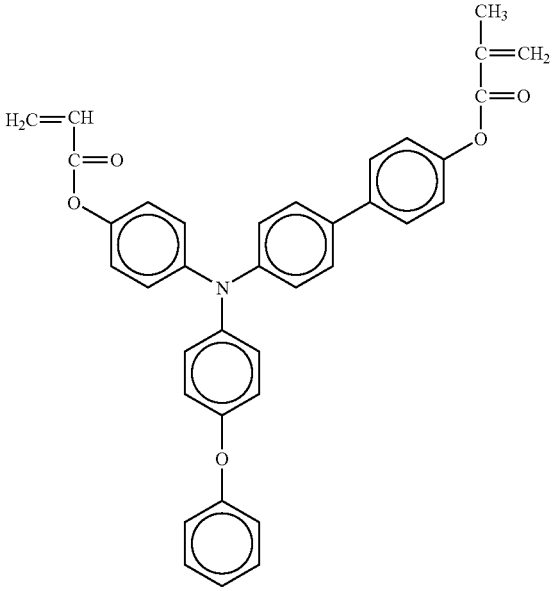
NO.282
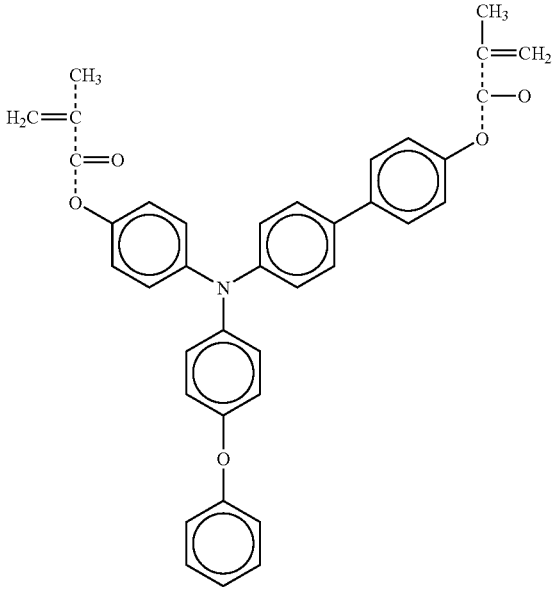
NO.283
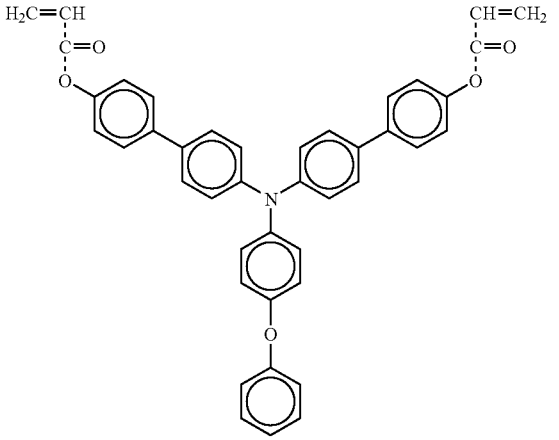
NO.284
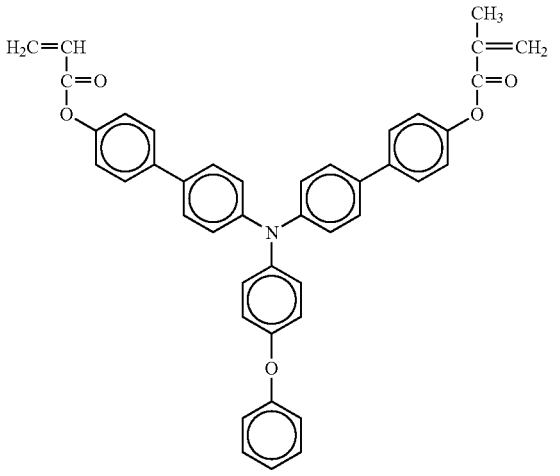

-continued
NO.285
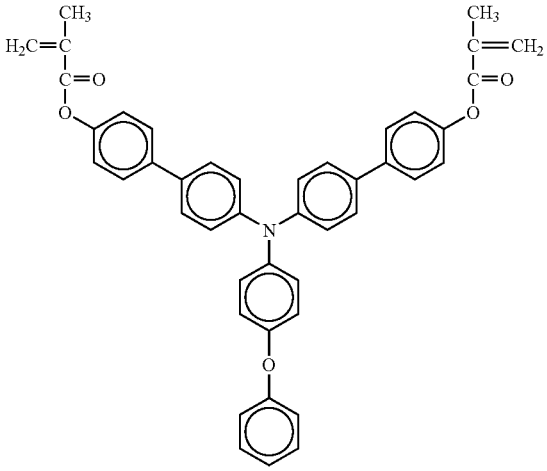
NO.286
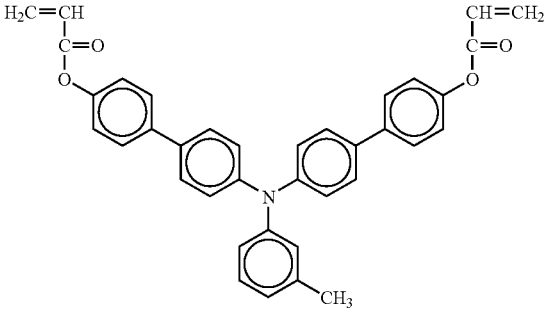
NO.287
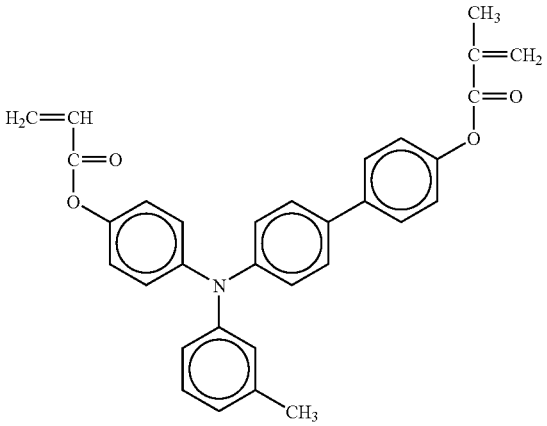
NO.288
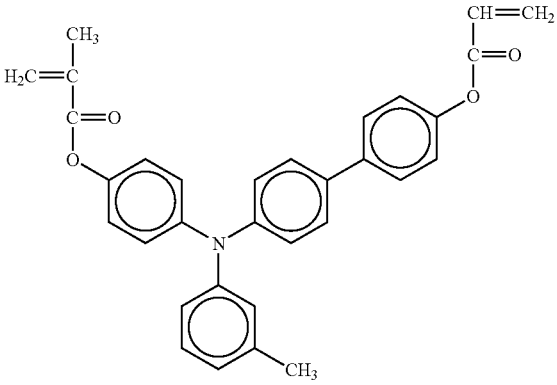
NO.289
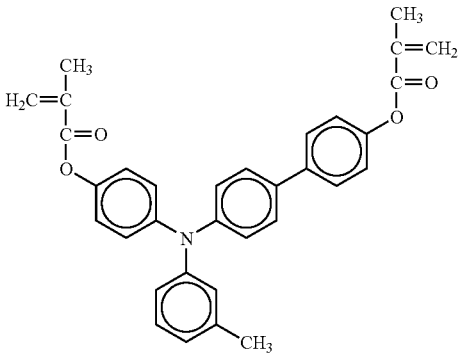
NO.290
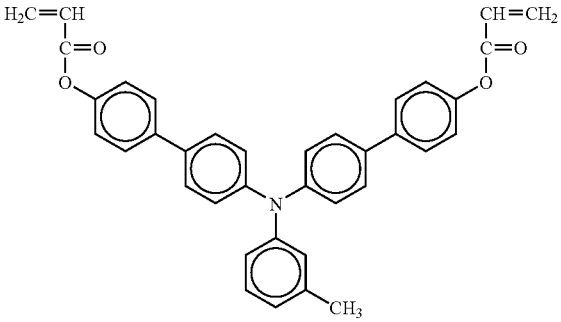

-continued
NO.291
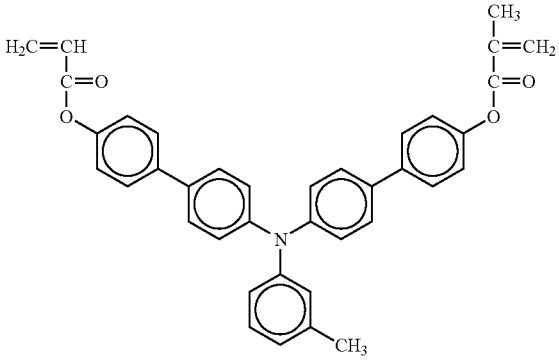
NO.292
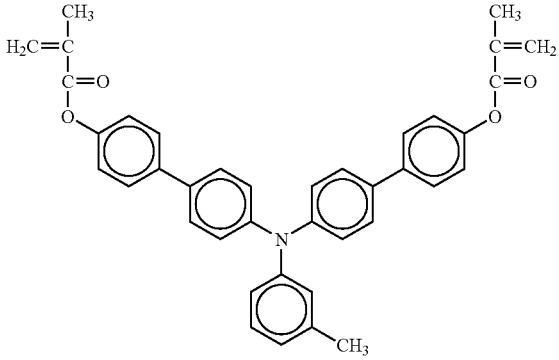
NO.293
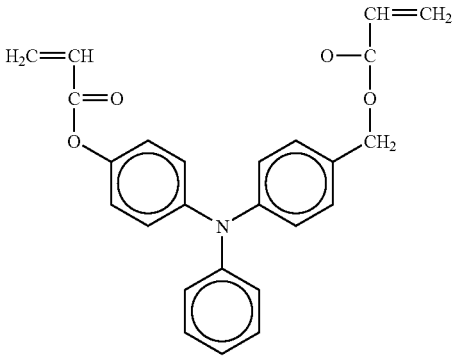
NO.294
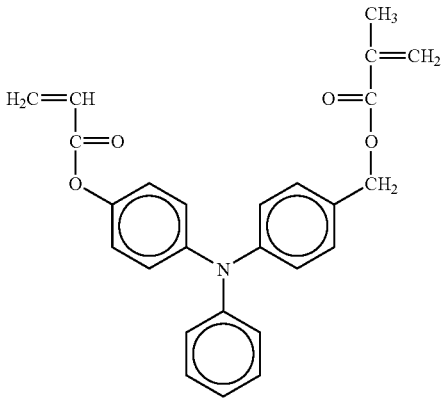
NO.295
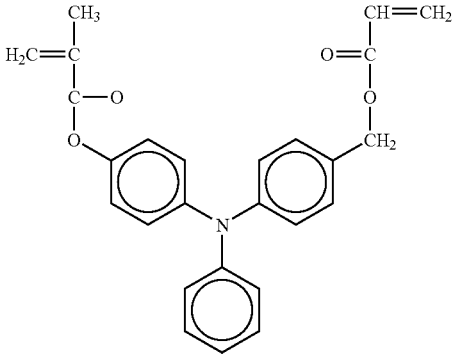
NO.296
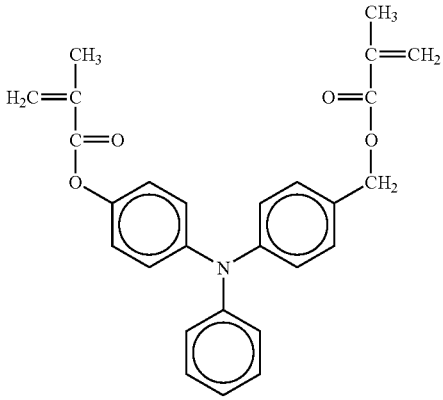
NO.297
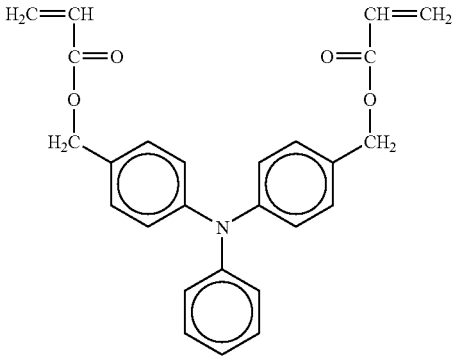
NO.298
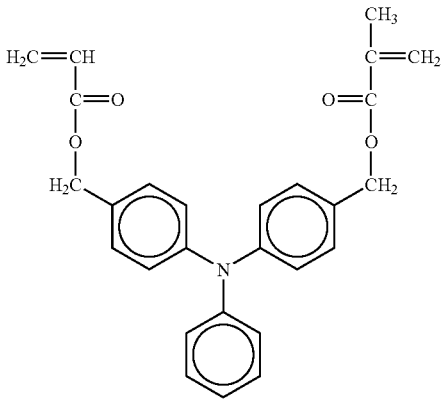

-continued
NO.299
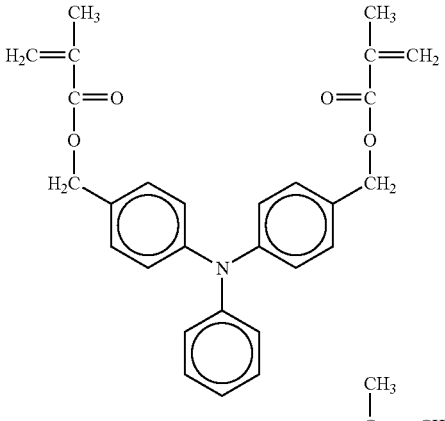
NO.300
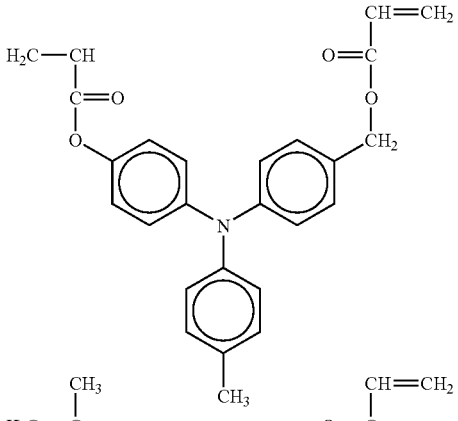
NO.301
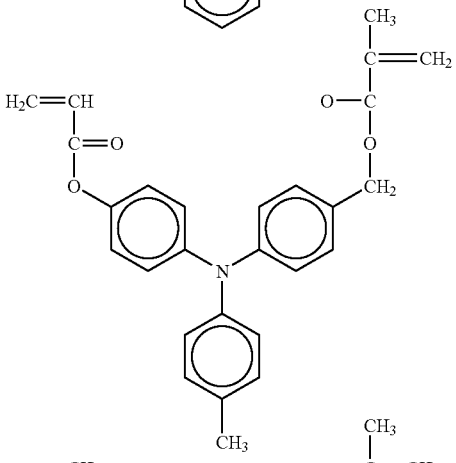
NO.302
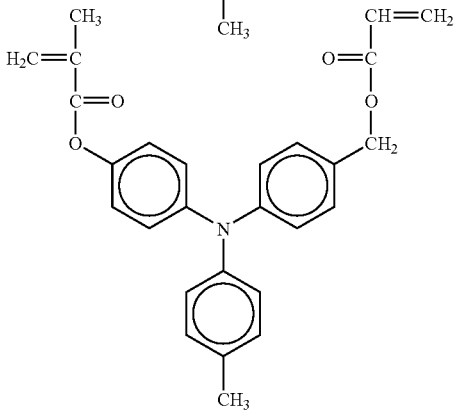
NO.303
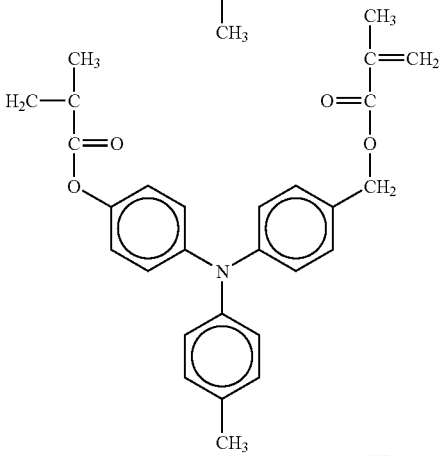
NO.304
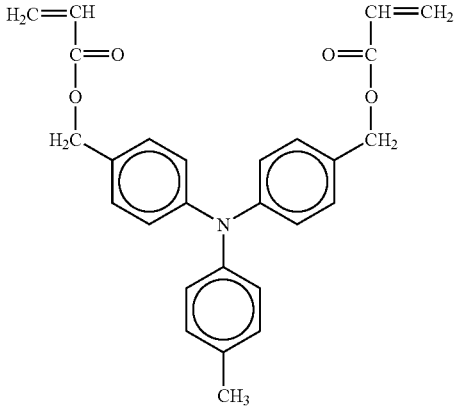
NO.305
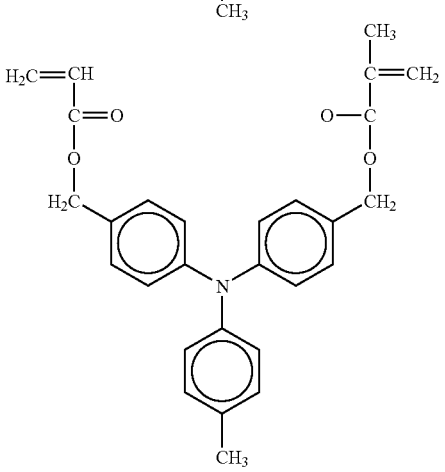
NO.306
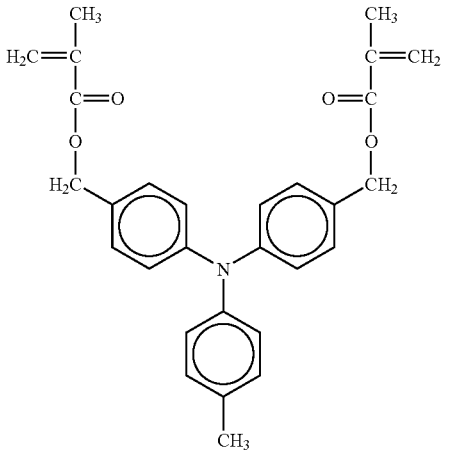

-continued
NO.307
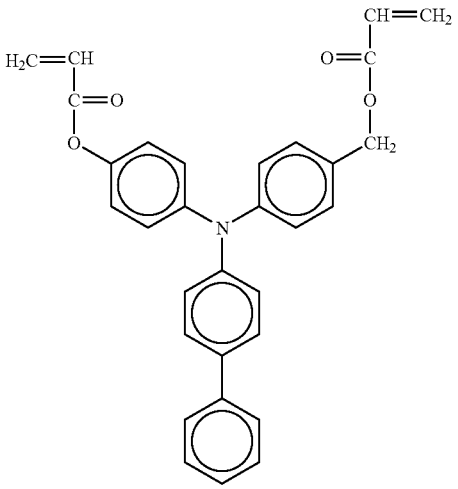
NO.308
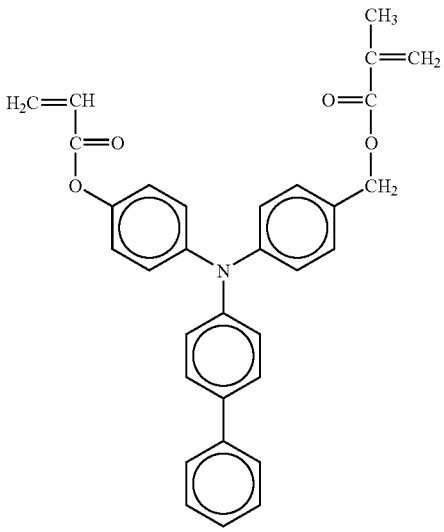
NO.309
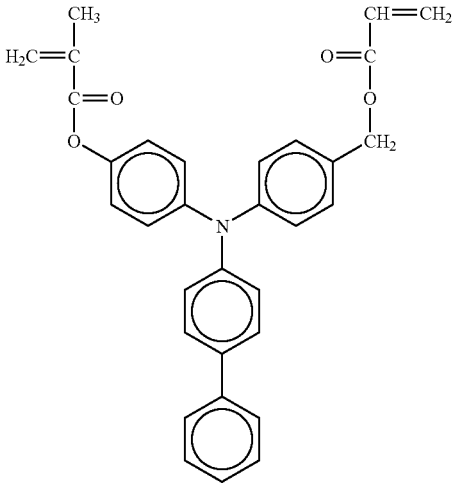
NO.310
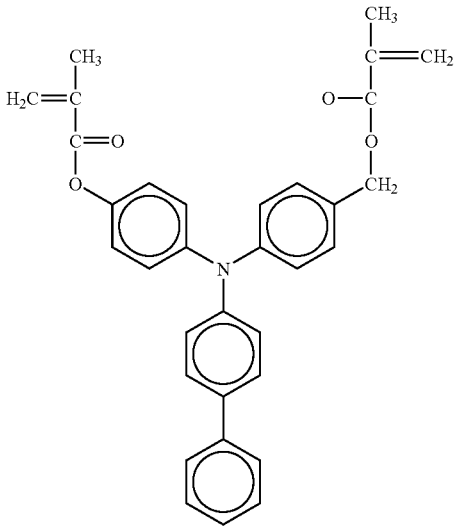
NO.311
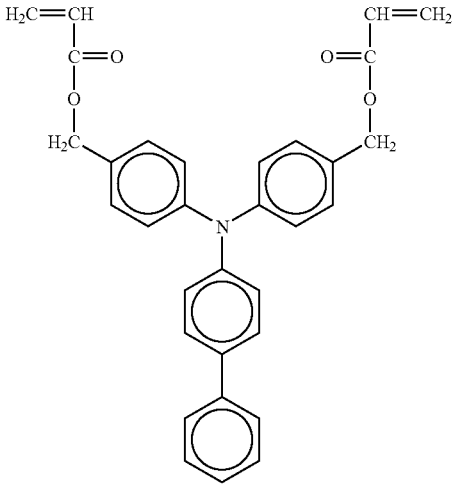
NO.312
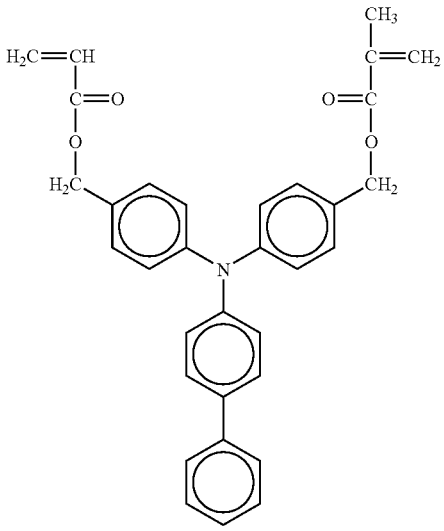

-continued
NO.313
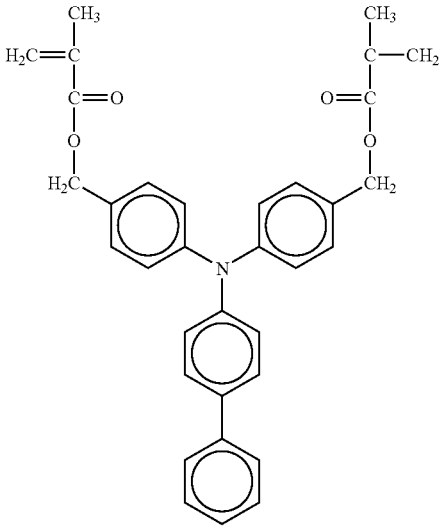
NO.314
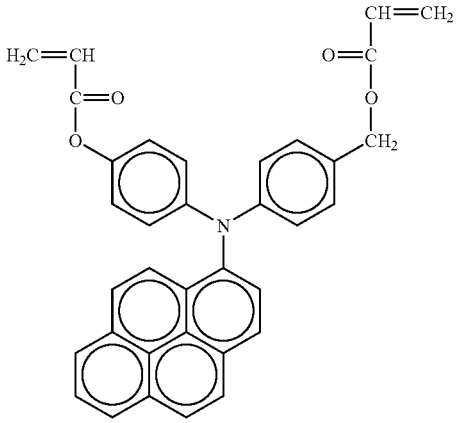
NO.315
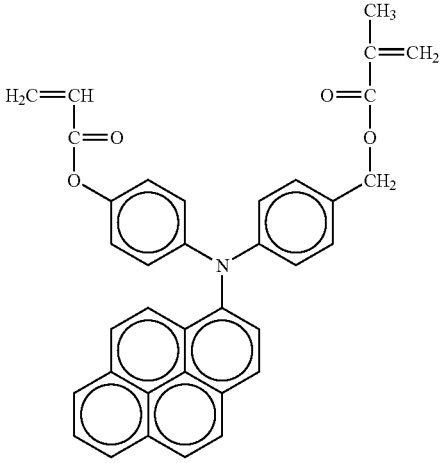
NO.316
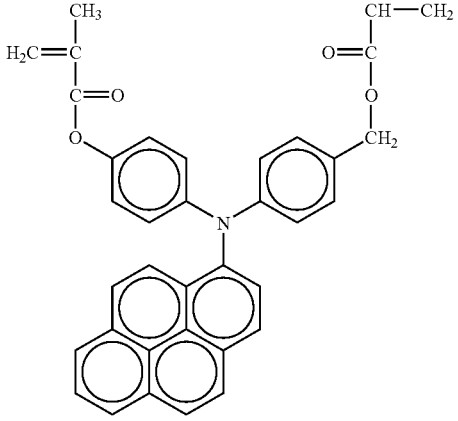
NO.317
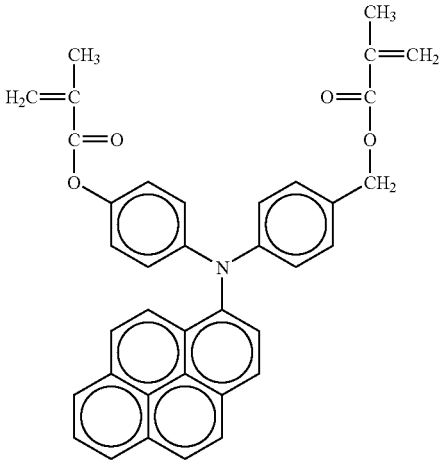
NO.318
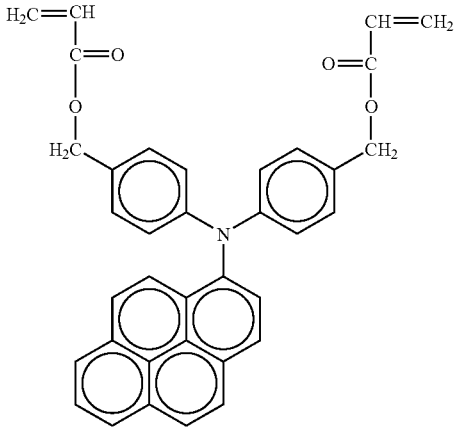

-continued
NO.319
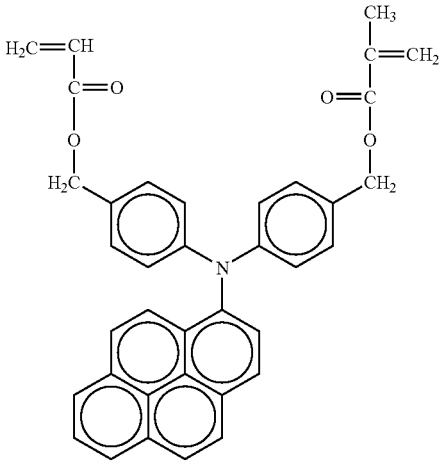
NO.320
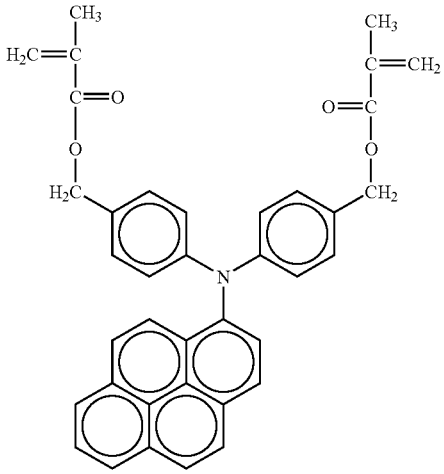
NO.321
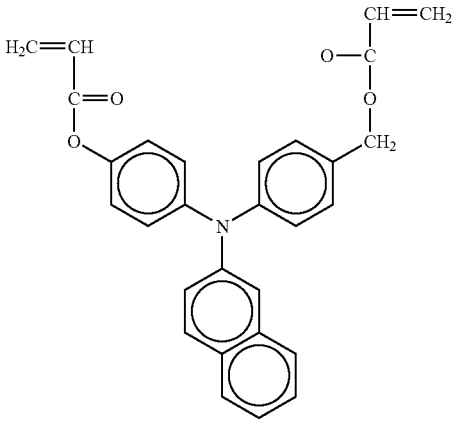
NO.322
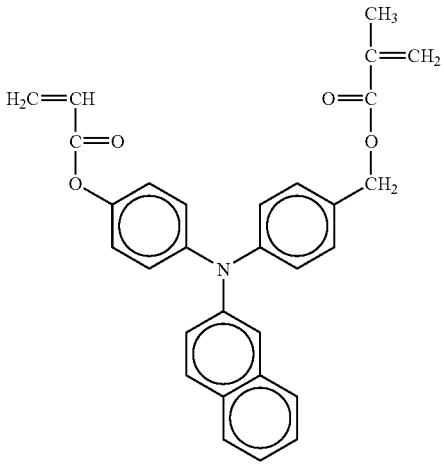
NO.323
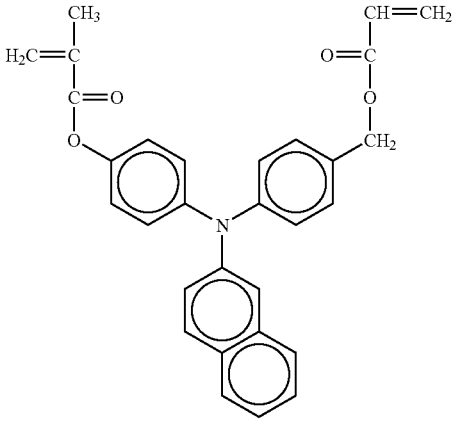
NO.324
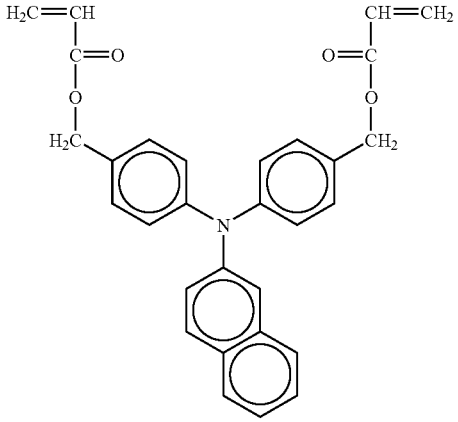

-continued
NO.325
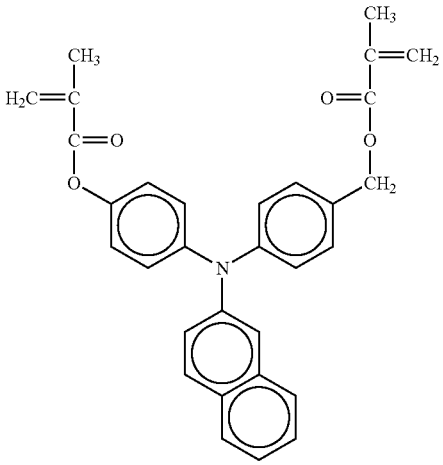
NO.326
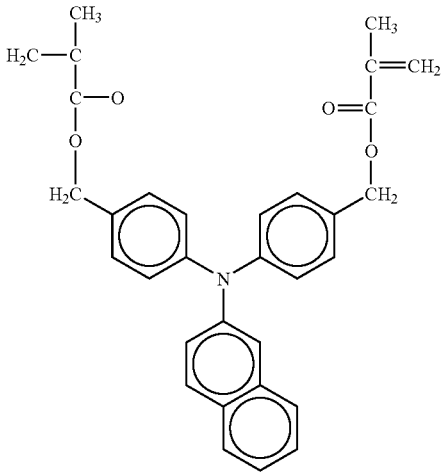
NO.327
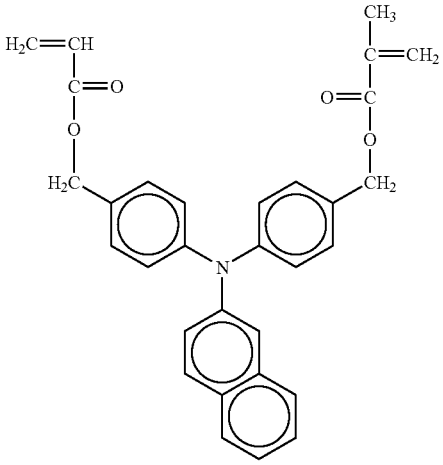
NO.328
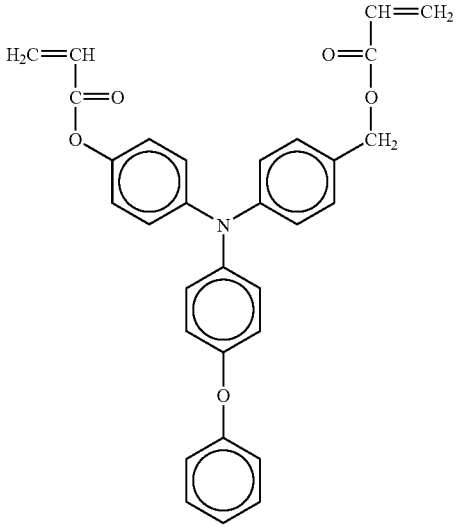
NO.329
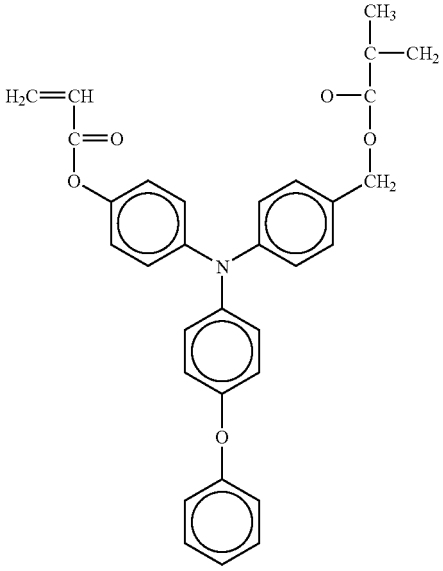
NO.330
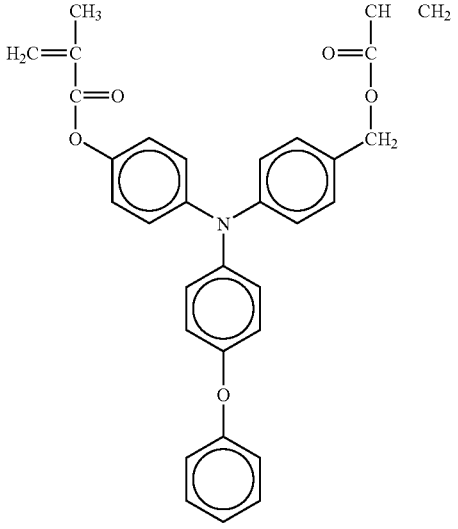

-continued
NO.331
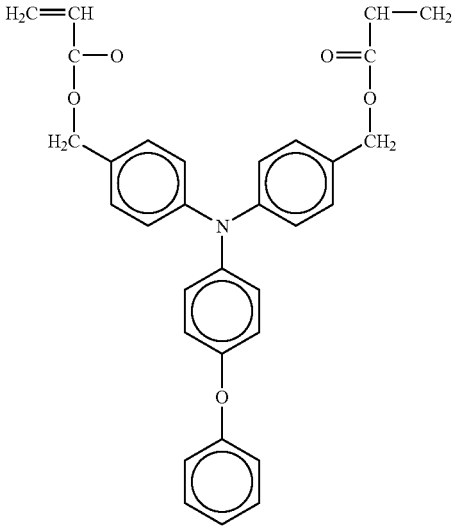
NO.332
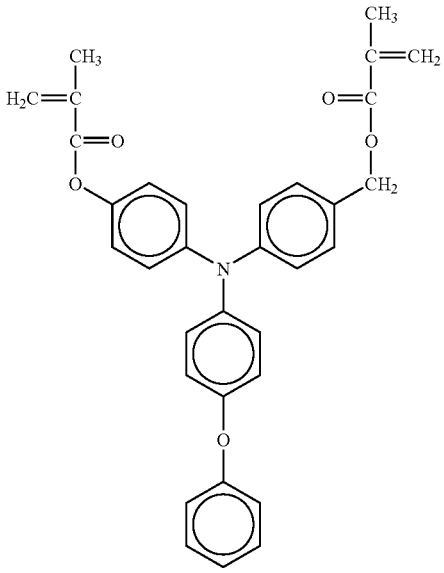
NO.333
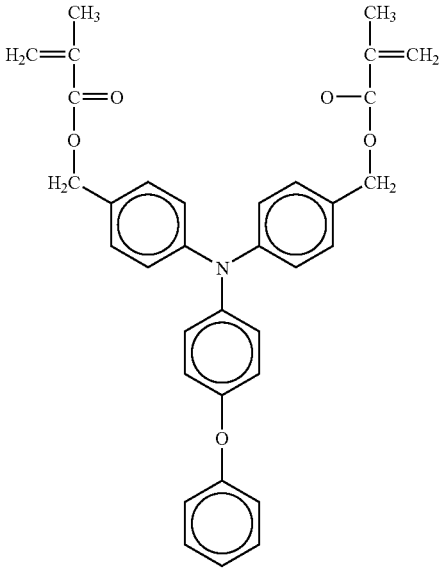
NO.334
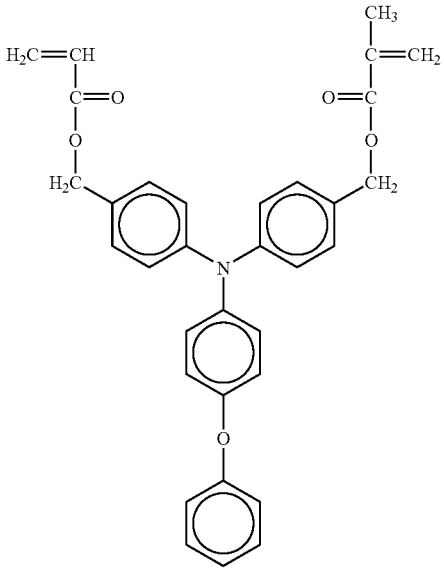
NO.336
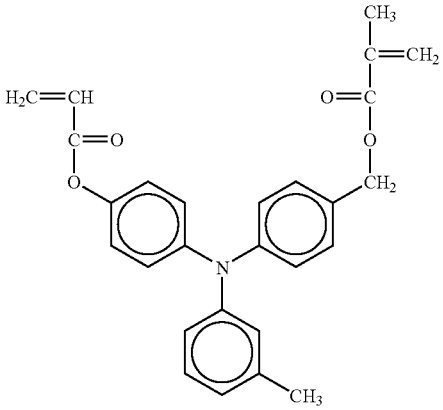
NO.335
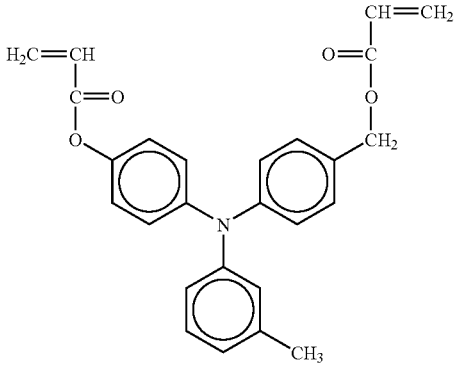

-continued
NO.337
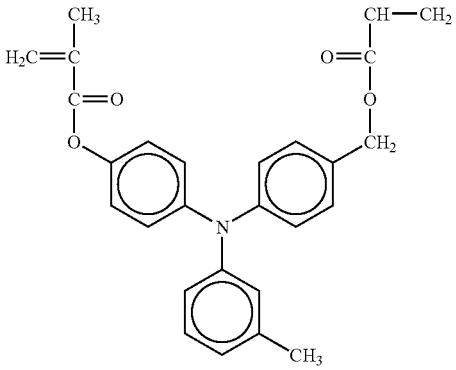
NO.338
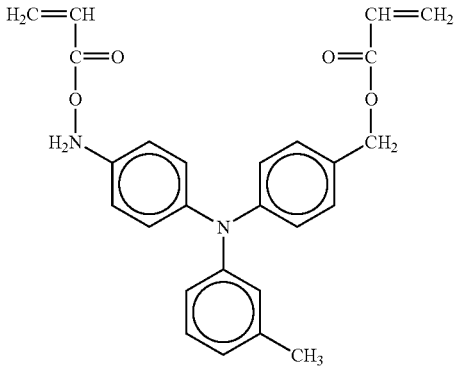
NO.339
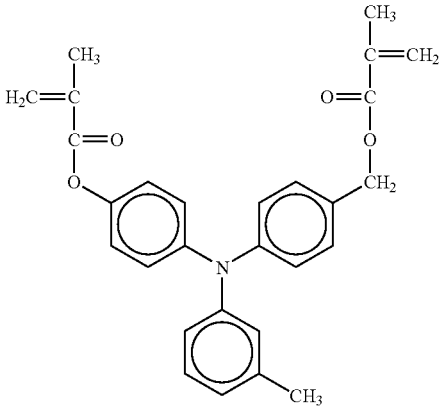
NO.340
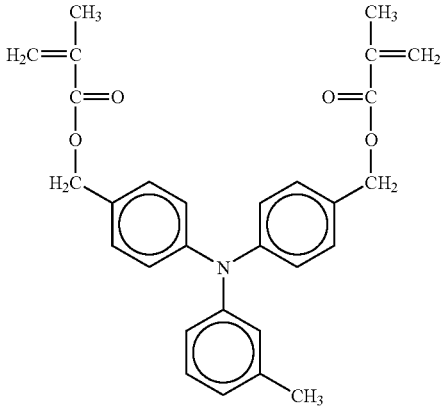
NO.341
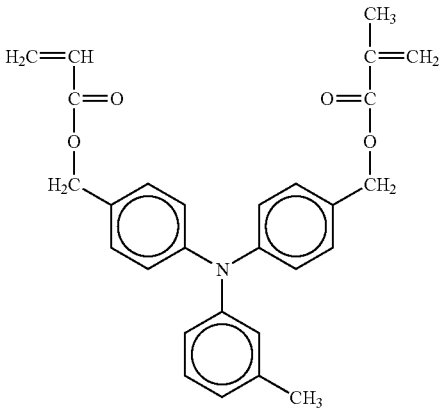
NO.342
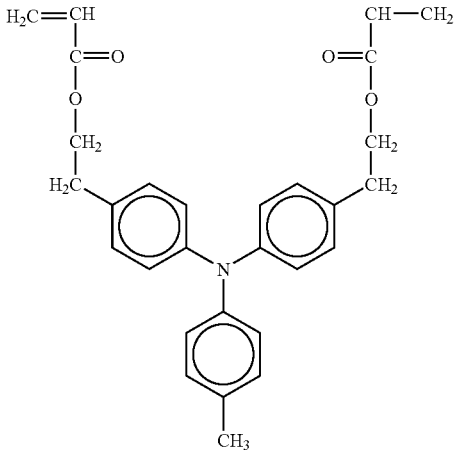

-continued
NO.343
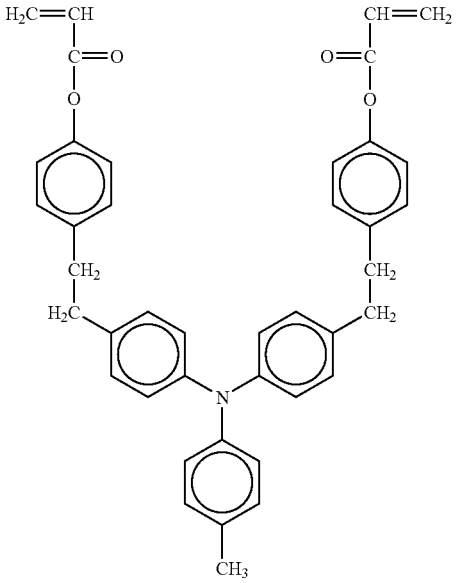
NO.344
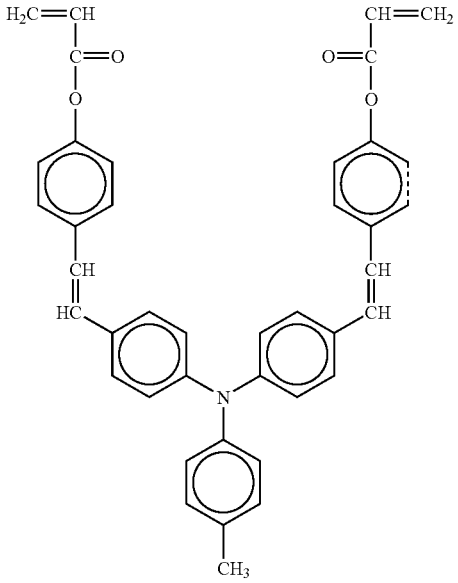
NO.345
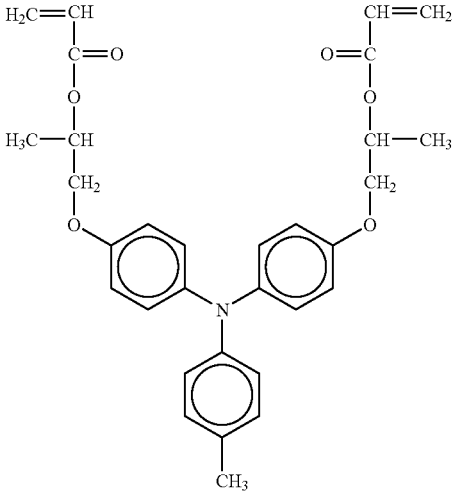
NO.346
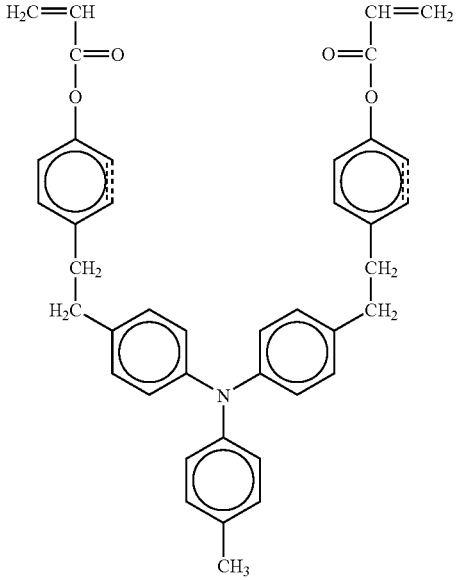
NO.347
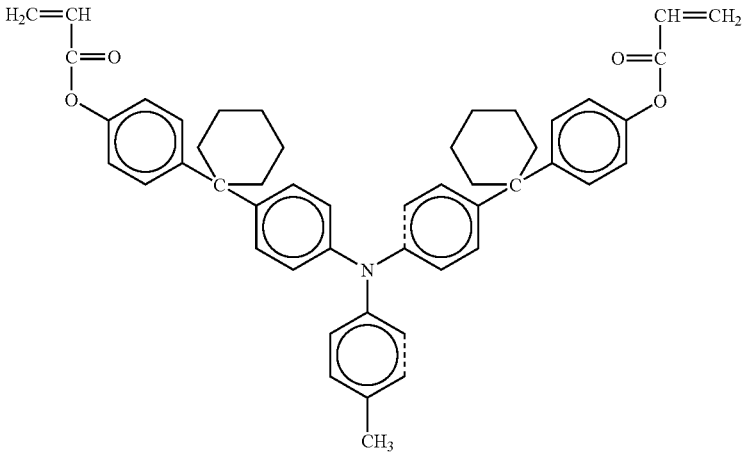

-continued
NO.348
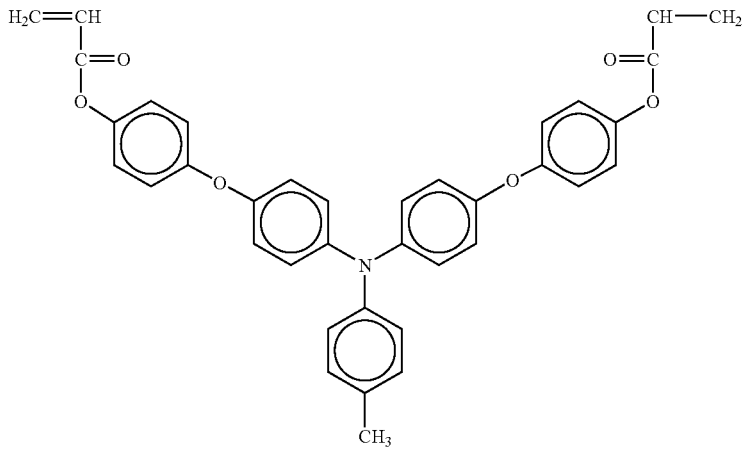
NO.349
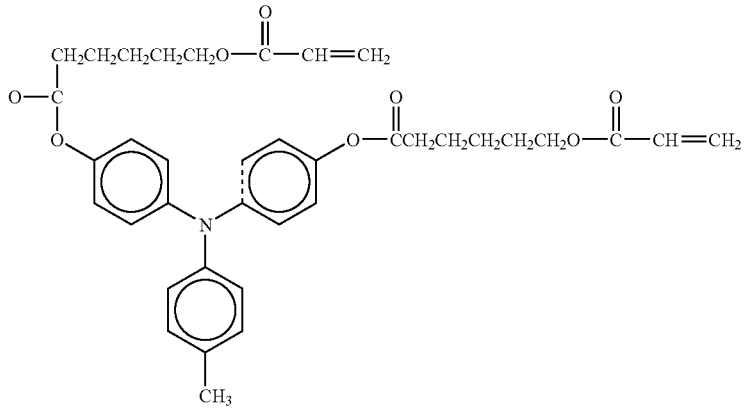
NO.350
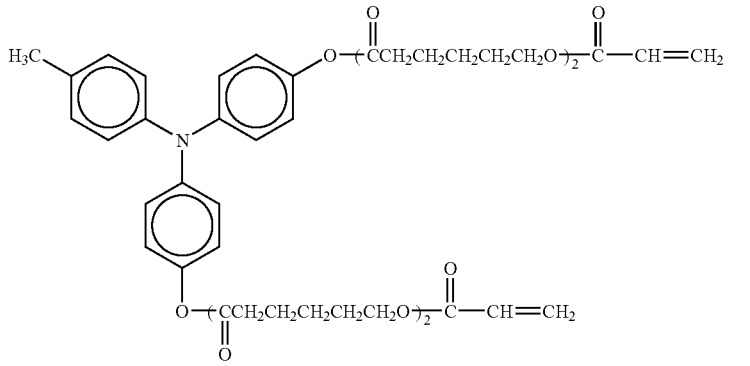

-continued
NO.351
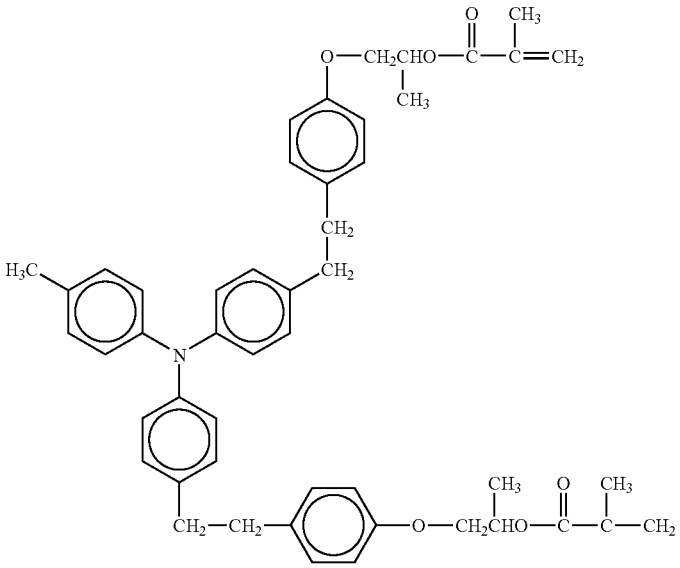
NO.352
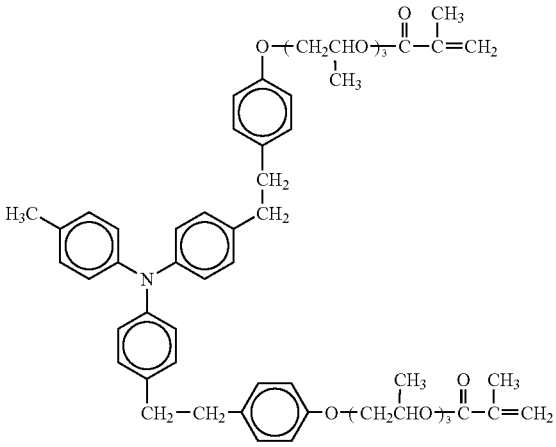
NO.353
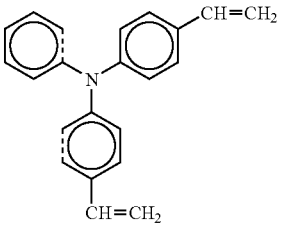
NO.354
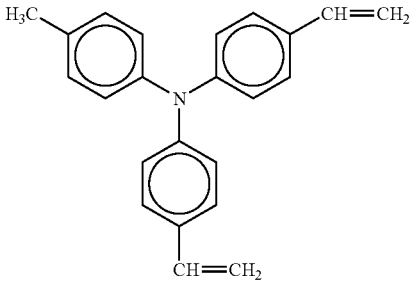
NO.355
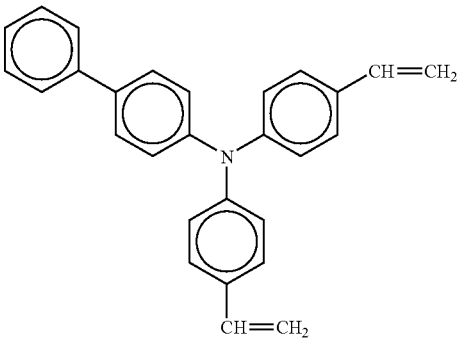

-continued
NO.356
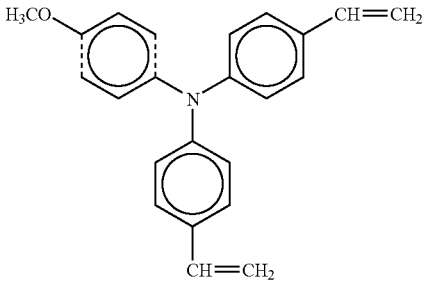
NO.357
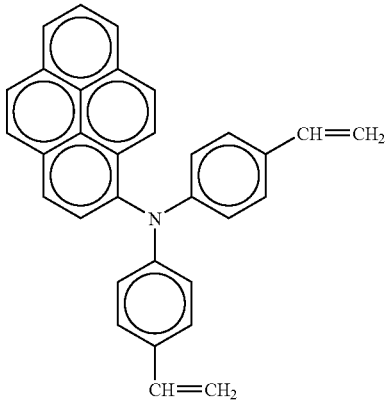
NO.358
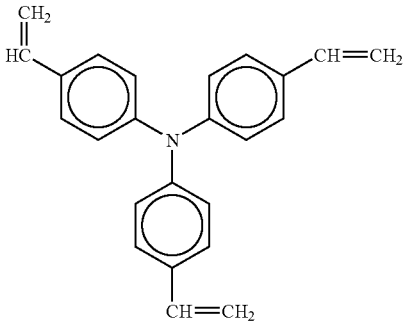
NO.359
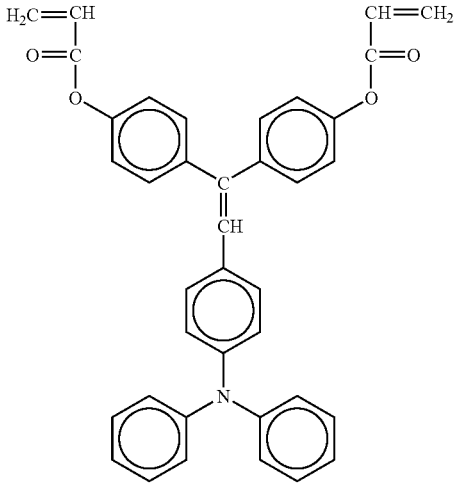
NO.360
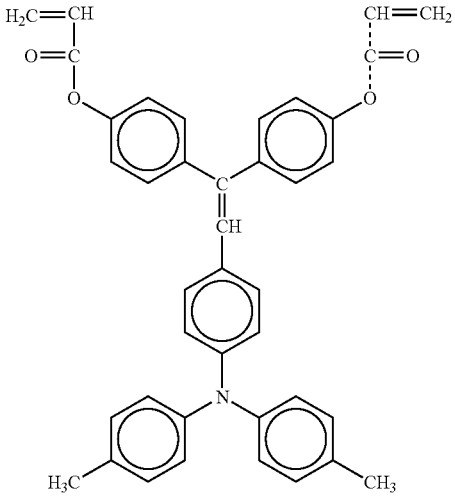
NO.361
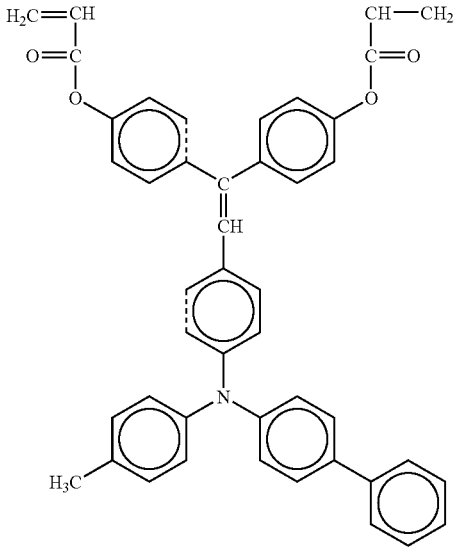

-continued
NO.362
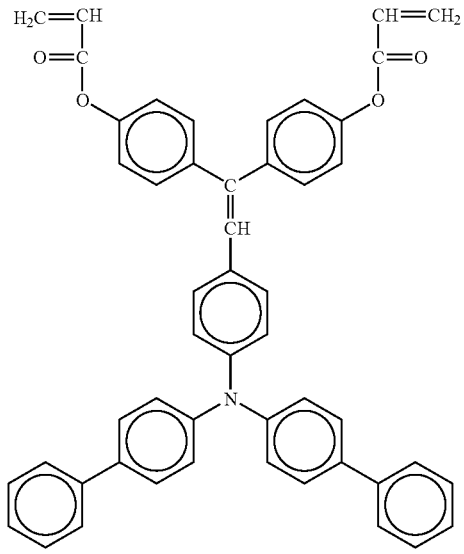
Specific examples of the radical polymerizable compound having three functional groups with a charge transport structure include, but are not limited to, the following.
NO.364
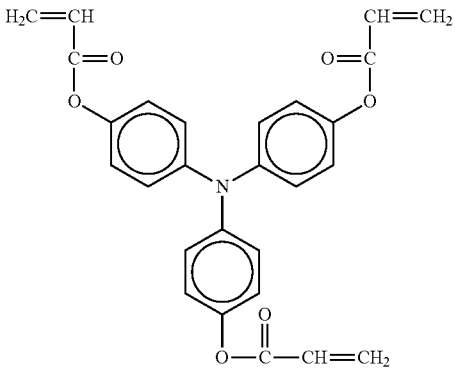
NO.365
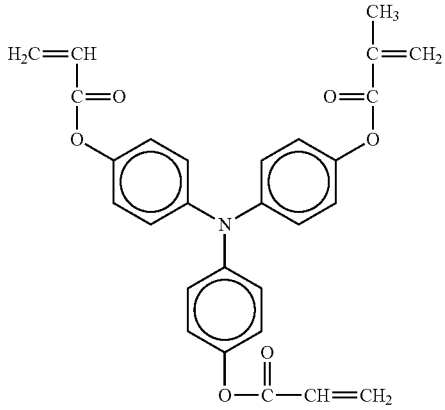
-continued
NO.366
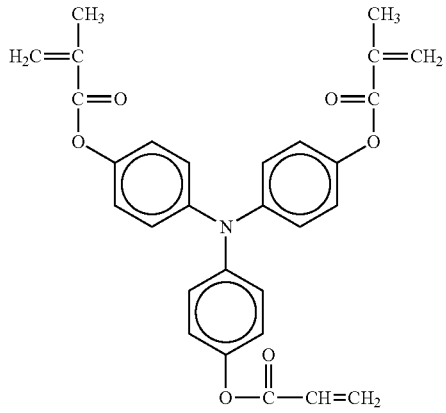
NO.367
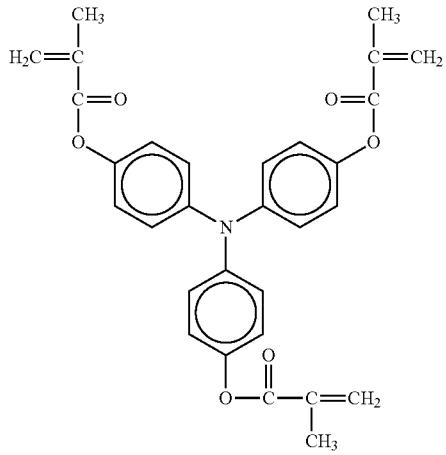

-continued
NO.368
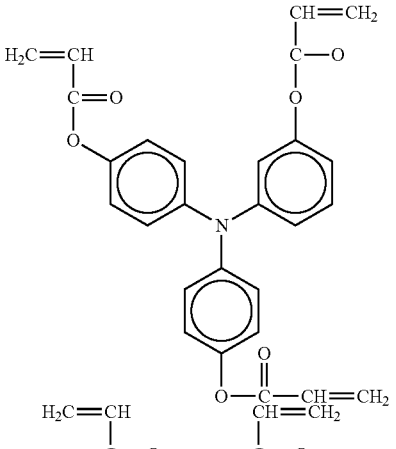
NO.369
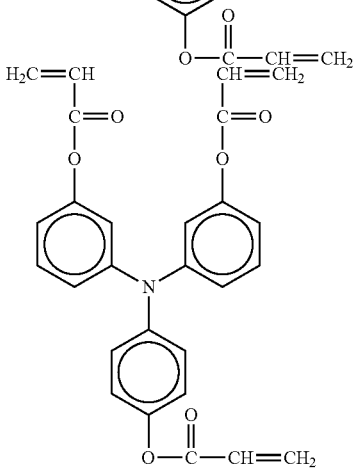
NO.370
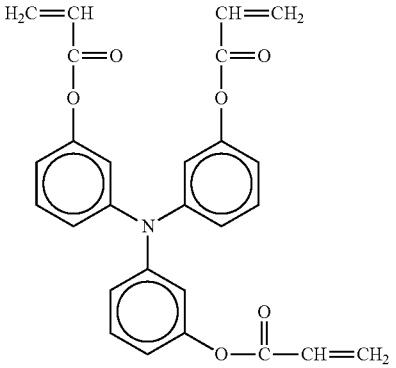
NO.371
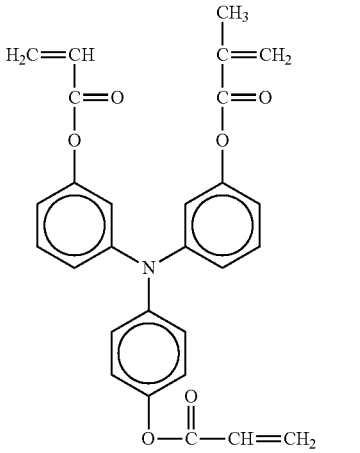
-continued
NO.372
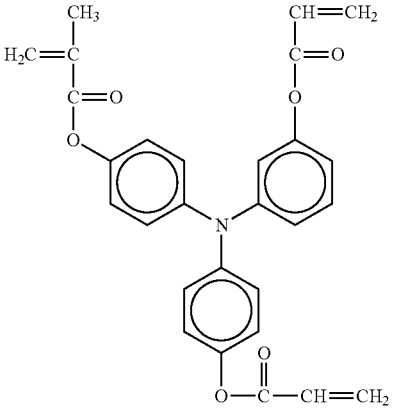
NO.373
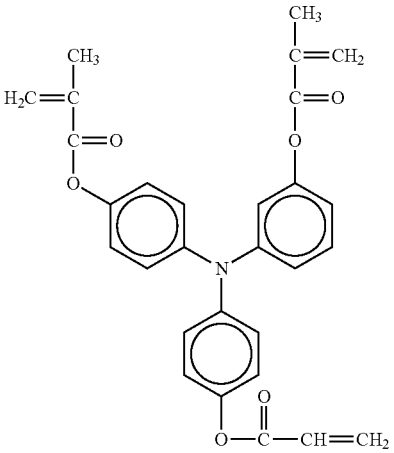
NO.374
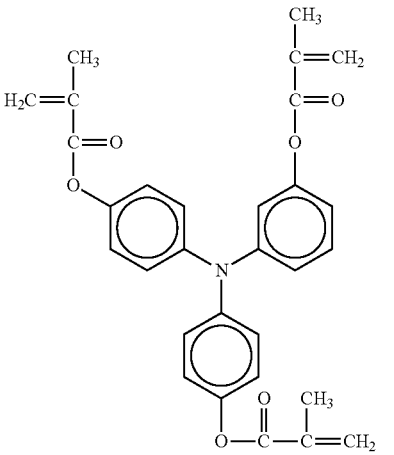

-continued
NO.375
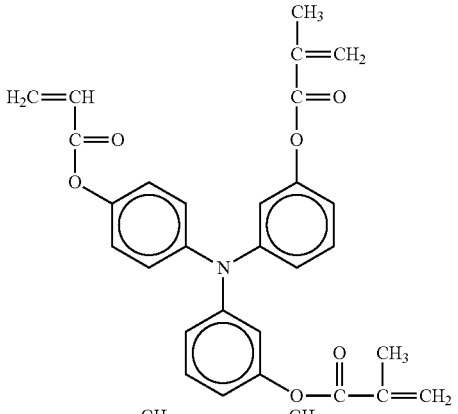
NO.376
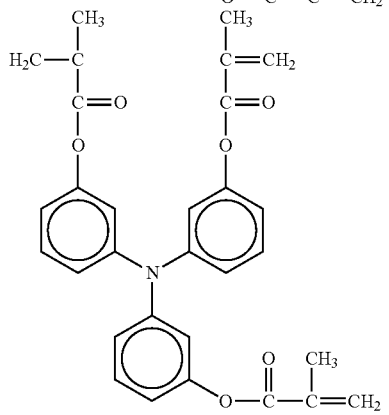
NO.377
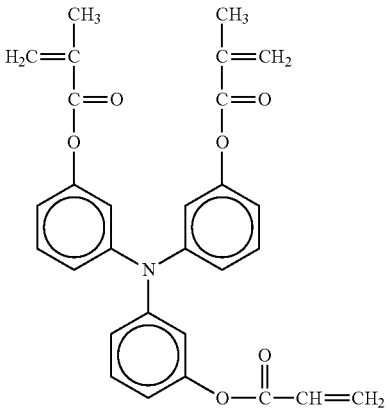
NO.378
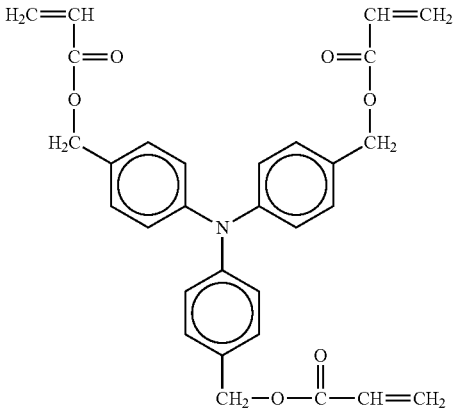
-continued
NO.379
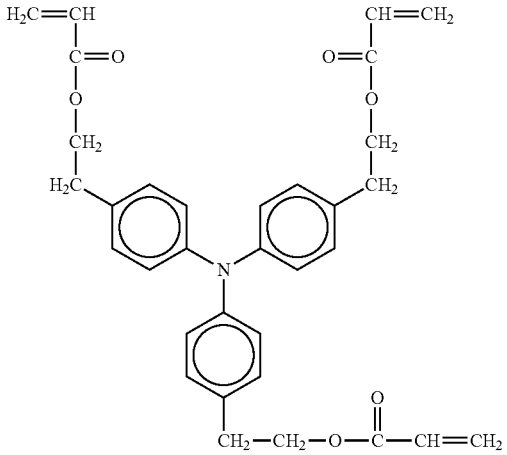
NO.380
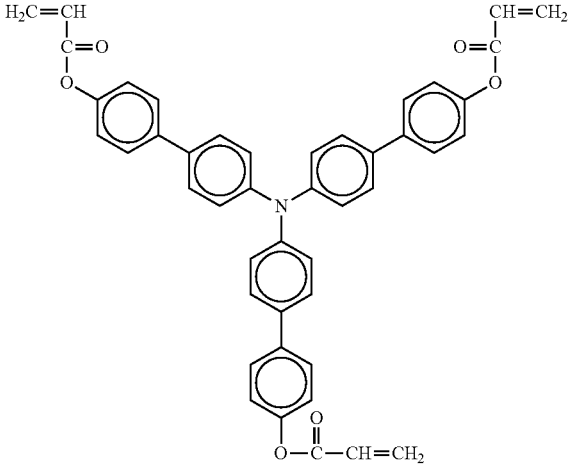
NO.381
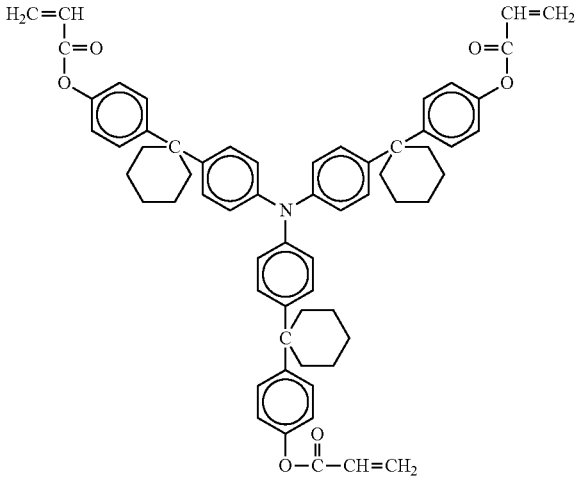

-continued

NO.382

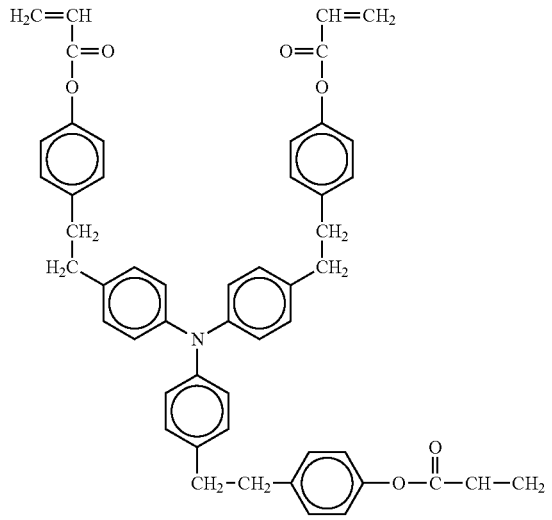

NO.383

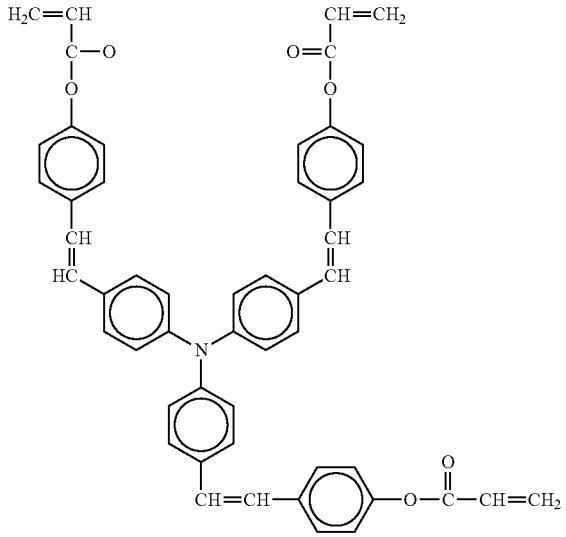

The radical polymerizable compound for use in the present invention having a charge transport structure imparts a charge transport function to a cross-linked protective layer. The content of the radical polymerizable compound having a charge transport structure is from 20 to 80% by weight, and preferably from 30 to 70% by weight based on the total weight of the cross-linked surface layer. When the content is too small, the charge transport function of the cross-linked surface layer is not maintained, which may lead to deterioration of the electric characteristics, for example, a decrease in sensitivity and a rise in the residual voltage, during repetitive use. When the content is too large, the content of the radical polymerizable monomer having at least three functional groups without a charge transport structure decreases. That is, the cross-linking density decreases, resulting in insufficient anti-abrasion. Desired electric characteristics and anti-abrasion property vary depending on the process. Therefore, it is difficult to jump to any conclusion but considering the balance of both characteristics and property, the addition amount is most preferable in the range of from 30 to 70% by weight.

The surface layer for use in the present invention is formed by curing at least a monomer having at least three radical polymerizable functional groups without a charge transport structure and a radical polymerizable compound having a charge transport structure. In addition to this, a monomer or oligomer having one or two radical polymerizable functional groups and a functional monomer can be used to provide functions, for example, adjusting the viscosity upon coating, relaxing the stress in the cross-linked surface layer, decreasing the surface energy, and reducing the friction index, etc. Any known radical polymerizable monomers and oligomers can be used.

Specific examples of the monomer having one radical polymerizable functional group include, but are not limited to, monomers of 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and styrene.

Specific examples of the monomer having two radical polymerizable functional groups include, but are not limited to, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include, but are not limited to, monomers having a fluorine atom therein, such as octafluoro penthyl acrylate, 2-perfluorooctyl ethyl acrylate, 2-perfluorooctyl ethyl methacrylate and 2-perfluoroisononyl ethyl acrylate; and vinyl monomers, acrylates and methacrylates having polysiloxane groups, such as acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in examined published Japanese patent application No. (hereinafter referred to as JPP) H05-60503 and H06-45770.

Specific examples of the radical polymerizable oligomer include, but are not limited to, epoxyacrylate based, urethane acrylate based, and polyester acrylate based oligomers.

When a monomer and/or oligomer having one or two radical polymerizable functional groups are contained in a large amount, the three dimensional cross-linked density of the cross-linked surface (protective) layer substantially decreases, which invites deterioration of the anti-abrasion property. Therefore, the content of the monomer and oligomer is not greater than 50 parts by weight and preferably not greater than 30 parts by weight based on 100 parts by weight of the monomer having at least three radical polymerizable functional groups.

The surface layer for use in the present invention is formed by curing at least a monomer having at least three radical polymerizable functional groups without a charge transport structure and a radical polymerizable compound having a charge transport structure. To conduct the cross-linking reaction effectively, a polymerization initiator, such as a thermal polymerization initiator or a photo polymerization initiator, can be added to the cross-linked surface layer, if desired.

Specific examples of the photo polymerization initiators include, but are not limited to, acetophenone based or ketal based photo polymerization initiators, such as diethoxy acetophenone, 2,2-dimethoxy-1,2-diphenylethane-1-one, 1-hydroxy cyclohexyl phenylketone, 4-(2-hydroxyethoxy)

phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propane dione-2-(o-ethoxycarbonyl)oxime; benzoin ether based photo polymerization initiators, such as benzoine, benzoine methyl ether, benzoin ethyl ether, benzoine isobutyl ether and benzoine isopropyl ether; benzophenone based photo polymerization initiators, such as benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, such as 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds. In addition, compounds having a photo polymerization promotion effect can be used alone or in combination with the photo polymerization initiators mentioned above. Specific examples thereof include, but are not limited to, triethanol amine, methyldiethanol amine, 4-dimethylamino ethyl benzoate, 4-dimethylamino isoamile benzoate, benzoic acid (2-dimethylamino) ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymerizable compound.

Furthermore, a liquid application for the cross-linked surface layer for use in the present invention can contain additives, for example, various kinds of plasticizing agents (to relax stress and improve adhesibility), leveling agents, and low molecular weight charge transport materials which are not radical polymerizable, if desired. Known additives can be used. Specific examples of the plasticizing agents include, but are not limited to, compounds which are used for typical resins, such as dibutyl phthalate and dioctyl phthalate. The addition amount of the plasticizing agent is not greater than 20% by weight and more preferably not greater than 10% by weight based on all the solid portion of the liquid application. Specific examples of the leveling agents include, but are not limited to, silicone oils, such as dimethyl silicone oil, and methylphenyl silicone oil, and polymers or oligomers having a perfluoroalkyl group in its branch chain. The addition amount of the leveling agent is not greater than 3% by weight based on all the solid portion of the liquid of application.

The cross-linked surface layer for use in the present invention is formed by coating and curing a liquid application containing at least a monomer having at least three radical polymerizable functional groups without having a charge transport structure and a radical polymerizable compound having a charge transport structure. When the monomer contained in a liquid application is liquid, it is possible to dissolve other components in the liquid application and coat the liquid application. A liquid application can be also diluted in a suitable solvent before coating, if desired. Specific examples of such solvents include, but are not limited to, an alcohol based solvent, such as methanol, ethanol, propanol and butanol; a ketone based solvent, such as acetone, methyl ethyl ketone, methyl isobutyl ketone, and cyclohexanone; an ester based solvent, such as ethyl acetate and butyl acetate; an ether based solvent, such as tetrahydrofuran, dioxane and propyl ether; a halogen based solvent, such as dichloromethane, dichloroethane, trichloroethane and chlorobenzene; an aromatic series based solvent, such as benzene, toluene and xylene; and a cellosolve based solvent, such as methyl cellosolve, ethyl cellosove and cellosolve acetate. These solvents can be used alone or in combination. The dilution ratio by these solvents depends on the solubility and the coating method of a composition, and a desired layer thickness. A dip coating method, a spray coating method, a beat coating method, a ring coating method, etc., can be used for coating the liquid application.

In the present invention, subsequent to the application of the liquid application, the cross-linked surface layer is cured upon application of external photo-energy. As light energy, a UV irradiation light source, such as a high pressure mercury lamp or a metal halide lamp, having an emission wavelength mainly in the ultraviolet area can be used. A visible light source can be selected according to the absorption wavelength of a radical polymerizable compound and a photopolymerization initiator. The irradiation light amount is preferably from 300 $mW/cm^2$ to 1,000 $mW/cm^2$. When the irradiation light amount is too small, it takes a long time to complete the curing reaction. When the irradiation light amount is too large, the reaction is not uniformly conducted and the degree of roughness of the cross-linked surface layer increases.

When cured by using photo-energy, it is preferred to reduce the density of oxygen to prevent cross-linking inhibition.

The composition contained in the liquid application of a cross-linked surface layer can contain a binder resin as long as the smoothness, electric characteristics, and durability of an image bearing member are not adversely affected. However, when polymer materials such as a binder resin are contained in a liquid application, phase separation tends to occur due to poor compatibility between the polymer and polymers produced from the curing reaction of radical polymerizable compositions (a monomer having a radical polymerizable function group and a radical polymerizable compound having a charge transport structure), which leads to increasing the surface roughness of the cross-linked surface layer. Therefore, it is preferred not to use a binder resin.

The cross-linked surface layer for use in the present invention is preferred to have a bulky charge transport structure for maintaining the electric characteristics and to increase the cross-linking bond density for fortifying the strength. Upon curing after coating of a cross-linked surface layer, when extremely high energy is applied from outside and the reaction is rapidly conducted, the curing advances non-uniformly so that the irregularity of the cross-linked surface layer is high. It is preferred to use external optical energy, because it is possible to control the reaction speed by the heating condition, the irradiation condition of light and the amount of a polymerization initiator.

Below are example methods of making the cross-linked surface layer for use in the present invention. When an acrylate monomer having three acryloyloxy groups and a triaryl amine compound having an acryloyloxy group are used as a liquid of application, the content ratio of the acrylate monomer to the triaryl amine is 3/7 to 7/3 and a polymerization initiator is added in an amount of 3 to 20% by weight based on the total amount of the acrylate compound followed by addition of a solvent to prepare the liquid of application. When a triaryl amine based donor and polycarbonate as a binder resin are used in a charge transport layer provided under the cross-linked surface layer and the surface thereof is formed by a spray coating method, it is preferred to use tetrahydrofuran, 2-butanone or ethyl acetate as the solvent mentioned above for the liquid application, the content of which is 3 to 10 times as much as the total amount of the acrylate compound.

Next, for example, the liquid application prepared as described above is applied with, for example, a spray, on an image bearing member in which an undercoating layer, a charge generating layer and a charge transport layer are accumulated on a substrate, such as an aluminum cylinder. Subsequent to natural drying or drying at a relatively low temperature (25 to 80° C.) for a short time (1 to 10 minutes), the liquid application is cured by UV ray irradiation or heat.

In the case of UV ray irradiation, a metal halide lamp, etc., is preferably used. The illuminance thereof is preferably from 300 to 1,000 mW/cm$^2$. For example, irradiation with UV light having an illuminance of 600 mW/cm$^2$ for about 45 to 360 seconds while rotating the cylinder is suitable to uniformly irradiate all the surface. The drum temperature is controlled not to be higher than 100° C.

After curing, the image bearing member for use in the present invention is obtained after being heated at 100 to 150° C. for 10 to 30 minutes to reduce the residual solvent.

The image bearing member for use in the present invention is described according to the layer structure thereof.

Figure 2:
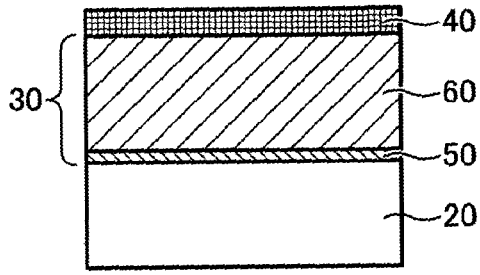
FIG. 2 is a schematic diagram illustrating an example of the layer structure of an image bearing member related to another embodiment of the present invention.

FIG. 1 is a cross section illustrating an example of the image bearing member for use in the present invention. The image bearing member is a single layered image bearing member having an electroconductive substrate on which a photosensitive layer 30 having both charge generating function and charge transport function is provided. A cross-linked surface layer 40 is provided on the photosensitive layer 30. FIG. 2 is a diagram illustrating the case of an image bearing member having a multi-layered structure of a charge generating layer 50 having a charge generating function and a charge transport layer 60 having a charge transport function. The cross-linked surface layer 40 is provided on the charge transport layer 60.

Figure 3:
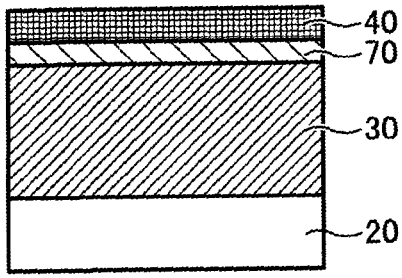
FIG. 3 is a schematic diagram illustrating an example of the layer structure of an image bearing member related to another embodiment of the present invention.
Figure 4:
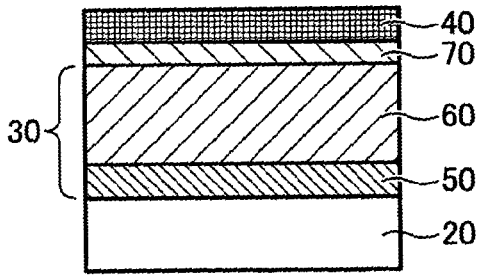
FIG. 4 is a schematic diagram illustrating an example of the layer structure of an image bearing member related to another embodiment of the present invention.

In the present invention, an adhesive layer can be provided to improve the adhesiveness between the photosensitive layer 30 or the charge transport layer 60 and the cross-linked surface layer 40. FIG. 3 is a diagram illustrating the case in which the adhesive layer is provided to the image bearing member of FIG. 1. FIG. 4 is a diagram illustrating the case in which the adhesive layer is provided to the image bearing member of FIG. 2.

Electroconductive Substrate

Materials having a volume resistance of not greater than $10^{10}$ Ω·cm can be used as a material for the electroconductive substrate 20. For example, there can be used plastic or paper having a film form or cylindrical form covered with a metal, such as aluminum, nickel, chrome, nichrome, copper, gold, silver, and platinum, or a metal oxide, such as tin oxide and indium oxide by depositing or sputtering. Also, a board formed of aluminum, an aluminum alloy, nickel, or a stainless metal can be used. Further, a tube which is manufactured from the board mentioned above by a crafting technique, such as extruding and extracting, and surface-treatment, such as cutting, super finishing and grinding, is also usable. In addition, an endless nickel belt or an endless stainless belt described in JOP S52-36016 can be used as the electroconductive substrate 20.

An electroconductive substrate can be formed by applying to the substrate mentioned above a liquid application in which electroconductive powder is dispersed in a suitable binder resin and can be used as the electroconductive substrate 20 for use in the present invention. Specific examples of such electroconductive powder include, but are not limited to, carbon black, acetylene black, metal powder, such as a powder of aluminum, nickel, iron, nichrome, copper, zinc or silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent, such as tetrahydrofuran (THF), dichloromethane (MDC), methyl ethyl ketone (MEK), and toluene and applying the resultant to an electroconductive substrate.

Also, an electroconductive substrate formed by providing a heat contraction tube as an electroconductive layer on a suitable cylindrical substrate can be used as the electroconductive substrate 20 for use in the present invention. The heat contraction tube can be formed of a material, such as polyvinyl chloride, polypropylene, polyester, polystyrene, polyvinylidene chloride, polyethylene, chloride rubber, and TEFLON® in which the electroconductive powder mentioned above is contained.

Photosensitive Layer

Next is a description about the photosensitive layer. The photosensitive layer can take a single layered structure or a multi-layered structure.

In the case of a multi-layered structure, the photosensitive layer is formed of a charge generating layer having a charge generating function and a charge transport layer having a charge transport function. In the case of a single layered structure, the photosensitive layer is a layer having both functions of charge generation and charge transport.

Described below are the photosensitive layer having a multi-layered structure and the photosensitive layer having a single-layered structure.

Multi-Layered Structure Formed of Charge Generating Layer and Charge Transport Layer Charge Generating Layer The charge generating layer 50 is a layer mainly formed of a charge generating material having a charge generating function. A binder resin can be used in combination, if desired. As the charge generating material, there are inorganic materials and organic materials.

Specific examples of the inorganic materials include, but are not limited to, crystal selenium, amorphous selenium, selenium-tellurium, selenium-tellurium-halogen, selenium-arsenic compounds and amorphous silicon. A suitable amorphous silicon is amorphous silicon in which a dangling bond is terminated by a hydrogen atom, or a halogen atom or a boron atom and/or a phosphorous atom are doped.

Any known material can be used as the organic materials. Specific examples thereof include, but are not limited to, phthalocyanine based pigments, such as metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bis-stilbene skeleton, azo pigments having distyryl oxadiazole skeleton, azo pigments having distyryl carbazole skeleton, perylene based pigments, anthraquinone based or polycyclic quinone based pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Specific examples of the optional binder resins for use in the charge generating layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles and polyacrylamides. These can be used alone or in combination.

In addition to the binder resins mentioned above, charge transport polymers having a charge transport function, such as polycarbonates having an arylamine skeleton, a benzidine skeleton, a hydrazone skeleton, a carbazole skeleton, a stilbene skeleton and/or a pyrazoline skeleton, polymer materials such as polyester, polyurethane, polyether and polysiloxane, or polymer materials having a polysiloxane skeleton can be also used.

Specific examples of the former charge transport polymers include compounds described in JOPs H01-001728, H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234840, H06-234841, H06-239049, H06-236050, H06-236051, H06-295077, H07-056374, H08-176293, H08-208820, H08-211640, H08-253568, H08-269183, H09-062019, H09043883, H09-71642, H09-87376, H09-104746, H09-110974, H09-110974, H09-110976, H09-157378, H09-221544, H09-227669, H09-221544, H09-227669, H09-235367, H09-241369, H09-268226, H09-272735, H09-272735, H09-302084, H09-302085 and H09-328539.

Specific examples of the latter charge transport polymers include polysilylene polymers described in JOPs S63-285552, H05-19497, H05-70595 and H10-73944.

The charge generating layer 304 can contain a charge transport material having a low molecular weight.

There are two types of charge transport materials which can be used for a charge generating layer. These are positive hole transport materials and electron transport materials.

Specific examples of such electron transport materials include, but are not limited to, electron acceptance materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives.

These electron transport materials can be used alone or in combination.

Specific examples of such positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These positive hole transport materials can be used alone or in combination.

As a method of forming a charge generating layer, it is possible to use a vacuum thin layer manufacturing method and a casting method from a solution dispersion system.

Specific examples of the vacuum thin layer manufacturing method include, but are not limited to, a vacuum deposition method, a glow discharging decomposition method, an ion plating method, a sputtering method, and a reactive sputtering method and a chemical vacuum deposition (CVD) method. Both inorganic materials and organic materials can be used for forming a charge transport layer.

When a casting method is used, if desired, it is possible to form a charge generating layer by applying a suitably diluted liquid dispersion obtained by dispersing the inorganic material or the organic material mentioned above in a solvent together with a binder resin using a dispersion device. Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include, but are not limited to, a ball mill, an attritor, a sand mill, and a bead mill. In addition, if desired, a leveling agent, such as dimethyl silicone oil or methylphenyl silicone oil, can be added to the liquid dispersion mentioned above. Furthermore, the application mentioned above is performed by a dip coating method, a spray coating method, a bead coating method or a ring coating method.

In the present invention, the thickness of the charge transport layer is preferably from 0.01 to 5 μm and more preferably from 0.05 to 2 μm.

Charge Transport Layer

The charge transport layer 60 is a layer having a charge transport function. The charge transport layer 60 is formed by dissolving and/or dispersing a charge transport material and a binder resin in a suitable solvent and applying the liquid to the charge generating layer 50 followed by drying. Thereafter, a liquid application for a cross-linked surface layer containing the radical polymerizable compound (a monomer having a radical polymerizable functional group without a charge transport structure and a radical polymerizable compound having a transport structure) mentioned above for use in the present invention is applied to the charge transport layer and cross-linked and cured by an external energy.

The electron transport materials, the positive hole transport materials and charge transport polymer mentioned above in the description about the charge generating layer can be used as the charge transport material. As described above, by using a charge transport polymer, it is possible to reduce the solubility of the underlayer when a surface layer is coated, which is useful.

Specific examples of the binder resin include, but are not limited to, thermoplastic resins or thermocuring resins, such as polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, acrylic resin, silicone resins, epoxy resins, melamine resins, urethane resins, phenol resins, and alkyd resins.

The content of the charge transport material is from 20 to 300 parts by weight and preferably from 40 to 150 parts by weight based on 100 parts by weight of the binder resin. When a charge transport polymer is used, it is possible to use such a charge transport polymer alone or in combination with a binder resin.

As a solvent for use in application of the charge transport layer 60, the same as the solvents for the charge generating layer 50 can be used. Solvents that suitably dissolve a charge transport material and a binder resin are preferred. These solvents can be used alone or in combination. It is also possible to use the same method in the case of the charge generating layer 50 for forming the charge transport layer 60. In the present invention, a plasticizing agent and/or a leveling agent can be contained, if desired.

Specific examples of the plasticizing agent for use in the charge transport layer 60 include, but are not limited to, dibutyl phthalate and dioctyl phthalate, which are used for typical resins. The addition amount of the plasticizing agent is preferably from 0 to 30 parts by weight based on 100 parts by weight of a binder resin.

Specific examples of the leveling agent for use in the charge transport layer 60 include, but are not limited to, silicone oils, such as dimethyl silicone oil and methyl phenyl silicone oil, and polymers or oligomers having perfluoroalkyl groups in its side chain. The addition amount of the leveling agent is preferably from 0 to 1 parts by weight based on 100 parts by weight of a binder resin.

The layer thickness of the charge transport layer 60 is suitably from about 5 to about 40 μm and preferably from about 10 to about 30 μm.

When a cross-linked surface layer is the surface portion of the charge transport layer 60, the cross-linked surface layer is formed by coating a liquid application containing radical polymerizable compositions (a monomer having a radical polymerizable function group and a radical polymerizable compound having a charge transport structure) followed by optional drying and starting the curing reaction thereof by external energy, as in the method of forming a cross-linked surface layer described above. The layer thickness of the cross-linked surface layer is from 1 to 20 μm and preferably from 2 to 10 μm. When the layer thickness is too thin, the obtained layer thickness is non-uniform and the durability thereof tends to vary. When the layer thickness is too thick, the layer thickness of the entire charge transport layer 60 is excessively thick, resulting in deterioration of reproducibility of images due to diffusion of charges.

Single Layered Photosensitive Layer

The single layered photosensitive layer is a layer having both of a charge generating function and a charge transport function and can be formed by dissolving and/or dispersing a charge transport material having a charge generating function, a charge transport function and a binder resin in a suitable solvent and applying the liquid followed by drying. A plasticizer, a leveling agent, etc. can be added, if desired. With regard to the method of dispersing a charge generating material, the charge generating material, the charge transport material, the plasticizer and the leveling agents, the same as mentioned in the charge generating layer 50 and the charge transport layer 60 can be used. As the binder resin, in addition to the binder resins mentioned in the charge transport layer 60, the binder resins mentioned in the charge generating layer 50 can be mixed therewith. In addition, the charge transport polymers mentioned above can also be used. This is advantageous to reduce comingling of the compound of the photosensitive sensitive layer 30 into the cross-liked surface layer. The layer thickness of the photosensitive layer 30 is suitably from about 5 to 30 μm and preferably from about 10 to 25 μm.

When the cross-linked surface layer is the surface portion of a photosensitive layer having a single layer structure, the cross-linked surface layer is formed by coating a liquid application containing radical polymerizable compositions and a charge generating material followed by optional drying and starting the curing reaction thereof by external energy, as described above. The layer thickness of the cross-linked surface layer is from 1 to 20 μm and preferably from 2 to 10 μm. When the layer thickness is too thin, the layer thickness is non-uniform and the durability thereof tends to vary. When the layer thickness is too thick, the layer thickness of the entire charge transport layer 60 is excessively thick, resulting in deterioration of reproducibility of images due to diffusion of charges.

The charge generating material contained in a photosensitive layer having a single layer structure is preferably from 1 to 30% by weight based on the total amount of the entire photosensitive layer. The content of the binder resin contained in the underlayer portion of the photosensitive layer is from 20 to 80% by weight of the total weight thereof and the content of the charge transport material is from 10 to 70% by weight based thereon.

Adhesive Layer

In the present invention, it is suitable to provide an adhesive layer between the photosensitive layer 30 and the cross-linked surface layer 40 to improve the adhesive strength therebetween. Anti-abrasion property is improved and the adhesiveness strength is weakened through curing of the surface by providing the cross-liked surface layer 40. The weakened adhesiveness is improved by the adhesive layer 50.

A liquid application containing a mixture of the binder resin for use in the transport layer 60, a radical polymerizable monomer for use in the cross-linked surface layer and optional radical polymerizable compound having a functional group with a charge transport structure is applied to the charge transport layer 60 followed by application of the liquid application for the cross-linked surface layer together with optical curing so that the formed adhesive layer 70 has a function of uniting the charge transport layer 60 and the cross-linked surface layer 40.

Next, the material composition for use in the adhesive layer is described.

In the adhesiveness layer 70, to improve the adhesiveness between the cross-linked surface layer 40 and the photosensitive layer 30, a monomer having a radical polymerizable functional group and a binder resin are contained. Also, to improve the electric characteristics, the adhesive layer 70 can optionally contain a radical polymerizable compound having a charge transport structure. A monomer having one or two radical polymerizable functional groups in addition to a monomer having three or higher radical polymerizable functional groups can be used as this radical polymerizable compound. As the compound having a radical polymerizable functional group with a charge transport structure, those for use in the cross-linked surface layer 40 can be used.

As the binder resin, those for use in the charge transport layer 60 can be used. Specific examples thereof include, but are not limited to, thermoplastic resins and thermosetting resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin. As the method of forming the adhesive layer 70, typical application methods mentioned above for use in the charge transport layer 60 adopted. The layer thickness of the adhesive layer 70 is preferably from 0.05 to 5 μm and more preferably from 0.1 to 1 μm. When the layer thickness is too thin, the adhesiveness effect is not sufficiently obtained. When the layer thickness is too thick, the electric characteristics tend to deteriorate.

Undercoating Layer

In the image bearing member of the present invention, an undercoating layer can be provided between an electroconductive substrate and a photosensitive layer. Such an undercoating layer is mainly made of a resin. Considering that a photosensitive layer is formed on such an undercoating layer (i.e., resin) using a solvent, the resin is preferably hardly soluble in a typically used organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing resins which form a three dimension mesh structure, such as polyurethane, melamine resins, phenol resins, alkyd-melamine resins and epoxy resins. In addition, to prevent moiré and reduce the residual voltage, it is possible to add to an undercoating layer fine powder pigments of metal oxide, such as titanium oxides, silica, alumina, zirconium oxides, tin oxides and indium oxides.

These undercoating layers can be formed by using a suitable solvent and a suitable coating method as described for the photosensitive layer. Silane coupling agents, titanium coupling agents or chromium coupling agents can be used in for the undercoating layer. Furthermore, an undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method.

The layer thickness of such an undercoating layer is suitably from 0 to 5 μm.

Addition of Anti-Oxidizing Agent

Furthermore, in the present invention, to improve the environment resistance, in particular, to prevent degradation of sensitivity and a rise in residual potential, an anti-oxidizing agent can be added to layers, i.e., the cross-linked surface layer 40, the charge generating layer 50, the charge transport layer 60, the undercoating layer and the adhesive layer 70.

Specific examples of the anti-oxidizing agent include, but are not limited to, phenol compounds, paraphenylene diamines, hydroquinones, organic sulfur compounds, and organic phosphorous compounds.

Phenol Compounds

Specific examples of the phenol compound include, but are not limited to, 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Paraphenylene Diamines

Specific examples of the paraphenylene diamines include, but are not limited to, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones

Specific examples of the hydroquinones include, but are not limited to, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Specific examples of the organic sulfur compounds include, but are not limited to, dilauryl-3,3'-thiodipropionate, distearyl-3,3'-thiodipropyonate, and ditetradecyl-3,3'-thiodipropyonate.

Organic Compounds

Specific examples of the organic phosphorous compounds include, but are not limited to, triphenylphosphine, tri(nonylphenyl)phosphine, tri(dinonylphenyl)phosphine, tricresylphosphine, and tri(2,4-dibutylphenoxy)phosphine.

The addition amount of the anti-oxidizing agent is preferably 0.01 to 10 parts by weight based on the total weight of the layer to which the anti-oxidizing agent is added.

The toner for use in the image bearing member of the present invention will be described next. First, the volume average particle diameter, the average circularity and the external additive of the toner are described followed by the composition material and the manufacturing method thereof.

Volume Average Particle Diameter

The toner of the present invention preferably has a volume average particle diameter of from 1.0 to 5.0 μm.

When the toner has such a volume average particle diameter, quality images having high definition can be obtained since the dots are truly reproduced. When such a toner is used especially in a full color photocopier, etc., quality images having excellent color reproducibility can be obtained. With an excessively large volume average particle diameter, it is difficult to obtain quality images having high definition and the variance of the toner particle diameter tends to be large when the toner in a developing agent is replenished. To the contrary, a toner having an excessively small volume average particle diameter is practically impossible to manufacture.

Generally, a toner having a small particle diameter is disadvantageous in light of cleaning property. The total system of the image bearing member, toner and cleaning blade provided by the present invention can solve this problem.

The volume average particle diameter of the toner is measured by a particle size measuring device COULTER MULTI-SIZER III (manufactured by Beckman Coulter Inc.) with an aperture of 100 μm and analyzed by a analysis software 'Beckman Coulter Multisizer 3, version 3.51).

The specific measuring method is as follows: Add 0.5 ml of 10 weight % surface active agent (alkylbenzene sulfonic acid salt, NEOGEN SC-A, manufactured by Dai-ichi Kogyo Seiyaku Co., Ltd.) in a 100 ml glass beaker; Add 0.5 g of each toner thereto followed by stirring by micro medicine spoon; Add 80 ml of deionized water; Conduct dispersion treatment for the obtained liquid dispersion by a supersonic wave disperser (W-113MK-II, manufactured by Honda Electronics Co., Ltd.) for 10 minutes; and measure the liquid dispersion with the Multisizer III with the measuring liquid of ISOTON III (manufacture by Beckman Coulter Inc.). The toner liquid dispersion sample is dropped to such that the density by the device is 6 to 10%. In this measuring method, it is desired that the density should be from 6 to 10% in terms of the measurement reproducibility. In this density range, the particle diameter can be obtained without an error.

Average Circularity

The toner for use in the image forming apparatus of the present invention preferably has an average circularity of from 0.95 to 0.98. The average circularity SR is defined by the following relationship: length of the circumference of a circle having the same area as that of the projected image of a particle/length of the circumference of the projected image of the particle)×100%. When a toner particle is close to a true sphere, the average circularity approaches to 100%. A toner having a low average circularity is easily affected by the development electric field and is developed as true to the electric field of a latent electrostatic image. To reproduce minute latent image dots, dense and uniform development is desired to have an excellent fine line reproducibility. In addition, a toner that has a high average circularity is easily affected by an electric field since the toner has a smooth surface and thus a suitable fluidity. Therefore, the toner tends to be transferred along the electric field so that the transfer ratio is high, resulting in quality images. However, when the average circularity is too low, true development with a high transfer ratio tends to be difficult.

This average circularity is obtained by thermal or mechanical spherical treatment in the case of a toner prepared by dry pulverization. With regard to thermal spherical treatment, for example, mother toner particles are sprayed with heated air stream to an atomizer. With regard to mechanical spherical treatment, for example, mother toner particle is placed and mixed with a mixing medium such as glass having a light specific weight in a mixing device such as a ball mill. In the thermal treatment, mother toner particles agglomerate so that coarse mother toner particles are produced. In the mechanical treatment, fine mother toner particles are produced. Thus, the mother toner particles obtained are subject to another classification process. Additionally, in the case of a toner prepared in an aqueous medium, the form thereof can be controlled by violent stirring in the process of removing solvent.

The average circularity of a toner is measured by a flow type particle size analyzer (FPIA-2100, manufactured by Sysmex Corporation) for super fine toner particles and analyzed by analysis software (FPIA-2100 Data processing Program for FPIA version 00-10). The specific measuring method is as follows: Add 0.1 to 0.5 ml of 10 weight % surface active agent (alkylbenzene sulfonic acid salt, NEOGEN SC-A, manufactured by Dai-ichi Kogyo Seiyaku Co., Ltd.) in a 100 ml glass beaker; Add 0.1 to 0.5 g of each toner thereto followed by stirring by a micro medicine spoon; Add 80 ml of deionized water thereto; and Conduct dispersion treatment for the obtained liquid dispersion by a supersonic wave disperser (manufactured by Honda Electronics Co., Ltd.) for 3 minutes. The form and the distribution of toner are measured by using FPIA-2100 mentioned above until the density becomes 5,000 to 15,000 particles/μl. In this measuring method, it is desired that the density should be 5,000 to 15,000 particles/μl in terms of the measurement reproducibility for the average circularity. To obtain the density of the liquid dispersion, it is suitable to change the conditions of liquid dispersion, i.e., the addition amount of a surface active agent and the amount of a toner. The addition amount of a surface active agent varies depending on hydrophobic property of the toner as in the case of the measurement of the toner particle diameter. When the addition amount is too large, noise caused by foam appears. By contrast, when the addition amount is too small, it is difficult to wet toner sufficiently, resulting in insufficient dispersion. The addition amount of toner depends on the particle diameter thereof. When a toner has a small particle diameter, the addition amount of toner is preferred to be small. When a toner has a large particle diameter, the addition amount of toner is preferred to be large. In the case of a toner having a particle diameter of from 1 to 5 μl, the density of a liquid dispersion can be adjusted to be in the range of from 5,000 to 15,000 particles/μl by adding 0.1 to 0.5 g of toner.

External Additive

As the external additives added to the surface of toner of the present invention, inorganic particulates are preferably used. Specific examples of the inorganic particulates include, but are not limited to, silica, alumina, titania, barium titanate, magnesium titanate, calcium titanate, strontium titanate, zinc titanate, quartz sand, clay, mica, sand lime, wollastonite, diatom earth, chrome titanate, cerium oxide, red iron oxide, antimony trioxide, magnesium oxide, zirconium oxide, barium oxide, calcium carbonate, silica carbide, and silica.

The addition amount of an external additive preferably satisfies the relationship (I): $1<3X/5+Y<3$ (I), wherein X represents the amount by weight % of an external additive having a primary particle diameter of from 10 to 20 nm and Y represents the amount by weight % of an external additive having an primary particle diameter of from 100 to 200 nm and X and Y have the following relationship: $X<Y$, $0<X\leqq 1$ and $1\leqq Y$.

The toner of the present invention is relatively small and close to a sphere in comparison with a typical toner so that the toner of the present invention has a disadvantage in terms of cleaning. By increasing the addition amount of an external additive having a large primary particle diameter of from 100 to 200 nm, a dam layer is formed at the blade edge portion to prevent toner from slipping therethrough. To the contrary, the addition amount of an external additive having a small primary particle diameter has a small dam layer formation effect and tends to slip through the blade so that the addition amount thereof is reduced. In addition, an external additive having a large particle diameter can reduce the adhesive force between an image bearing member and toner or an intermediate transfer belt and toner and thus improve the transfer ratio of toner from an image bearing member to an intermediate transfer belt or from an intermediate transfer belt to a transfer body. It is possible to reduce the amount of toner untransferred from an image bearing member to an intermediate transfer belt, which is a good advantage in terms of cleaning. This effect of reducing the amount of untransferred toner on an image bearing member is boosted in combination with the image bearing member for use in the present invention. This large external additive is not easily embedded in mother toner particles even when the additive external is under mechanical stress over time. Therefore, such a large external additive can maintain the effect for an extended period of time. The small external additive has an effect of reducing the adhesive force but the effect is relatively small and not drastic in comparison with that of the large external additive. Furthermore, the small external additive is easily embedded into mother toner particles when the external additive is under mechanical stress over time. Therefore, such a small external additive is difficult to maintain the effect for an extended period of time.

As the result of the present invention, it is found that when the relationship (I) is satisfied between the addition amount of a small external additive and of a large external additive, the effect of reducing the amount of particles slipped through a cleaning blade is good. When the value of 3X/5+Y is too small, the amount of a large external additive is small to form a dam layer so that the toner easily slips through a cleaning blade. When the value is too great, the fluidity of toner extremely deteriorates, which has an adverse impact on other processes.

The composition material of toner for use in the image forming apparatus of the present invention and the manufacturing method thereof are described. A mother toner color particle for use in the present invention contains a binder resin, a coloring agent, and a releasing agent and can be manufactured by a pulverization method, a polymerization method (e.g., suspension polymerization, emulsification polymerization, dispersion polymerization, emulsification agglomeration, emulsification association), etc. The toner for use in the present invention preferably has a small particle diameter and a spherical form for producing quality images with high definition. To prepare such a toner, a suspension polymerization method, an emulsification polymerization method, a polymer suspension method, etc. can be used. In these methods, mother toner particles are formed by emulsifying, suspending or agglomerating an oil in an aqueous medium. Next, the toner manufacturing methods and the materials and the additives for use therein are described.

Suspension Polymerization Method

A coloring agent, a releasing agent, etc. are dispersed in an oil soluble polymerization initiator and a polymerizable monomer and the resultant liquid is emulsified and dispersed in an aqueous medium having a surface active agent and other solid dispersing agent by the emulsification method described later. Thereafter, a polymerization is conducted for granulation and residual surface active agent, etc. are washed away. Toner particles are thus obtained. It is possible to introduce a functional group to the surface of a toner particle by using an acid, such as acrylic acid, methacylic acid, α-cyanoacrylic acid, α-cyanomethacrylic acid, itaconic acid, crotonic acid, fumaric acid, maleic acid and maleic anhydride, and acrylates or methacrylates having an amino group, such as acrylamide, methacrylamide and diacetoneacrylamide and their methylol compounds, vinyl pyridine, vinyl pyrrolidone, vinyl imidazole and ethylene imine, and dimethyl aminoethyl methacrylate as part of the polymerizable monomer. In addition, by selecting an acid group and a basic group as the dispersing agent, the dispersing agent can be absorbed and remain on the surface of a particle so that a functional group can be introduced.

Emulsification Polymerization Agglomeration Method

A water soluble polymerization initiator and a polymerizable monomer are emulsified in an aqueous medium by using a surface active agent and a latex is synthesized by a typical emulsification polymerization method. Separately, a dispersion body in which a coloring agent, a releasing agent, etc. are dispersed in an aqueous medium is prepared and mixed with the latex. After the resultant is agglomerated to the size of a toner particle followed by heating and fusing, a toner is obtained. It is possible to introduce a functional group on the surface of a toner particle by selecting a monomer from the monomers that can be used in the suspension polymerization method mentioned above when preparing the latex.

Polymer Suspension Method

As an aqueous medium, water can be used alone but a solvent soluble in water can be used in combination with water.

Specific examples of such solvents include, but are not limited to, alcohol (methanol, isopropanol, ethylene glycol, etc.), dimethylformamide, tetrahydrofuran, cellosolve (methylcellosolve, etc.), and lower ketones (acetone, methylethylketone, etc.). In the oil phase of a toner composition, a resin, a prepolymer, a coloring agent, a releasing agent, a charge control agent, etc. can be dissolved or dispersed in a volatile solvent. The oil phase formed of the toner composition is dispersed in the aqueous medium under the presence of a surface active agent, and a solid dispersing agent. Prepolymer reaction is conducted for granulation.

A functional group can be introduced to a toner particle by using a copolymer with a monomer having the functional group for use in the suspension polymerization method mentioned above. In the case of a polyester resin, an acid monomer having at least three acid functional groups can be used and also hydroxyl groups at the end of an obtained polyester resin can be esterified by a compound having at least two acid functional groups. In addition, as a dispersion stabilizer in an aqueous medium described later, it is possible to introduce an acid group on the surface of a toner particle by using a surface active agent, a polar molecule, an organic or inorganic resin particulate having an acid group. Specific examples of such acid groups include, but are not limited to, carboxyl group, sulfonyl group, sulfonate group and phosphate group.

Dry Pulverization Method

As an example pulverization method, a method including at least a process of mechanically mixing a material containing at least a binder resin, a charge control agent and a coloring agent, a melting and fusion process, a pulverization process, and a classification process can be applied. In addition, to improve the dispersion property of a coloring agent, subsequent to master batch treatment to a coloring agent, the coloring agent can be mixed with other materials before the next process.

The mechanical mixing process can be performed by using a typical mixer having a rotary wing under typical conditions and there is no specific limit thereto. When the mixing process is complete, the mixture is placed in a kneader for melting and kneading. It is suitable to use a one or two axis continuous kneader, or a batch type kneader having a roll mill as a kneader. Specific examples of kneading a toner include, but are not limited to, a batch type two roll, a BANBURRY® mixer, a two axis extruder (e.g., a KTK type two axis extruder manufactured by Kobe Steel Ltd., a TEM type two axis extruder manufactured by TOSHIBA MACHINE CO., LTD, a two axis extruder manufactured by KCK Co., Ltd., a PCM type two axis extruder manufactured by Ikegai Ltd., or a KEX type two axis extruder manufactured by Kurimoto Ltd.), or a continuous type one axis kneader (e.g., Cokneader manufactured by Buss Co., Ltd.). The melted and kneaded mixture obtained is thereafter cooled down and pulverized. As to pulverization, the melted and kneaded mixture is coarsely-pulverized by, for example, a hammer mill, ROTOPLEX, etc., and then finely-pulverized by a fine pulverizer using a jet air or a mechanical fine pulverizer. It is preferred to pulverize the mixture in such a manner that the pulverized mixture has an average particle diameter of from 3 to 15 μm. Further, the pulverized mixture is preferably adjusted by, for example, an air classifier, in a manner that the size of the adjusted particles is from 1 to 5 μm. Thereafter, external additives are attached to a mother toner particle. The external additives and the mother toner particle are mixed and stirred by a mixer, etc., and thus the surface of the mother toner particle is covered with the external additives while the external additives are pulverized.

Typical binder resins can be used for manufacturing these pulverized toners. It is preferred to use a polyester resin to obtain an image having a wide range of color reproducibility. Furthermore, it is possible to secure a wide range of fixing temperature when this toner contains a crystalline polyester resin, a non-crystalline polyester resin and a releasing agent. To secure gloss, the dispersion property of a releasing agent is improved, which also prevents the occurrence of hot offset.

The toner for use in the image forming apparatus of the present invention is preferred to be a toner obtained by a method similar to a polymer suspension method. Namely, the toner is obtained by conducting a cross-linking and/or elongating reaction of a toner liquid material in which at least a polymer having a portion reactive with a compound having an active hydrogen group, a polyester, a coloring agent, and a releasing agent is dissolved or dispersed in an organic solvent in an aqueous medium. As the polymer having a portion reactive with a compound having an active hydrogen group, a polyester prepolymer having a portion reactive with a compound having an active hydrogen group is preferred and the polyester prepolymer is cross-linked and/or elongated in an aqueous medium and contained in a toner as a modified polyester. The toner manufacturing method is detailed below.

Modified Polyester

The toner for use in the present invention is preferred to contain a modified polyester (i) as a binder resin. The modified polyester (i) is a polyester which has a bonding group other than the ester bonding in a polyester resin or a polyester in which different resin components are bonded by covalent bonding or ionic bonding.

For example, such a modified polyester resin is modified by introducing a functional group such as an isocyanate group reactive with a carboxyl group or hydroxyl group to the end of the polyester and conducting a reaction with a compound having an active hydrogen group.

As the modified polyester (i), a urea modified polyester obtained by a reaction between a polyester prepolymer (A) having an isocyanate group and an amine (B) can be used. Specific examples of the prepolymer (A) having an isocyanate group include, but are not limited to, a polycondensation compound of a polyol (PO) and a polycarbonate (PC) in which the polyester having an active hydrogen group is reacted with a polyisocyanate compound (PIC). Specific examples of the active hydrogen group contained in the polyester include, but are not limited to, hydroxyl group (alcoholic hydroxyl group and phenolic alcohol group), amino group, carboxyl group, and mercapto group. Among these, alcohol hydroxyl group is preferred.

Urea modified polyesters are described below.

Specific examples of the polyols include, but are not limited to, diols (DIO) and polyols (TO) having three or more hydroxyl groups. It is preferred to use a diol (DIO) alone or a mixture in which a small amount of a polyol (TO) is added to a diol (DIO).

Specific examples of the diols (DIO) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (TO) include, but are not limited to, aliphatic alcohols having three or more hydroxyl groups (e.g., glycerin, trimethylol ethane, trimethylol propane, pentaerythritol and sorbitol); polyphenols having three or more hydroxyl groups (triphenol PA, phenol novolak and cresol novolak); adducts of the polyphenols mentioned above with an alkylene oxide; etc.

Suitable polycarboxylic acids (PC) include, but are not limited to, dicarboxylic acids (DIC) and polycarboxylic acids (TC) having three or more carboxyl groups. It is preferred to use dicarboxylic acids (DIC) alone or mixtures in which a small amount of a polycarboxylic acid (TC) is added to a dicarboxylic acid (DIC).

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include, but are not limited to, aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

A suitable mixing ratio (i.e., an equivalence ratio [OH]/[COOH]) of polyol (PO) to polycarboxylic acid (PC) ranges from 2/1 to 1/1, preferably from 1.5/1 to 1/1 and more preferably from 1.3/1 to 1.02/1.

As polyol compounds (PO) and polycarboxyl compounds (PC), any compound which can form a polyester having an active hydrogen group by polycondensation can be used in addition to the compounds mentioned above.

Specific examples of the polyisocyanates (PIC) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisoycantes (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

A suitable mixing ratio (i.e., [NCO]/[OH]) of polyisocyanate (PIC) to polyester having a hydroxyl group varies from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, resulting in deterioration of the hot-offset resistance of the toner.

The content of the constitutional component of a polyisocyanate (PIC) in the polyester prepolymer (A) having an isocyanate group at its end portion ranges from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small (less than 1 per 1 molecule), the molecular weight of the resultant urea-modified polyester decreases and thereby the hot offset resistance deteriorates.

Specific examples of the amines (B), which are to be reacted with a polyester prepolymer (A), include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include, but are not limited to, aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include, but are not limited to, diethylene triamine, triethylene tetramine. Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan. Specific examples of the amino acids (B5) include, but are not limited to, amino propionic acid and amino caproic acid. Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferred.

The mixing ratio (i.e., a ratio [NCO]/[NHx]) of the content of the prepolymer (A) having an isocyanate group to the amine (B) ranges from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The modified polyesters may include a urethane linkage as well as a urea linkage. The molar ratio (urea/urethane) of the urea linkage to the urethane linkage may vary from 100/0 to 10/90, preferably from 80/20 to 20/80 and more preferably from 60/40 to 30/70. When the content of the urea linkage is too low, the hot offset resistance of the resultant toner deteriorates.

The modified polyester (i) for use in the present invention is manufactured by a one shot method or a prepolymer method.

The weight average molecular weight of the modified polyester (i) is not less than 10,000, preferably from 20,000 to 10,000,000 and more preferably from 30,000 to 1,000,000. The peak molecular weight at this point is preferably from 1,000 to 10,000. When the peak molecular weight is too small, it is not easy to conduct an elongation reaction and obtain a resilient toner so that the hot offset resistance deteriorates. An excessive peak molecular weight tends to cause deterioration of fixability and a manufacturing problem in the granulation and pulverization. There is no specific limit to the number average molecular weight of the modified polyester (i) when an unmodified polyester (ii) described later is used. Any number average molecular weight is suitable as long as the weight average molecular weight mentioned above is easily obtained. In the case of the modified polyester resin (i) alone, the number average molecular weight is not greater than 20,000, preferably from 1,000 to 10,000 and more preferably from 2,000 to 8,000. When the number average molecular weight is too large, the low temperature fixability deteriorates, and the gloss deteriorates when the toner is used in a full color apparatus.

In the cross-linking reaction and/or elongation reaction of a polyester prepolymer (A) with an amine (B) to obtain the modified polyester (i), a reaction inhibitor can be optionally used to control the molecular weight of the resultant urea-modified polyester. Specific examples of such a reaction inhibitor include, but are not limited to, monoamines (e.g., diethyl amine, dibutyl amine, butyl amine and lauryl amine), and blocked amines (i.e., ketimine compounds) prepared by blocking the monoamines mentioned above.

Unmodified Polyester

In the present invention, it is also possible to contain the unmodified polyester (ii) in the binder resin together with the modified polyester resin (i). When the unmodified polyester (ii) is used in combination, the low temperature fixability is improved, and the gloss ameliorates when used in a full color apparatus. Thus, the combinational use is preferred. As the unmodified polyester (ii), polycondensation compounds of the polyols (PO) and the polycarboxylic acid (PC) mentioned above for the polyester component for the modified polyester (i) are suitable and preferred examples thereof are the same as in the case of modified polyester resin (i). The unmodified polyester (ii) can be a polyester modified by a chemical bonding (e.g., urethane bonding) other than the urea bonding. When a mixture of the modified polyester (i) with the urea-unmodified polyester (ii) is used, it is preferred that the modified polyester (i) partially or entirely mix with the unmodified polyester (ii) in terms of the low temperature fixability and hot offset resistance of the resultant toner. Namely, it is preferred that the unmodified polyester has a structure similar to that of the urea-modified polyester. When the unmodified polyester (i) is used, the mixing ratio of the modified polyester (i) to the urea-modified polyester (ii) varies from 95/5 to 20/80, preferably from 95/5 to 70/30, more preferably from 95/5 to 75/25, and even more preferably from 93/7 to 80/20. When the addition amount of the urea-modified polyester is too small, the hot offset resistance of the resultant toner deteriorates and, in addition, it is difficult to impart a good combination of high temperature preservability and low temperature fixability to the resultant toner.

The peak molecular weight of the unmodified polyester (ii) is from 1,000 to 10,000, preferably from 2,000 to 8,000 and more preferably from 2,000 to 5,000. When the molecular weight is too small, the high temperature preservability tends to deteriorate. When the molecular weight is too large, the low temperature fixability tends to deteriorate. The hydroxyl value of the unmodified polyester (ii) is preferably not less than 5, more preferably from 10 to 120, and particularly preferably from 20 to 80. When the hydroxyl value is too small, it is not good to impart a good combination of the high temperature preservability and the low temperature fixability.

The glass transition temperature (Tg) of the binder resin is from 35 to 70, and preferably from 55 to 65. When the glass transition temperature is too low, the high temperature preservability tends to deteriorate. When the glass transition temperature is too high, the low temperature fixability tends to be insufficient. Since a urea-modified polyester tends to exist on the surface of mother toner particles, the high temperature preservability thereof is relatively good even with a low glass transition temperature in comparison with a typical polyester based toner.

Coloring Agent

Suitable coloring agents for use in the toner of the present invention include known dyes and pigments.

Specific examples of the coloring agents include, but are not limited to, carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent in the toner is preferably from 1 to 15% by weight, and more preferably from 3 to 10% by weight, based on the total weight of the toner.

Master batch pigments, which are prepared by combining a coloring agent with a resin, can be used as the coloring agent of the toner composition of the present invention. Specific examples of the resins for use in the master batch pigments or for use in combination with master batch pigments include, but are not limited to, the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch for use in the toner of the present invention is typically prepared by mixing and kneading a resin and a coloring agent upon application of high shear stress thereto. In this case, an organic solvent can be used to boost the interaction of the coloring agent with the resin. In addition, flushing methods, in which an aqueous paste including a coloring agent is mixed with a resin solution of an organic solvent to transfer the coloring agent to the resin solution and then the aqueous liquid and organic solvent are separated to be removed, can be preferably used because the resultant wet cake of the coloring agent can be used as it is. In this case, three-roll mills can be preferably used for kneading the mixture upon application of high shear stress thereto.

Release Agent

A release agent may be included in the toner of the present invention as well as toner binders and coloring agents. Suitable release agents include known waxes.

Specific examples of the release agent include, but are not limited to, polyolefin waxes such as polyethylene waxes and polypropylene waxes; long chain hydrocarbons such as paraffin waxes and SAZOL waxes; waxes including a carbonyl group, etc.

Among these waxes, the waxes including a carbonyl group are preferably used. Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkylamide such as trimellitic acid tristearylamide; dialkyl ketone such as distearyl ketone, etc. Among these materials, polyalkane acid esters are preferred.

The waxes for use in the toner of the present invention preferably have a melting point of from 40 to 160° C., more preferably from 50 to 120° C., and even more preferably from 60 to 90° C. When the melting point of the wax included in the toner is too low, the high temperature preservability of the toner deteriorates. In contrast, when the melting point is too high, a cold offset problem, in that an offset phenomenon occurs at a low fixing temperature, tends to occur.

The wax used in the toner of the present invention preferably has a melt viscosity of from 5 to 1000 cps and more preferably from 10 to 100 cps at a temperature 20° C. higher than the melting point of the wax. When the melt viscosity is too high, the effect of improving the hot offset resistance and low temperature fixability is lessened. The content of the wax in the toner is from 0 to 40% by weight and preferably from 3 to 30% by weight based on the total weight of the toner.

Charge Controlling Agent

A charge controlling agent may be included in the toner of the present invention.

Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large of a charge quantity, and thereby the electrostatic force of a developing roller attracting the toner increases, resulting in deterioration of the fluidity of the toner and a decrease of the image density of toner images.

The charge controlling agent can be dissolved or dispersed in an organic solvent after kneaded together with a master batch pigment and resin. In addition, the charge controlling agent can be directly dissolved or dispersed in an organic solvent when the toner liquid materials are dissolved or dispersed in the organic solvent. Alternatively, the charge controlling agent may be fixed on the surface of the toner particles after the toner particles are prepared.

External Additive

The significance of the external additive in the present invention is as mentioned above. The following is what should be considered in a typical case. Inorganic particulates, hydrophobized inorganic particulates, etc. can be used as the external additive which supports the fluidity, developability and chargeability of obtained color particles. Any known particulates can be used as long as the conditions are met. For example, such an external additive can contain silica particulates, hydrophobized silica, aliphatic metal salts (zinc stearate, aluminum stearate, etc.), metal oxides (titania, alumina, tin oxide, anthimony oxide, etc.) and fluoropolymers.

Particularly suitable examples of the external additives include, but are not limited to, particulates of hydrophobized silica, titania, titanium oxide and alumina. Specific examples of the silica particulates include, but are not limited to, HDK H 2000, HDK H 2000/4. HDK H 2050EP, HVK21, HDK H 1303 (all manufactured by Sanofi Aventis KK), and R972, R974, RX200, RY200, R202, R805, R812 (all manufactured by NIPPON AEROSIL CO., LTD.). Specific examples of titania particulates include, but are not limited to, P-25 (manufactured by NIPPON AEROSIL CO., LTD.), STT-30, STT-65C-S (manufactured by Titan Kogyo Ltd.), TAF-140 (manufactured by Fuji Titanium Industry Co., Ltd.), and MT-150 W, MT-500B, MT-600B, MT-150A (all manufactured by Tayca Corporation). Especially, as hydrophobized titanium oxide particulates, T-805 (manufactured by NIPPON AEROSIL CO., LTD.), STT-30A, STT-65S-S (all manufactured by Titan Kogyo Ltd.), TAF-500T, TAF-1500T (all manufactured by Fuji Titanium Industry Co., Ltd.), MT-100S, MT-100T (all manufactured by Tayca Corporation) and IT-S (Ishihara Sangyo Kaisha Ltd.).

Hydrophobized inorganic particulates, silica particulates, titania particulates and alumina particulates can be obtained by treatment of hydrophilic particulates with a silane coupling agent, such as methyl trimethoxysilane, methyl triethoxysilane and octyl trimethoxysilane. Silicone oil treated inorganic particulates, can be obtained by treatment of inorganic particulates with silicone oil with optional heating.

Specific examples of the silicone oils include, but are not limited to, dimethyl silicone oil, methylphenyl silicone oil, chlorophenyl silicone oil, methylhydrogen silicone oil, alkyl-modified silicone oil, fluorine-modified silicone oil, polyether modified silicone oil, alcohol-modified silicone oil, amino-modified silicone oil, epoxy-modified silicone oil, epoxy-polyether modified silicone oil, phenol-modified silicone oil, carboxyl-modified silicone oil, mercapto-modified silicone oil, acryl, methacryl-modified silicone oil, and $\alpha$-methylstyrene-modified silicone oil.

As the inorganic particulates, for example, silica and alumina can be used as described above. Among these, silica and titanium dioxide are particularly preferred. In addition, polymer particulates, such as polystyrene, methacrylate copolymers and acrylate copolymers, which are obtained by soap-free emulsification polymerization and suspension polymerization and dispersion polymerization, and polycondensation thermocuring resin particles, such as silicone, benzoguanamine and nylon, can be used.

The fluidizers mentioned above can be surface-treated to improve the hydrophobic property and prevent deterioration of the fluidity characteristics and chargeability under high humidity. Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

As a cleaning property improver by which a developing agent remaining on an image bearing member or a primary transfer medium after transfer is removed, stearic acid, aliphatic metal salts, for example, zinc stearate and calcium stearate, and polymer particulates manufactured by soap-free emulsification polymerization, such as polymethyl methacrylate particulates and polystyrene particulates, can be used. Such polymer particulates preferably have a relatively sharp particle size distribution and a volume average particle size of from 0.01 to 1 μm.

Preferred toner manufacturing methods are described next but the toner manufacturing methods are not limited thereto.

Toner Manufacturing Method (1) A coloring agent, an unmodified polyester resin, a polyester prepolymer having an isocyanate group, and a release agent are dissolved or dispersed in an organic solvent to prepare a toner liquid material.

A suitable preferred organic solvent is a volatile organic solvent having a boiling point lower than 100° C. since such a solvent can be easily removed from the resultant toner particle dispersion.

Specific examples of the organic solvents include, but are not limited to, toluene, xylene, benzene, carbon tetrachloride, methylene chloride, 1,2-dichloroethane, 1,1,2-trichloroethane, chloroform, monochlorobenzene, dichloroethylidene, methyl acetate, ethyl acetate, methyl ethyl ketone, methyl isobutyl ketone, etc. These can be used alone or in combination. In particular, aromatic solvents such as toluene and xylene, and halogenated hydrocarbons such as 1,2-dichloroethane, chloroform and carbon tetrachloride are preferably used.

The addition quantity of the organic solvent is from 0 to 300 parts by weight, preferably from 0 to 100 parts by weight and more preferably from 25 to 70 parts by weight, per 100 parts by weight of the polyester prepolymer used.

(2) Next, the toner liquid material is emulsified in an aqueous medium under the presence of a surface active agent and a particulate resin.

Suitable aqueous media include, but are not limited to, water, and mixtures of water with alcohols (such as methanol, isopropanol and ethylene glycol), dimethylformamide, tetrahydrofuran, cellosolves (such as methyl cellosolve) and lower ketones (such as acetone and methyl ethyl ketone).

The mixing ratio (A/T) of the aqueous medium (A) to the toner liquid material (T) is from 50/100 to 2000/100 by weight, and preferably from 100/100 to 1000/100 by weight. When the content of the aqueous medium is too low, the toner liquid material is not dispersed well, and thereby toner particles having a desired particle diameter are not produced. In contrast, when the content of the aqueous medium is too high, the manufacturing cost of the toner increases.

When the toner liquid material is dispersed in an aqueous medium, a dispersing agent, for example, a surface active agent and resin particulates, can be preferably used to prepare a stable dispersion.

Specific examples of the surface active agents include, but are not limited to, anionic surface active agents such as alkylbenzene sulfonic acid salts, α-olefin sulfonic acid salts, and phosphoric acid salts; cationic surface active agents such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecyldi(aminoethyl)glycin, di)octylaminoethyle)glycin, and N-alkyl-N,N-dimethylammonium betaine.

By using a surface active agent having a fluoroalkyl group, a good dispersion can be prepared even when a small amount of the surface active agent is used. Specific examples of the anionic surface active agents having a fluoroalkyl group include, but are not limited to, fluoroalkyl carboxylic acids having from 2 to 10 carbon atoms and their metal salts, disodium perfluorooctane sulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include, but are not limited to, SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include, but are not limited to, primary, secondary and tertiary aliphatic amino acids, aliphatic quaternary ammonium salts (such as perfluoroalkyl(C6-C10)sulfoneamidepropyltrimethylammonium salts), benzalkonium salts, benzetonium chloride, pyridinium salts, imidazolinium salts, etc., all of which have a fluoroalkyl group Specific examples of commercially available products of these elements include, but are not limited to, SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable resin particles include any known resins that can form an aqueous dispersion. Specific examples of these resins include, but are not limited to, thermoplastic resins and thermosetting resins, such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins, and mixtures thereof are preferably used because an aqueous dispersion including fine spherical particles can be easily prepared.

Specific examples of the vinyl resins include, but are not limited to, polymers which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers and styrene-(meth) acrylic acid copolymers. The average particle diameter of such resin particulate is from 5 to 200 nm and preferably from 20 to 200 nm. In addition, an inorganic dispersing agent can be added to the aqueous medium. Specific examples of the inorganic dispersing agents include, but are not limited to, tricalcium phosphate, calcium carbonate, titanium oxide, colloidal silica, hydroxyapatite, etc.

In addition, an inorganic dispersing agent can be added to the aqueous medium. Specific examples of the inorganic dispersing agents include, but are not limited to, tricalcium phosphate, calcium carbonate, titanium oxide, colloidal silica, hydroxyapatite, etc.

Further, it is possible to stably disperse toner liquid material in an aqueous medium using a polymeric protection colloid in combination with the inorganic dispersing agents and/or particulate polymers mentioned above.

Specific examples of such protection colloids include, but are not limited to, polymers and copolymers prepared by using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds such as methyl cellulose, hydroxyethyl cellulose and hydroxypropyl cellulose, can also be used as the polymeric protective colloid.

The dispersion method is not particularly limited. Low speed shearing methods, high speed shearing methods, friction methods, high pressure jet methods, ultrasonic methods, etc. can be used. Among these methods, high speed shearing methods are preferred because particles having a particle diameter of from 2 to 20 μm can be easily prepared. At this point, the particle diameter (2 to 20 μm) means a particle diameter of particles including a liquid.

When a high speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

(3) At the same time when a toner liquid material is dispersed in an aqueous medium for emulsification, an amine (B) is added to the aqueous medium to conduct reaction with the polyester prepolymer (A) having an isocyanate group.

This reaction accompanies crosslinking and/or elongation of the molecular chains of the polyester prepolymer (A). The reaction time is determined depending on the reactivity of the amine (B) with the polyester prepolymer used, but is typically from 10 minutes to 40 hours, and preferably from 2 to 24 hours. The reaction temperature is from 0 to 150° C., and preferably from 40 to 98° C. In addition, known catalysts, such as dibutyltin laurate and dioctyltin laurate, can be used for the reaction, if desired.

(4) After the reaction, the organic solvent is removed from the resultant dispersion (emulsion, or reaction product), and then the solid components are washed and then dried. Thus, a mother toner is prepared.

To remove the organic solvent, all the system is gradually heated while agitating under laminar flow conditions. Then, the system is strongly agitated in a certain temperature range, followed by solvent removal, to prepare a mother toner having a spindle form.

In this case, when compounds such as calcium phosphate which are soluble in an acid or alkali are used as a dispersion stabilizer, it is preferable to dissolve the compounds by adding an acid such as hydrochloric acid, followed by washing of the resultant particles with water to remove calcium phosphate therefrom. In addition, calcium phosphate can be removed using a zymolytic method.

(5) Subsequently, a charge control agent is fixedly adhered to the mother toner particle. In addition, an external additive such as combinations of a particulate silica and a particulate titanium oxide, is adhered to the mother toner particle to prepare the toner for use in the present invention.

The charge control agent is fixedly adhered and the inorganic particulates are externally added by a typical method using a mixer, etc.

By using this manufacturing method, the resultant toner can have a relatively small particle diameter and a narrow particle diameter distribution. By controlling the strong agitation during the solvent removing process, the shape of the toner can be controlled to have a desired form, i.e., a form between a rugby ball and a true sphere form. In addition, the surface characteristics of the toner can also be controlled to produce a surface having a desired roughness, i.e., a surface that is not too smooth or too rough.

The toner for use in the present invention can be mixed with a magnetic carrier to be used as a two-component developing agent. The density of the toner to the carrier is preferably from 1 to 10% by weight.

Suitable magnetic carriers for use in a two component developer include, but are not limited to, known carrier materials such as iron powders, ferrite powders, magnetite powders, and magnetic resin carriers, which have a particle diameter of from about 20 to about 50 μm. The surface of the carriers may be coated by a resin.

It is preferred to coat the surface of the carriers with a resin layer. Specific examples of such resins include, but are not limited to, amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder can be contained in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

A preferred embodiment of the image forming apparatus of the present invention is described. The hardness of cleaning blade, rebound resilience, polyurethane rubber board, etc. of the image forming apparatus of the present invention are described.

Hardness of Cleaning Blade

The cleaning blade in the present invention preferably has a hardness of from 70 to 80° (JIS-A hardness, JIS K6253 hardness test). When the hardness is too low, the cleaning blade is soft and easily abraded so that toner slips through the gap caused by the abrasion and thus the cleaning performance deteriorates over time. By contrast, when the hardness is too large, the cleaning blade is hard so that the cleaning blade tends to chip off and thus the cleaning performance deteriorates over time.

Therefore, suitable hardness of the cleaning blade in the image forming apparatus of the present invention is from 70 to 80° and preferably from 72 to 75°. It is thereby possible to restrain the deterioration of the cleaning performance over time.

Rebound Resilience of Cleaning Blade

The cleaning blade for use in the present invention preferably has a rebound resilience of from 10 to 35% at 25° C. (JIS K6255 rebound resilience test). Toner easily slips through a cleaning blade that has an excessively low rebound resilience. A cleaning blade that has an excessively high rebound resilience causes strong stick-slip movement in which the blade edge minutely vibrates so that the blade edge tends to chip off over time and toner easily slips through the chip-off portion, resulting in bad cleaning performance.

Therefore, suitable rebound resilience of the cleaning blade for use in the present invention is from 10 to 35% at 25° C. It is thereby possible to restrain the deterioration of the cleaning performance over time.

Manufacturing of Cleaning Blade

The cleaning blade can be made by a known method. For example, a polyurethane rubber board is manufactured by: the process of manufacturing prepolymer in which an isocyanate prepolymer or an isocyanate pseudo prepolymer is manufactured by conducting reaction between a polyol compound and a diisocaynate compound; the process of mixing the isocyanate prepolymer or the isocyanate pseudo prepolymer with a component containing a cross-linking agent and a chain elongation agent to obtain a reactive component; and the process of molding the reactive component into a desired form using a die. The thus obtained urethane rubber is cut into a desired blade form by the cutting process.

The hardness and the rebound resilience vary depending on the kind, the ratio and the cross-linking method of the isocyanate compound and the polyol compound. It is desired to make a suitable adjustment thereto to obtain a polyurethane rubber board having a hardness and a rebound resilience in the range suitable for the present invention.

The cleaning blade in an embodiment of the present invention has a thickness of 2 mm and is attached to an iron substrate having a thickness of 1 mm with a hot-melt adhesive agent.

According to the present invention, a tandem type image forming apparatus and an image forming method having at least two image bearing members, charging devices, irradiation devices and transfer devices are provided. Thereby, full color quality images can be obtained in a relatively extremely short time in comparison with the case of a single drum type image forming apparatus.

In addition, the image forming apparatus according to the present invention is an image forming apparatus having an intermediate transfer device by which a toner image developed on an image bearing member and primarily transferred to an intermediate transfer body is secondarily transferred to a recording medium. The image forming apparatus can provide quality images having a good color alignment by forming a color image by sequentially overlapping multiple toner images having respective colors atop and secondarily transferring the color image to a recording medium at one time.

The configuration having an intermediate transfer body improves the free latitude of the configuration inside the image forming apparatus, which leads to size reduction and improvement in maintenance.

Image Forming Method and Image Forming Apparatus

The image forming method and the image forming apparatus of the present invention are described with reference to accompanying drawings.

The image forming method and the image forming apparatus of the present invention are an image forming method and an image forming apparatus which use an image bearing member having a flat charge transport surface cross-linking layer and include processes of charging, image irradiation and development around the image bearing member followed by a process of transferring a toner image to an image bearing body (e.g., transfer paper), a process of fixing the image thereon and a process of cleaning the surface of the image bearing member.

Figure 5:
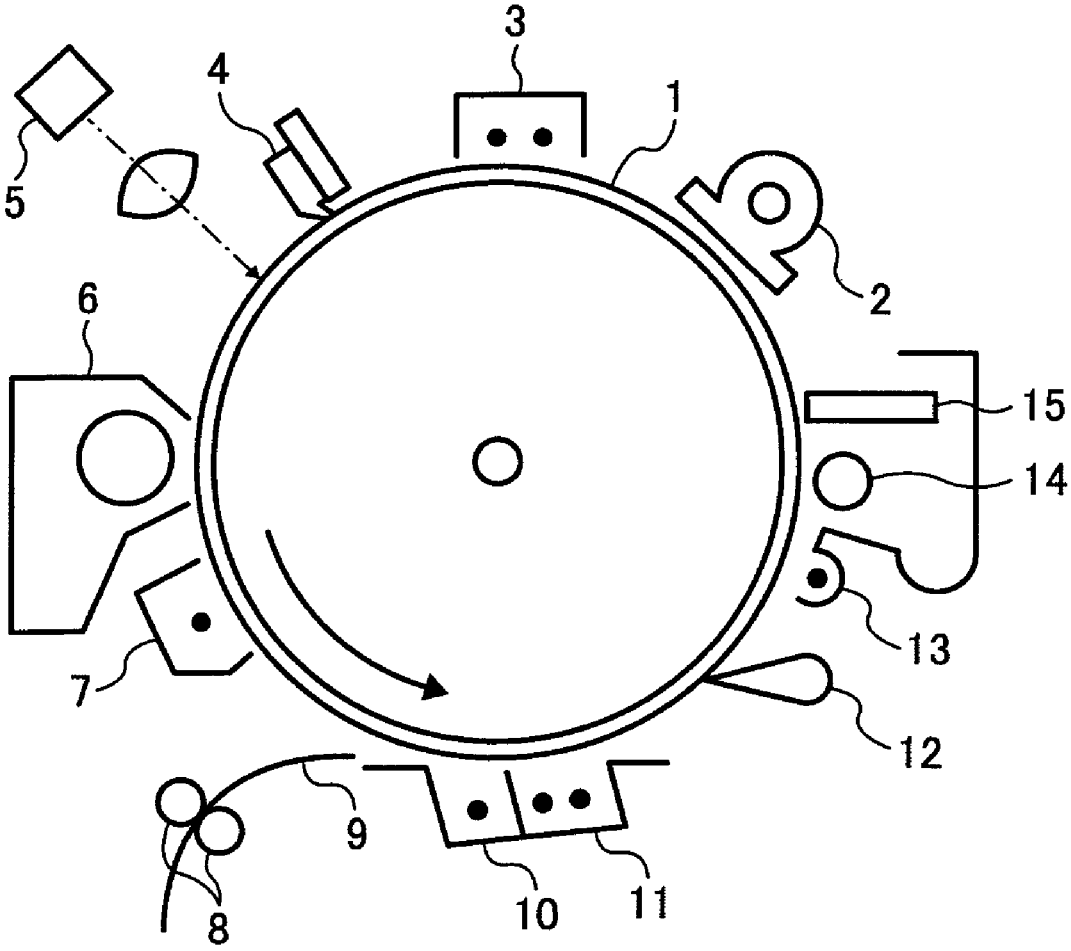
FIG. 5 is a schematic diagram illustrating an example of an image forming apparatus relating to an embodiment of the present invention.

FIG. 5 is a schematic diagram illustrating an example of the image forming apparatus. As a device to uniformly charge an image bearing member, a charging device (charger) 3 is used. Specific examples of the charging device 3 that can be used include, but are not limited to, a corotoron device, a scorotron device, a solid discharging element, a needle electrode device, a roller charging device and an electroconductive brush device, and any known system can be used.

In particular, the structure of the present invention is effective in the case of contact type charging system or non-contact and proximity type charging system, by which the composition of an image bearing member may be dissolved. The contact type charging system is a charging system in which a charging roller, a charging brush, a charging blade, etc., is brought into direct contact with an image bearing member. The non-contact and proximity charging system is that, for example, a charging roller and an image bearing member are arranged to have a gap of not greater than 200 μm therebetween, i.e., not in a contact state. When this gap is too wide, the charging tends to be not stable. When the space is too narrow, the surface of a charging device may be contaminated by toner remaining on an image bearing member. Therefore, this gap is suitably from 10 to 200 μm and preferably from 10 to 100 μm. In addition, it is preferred that a direct voltage with which at least an alternate voltage is overlapped is applied to a charging device.

Next, an image irradiation portion 5 is used to form a latent electrostatic image on the image bearing member 1 which has been uniformly charged. As the light source, typical luminescent materials, such as a fluorescent lamp, a tungsten lamp, a halogen lamp, a mercury lamp, a sodium lamp, a luminescent diode (LED), a semi-conductor laser (LD) and electroluminescence (EL), can be used. Various kinds of filters, such as a sharp cut filter, a band pass filter, an infrared cut filter, a dichroic filter, a coherency filter and a color conversion filter, can be used to irradiate the image bearing member 1 with light having only a desired wavelength.

Next, to visualize a latent electrostatic image formed on the image bearing member 1, a developing unit 6 is used. As the developing method, there are a single component developing method and a two component developing method using a dry toner, and a wet developing method using a wet toner. When the image bearing member is positively (negatively) charged and image irradiation is performed, a positive (negative) latent electrostatic image is formed on the surface of the image bearing member 1. When this positive (negative) latent electrostatic image is developed with a toner (electric detecting particulates) having a negative (positive) polarity, a positive image is obtained. When the image is developed with a toner having a positive (negative) polarity, a negative image is obtained.

Next, a transfer charging device 10 is used to transfer the visualized toner image on the image bearing member 1 to a transfer medium 9. In addition, to perform a good transferring, a pre-transfer charging device 7 can be used. As the transfer device, an electrostatic transfer system using a transfer charging device or a bias roller, a mechanical transfer system using an adhesive transfer method or a pressure transfer method, and a magnetic transfer system can be used. As the electrostatic transfer system, the same device specified for the charging device 3 can be used.

Next, as a device to separate the transfer medium 9 from the image bearing member 1, a separation charging device 11 and a separation claw 12 are used. As other separating devices, electrostatic absorption guiding separation, side end belt separation, front end grip transfer, curvature separation, etc., can be used. As the separation charging device 11, the device specified for the charging device 3 can be used.

Next, after transfer, to remove the toner remaining on the image bearing member 1, a fur brush 14 and a cleaning blade 15 are used. As described above, the cleaning blade 15 preferably has a hardness of from 70 to 80° (according to JIS-A hardness, JIS K6253 hardness test) and a rebound resilience of from 10 to 35% at 25° C. (according to JIS K6255 rebound resilience test).

In addition, to efficiently perform cleaning, a pre-cleaning charging device 13 can be used. Other cleaning devices, such as a web-system device and a magnet brush system device, can be also used. These cleaning devices can be used alone or in combination.

Next, if desired, a discharging device is used to remove the latent electrostatic image on the image bearing member 1. A discharging lamp 2 and a discharging charger can be used as the discharging device. The devices specified for the irradiation light sources and the charging devices can be used as the discharging device.

In the processes of scanning originals, paper feeding, fixing images, discharging recording media, etc., which are performed not in the vicinity of the image bearing member 1, known devices can be used.

Figure 6:
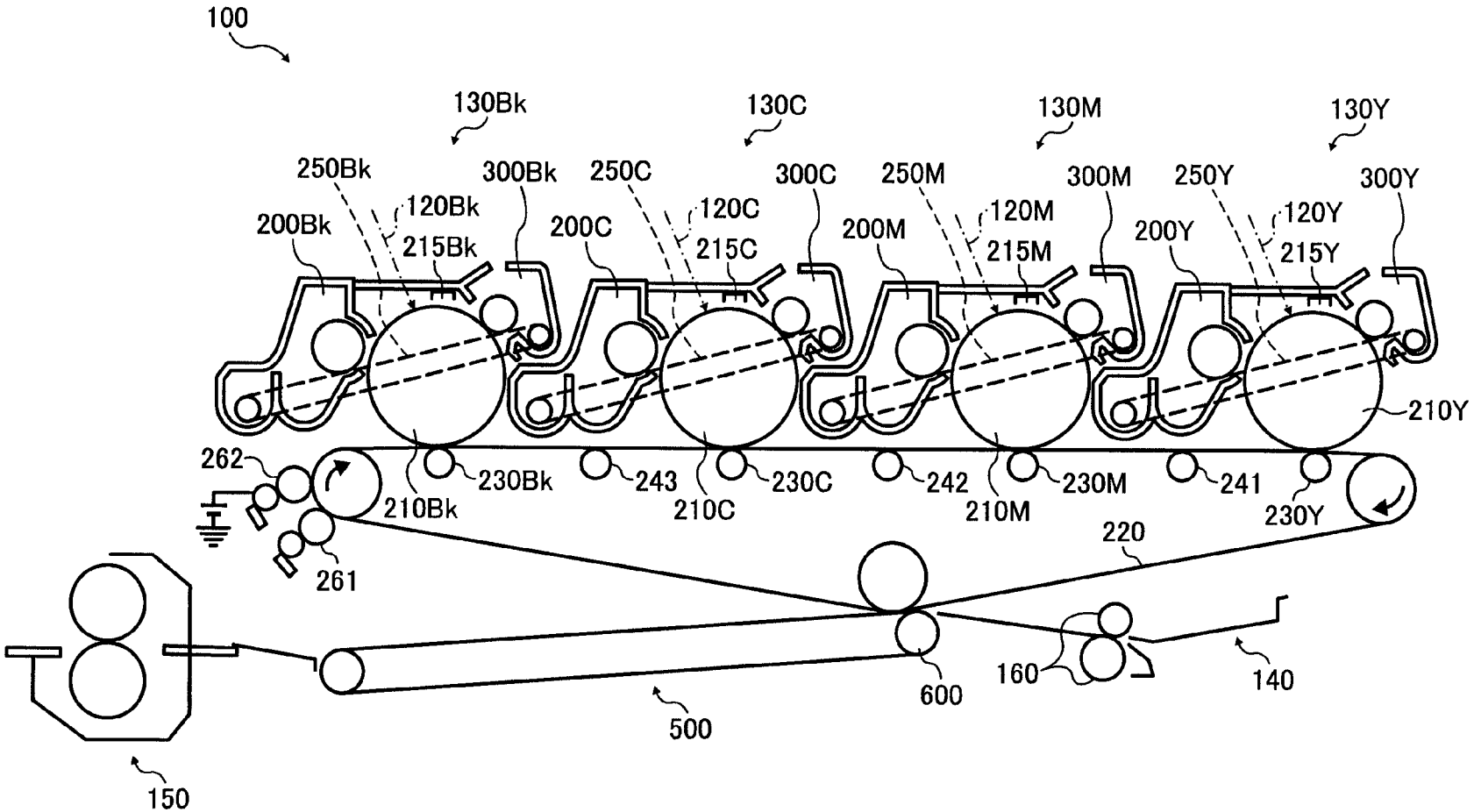
FIG. 6 is a schematic diagram illustrating an example of an image forming apparatus relating to another embodiment of the present invention.

As the image forming apparatus of the present invention, for example, an image forming apparatus having an intermediate transfer device as illustrated in FIG. 6 can be used.

In FIG. 6, a main body 100 is mainly formed of image writing units irradiating the image bearing members 210Bk, 210C, 210M and 210Y with laser beams 120Bk, 120C, 120M and 120Y, image forming units 130 Bk, 130C, 130M and 130Y, and a paper feeder 140. Image processing is performed at an image processing unit (not shown) based on the image signals, and the image signals are converted into respective color signals of black (Bk), cyan (C), magenta (M) and yellow (Y) and transmitted to the image writing units. The image writing units are, for example, a laser scanning optical system formed of a laser beam source, a deflector, for example, a polygon mirror, a scanning image focus optical system and a group of mirrors (all are not shown) with four respective writing paths corresponding to the respective color signals, and writes images on the image forming units 130 Bk, 130C, 130M and 130Y according to the respective color signals.

The image forming units 130 Bk, 130C, 130M have respective image bearing members 210Bk, 210C, 210M and 210Y for black, cyan, magenta and yellow. For each of the image bearing members 210Bk, 210C, 210M and 210Y, the image bearing member having a cross-linked surface layer related to the present invention is used. Around the respective image bearing members 210Bk, 210C, 210M and 210Y, charging devices 215Bk, 210C, 215M and 215Y, irradiation portions of laser beams 120Bk, 120C, 120M and 120Y from the image writing units, development devices 200BK, 200C, 200M and 200Y for respective colors, primary transfer devices 230BK, 230C, 230M and 230Y, cleaning devices 300BK, 300C, 300M and 300Y and discharging devices (not shown) are arranged. In the development devices 200BK, 200C, 200M and 200Y, a two-component magnetic brush development system is used. In addition, there is provided an intermediate transfer belt between the image bearing members 210Bk, 210C, 210M and 210Y and primary transfer devices 230BK, 230C, 230M and 230Y. Respective color toner images are sequentially transferred from each image bearing member and overlapped on the intermediate transfer belt 220.

There are provided electroconductive rollers, 241, 242 and 243 between primary transfer devices 230BK, 230C, 230M and 230Y. A transfer paper is fed from the paper feeder 140 and through a pair of registration rollers and borne on a transfer belt 500. At the point where the intermediate transfer belt 220 and the transfer belt 500 meet, the toner image on the intermediate transfer belt 220 is transferred to the transfer paper by a secondary transfer roller 600. A color image is thus formed on the transfer paper.

The transfer paper after image transfer is conveyed to a fixing device by the transfer belt 500, where the color image is fixed. Toner remaining on the intermediate transfer belt 220 is removed by an intermediate transfer cleaning device having electroconductive fur brushes 261 and 262.

The polarity of the toner on the intermediate transfer belt 220 before transferred to the transfer paper is the same polarity, i.e., negative polarity, as that at development. Therefore, a positive transfer bias is applied to the secondary transfer roller 600 and the toner is transferred to the transfer paper. The nip pressure at this point affects the transferability, which has a large impact on the fixability. In addition, the toner remaining on the intermediate transfer belt 220 is dischargingly charged on the positive polarity side, i.e., from 0 to plus voltage, at when the transfer paper and the intermediate transfer belt 220 are detached from each other. The toner image formed during paper jamming or in a non-image area is not affected by the secondary transfer so that the toner image is still on the negative polarity side.

In this embodiment, the layer thickness of photosensitive layer of the image bearing member is 30 μm, the beam spot diameter of the optical system is 50×60 μm, and the amount of light is set to be 0.47 mW. In the development process, the charging voltage (on the irradiation side) V0 of the image bearing member 210Bk is −700 V, the voltage VL after irradiation is −120 V, and the development bias voltage is set to be −470 V, namely, the development potential is 350 V. The visualized black toner image formed on the image bearing member 210Bk is completed as the image after the transfer process (to intermediate transfer belt and transfer paper) and the fixing process. The image is firstly transferred from the primary transfer devices 230Bk, 230C, 230M and 230Y to the intermediate transfer belt 220 for all colors and then transferred to the transfer paper by application of bias voltage to the secondary transfer roller 600.

The next process is about a cleaning device for an image bearing member. In FIG. 6, each of the development devices 200BK, 200C, 200M and 200Y are connected to each of the cleaning devices 300BK, 300C, 300M and 300Y via each of toner transfer tubes 250BK, 250C, 250M and 250Y (shown by dotted lines in FIG. 6). A screw (not shown) is provided in each of the toner transfer tubes 250BK, 250C, 250M and 250Y and thereby the toner retrieved by the cleaning devices 300BK, 300C, 300M and 300Y is transferred to the development devices 200BK, 200C, 200M and 200Y.

In the typical direct transfer system, which has a combination of four image bearing member drums and belt transfer, the image bearing member and the transfer paper are in contact with each other directly. Therefore, the retrieved toner contains paper dust and thus is not suitable for image formation because the paper dust causes image deterioration, for example, toner drop. Furthermore, in the typical system having a combination of a single image bearing member drum and intermediate transfer, such paper dust attachment to the image bearing member does not occur but it is practically impossible to separate color mixed toner retrieved from the surface from the image bearing member. There is a proposal that the color mixed toner should be used as black toner. However, all the color toners do not appear as black when mixed. Therefore, the color of an image varies depending on print modes so that this typical system is not suitable for recycling toner.

To the contrary, in the printer according to the present invention, the intermediate transfer belt 220 is used, meaning there is little paper dust comingling and the paper dust attachment to the intermediate transfer belt 220 during image transfer to the transfer paper is prevented. Each of the image bearing members 210Bk, 210C, 210M and 210Y uses independent color so that it is unnecessary to attach and detach each of the cleaning devices 300BK, 300C, 300M and 300Y. Therefore, only toner can be retrieved.

The positively charged toner remaining on the intermediate transfer belt 220 is removed by the electroconductive fur brush 262 which is negatively charged. The voltage application method to the electroconductive fur brush 262 is identical to that for the electroconductive fur brush 261 except for the polarity. The residual toner that has not been transferred is almost all removed by the two electroconductive fur brushes 261 and 262. Toner, paper dust, talc, etc. remaining on the image bearing member which has not been removed by the two electroconductive fur brushes 261 and 262 is negatively charged by the electroconductive fur brush 262. The next black color toner primary transfer is positively transferred and the negatively charged toner, etc. are attracted to the intermediate transfer belt 220 so that the transfer of the toner, etc. to the image bearing member 210Bk is prevented.

The intermediate transfer belt 220 for use in an embodiment of the present invention is described next. As described above, it is preferred that that intermediate transfer belt has a single resin layer. Optionally, an elastic layer and a surface layer can be formed.

Specific examples of the resin material forming the above-mentioned resin layer include, but are not limited to, polycarbonate, fluorine containing resin (ETFE and PVDF), polystyrene and polystyrene based resins (monopolymers or copolymers containing styrene or styrene substituent): chloropolystyrene, poly-α-methylstyrene, styrene-butadiene copolymers, styrene-vinyl chloride copolymers, styrene-vinyl acetate copolymers, styrene-maleic acid copolymers, styrene-acrylate copolymers (styrene-methylacrylate copolymers, styrene-ethylacrylate copolymers, styrene-butylacrylate copolymers, styrene-octylacrylate copolymers, and styrene-phenylacrylate copolymers), styrene-methacrylate copolymers (styrene-methylmethacrylate copolymers, styrene-ethylmethacrylate copolymers, and styrene-phenylmethacrylate copolymers), styrene-α-chloro methylacrylate copolymers, styrene-acrylonitrile-acrylate copolymers); methyl methacrylate resins, butyl methacrylate resins, ethyl acrylate resins, butyl acrylate resins, modified acryl resins (silicone-modified acryl aresins, vinyl chloride resin modified acryl resins and acryl urethane resins), vinyl chloride resins, styrene-vinylacetate copolymers, vinyl chloride-vinyl acetate copolymers, rosin-modified maleic acid resins, phenol resins, epoxy resins, polyester resins, polyester polyurethane resins, polyethylene, polypropylene, polybutadiene, polyvinylidene chloride, ionomer reins, polyurethane resins, silicone resins, ketone resins, ethylene-ethylacrylate copolymers, xylene resins and polyvinyl butyral resins, polyamide resins, and modified polyphenylene oxide resins. These can be used alone or in combination.

Specific examples of the elastic material forming the elastic layers mentioned above include, but are not limited to, butyl rubber, fluorine containing rubber, acryl rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorosulfonated polyethylene, silicone rubber, fluorine rubber, polysulfide rubber, polynorbornene rubber, hydrogenerated nitrile rubber, and thermoplastic elastomer (e.g., polyethylene-based, polyolefin-based, polyvinyl chloride-based, polyurethane-based, polyamide-based, polyurea-based, polyester-based, or fluorine resin based elastomers). These can be used alone or in combination.

There is no specific limit to the materials for the surface layer mentioned above. It is preferred to use a material that can reduce the adhesive force of toner to the surface of the intermediate transfer belt 220 to improve the secondary transfer property. For example, polyurethane, polyester and/or epoxy resins can be used and to reduce the surface energy and improve the lubrication property, for example, powder of particles of fluorine resins, fluorine compounds, fluorine carbide, titanium dioxide and/or silicon carbide can be dispersed therein. The powder and the particles can have different diameters. It is also possible to use a material that can form a fluorine rich layer by thermal treatment to reduce the surface energy like a fluorine-based rubber material.

To the resin layer and the elastic layer mentioned above, an electroconductive agent for adjusting a resistance value is added. There is no specific limit to the electroconductive agent for adjusting a resistance value. Specific examples thereof include, but are not limited to, carbon black, graphite, metal powder of aluminum and nickel, and electroconductive metal oxides, such as tin oxide, titanium oxide, anthimony oxide, indium oxide, potassium oxide, complicated oxides of anthimony oxide and tin oxide (ATO), and complicated oxides of indium oxide and tin oxide (ITO). The electroconductive metal oxides can be covered with insulating particulates, such as barium sulfide, magnesium silicate, and calcium carbide.

Figure 7:
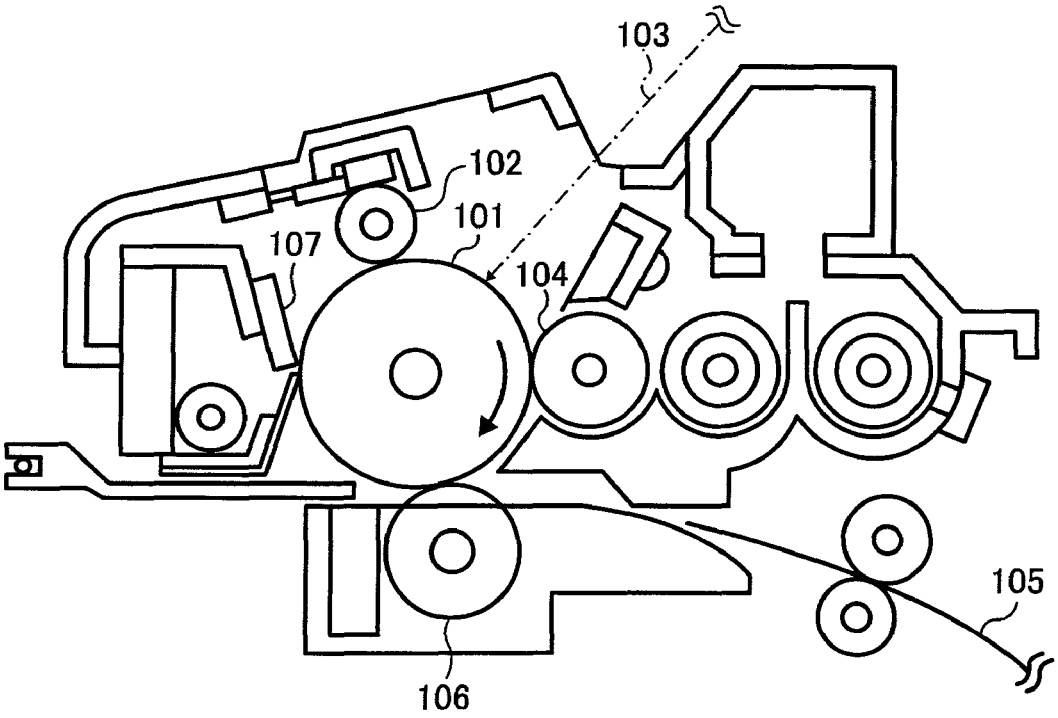
FIG. 7 is a schematic diagram illustrating an example of a process cartridge for use in an image forming apparatus related to an embodiment of the present invention.

The present invention provides the image forming method and the image forming apparatus using the image bearing member having the cross-linked surface layer on a photosensitive layer as the image forming device. This image forming device can be dispersed in a photocopier, a facsimile machine, a printer, etc. in a fixed manner or can be detachably attached thereto as the form of a process cartridge. FIG. 7 is a diagram illustrating an example of such a process cartridge.

The process cartridge for use in an image forming apparatus is a device (part) detachably attached to the main body of an image forming apparatus and has an image bearing member 101 and at least one optional device selected from a charging device 102, a developing device 104, a transfer device 106, a cleaning device 107 and a discharging device (not shown).

The image formation process by the device illustrated in FIG. 7 is as follows: an irradiation image and a latent electrostatic image corresponding thereto are formed on the surface of the image bearing member 101 by charging and irradiation light 103 by a charging device 102 and an irradiation device (not shown) while the image bearing member 101 is in rotation in the direction indicated by the arrow in FIG. 7; the latent electrostatic image is developed with toner by a developing device 104; the toner image is transferred to a transfer body 105 by the transfer device 106 and then printed; the surface of the image bearing member 101 is cleaned by a cleaning device 107 after image transfer; and the image bearing member 101 is discharged by a discharging device (not shown) to be ready for the next cycle.

The process cartridge of the present invention has an image bearing member having a flat charge transport cross-linked surface layer and at least a developing device and a cleaning device.

Figure 8:
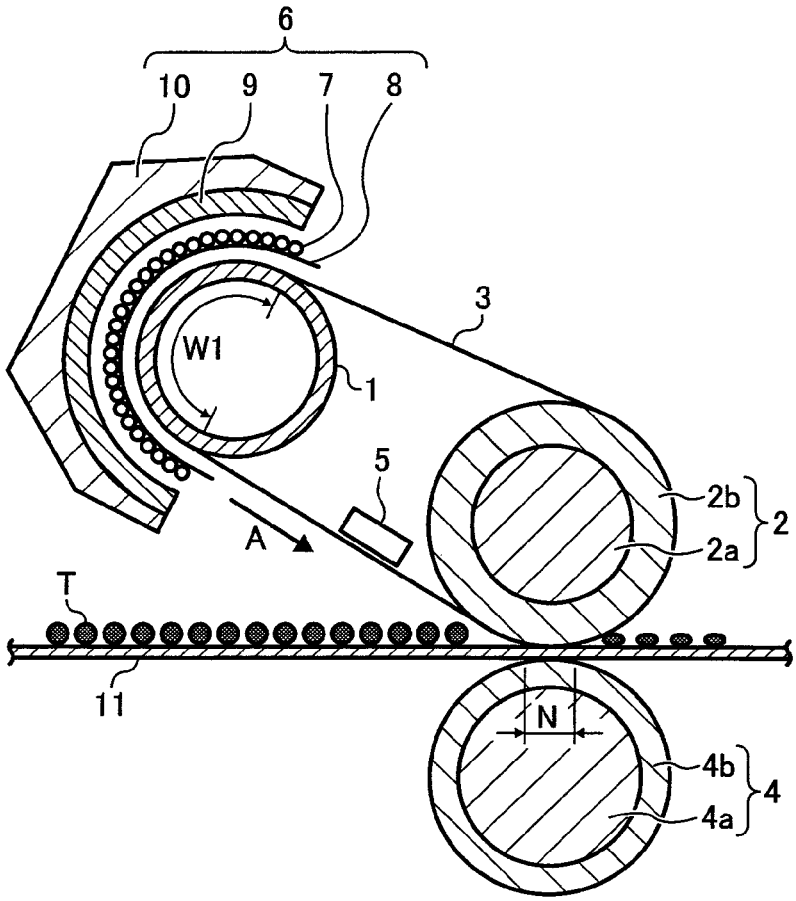
FIG. 8 is a schematic diagram illustrating an example of a fixing device according to an embodiment of the represent invention.

An example of the fixing device for use in the image forming method of the present invention is illustrated in FIG. 8.

The fixing device illustrated in FIG. 8 includes a heating roller 1 heated by electromagnetic induction of a heat induction device 6, a fixing roller 2 (opposing rotationary body) disposed in parallel with the heating roller 1, an endless heat resistant belt (a medium for heating toner) which is suspended over the heating roller 1 and the fixing roller 2 and heated by the heating roller 1 and rotationally driven by the rotation of either of these rollers in the direction indicated by the arrow A, and a pressing roller 4 (pressing rotary body) which is pressed against the fixing roller 2 via the belt 3 and rotates forward with the belt 3.

The pressing roller 1 is formed of a hollow magnetic metal, such as iron, cobalt, nickel or alloys thereof and has an outer diameter of from 20 to 40 mm with a thickness of, for example, from 0.3 to 1.0 mm. The pressing roller 1 has a low heat capacity and thus the rising speed of the temperature thereof is high.

The fixing roller 2 (opposing rotationary body) is formed of a metal core 2*a* made of, for example, stainless steel, and an elastic member 2*b* formed of heat resistant silicone rubber having a solid form or foam form by which the metal core 2*a* is covered. The fixing roller 2 has an outer diameter of from about 20 to about 40 mm and is made to be larger than the pressing roller to form a contact portion having a particular width between the pressing roller 4 and the fixing roller 2 by the pressure from the pressing roller 4. The elastic member 2*b* has a thickness of from about 4 to 6 mm. In this configuration, the heat capacity of the heating roller 1 is lower than that of the fixing roller 2 so that the heating roller 1 is rapidly heated and the warm-up time is short.

The belt 3 suspended over the heating roller 1 and the fixing roller 2 is heated at a contact portion W1 contacting with the heating roller 1 heated by the heat induction device 6. As the rollers 1 and 2 rotate, the inside of the belt 3 is continuously heated and thus the entire belt is heated.

Figure 9:
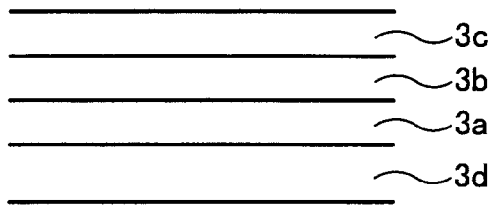
FIG. 9 is a schematic diagram illustrating an example of the layer structure of a belt for use in an embodiment of the fixing device of the present invention.

The structure of the belt 3 is illustrated in FIG. 9. The structure of the belt 3 is as follows, i.e., the following 4 layers from the inside to the surface:

Substrate 3*d*: resin layer: polyimide (PI) resin, etc.

Heat generation layer 3*a*: Ni, Ag, SUS, etc. are used as the electroconductive material Intermediate layer 3*b*: aimed for uniform fixing by this elastic layer Surface layer (Releasing layer) 3*c*: made of fluorine resin material and aimed for obtaining releasing effect and oilless performance The surface layer 3*c* is desired to have a thickness of from about 10 to about 300 μm and preferably about 200 μm. In this structure, a toner image T formed on a transfer material 11 is sufficiently rolled up by the surface portion of the belt 3 so that the toner image T can be uniformly fused.

The surface layer 3, i.e., the releasing layer 3*c*, is desired to have a thickness of at least 10 μm to secure the anti-abrasion property over time.

In addition, when the surface layer 3*c* is too thick, the heat capacity of the belt 3 increases, resulting in elongation of the warm-up time. In addition, the temperature of the belt surface does not easily drop during the toner fixing process so that the agglomeration effect of fused toner at the exit of the fixing portion is not obtained. Thus, the releasing property of the belt deteriorates and the toner is attached to the belt, namely, hot offset occurs.

As the base material of the belt 3, instead of the heat generation layer 3*a* made of the metal mentioned above, there can be used a resin layer containing a resin having heat resistance property, such as fluorine resins, polyimide resins, polyamide resins, polyamide imide resins, PEEK resins, PES resins and PPS resins.

The pressing roller 4 is formed of a metal core 4*a* having a cylindrical metal portion having a high heat conductance, such as copper or aluminum, and an elastic member 4*b* formed on the surface of the metal core 4*a* which has a high heat resistance and a good toner releasing property. It is also possible to use SUS for the metal core 4*a* in addition to the metals mentioned above. The pressing roller 4 presses the fixing roller 2 with the belt 3 therebetween and forms a nip portion N for fixing. In this embodiment, the pressing roller 4 is harder than the fixing roller 2 and thus bites into the fixing roller 2 and the belt 3. According to this biting, a recording medium 11 moves along the circumference form of the surface of the pressing roller 4 and thus, the recording medium 11 is easily detached from the surface of the belt 3. The outer diameter of the pressing roller 4 is about the same as that of the fixing roller, i.e., from about 20 to about 40 mm. The thickness of the pressing roller 4 is from about 0.5 to 2.0 mm, which is thinner than that of the fixing roller 2.

As illustrated in FIG. 8, the heat induction device 6, which heats the heating roller 1 by electromagnetic induction, includes an exciting coil 7, and a coil guide plate 8 around which the exciting coil is wrapped. The coil guide plate 8 has a semicylindrical form and is provided in the vicinity of the outer surface of the heating roller 1. The exciting coil 7 is a long exciting coil line material alternately wrapped along the coil guide plate 8 in the axis direction of the heating roller 1. The exciting coil 7 is connected to the driving power source (not shown) having an oscillation circuit having variable frequencies. Outside the exciting coil 7, an exciting coil 9 having a half cylindrical form which is made of a strong magnetic material, such as ferrite, is provided in the vicinity of the exciting coil 7 and fixed to an exciting coil core support material 10.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, toners for use in evaluation are specified. The toner of the present invention is not limited thereto.

Toner 1

Synthesis of Organic Particulate Emulsion

The following recipe is placed in a reaction container equipped with a stirrer and a thermometer and the mixture is agitated for 30 minutes at a revolution of 3,800 rpm to obtain a white emulsion.

| | |
|---|---|
| Water | 683 parts |
| Sodium salt of sulfate of an adduct of methacrylic acid with ethyleneoxide (EREMINOR RS-30 manufactured by Sanyo Chemical Industries Ltd.) | 11 parts |
| Methacrylic acid | 166 parts |
| Butyl acrylate | 110 parts |
| Ammonium persulfate | 1 part |

The emulsion is heated at 75° C. to conduct reaction for 4 hours. Then, 30 parts of a 1% aqueous solution of ammonium persulfate are added to the emulsion and the mixture is further aged for 6 hours at 75° C. Thus, an aqueous liquid dispersion (particulate liquid dispersion 1) of a vinyl based resin (i.e., a copolymer of methacrylic acid, butyl acrylate and sodium salt of sulfate of an adduct of methacrylic acid with ethyleneoxide) is obtained. The volume average particle diameter of the particulate liquid dispersion 1 is 110 nm when measured by LA-920. Part of the particulate liquid dispersion 1 is dried and the resin portion thereof is separated. Tg of the separated resin is 58° C. and the weight average molecular weight is 130,000.

Preparation of Aqueous Phase

Eighty three (83) parts of the particulate liquid dispersion 1 are mixed and stirred with the following components to obtain a milky white liquid, which is defined as aqueous phase 1:

| | |
|---|---|
| Water | 990 parts |
| 48.3% aqueous solution of sodium dodecyldiphenyletherdisulfonate (EREMINOR MON-7 from Sanyo Chemical Industries, Ltd.) | 37 parts |
| Ethyl acetate | 90 parts |

Preparation of Aqueous Solution of Fluorine Based Active Agent

Ten (10) parts of N,N,N-trimethyl-[3-(4-perfluorononenyloxydo benzamide)propyl]ammonium iodide (FTERGENT 310, manufactured by Neos Company Limited.) and 297 parts of methanol are placed in a vessel, heated to 50° C. and agitated until the liquid is transparent. The obtained fluorine based active agent methanol solution is dropped to 693 parts of deionized water while the deionized water is being stirred and thereafter stirred at 50° C. for 30 minutes to obtain fluorine based active agent 1.

Synthesis of Low Molecular Weight Polyester

The following components are contained in a reaction container equipped with a condenser, stirrer and a nitrogen introducing tube to conduct a reaction at 230° C. for 7 hours followed by another reaction with a reduced pressure of 10 to 15 mmHg for 5 hours:

| | |
|---|---|
| Adduct of bisphenol A with 2 mol of ethylene oxide | 229 parts |
| Bisphenol A with 3 mole of propylene oxide | 529 parts |
| Terephthalic acid | 208 parts |
| Adipic acid | 46 parts |
| Dibutyl tin oxide | 2 parts |

Forty four (44) parts of trimellitic anhydride is added in the container to conduct a reaction at 180° C. under normal pressure for 3 hours and obtain low molecular weight polyester 1. The low molecular weight polyester 1 has a number average molecular weight of 2,300, a weight average molecular weight of 6,700, a glass transition temperature of 43° C. and an acid value of 25 mgKOH/g.

Synthesis of Intermediate Polyester

The following components are contained in a container equipped with a condenser, a stirrer and a nitrogen introducing tube to conduct a reaction at 230° C. at normal pressure for 7 hours followed by another reaction for 5 hours with a reduced pressure of 10 to 15 mmHg to obtain intermediate polyester 1:

| | |
|---|---|
| Adduct of bisphenol A with 2 mol of ethylene oxide | 682 parts |
| Bisphenol A with 2 mole of propylene oxide | 81 parts |
| Terephthalic acid | 283 parts |
| Trimellitic anhydrate | 22 parts |
| Dibutyl tin oxide | 2 parts |

The intermediate polyester 1 has a number average molecular weight of 2,200, a weight average molecular weight of 9,700, a glass transition temperature of 54° C., an acid value of 0.5 mgKOH/g and a hydroxyl value of 52 mgKOH/g.

The following components are placed in a container equipped with a condenser, a stirrer and a nitrogen introducing tube to conduct a reaction at 100° C. for 5 hours and prepolymer 1 is obtained:

| | |
|---|---|
| Intermediate polyester 1 | 410 parts |
| Isophorone diisocyanate | 89 parts |
| Ethyl acetate | 500 parts |

The prepolymer 1 has an isolated isocyanate weight % of 1.53%.

Synthesis of Ketimine

In a reaction container equipped with a stirrer and a thermometer, 170 parts of isophoronediamine and 75 parts of methyl ethyl ketone are mixed to conduct reaction at 50° C. for 4 and a half hours and ketimine compound 1 is obtained. The amine value of the ketimine compound 1 is 417.

Synthesis of Master Batch (MB)

One thousand two hundred (1200) parts of water, 540 parts of carbon black (Printex 35 from Degussa AG) which has a dibutyl phthalate (DBP) oil absorption of 42 ml/100 mg and has a PH of 9.5, and 1200 parts of a polyester resin are added and mixed by a HENSCEL mixer (manufactured by Mitsui Mining Company, Limited). This mixture is kneaded for 1 hour at 130° C. using a two-roll mill followed by rolling and cooling down. Thereafter, the kneaded mixture is pulverized by a pulverizer to obtain Master batch 1.

Manufacturing Oil Phase

The following is placed and mixed in a reaction container equipped with a stirrer and a thermometer:

| | |
|---|---|
| Low molecular weight polyester 1 | 378 parts |
| Carnauba wax | 100 parts |
| Ethyl acetate | 947 parts |

The mixture is heated to 80° C. while agitated, and kept at 80° C. for 5 hours and then cooled down to 30° C. in 1 hour. Then, 500 parts of the master batch 1 and 500 parts of ethyl acetate are added to the reaction container and mixed for 1 hour to obtain liquid material 1.

Then, 1,324 parts of the liquid material 1 are transferred to a reaction container and dispersed using a bead mill (ULTRAVISCOMILL from AIMEX) under the following conditions to disperse carbon black and the wax:

Liquid feeding speed: 1 kg/hr

Disc circumference speed: 6 m/sec

Diameter of zirconia beads: 0.5 mm,

Filling factor: 80% by volume

Repeat number of dispersion treatment: 3 times

Next, 1,324 parts of the low molecular weight polyester 1 of 65% by weight of ethyl acetic acid solution are added to the wax liquid dispersion. After 1 pass of the bead mill under the same condition mentioned above, liquid dispersion 1 of pigment and wax is obtained. The solid portion density thereof is 50% (measuring conditions: 130° C. for 30 minutes).

Emulsification and Solvent Removal

The following components are contained in a container and mixed for 2 minutes using a TK HOMOMIXER (manufactured by Tokushu Kika Kogyo Co., Ltd.) at a revolution of 5,000 rpm.

| | |
|---|---|
| Liquid dispersion 1 of pigment and wax | 749 parts |
| Prepolymer 1 | 115 parts |
| Ketimine compound | 2.9 parts |

Then, 1200 parts of the aqueous phase 1 are added thereto followed by mixing for 25 minutes at a revolution of 13,000 rpm using the TK HOMOMIXER to prepare emulsion slurry 1. The emulsion slurry 1 is placed in a container equipped with a stirrer and a thermometer to remove the solvents at 30° C. for 8 hours. Thereafter, the resultant is aged at 45° C. for 7 hours to obtain slurry dispersion 1.

Washing, Flourine Active Agent Treatment, Drying and Wind Sieving

One hundred (100) parts of the slurry dispersion 1 are filtered under a reduced pressure followed by the operations below.

(1) 100 parts of deionized water are added to the thus prepared filtered cake and the resultant is mixed for 10 minutes at a rotation of 12,000 rpm by a TK HOMOMIXER and then filtered;

(2) 100 parts of 10% sodium hydroxide aqueous solution are added to the filtered cake prepared in (1) and the resultant is mixed for 30 minutes at a rotation of 12,000 rpm by a TK HOMOMIXER and then filtered under a reduced pressure;

(3) 100 parts of a 10% hydrochloric acid are added to the filtered cake prepared in (2) and the resultant is mixed for 10 minutes at a rotation of 12,000 rpm by a TK HOMOMIXER and then filtered;

(4) 300 parts of deionized water are added to the filtered cake prepared in (3) and the resultant is mixed for 10 minutes at a rotation of 12,000 rpm by a TK HOMOMIXER and then filtered. This washing is repeated twice to obtain filtered cake 1; and.

(5) 630 parts of the filtered cake 1 and 2,928 parts of deionized water are placed in a container and stirred at a rotation of 400 rpm for 5 minutes by a three one motor (manufactured by Shinto Kagaku KK) followed by heating to 30° C. While keeping the rotation and the temperature, 11 parts of the fluorine active agent aqueous solution 1 is dropped thereto. Subsequent to 60 minute stirring and filtration, filtered cake 1 after fluorine active agent treatment is obtained.

The filtered cake 1 after fluorine active agent treatment is dried at 45° C. for 48 hours using a circulating drier. The obtained dried cake is filtered using a screen having a mesh of 75 μm and thus a toner is obtained.

One hundred (100) parts of the obtained toner are mixed with 0.1 parts of silica fine powder (hexamethyl disilazane treated) having an average particle diameter of 0.015 μm, 0.1 parts of titanium oxide fine powder (isobutyl trimethoxy silane treatment) having an average particle diameter of 0.015 μm and 1.0 parts of silica fine powder (hexamethyl disilazane treated) having an average particle diameter of 0.140 μm by a HENSCHEL MIXER followed by sieving. Toner 1 is thus obtained.

Toner 2

Toner 2 is manufactured in the same manner as in Toner 1 except that the external additives in Toner 1 are replaced with 0.5 parts of silica fine powder (hexamethyl disilazane treated) having an average particle diameter of 0.015 μm, 0.4 parts of titanium oxide fine powder (isobutyl trimethoxy silane treatment) having an average particle diameter of 0.015 μm and 1.0 parts of silica fine powder (hexamethyl disilazane treated) having an average particle diameter of 0.140 μm.

Toner 3

Toner 3 is manufactured in the same manner as in Toner 1 except that the emulsification and solvent removal process is changed to the following and the external additives in Toner 1 are replaced with 0.7 parts of silica fine powder (hexamethyl disilazane treated) having an average particle diameter of 0.015 μm, 0.3 parts of titanium oxide fine powder (isobutyl trimethoxy silane treated) having an average particle diameter of 0.015 μm and 1.2 parts of silica fine powder (hexamethyl disilazane treated) having an average particle diameter of 0.140 μm.

Emulsification and Solvent Removal

The following components are contained in a container and mixed for 2 minutes using a TK HOMOMIXER (manufactured by Tokushu Kika Kogyo Co., Ltd.) at a revolution of 6,000 rpm.

| | |
|---|---|
| Liquid dispersion 1 of pigment and wax | 749 parts |
| Prepolymer 1 | 115 parts |
| Ketimine compound | 2.9 parts |

Then, 1,200 parts of the aqueous phase 1 are added thereto followed by mixing for 10 minutes at a revolution of 13,000 rpm using the TK HOMOMIXER to prepare emulsion slurry 2. The emulsion slurry 2 is placed in a container equipped with a stirrer and a thermometer to remove the solvents at 30° C. for 5 hours. Thereafter, the resultant is aged at 45° C. for 3 hours to obtain slurry dispersion 2.

Toner 4

Toner 4 is manufactured in the same manner as in Toner 3 except that the external additives in Toner 3 are replaced with 0.7 parts of silica fine powder (hexamethyl disilazane treated) having an average particle diameter of 0.015 μm, 0.3 parts of titanium oxide fine powder (isobutyl trimethoxy silane treated) having an average particle diameter of 0.015 μm and 2.2 parts of silica fine powder (hexamethyl disilazane treated) having an average particle diameter of 0.140 μm.

Toner 5

Toner 5 is manufactured in the same manner as in Toner 3 except that the external additives in Toner 3 are replaced with 0.3 parts of silica fine powder (hexamethyl disilazane treated) having an average particle diameter of 0.015 μm, 0.2 parts of titanium oxide fine powder (isobutyl trimethoxy silane treated) having an average particle diameter of 0.015 μm and 1.7 parts of silica fine powder (hexamethyl disilazane treated) having an average particle diameter of 0.140 μm.

Toner 6

Toner 6 is manufactured in the same manner as in Toner 1 except that the emulsification and solvent removal process is changed to the following and the external additives in Toner 1 are replaced with 0.2 parts of silica fine powder (hexamethyl disilazane treated) having an average particle diameter of 0.015 μm, 0.1 parts of titanium oxide fine powder (isobutyl trimethoxy silane treated) having an average particle diameter of 0.015 μm and 1.0 parts of silica fine powder (hexamethyl disilazane treated) having an average particle diameter of 0.140 μm.

Emulsification and Solvent Removal

The following components are contained in a container and mixed for 3 minutes using a TK HOMOMIXER (manufactured by Tokushu Kika Kogyo Co., Ltd.) at a revolution of 6,500 rpm.

| | |
|---|---|
| Liquid dispersion 1 of pigment and wax | 749 parts |
| Prepolymer 1 | 115 parts |
| Ketimine compound | 2.9 parts |

Then, 1200 parts of the aqueous phase 1 are added thereto followed by mixing for 35 minutes at a revolution of 16,000 rpm using the TK HOMOMIXER to prepare emulsion slurry 4. The emulsion slurry 4 is placed in a container equipped with a stirrer and a thermometer to remove the solvents at 30° C. for 8 hours. Thereafter, the resultant is aged at 45° C. for 7 hours to obtain slurry dispersion 4.

Comparative Toner 1

Comparative Toner 1 is manufactured in the same manner as in Toner 1 except that the external additives in Toner 1 are replaced with 0.8 parts of silica fine powder (hexamethyl disilazane treated) having an average particle diameter of 0.015 μm, 0.4 parts of titanium oxide fine powder (isobutyl trimethoxy silane treatment) having an average particle diameter of 0.015 μm and 1.4 parts of silica fine powder (hexamethyl disilazane treated) having an average particle diameter of 0.140 μm.

Comparative Toner 2

Comparative Toner 2 is manufactured in the same manner as in Toner 1 except that the external additives in Toner 1 are replaced with 0.3 parts of silica fine powder (hexamethyl disilazane treated) having an average particle diameter of 0.015 μm, 0.2 parts of titanium oxide fine powder (isobutyl trimethoxy silane treatment) having an average particle diameter of 0.015 μm and 2.8 parts of silica fine powder (hexamethyl disilazane treated) having an average particle diameter of 0.140 μm.

Comparative Toner 3

Comparative Toner 3 is manufactured in the same manner as in Toner 1 except that the emulsification and solvent removal process is changed to the following and the external additives in Toner 1 are replaced with 0.3 parts of silica fine powder (hexamethyl disilazane treated) having an average particle diameter of 0.015 μm, 0.2 parts of titanium oxide fine powder (isobutyl trimethoxy silane treatment) having an average particle diameter of 0.015 μm and 1.7 parts of silica fine powder (hexamethyl disilazane treated) having an average particle diameter of 0.140 μm.

Emulsification and Solvent Removal

The following components are contained in a container and mixed for 2 minutes using a TK HOMOMIXER (manufactured by Tokushu Kika Kogyo Co., Ltd.) at a revolution of 5,000 rpm.

| | |
|---|---|
| Liquid dispersion 1 of pigment and wax | 630 parts |
| Prepolymer 1 | 120 parts |
| Ketimine compound | 3.1 parts |

Then, 1200 parts of the aqueous phase 1 are added thereto followed by mixing for 50 minutes at a revolution of 11,000 rpm using the TK HOMOMIXER to prepare emulsion slurry 3. The emulsion slurry 3 is placed in a container equipped with a stirrer and a thermometer to remove the solvents at 30° C. for 10 hours. Thereafter, the resultant is aged at 45° C. for 10 hours to obtain slurry dispersion 3.

Comparative Toner 4

Comparative Toner 4 is manufactured in the same manner as in Toner 1 except that the external additives in Toner 1 are replaced with 0.5 parts of silica fine powder (hexamethyl disilazane treated) having an average particle diameter of 0.015 μm, 0.1 parts of titanium oxide fine powder (isobutyl trimethoxy silane treatment) having an average particle diameter of 0.015 μm and 0.9 parts of silica fine powder (hexamethyl disilazane treated) having an average particle diameter of 0.140 μm.

Comparative Example 5

Comparative Toner 5 is manufactured in the same manner as in Toner 1 except that the external additives in Toner 1 are replaced with 1.0 parts of silica fine powder (hexamethyl disilazane treated) having an average particle diameter of 0.015 μm, 0.1 parts of titanium oxide fine powder (isobutyl trimethoxy silane treatment) having an average particle diameter of 0.015 μm and 1.0 parts of silica fine powder (hexamethyl disilazane treated) having an average particle diameter of 0.140 μm.

The physical properties of the toners obtained as described above are shown in Table 1.

TABLE 1

| | Volume Average Particle diameter Dv (μm) | Circularity | External additive X (weight %) | External additive Y (weight %) | External additive 3X/5 + Y (weight %) |
|---|---|---|---|---|---|
| Toner 1 | 4.8 | 0.95 | 0.2 | 1.0 | 1.12 |
| Toner 2 | 4.8 | 0.95 | 0.9 | 1.0 | 1.54 |
| Toner 3 | 4.9 | 0.98 | 1.0 | 1.2 | 1.80 |
| Toner 4 | 4.9 | 0.98 | 1.0 | 2.2 | 2.80 |
| Toner 5 | 4.9 | 0.98 | 0.5 | 1.7 | 2.00 |
| Toner 6 | 2.5 | 0.96 | 0.3 | 1.0 | 1.18 |
| Comparative Toner 1 | 4.8 | 0.95 | 1.2 | 1.4 | 2.12 |
| Comparative Toner 2 | 4.8 | 0.95 | 0.5 | 2.8 | 3.10 |
| Comparative Toner 3 | 5.2 | 0.94 | 0.5 | 1.7 | 2.00 |
| Comparative Toner 4 | 4.8 | 0.95 | 0.6 | 0.9 | 1.26 |
| Comparative Toner 5 | 4.8 | 0.95 | 1.1 | 1.0 | 1.66 |

Next is the description about the synthesis example of composition materials of an image bearing member, and the manufacturing examples thereof.

Manufacturing of Image Bearing Member

Manufacturing examples of the image bearing member for use in evaluation are specified first, however, the image bearing member of the present invention is not limited thereto.

Synthesis Example of Compound Having One Functional Group with Charge Transport Structure The compounds having a functional group with a charge transport material in the present invention can be synthesized by a method described in Japanese Patent No. 3164426. The following is an example thereof.

(1) Synthesis of Triaryl Amine Compound (Represented by Chemical Structure B) Substituted by Hydroxy Group 240 ml of sulfolane is added to 113.85 g (0.3 mol) of a methoxy group-substituted triarylamine compound (represented by the chemical structure A), and 138 g (0.92 mol) of sodium iodide. The resultant is heated to 60° C. in nitrogen gas stream. 99 g (0.91 mol) of trimethylchlorosilane is dropped to the resultant solution in one hour. Thereafter, the solution is stirred for 4.5 hours at around 60° C. and the reaction is terminated. To the reaction liquid, approximately 1,500 ml of toluene is added, and the reaction liquid is cooled down to the room temperature followed by repetitive washing with water and a sodium carbonate aqueous solution. Then, the solvent is removed from the toluene solution, and the solution is purified by column chromatography (absorption medium: silica gel; developing solvent: toluene:ethyl acetate=20:1). Cyclohexane is added to the obtained cream-colored oil to precipitate crystal. Thus, 88.1 g (yield constant: 80.4%) of white-color crystal represented by the following chemical structure B is obtained.

Melting point: 64.0 to 66.0° C.

TABLE 2

| | C | H | N |
|---|---|---|---|
| Measured value | 85.06 | 6.41 | 3.73 |
| Calculated value | 85.44 | 6.34 | 3.83 |

Chemical Structure A

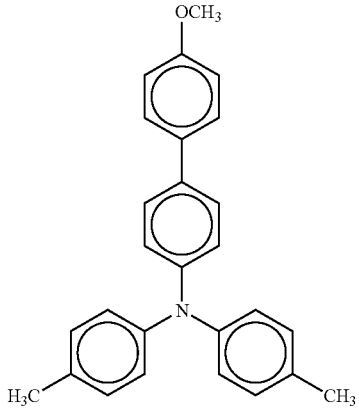

Chemical Structure B

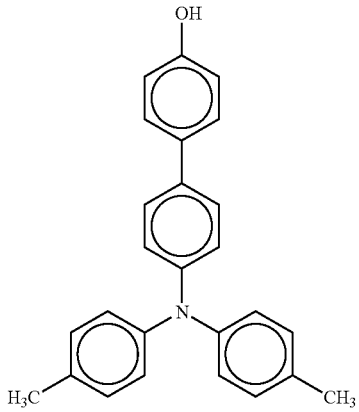

(2) Synthesis of Triarylamine Group-Substituted Acrylate Compound (Compound Example No. 54 Illustrated Above)

82.9 g (0.227 mol) of the hydroxy group-substituted triarylamine compound obtained in the (1) (Chemical structure B) is dissolved in 400 ml of tetrahydrofuran, and a sodium hydroxide solution (NaOH: 12.4 g, water: 100 ml) is dropped into the dissolved solution in nitrogen gas stream. The solution is cooled down to 5° C., and 25.2 g (0.272 mol) of acrylic acid chloride is dropped thereto in 40 minutes. Thereafter, the solution is stirred for 3 hours at 5° C., and the reaction is terminated. The reaction liquid is poured to water and extracted using toluene. The extract is repetitively washed with a sodium hydrogen carbonate aqueous solution and water. Thereafter, the solvent is removed from the toluene solution, and the solution is purified by column chromatography (absorption medium: silica gel; developing solvent: toluene). Then, n-hexane is added to the obtained colorless oil to precipitate crystal. 80.73 g (yield constant: 84.8%) of white-color crystal of Compound Example No. 54 illustrated above is obtained.

Melting point: 117.5 to 119.0° C.

Element analytical value: (%)

TABLE 3

| | C | H | N |
|---|---|---|---|
| Measured value | 83.13 | 6.01 | 3.16 |
| Calculated value | 83.02 | 6.00 | 3.33 |

Synthesis examples of titanyl phthalocyanine pigment for use in a charge transport material are specified.

Synthesis Example 1

A titanyl phthalocyanine pigment is manufactured as follows: Mix 292 g of 1,3-diiminoisoindoline and 2,000 ml of sulforan and drop 204 g of titanium tetrabuthoxide to the resultant liquid in nitrogen atmosphere; Subsequent to the drop, gradually heat the resultant liquid to 180° C. followed by 5 hour stirring while keeping the reaction temperature between 170 to 180° C.; After standing to cool, filter the precipitated material and wash the resultant powder with chloroform until the color thereof shows blue; Wash the resultant with methanol several times and thereafter with hot water of 80° C. several times; Subsequent to drying, coarse titanyl phthalocyanine is obtained; Dissolve the coarse titanyl phthalocyanine in concentrated sulfuric acid having an amount 20 times as much as the amount of the coarse titanyl phthalocyanine and drop the resultant to iced water in an amount 100 times as much as that of the resultant while stirring; Filter the precipitated crystal and repetitively wash the crystal with water until the washing water shows neutral and wet cake (water paste) of titanyl phthalocyanine pigment is thus obtained; wash the wet cake thoroughly with deionized water until a water soluble ion (impurity) is not detected in the washings;

20 g of the obtained wet cake is placed in 200 g of 1,2-dichloroethane followed by 4 hour stirring; 1,000 g of methanol is added thereto. Subsequent to one hour stirring, the resultant is filtered and dried. Thus, titnaly phthalocyanine powder (pigment 1) is obtained.

X ray diffraction spectrum of the thus obtained titanyl phthalocyanine pigment is measured under measuring conditions X ray tube: Cu Voltage: 40 kV Current: 20 mA Scanning speed: 1°/min Scanning area: 3 to 40

Time constant: 2 seconds

Figure 10:
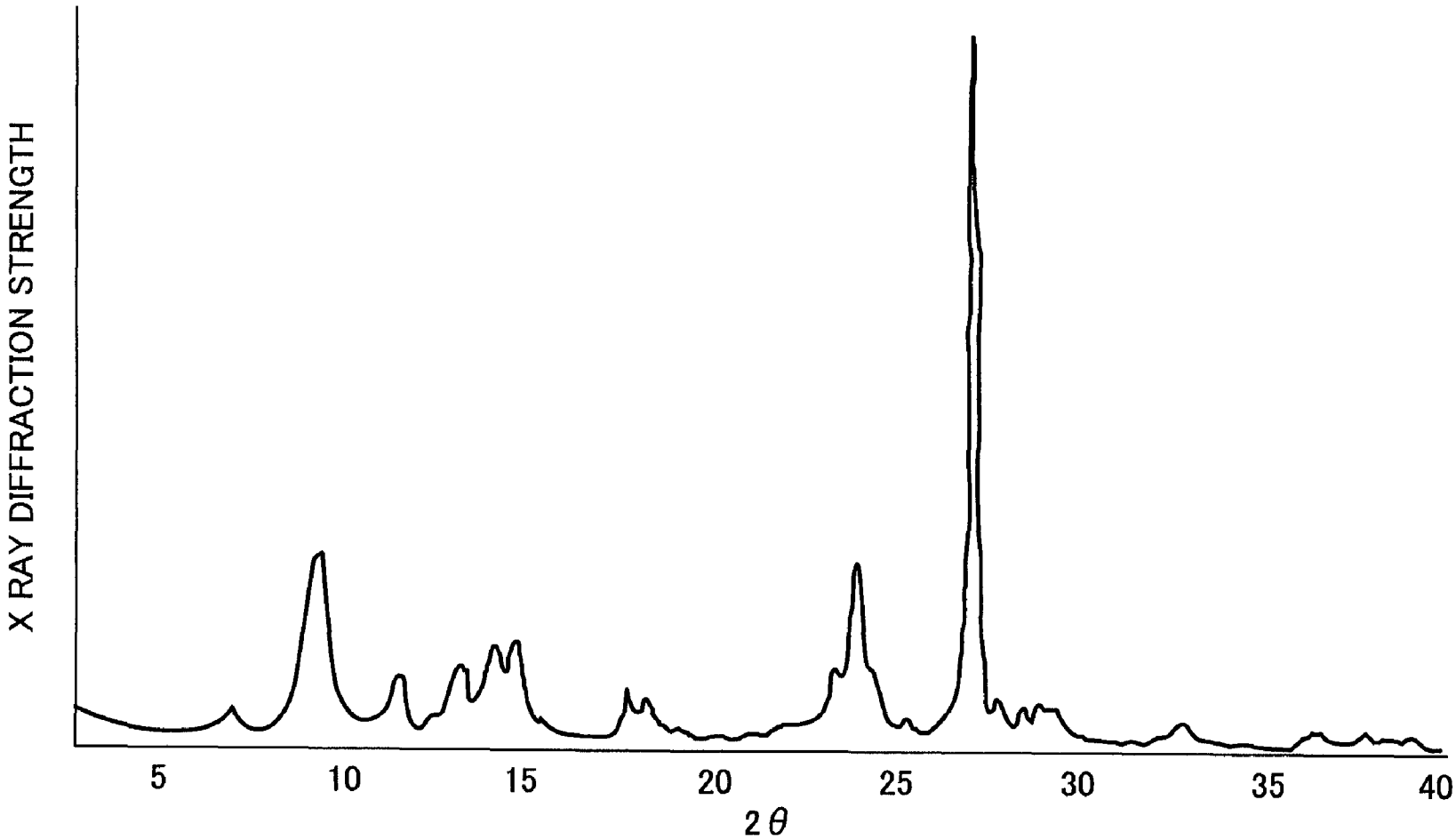
FIG. 10 is a diagram illustrating an X ray diffraction spectrum of titanyl phthalocyanine pigment related to an embodiment of the present invention, where Y axis represents arbitrary γ strength of X ray diffraction and X axis represents reflection angle 2θ (°).

X ray diffraction spectrum of the titanyl phthalocyanine pigment obtained in Synthesis example 1 is shown in FIG. 10. The titanyl phthalocyanine pigment has a crystalline form having a diffraction that the main diffraction peaks are observed at least 9.6±0.2°, 24.0±0.2°, and 27.2±0.2°.

Next, manufacturing examples of an image bearing member is specified.

Image Bearing Member 1

An undercoating layer is formed by applying a liquid application for an undercoating layer having the following composition to an aluminum substrate having an outer diameter of 30 mmΦ by a dip coating method such that the layer thickness after drying is 3.5 μm.

| | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide (CR-EL, manufactured by Ishihara Sangyo Kaisha Ltd.) | 40 parts |
| Methylethylketone | 50 parts |

A charge generating layer having a layer thickness of 0.2 μm is formed by dip-coating a liquid application for a charge generating layer containing the bisazo pigment represented by the following chemical structure C to the undercoating layer followed by heating and drying.

| Liquid Application for Charge generating Layer | |
|---|---|
| Bis-azo pigment represented by the following chemical structure C | 2.5 parts |

Chemical Structure C

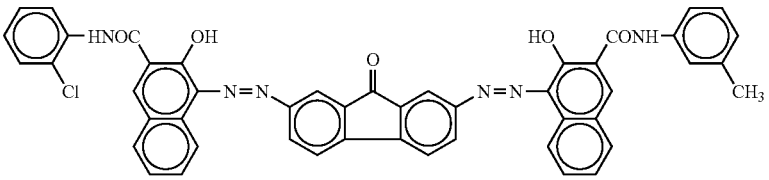

| | |
|---|---|
| Polyvinylbutyral (XYHL, manufactured by Union Carbide Corp.) | 0.5 parts |
| Cyclohexanon | 200 parts |
| Methylethylketone | 80 parts |

A charge transport layer having a layer thickness of 22 μm is formed by dip-coating a liquid application for a charge transport layer represented by the following structure on the charge generating layer followed by heating and drying.

| Liquid Application for Charge Transport Layer | |
|---|---|
| Bisphenol Z type polycarbonate (Panlite TS-2050, manufactured by Teijin Chemicals Ltd.) | 10 parts |
| Low-molecular charge transport material D-1 represented by the following chemical structure D | 10 parts |
| Tetrahydrofuran | 80 parts |
| Tetrahydrofuran solution of 1% silicone oil (KF50-100CS, manufactured by Shin-Etsu Chemical Co., Ltd.) | 0.2 parts |

Chemical structure D

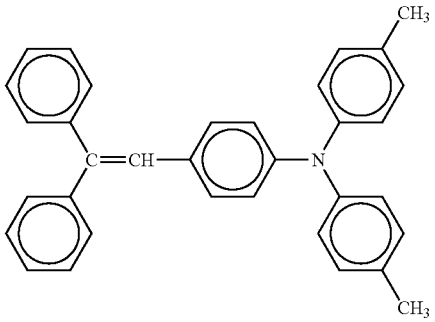

The image bearing member of the present invention is obtained by spray-coating a liquid application for a cross-linked surface layer having the following recipe on the charge transport layer and irradiating with light by a metal halide lamp under the condition of irradiation intensity of 450 mW/cm$^2$ and irradiation time of 120 seconds followed by drying at 130° C. for 30 minutes to form a cross-linked surface layer having a thickness of 4.0 μm.

| Liquid Composition for Cross-linked Surface Layer | |
|---|---|
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional Molecular weight/Number of functional groups = 99 | 8 parts |
| Monomer having at least three radical polymerizable functional groups without a charge transport structure (KAYARAD DPCA120, manufactured by Nippon Kayaku Co., Ltd.) represented by the chemical structure E | |

Chemical structure E

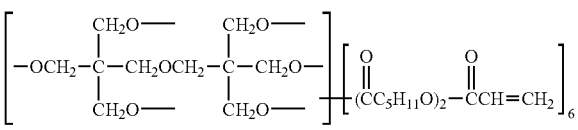

-continued

| Liquid Composition for Cross-linked Surface Layer | |
|---|---|
| Radical polymerizable compound having one functional group with a charge transport structure (Compound Example No. 54 illustrated above) | 10 parts |
| Photo-polymerization initiator 1-hydroxy-cyclohexyl-phenyl-keton (IRGACURE 184, manufactured by Chiba Specialty Chemicals K.K.) | 1 part |
| Tetrahydrofuran | 80 parts |

Thus, Image bearing member 1 is obtained.

Image Bearing Member 2

An image bearing member is manufactured in the same manner as described for Image bearing member 1 except that the radical polymerizable compound having a functional group with a charge transport structure is changed from the compound example No. 54 illustrated above to the illustrated compound No. 115.

Image bearing member 2 is thus obtained.

Image Bearing Member 3

An image bearing member is manufactured in the same manner as described for Image bearing member 1 except that the monomer having a radical polymerizable functional group without a charge transport structure is changed from KAYARAD TMPTA, manufactured by Nippon Kayaku Co., Ltd. to dipentaerythritol hexaacrylate (KAYARAD DPHA, manufactured by Nippon Kayaku Co., Ltd.)

Image bearing member 3 is thus obtained.

Image Bearing Member 4

To an aluminum cylinder having a diameter of 30 mm, a liquid application for undercoating layer, a liquid application for a charge generating layer, and a liquid application for a charge transport layer are applied and dried in this order. Thus, an undercoating layer having a thickness of 3.5 μm, a charge generating layer having a thickness of 0.3 μm and a charge transport layer having a thickness of 23 μm are formed. The liquid application for an adhesive layer and the liquid application for a cross-linked surface layer are spray-coated to the charge transport layer followed by irradiation by a metal halide lamp under the following conditions: 160 W/cm; irradiation distance: 120 mm, irradiation intensity: 500 mW/cm$^2$; irradiation time: 120 seconds. Furthermore, the resultant is dried at 130° C. for 20 minutes and an adhesive layer having a thickness of 0.5 μm and a cross-linked surface layer having a thickness of 4 μm are provided thereon.

| Liquid Application for Undercoating Layer | |
|---|---|
| Alkyd resin (Beckozole 1307-60-EL, available from Dainippon Ink and Chemicals, Inc.) | 6 parts |
| Melamine resin (Super-beckamine, available from Dainippon Ink and Chemicals, Inc.) | 4 parts |
| Titanium oxide (CR-EL, manufactured by Ishihara Sangyo Kaisha Ltd.) | 40 parts |
| Methylethylketone | 50 parts |

| Liquid Application for Charge Generating Layer | |
|---|---|
| Bis-azo pigment represented by the following chemical structure C | 2.5 parts |

Chemical Structure C

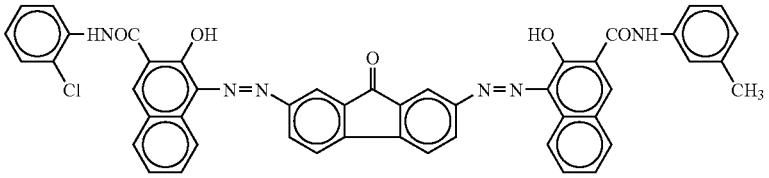

| | |
|---|---|
| Polyvinylbutyral (XYHL, manufactured by Union Carbide Corp.) | 0.5 parts |
| Cyclohexanon | 200 parts |
| Methylethylketone | 80 parts |

| Liquid Application for Charge Transport Layer | |
|---|---|
| Bisphenol Z type polycarbonate (Panlite TS-2050, manufactured by Teijin Chemicals Ltd.) | 10 parts |
| Low-molecular charge transport material represented by the chemical structure D | 7 parts |
| Tetrahydrofuran | 100 parts |
| Tetrahydrofuran solution of 1% silicone oil (KF50-100CS, manufactured by Shin-Etsu Chemical Co., Ltd.) | 1 part |

Chemical structure D

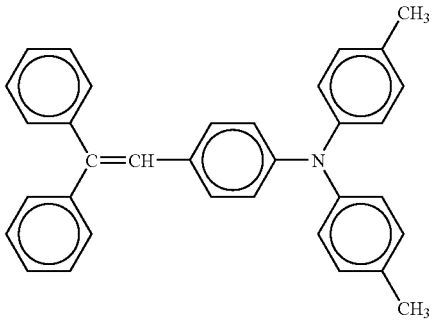

| Liquid Application for Adhesive Layer | |
|---|---|
| Polyarylate (U polymer U-100, manufactured by Unitica Ltd.) | 1 part |
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional Molecular weight/Number of functional groups = 99 | 9 parts |
| Radical polymerizable compound having a functional group with a charge transport structure (Compound Example No. 54 illustrated above) | 5 parts |
| Photo-polymerization initiator 1-hydroxy-cyclohexyl-phenyl-keton (IRGACURE 184, manufactured by Chiba Specialty Chemicals K.K.) | 0.5 parts |
| Tetrahydrofuran | 400 parts |

| Liquid Composition for Cross-Linked Surface Layer | |
|---|---|
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional Molecular weight/Number of functional groups = 99 | 10 parts |
| Radical polymerizable compound having a functional group with a charge transport structure (Compound Example No. 54 illustrated above) | 10 parts |
| Photo-polymerization initiator 1-hydroxy-cyclohexyl-phenyl-keton (IRGACURE 184, manufactured by Chiba Specialty Chemicals K.K.) | 1 part |
| Tetrahydrofuran | 100 parts |

Image bearing member 4 is thus obtained.

Image Bearing Member 5

An image bearing member is manufactured in the same manner as in Image bearing member 4 except that the liquid application for an adhesive layer is changed to the following:

| Liquid Application for Adhesive Layer | |
|---|---|
| Polyarylate (U polymer U-100, manufactured by Unitica Ltd.) | 3 parts |
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional Molecular weight/Number of functional groups = 99 | 7 parts |
| Radical polymerizable compound having a functional group with a charge transport structure (Compound Example No. 54 illustrated above) | 5 parts |
| Photo-polymerization initiator 1-hydroxy-cyclohexyl-phenyl-keton (IRGACURE 184, manufactured by Chiba Specialty Chemicals K.K.) | 0.5 parts |
| Tetrahydrofuran | 400 parts |

Thus, Image bearing member 5 is obtained.

Image Bearing Member 6

An image bearing member is manufactured in the same manner as in Image bearing member 1 except that the liquid application for an adhesive layer of Image bearing member 4 is changed to the following:

| Liquid Application for Adhesive Layer | |
|---|---|
| Polyarylate (U polymer U-100, manufactured by Unitica Ltd.) | 5 parts |
| Monomer having at least three radical polymerizable functional groups without a charge transport structure Trimethylolpropantriacrylate (KAYARAD TMPTA, manufactured by Nippon Kayaku Co., Ltd.) Molecular weight: 296 Number of functional groups: trifunctional Molecular weight/Number of functional groups = 99 | 5 parts |
| Radical polymerizable compound having a functional group with a charge transport layer (Compound Example No. 54 illustrated above) | 5 parts |
| Photo-polymerization initiator 1-hydroxy-cyclohexyl-phenyl-keton (IRGACURE 184, manufactured by Chiba Specialty Chemicals K.K.) | 0.5 parts |
| Tetrahydrofuran | 400 parts |

Thus, Image bearing member 6 is obtained.

Image Bearing Member 7

To an aluminum cylinder having a diameter of 30 mm, a liquid application for an undercoating layer, a liquid application for a charge generating layer, and a liquid application for a charge transport layer are applied and dried in this order. Thus, an undercoating layer having a thickness of 1.5 μm, a charge generating layer having a thickness of 0.3 μm and a charge transport layer having a thickness of 23 μm are formed. The liquid application for an adhesive layer and the liquid application for a cross-linked surface layer are spray-coated to the charge transport layer followed by irradiation by a metal halide lamp under the following conditions: 160 W/cm; irradiation distance: 120 mm, irradiation intensity: 500 mW/cm$^2$; irradiation time: 120 seconds. Furthermore, the resultant is dried at 130° C. for 20 minutes and an adhesive layer having a thickness of 0.03 μm and a cross-linked surface layer having a thickness of 4 μm are provided thereon.

| Liquid Application for Undercoating Layer | |
|---|---|
| Titanium oxide | 40 parts |
| Alcohol soluble nylon | 32 parts |
| Methanol | 400 parts |

| Liquid Application for Charge Generating Layer | |
|---|---|
| Powder of titanylphthalocyanine synthesized in Synthesis Example 1 | 4 parts |
| Polyvinylbutyral | 2 parts |
| Methylethylketone | 150 parts |

| Liquid Application for Charge transport Layer | |
|---|---|
| Bisphenol Z type polycarbonate (Panlite TS-2050, manufactured by Teijin Chemicals Ltd.) | 10 parts |
| Low-molecular charge transport material represented by the following chemical structure D | 7 parts |
| Tetrahydrofuran | 100 parts |

Chemical structure D

-continued

Liquid Application for Charge transport Layer

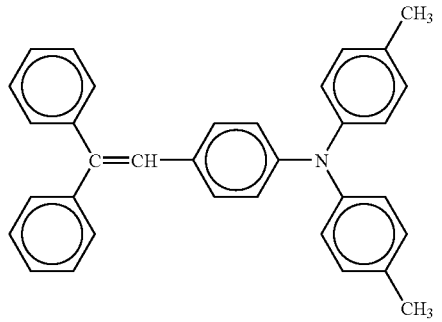

| | |
|---|---|
| Tetrahydrofuran solution of 1% silicone oil (KF50-100CS, manufactured by Shin-Etsu Chemical Co., Ltd.) | 1 part |

| Liquid Application for Adhesive Layer | |
|---|---|
| Bisphenol Z type polycarbonate (Panlite TS-2050, manufactured by Teijin Chemicals Ltd.) | 5 parts |
| Monomer having at least three radical polymerizable functional groups without a charge transport structure Trimethylol propantriacrylate (KAYARAD TMPTA, manufactured by Nippon Kayaku Co., Ltd.) Molecular weight: 536 Number of functional groups: 5.5 Molecular weight/Number of functional groups = 97 | 5 parts |
| Radical polymerizable compound having a functional group with a charge transport structure (Compound Example No. 105 illustrated above) | 5 parts |
| Photo-polymerization initiator 1-hydroxy-cyclohexyl-phenyl-keton (IRGACURE 184, manufactured by Chiba Specialty Chemicals K.K.) | 0.5 parts |
| Tetrahydrofuran | 400 parts |

| Liquid Composition for Cross-Linked Surface Layer | |
|---|---|
| Monomer having at least three radical polymerizable functional groups without a charge transport structure Dipentaerythritol hexaacrylate (KAYARAD DPHA, manufactured by Nippon Kayaku Co., Ltd.) Molecular weight: 536 Number of functional groups: 5.5 Molecular weight/Number of functional groups = 97 | 10 parts |
| Radical polymerizable compound having a functional group with a charge transport structure (Compound Example No. 105 illustrated above) | 10 parts |
| Photo-polymerization initiator 1-hydroxy-cyclohexyl-phenyl-keton (IRGACURE 184, manufactured by Chiba Specialty Chemicals K.K.) | 1 part |
| Tetrahydrofuran | 100 parts |

Thus, Image bearing member 7 is obtained.

Image Bearing Member 8

An image bearing member is manufactured in the same manner as in Image bearing member 2 except that the radical polymerizable compound having a functional group with a charge transport structure in the cross-linked surface layer (Compound Example No. 115 illustrated above) is replaced with the compound having two radical polymerizable functional groups with a charge transport structure in the cross-linked surface layer (Compound Example No. 180 illustrated above).

Thus, Image bearing member 8 is obtained.

Image Bearing Member 9

An image bearing member is manufactured in the same manner as in Image bearing member 7 except that the compound having a radical polymerizable functional group with a charge transport structure in the cross-linked surface layer (Compound Example No. 105 illustrated above) is replaced with the compound having three radical polymerizable functional groups with a charge transport structure in the cross-linked surface layer (Compound Example No. 379 illustrated above).

Thus, Image bearing member 9 is obtained.

Comparative Image Bearing Member 1

An image bearing member is manufactured in the same manner as in Image bearing member 1 except that no cross-linked surface layer is provided.

Thus, Comparative image bearing member 1 is obtained.

Cleaning Blade

The physical properties of the cleaning blade for evaluation are shown in Table 4.

The blade is formed of polyurethane rubber. Hardness and rebound resilience are made different according to the kind, the ratio, the reaction condition and the cross-linking method of the isocyanate compound and the polyol compound. The blade has a thickness of 2 mm and is attached to an iron substrate having a thickness of 1 mm with hot melt adhesive.

TABLE 4

| | Hardness (°) | Rebound resilience (%) |
|---|---|---|
| Blade 1 | 72 | 13 |
| Blade 2 | 72 | 33 |
| Blade 3 | 79 | 12 |
| Blade 4 | 79 | 33 |
| Comparative Blade 1 | 68 | 9 |
| Comparative Blade 2 | 83 | 37 |

Manufacturing of Carrier

Next, a manufacturing example of carrier for use in evaluation is described. The carrier for use in the present invention is not limited thereto.

The following components are dispersed by a HOMOMIXER for 10 minutes and a blend of a coating film forming solution of acryl resin and silicone resin containing aluminum particles is obtained.

| | |
|---|---|
| Acryl resin solution (Solid portion: 50 weight %) | 21.0 parts |
| Guanamine solution (Solid portion: 50 weight %) | 6.4 parts |
| Alumina particles (0.3 μm, resistivity: $10^{14}$ Ω · cm) | 7.6 parts |
| Silicone resin solution (Solid portion: 23 weight %) (SR2410, manufactured by Dow Corning Toray Co., Ltd.) | 65.0 parts |
| Aminosilane (Solidportion: 100 weight %) (SH6020, manufactured by Dow Corning Toray Co., Ltd.) | 1.0 part |
| Toluene | 60 parts |
| Butyl cellosolve | 60 parts |

As a core material, calcined ferrite powder [$(MgO)_{1.8}(MnO)_{49.5}(Fe_2O_3)_{48.0}$: Average particle diameter: 35 μm] is used and the coating film forming solution is applied to the surface of core material by a SPIRA COTA (manufactured by Okada Seiko Co., ltd.) and dried. The resultant is burnt in an electric furnace at 1,500° C. for an hour. Subsequent to cooling down, ferrite bulk is fractured using a sieve having an opening of 106 μm to obtain a carrier. Since the coating layer covering the surface of a carrier can be observed with a transmission type electron microscope (a carrier cross section is observed). The layer thickness is defined to be the average of the observed surface layer thickness.

Manufacturing of Two Component Developing Agent

Developing agents are prepared using the Toners 1 to 6, the Comparative Toners 1 to 5 and the ferrite carrier mentioned above having an average particle diameter of 35 μm. A turbla mixer that performs stirring by tumbling a container is used to uniformly mix and charge a mixture. The ratio of the toner to the carrier is that 7 parts by weight of the toner is used based on 100 parts by weight of the toner.

Examples 1 to 24 and Comparative Examples 1 to 15

The thus obtained two component developers, the Image bearing member 1 to 9, the Comparative Example 1, the Blades 1 to 4 and the Comparative Blades 1 to 4 are set in a full color multi-function apparatus for evaluation remodeled based on Imagio NeoC 600, manufactured by Ricoh Co., Ltd. The test images having an image area ratio of 5% are output on A4 paper for a running test.

Evaluation Method

Cleaning Property

After a run length of 50,000th paper and 100,000th paper, the image bearing members are extracted. The residual toner remaining on the image bearing member that has slipped through the cleaning blade is collected by PRINTAC C with a thickness of 25 μm (manufactured by Nitto Denko Corporation) and attached to white paper. Using 938 spectrodensitometer (manufactured by X-Rite, Incorporated), ID is measured at 10 points with a light source D50 for observation and a view angle of 2° and the average thereof is calculated. These averages are ranked in comparison (difference) with blank as follows:

E (Excellent): not greater than 0.005

G (Good): from 0.006 to 0.010

F (Fair): from 0.011 to 0.015

P (Poor): not less than 0.016

Contamination (Fouling) on Charging Roller

The charging roller is extracted after printing 50,000th paper and 100,000th paper and the contamination thereof is determined by naked eyes.

These are ranked as follows:

E (Excellent): without contamination

G (Good): barely contaminated but with no practical problem

F (Fair): slightly contaminated but usable

P (Poor): significantly contaminated and not usable

TABLE 5

| | Evaluated image bearing member | Evaluated toner | Evaluated blade | 50,000th printing | | 100,000th printing | |
|---|---|---|---|---|---|---|---|
| | | | | Cleaning property | Contamination on charging roller | Cleaning property | Contamination on charging roller |
| Example 1 | Image bearing member 1 | Toner 1 | Blade 1 | E | E | G | G |
| Example 2 | Image bearing member 1 | Toner 2 | Blade 1 | E | E | G | G |
| Example 3 | Image bearing member 1 | Toner 3 | Blade 1 | E | E | G | G |
| Example 4 | Image bearing member 1 | Toner 4 | Blade 1 | E | E | E | G |
| Example 5 | Image bearing member 1 | Toner 5 | Blade 1 | E | E | E | G |
| Example 6 | Image bearing member 1 | Toner 5 | Blade 2 | E | E | E | E |
| Example 7 | Image bearing member 1 | Toner 5 | Blade 3 | E | E | E | G |
| Example 8 | Image bearing member 1 | Toner 5 | Blade 4 | E | E | E | E |
| Example 9 | Image bearing member 2 | Toner 5 | Blade 4 | E | E | E | E |
| Example 10 | Image bearing member 3 | Toner 5 | Blade 4 | E | E | E | E |
| Example 11 | Image bearing member 1 | Toner 6 | Blade 1 | E | E | G | G |
| Example 12 | Image bearing member 4 | Toner 1 | Blade 1 | E | E | G | G |
| Example 13 | Image bearing member 4 | Toner 2 | Blade 1 | E | E | G | G |
| Example 14 | Image bearing member 4 | Toner 3 | Blade 1 | E | E | G | G |
| Example 15 | Image bearing member 4 | Toner 4 | Blade 1 | E | E | E | G |
| Example 16 | Image bearing member 4 | Toner 5 | Blade 1 | E | E | E | G |
| Example 17 | Image bearing member 4 | Toner 5 | Blade 2 | E | E | E | E |
| Example 18 | Image bearing member 4 | Toner 5 | Blade 3 | E | E | E | G |
| Example 19 | Image bearing member 4 | Toner 5 | Blade 4 | E | E | E | E |
| Example 20 | Image bearing member 5 | Toner 5 | Blade 4 | E | E | E | E |
| Example 21 | Image bearing member 6 | Toner 5 | Blade 4 | E | E | E | E |
| Example 22 | Image bearing member 7 | Toner 5 | Blade 4 | E | E | E | E |
| Example 23 | Image bearing member 8 | Toner 5 | Blade 4 | E | E | E | G |
| Example 24 | Image bearing member 9 | Toner 5 | Blade 4 | E | E | G | G |

TABLE 5-continued

| | Evaluated image bearing member | Evaluated toner | Evaluated blade | 50,000th printing | | 100,000th printing | |
|---|---|---|---|---|---|---|---|
| | | | | Cleaning property | Contamination on charging roller | Cleaning property | Contamination on charging roller |
| Comparative Example 1 | Image bearing member 1 | Toner 1 | Comparative blade 1 | G | G | G | G |
| Comparative Example 2 | Image bearing member 1 | Toner 1 | Comparative blade 2 | G | G | F | F |
| Comparative Example 3 | Image bearing member 1 | Comparative Toner 1 | Blade 1 | G | G | G | F |
| Comparative Example 4 | Image bearing member 1 | Comparative Toner 2 | Blade 1 | G | G | F | F |
| Comparative Example 5 | Image bearing member 1 | Comparative Toner 3 | Blade 1 | G | G | G | G |
| Comparative Example 6 | Image bearing member 1 | Comparative Toner 4 | Blade 1 | G | G | F | F |
| Comparative Example 7 | Image bearing member 1 | Comparative Toner 5 | Blade 1 | G | G | F | F |
| Comparative Example 8 | Comparative image bearing member 1 | Toner 1 | Blade 1 | G | G | P | P |
| Comparative Example 9 | Comparative image bearing member 1 | Comparative Toner 1 | Comparative blade 1 | P | P | P | P |
| Comparative Example 10 | Image bearing member 4 | Toner 1 | Comparative blade 1 | G | G | G | G |
| Comparative Example 11 | Image bearing member 4 | Toner 1 | Comparative blade 2 | G | G | F | F |
| Comparative Example 12 | Image bearing member 4 | Comparative Toner 1 | Blade 1 | G | G | G | F |
| Comparative Example 13 | Image bearing member 4 | Comparative Toner 2 | Blade 1 | G | G | F | F |
| Comparative Example 14 | Image bearing member 4 | Comparative Toner 3 | Blade 1 | G | G | G | G |
| Comparative Example 15 | Image bearing member 4 | Comparative Toner 1 | Comparative blade 1 | F | F | P | P |

As seen in Table 5, the image forming apparatus of Examples in which the image bearing member, the toner and the blade of the present invention has excellent cleaning property with little fouling on the charging roller in the running tests with a run length of 50,000 and 100,000. The image bearing member, toner and blade satisfy the conditions of the present invention in total. Therefore, it is possible to provide an image bearing member, an image forming method and a process cartridge having an excellent cleaning property with little fouling on a charging roller over an extended period of time. When at least one of an image bearing member, toner and blade does not meet the conditions of the present invention, it is not possible to provide the image forming apparatus, the image forming method and the process cartridge mentioned above.

In the embodiments described above, the contamination on a charging roller caused by toner that has slipped through a cleaning blade can be reduced even when an image bearing member having a relatively hard surface layer in comparison with that of a typical image bearing member and a toner having a relatively small particle diameter in comparison with a typical toner are used. Therefore, it is possible to provide an image forming apparatus that can produce quality images without image deficiency caused by the contamination through a cleaning blade can be reduced even when an image bearing member having a relatively hard surface layer in comparison with that of a typical image bearing member and a toner having a relatively small particle diameter in comparison with a typical toner are used. Therefore, it is possible to provide an image bearing member that can produce quality images without image deficiency caused by the contamination. In addition, a toner having a sharp particle size distribution can be easily obtained. Quality images with a high definition can be formed with such toner.

The toner is a color toner so that the characteristics of being a small particle can be fully exploited.

In addition, whether the toner is used as a two component developing agent or a single component agent, it is possible to reduce the contamination on a charging roller.

Furthermore, it is possible to improve the property of uniform charging for the surface of an image bearing member.

Furthermore, it is possible to obtain a charging device having little contamination by residual toner remaining on the surface of an image bearing member.

Furthermore, it is possible to obtain full color quality images at a high speed.

Furthermore, since a color image is transferred to a recording medium at one time, it is possible to produce quality images at a high speed without color misalignment.

Furthermore, as described above, it is possible to provide an image forming method and a process cartridge using an image bearing member having a hard surface layer and toner having a small particle diameter, by which contamination on a charging device (roller) caused by toner that has slipped through a cleaning blade is reduced and image deficiency does not occur.

This document claims priority and contains subject matter related to Japanese Patent Applications Nos. 2006-314898 and 2007-175832, filed on Nov. 21, 2006, and Jul. 4, 2007, respectively, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

an image bearing member configured to bear a latent electrostatic image a surface thereof;

a charging device configured to uniformly charge the image bearing member;

an irradiating device configured to irradiate the surface of the image bearing member with writing light to form the latent electrostatic image thereon;

a developing device configured to develop and visualize the latent electrostatic image with a developing agent comprising a toner;

a transfer device configured to transfer the visualized image to a recording medium;

a fixing device configured to fix the visualized image on the recording medium; and a cleaning device configured to clean the surface of the image bearing member, wherein the image bearing member comprises a substrate on which at least a photosensitive layer and a cross-linked surface layer are accumulated and the cross-linked surface layer comprises a monomer having at least three radical polymerizable function groups without a charge transport structure and a radical polymerizable compound having a charge transport structure cured by a photo-energy irradiation device, wherein the toner has a volume average particle diameter of from 1 to 5 μm and an average circularity of from 0.95 to 0.98, wherein external additives added to a surface of the toner satisfy the following relationship: $1<3X/5+Y<3$, wherein X represents an amount by weight % of an external additive having a primary particle diameter of from 10 to 20 nm and Y represents an amount by weight % of an external additive having an primary particle diameter of from 100 to 200 nm and X and Y satisfy the following relationship: $X<Y$, $0<X\leqq 1$ and $1\leqq Y$, and wherein the cleaning device comprises a cleaning blade comprising a polyurethane rubber plate having a hardness of from 70 to 80°, and an rebound resilience of from 10 to 35% at 25° C.

2. The image forming apparatus according to claim 1, wherein the image bearing member comprises an adhesive layer between the photosensitive layer and the cross-linked surface layer and at least the photosensitive layer, the adhesive layer and the cross-linked surface layer are laminated in this order.

3. The image forming apparatus according to claim 1, wherein the toner is prepared by conducting in an aqueous medium at least one of cross-linking reaction and elongation reaction of a toner liquid material in which at least a polymer having a portion reactive with a compound having an active hydrogen group, a polyester, a coloring agent, and a releasing agent are dispersed or dissolved in an organic solvent.

4. The image forming apparatus according to claim 1, wherein the toner is a color toner.

5. The image forming apparatus according to claim 1, wherein the developing agent is a two component developing agent comprising the toner and a carrier.

6. The image forming apparatus according to claim 1, wherein the developing agent is a one component developing agent comprising the toner.

7. The image forming apparatus according to claim 1, wherein the charging device applies a voltage in which at least an alternating voltage is overlapped with a direct voltage.

8. The image forming apparatus according to claim 1, wherein the charging device comprises a charging member having a roller form and located in the vicinity of the image bearing member in a non-contact manner.

9. The image forming apparatus according to claim 1, further comprising an intermediate transfer body to which the toner image developed on the image bearing member is primarily transferred, wherein a plurality of color toner images are sequentially overlapped on the intermediate transfer body to form a color image and the color image is secondarily transferred to the recording medium at one time.

10. The image forming apparatus according to claim 1, wherein the fixing device comprises a heating roller comprising a magnetic metal and heated by electromagnetic induction, a fixing roller provided in parallel with the heating roller, a toner heating medium having an endless form which is heated by the heating roller, suspended over the heating roller and the fixing roller and rotationally driven thereby, and a pressing roller which is pressed against the fixing roller via the toner heating medium to form a nip portion therewith while rotating in a forward direction of the toner heating medium.

11. An image forming method comprising:

charging an image bearing member;

irradiating a surface of the image bearing member with a writing light to form the latent electrostatic image thereon;

developing the latent electrostatic image with a developing agent comprising a toner;

transferring the visualized image to a recording medium;

fixing the visualized image on the recording medium; and cleaning the surface of the image bearing member, wherein the image forming apparatus of claim 1 is used in the image forming method.

12. A process cartridge comprising:

an image bearing member configured to bear a latent electrostatic image on a surface thereof;

a developing device configured to develop and visualize the latent electrostatic image with a developing agent comprising a toner; and a cleaning device configured to clean the surface of the image bearing member wherein the image bearing member comprises a substrate on which at least a photosensitive layer and a cross-linked surface layer are accumulated and the cross-linked surface layer comprising a monomer having at least three radical polymerizable function groups without a charge transport structure and a radical polymerizable compound having a charge transport structure cured by a photo-energy irradiation device, wherein the toner has a volume average particle diameter of from 1 to 5 μm and an average circularity of from 0.95 to 0.98, wherein an additive externally added to a surface of the toner satisfies the following relationship: $1<3X/5+Y<3$, wherein X represents an amount by weight % of an external additive having a primary particle diameter of from 10 to 20 nm and Y represents an amount by weight % of an external additive having an primary particle diameter of from 100 to 200 nm, and wherein the cleaning device comprises a cleaning blade comprising a polyurethane rubber plate having a hardness of from 70 to 80°, an impact resilience of from 10 to 35% at 25° C.

* * * * *